US007157217B2

(12) United States Patent
Nakagawa et al.

(10) Patent No.: US 7,157,217 B2
(45) Date of Patent: Jan. 2, 2007

(54) PHOTOTHERMOGRAPHIC MATERIAL

(75) Inventors: Hajime Nakagawa, Kanagawa (JP); Yoshihisa Tsukada, Kanagawa (JP); Keiichi Suzuki, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 36 days.

(21) Appl. No.: 10/734,660

(22) Filed: Dec. 15, 2003

(65) Prior Publication Data

US 2004/0126717 A1 Jul. 1, 2004

(30) Foreign Application Priority Data

| | | |
|---|---|---|
| Dec. 17, 2002 | (JP) | 2002-365298 |
| Dec. 18, 2002 | (JP) | 2002-366234 |
| Dec. 27, 2002 | (JP) | 2002-379770 |
| Jan. 6, 2003 | (JP) | 2003-000314 |
| Jan. 9, 2003 | (JP) | 2003-002757 |

(51) Int. Cl.
*G03C 1/76* (2006.01)
*G03C 1/31* (2006.01)
*G03C 1/498* (2006.01)

(52) U.S. Cl. ..... 430/523; 430/531; 430/619; 430/620; 430/628; 430/631; 430/639; 430/641; 430/643

(58) Field of Classification Search ..... 430/531, 430/619, 523, 631, 620, 628, 639, 641, 642, 430/643
See application file for complete search history.

(56) References Cited

U.S. PATENT DOCUMENTS

| | | | | |
|---|---|---|---|---|
| 4,113,854 | A * | 9/1978 | Andrews et al. | 424/78.05 |
| 6,140,038 | A | 10/2000 | Ishizuka et al. | |
| 6,156,491 | A * | 12/2000 | Goto | 430/619 |
| 6,261,754 | B1 * | 7/2001 | Ishigaki et al. | 430/523 |
| 6,582,898 | B1 * | 6/2003 | Morita | 430/619 |
| 6,821,720 | B1 | 11/2004 | Iwado | |
| 2001/0051319 | A1 * | 12/2001 | Oya et al. | 430/611 |
| 2003/0232288 | A1 | 12/2003 | Oka et al. | |
| 2004/0234911 | A1 | 11/2004 | Suzuki | |

FOREIGN PATENT DOCUMENTS

| | | |
|---|---|---|
| EP | 1041434 A | 10/2000 |
| EP | 1306720 A | 5/2003 |
| EP | 1308776 A | 5/2003 |
| JP | A 10-312038 | 11/1998 |
| JP | A 11-84573 | 3/1999 |
| JP | A-11-282123 | 10/1999 |
| JP | A-2001-194744 | 7/2001 |

OTHER PUBLICATIONS

Dewent-Acc-No. 1982-18594E.*

* cited by examiner

*Primary Examiner*—Thorl Chea
(74) *Attorney, Agent, or Firm*—Margaret A. Burke; Sheldon J. Moss

(57) ABSTRACT

A photothermographic material comprising, on a support, an image forming layer containing at least a photosensitive silver halide, a non-photosensitive organic silver salt, a reducing agent and a binder, and a non-photosensitive outermost layer at a surface side of the support at which the image forming layer is provided, wherein:

1) the non-photosensitive organic silver salt contains 90% by mole or more of silver behenate; and a binder in the outermost layer contains 50% by weight or more of a hydrophobic polymer latex,
2) the outermost layer contains a polymer latex; and a layer adjacent to the outermost layer contains a binder which can lose fluidity upon a decrease in temperature, or
3) the outermost layer contains a polymer latex; and a coating solution for forming the outermost layer can lose fluidity upon a decrease in temperature.

26 Claims, No Drawings

PHOTOTHERMOGRAPHIC MATERIAL

CROSS-REFERENCE TO RELATED APPLICATION

This application claims priority under 35 USC 119 from Japanese Patent Application Nos. 2002-365298, 2002-366234, 2002-379770, 2003-314 and 2003-2757, the disclosures of which are incorporated by reference herein.

BACKGROUND OF THE INVENTION

1. Field of the Invention

The present invention relates to a photothermographic material.

2. Description of the Related Art

Recently, in the field of films for medical imaging, there is a strong demand for reducing the volume of waste processing liquid from the viewpoints of environmental preservation and economy of space. There have been demands for technologies relating to use of a photothermographic material as a film for medical imaging and a film for graphic arts. In particular, there is a demand for a photothermographic material that can be efficiently exposed by a laser image setter or a laser imager, and can provide black-toned images with high resolution and sharpness. Such a photothermographic material can provide users with a more simple and ecological thermal developing system without the use of liquid processing chemicals.

Although there are similar demands in the field of general image forming materials, high image quality (i.e., excellent sharpness and fine graininess) is particularly required for images used in medical imaging where high image quality of excellent sharpness and granularity are necessary. Further, images with blue-black tones are preferred from the perspective of facilitating diagnosis. Various types of hard copy systems using pigment or dye, such as an inkjet printer and an electrophotograph system, are commonly used as a general image forming system. However none of these is satisfactory as an output system for medical images.

In general, thermal image forming systems using organic silver salts are described in U.S. Pat. Nos. 3,152,904 and 3,457,075 and on pages 279 to 291, Chapter 9, "Thermally Processed Silver Systems," written by D. Klosterboer, in (Imaging Processes and Materials) Neblette, 8th edition, compiled by J. Sturge, V. Walworth and A. Shepp (1989), the disclosures of which are incorporated herein by reference.

A photothermographic material typically includes a photosensitive layer in which a photocatalyst (e.g., silver halide) of a catalytically active amount, a reducing agent, reducible silver salt (e.g., organic silver salt) and a toner for controlling the tone of a developed silver image as needed are dispersed in the matrix of a binder. After an image is exposed thereon, the photothermographic material is heated to a high temperature (e.g., 80° C. or above) to cause an oxidation-reduction reaction between a silver halide or a reducible silver salt (which acts as an oxidizing agent) and a reducing agent, thus providing a black silver image. The oxidation-reduction reaction is accelerated by the catalytic action of a latent image of the exposed silver halide. As a result the black silver image is formed in the exposed region (see U.S. Pat. No. 2,910,377 and Japanese Patent Application Publication (JP-B) No. 43-4924). Further, Fuji medical dry imager FM-DP L is an example of a practical medical image forming system using a photothermographic material that has been marketed.

In production of a photothermographic system including an organic silver salt, two methods are available. In one method, a solvent coating is adopted, and in the other method, a coating liquid containing polymer fine particles as a main binder in an aqueous dispersion is applied and dried. In the latter method, since no necessity arises for a process of solvent recovery or the like, a production facility is simple and the method is advantageous for mass production.

Clear images have been obtained through intensive improvements such as forming the image forming layer using a binder mainly comprising a hydrophobic latex for excluding the effect of moisture on the photographic properties in the thermal imaging system (see for example Japanese Patent Application Laid-open (JP-A) No. 2002-171936) having an image forming layer applied as an aqueous coating and taking advantage of organic silver salts.

Stable images may be formed without depending on preservation conditions by forming at least two layers including a protective layer at the image forming layer side in either of the application methods using a solvent or aqueous solution. While photosensitive materials having good resistance to scratches and good conveyability in handling before and during processing of the photosensitive material may be obtained, the at least two layers are preferably applied at the same time considering the production cost.

When a polymer derived from an animal protein (for example gelatin) is used at the outermost layer (see for example JP-A No. 2002-162712), water resistance is not sufficient, and time-dependent variation of sensitivity is not sufficiently stable when the photosensitive material is preserved under high temperature and high humidity conditions. While a dye that serves as a background color is often used in order to control the tone of the image obtained, it was found to be another problem that the color is transferred when the images are preserved in layers.

Since the outermost layer is hydrophilic, the layer becomes sticky, while being poor in image stability due to fingerprints left behind.

While a layer excellent in water resistance may be formed by applying a coating solution mainly comprising latex (for example JP-A Nos. 2000-227643 and 2001-194744), it was revealed that it is quite difficult to uniformly apply the coating layer without forming an irregular surface since the layer cannot be set after coating, and stability of the coating solution at the outermost layer is particularly sensitive to a salt concentration of the adjacent layer, to pH of the adjacent layer, or to the surface charge of added dispersed particles in the adjacent layer, such that the surface of the photosensitive material tends to be wrinkled in the drying step after coating.

Since the coating solution containing the polymer latex usually has a low viscosity, dispersed matting agent particles added for improving conveyability tend to be precipitated after mixing. Moreover, the dispersed particles are readily aggregated, resulting in the problem of rapid precipitation. Image quality may be decreased and handling performance such as conveyability may be deteriorated when precipitation of the dispersed particles is remarkable.

Accordingly, in the photothermographic material formed using the aqueous coating, the surface state of the outermost layer is quite important with respect to the influence on thermal developing apparatus, efficiency of the coating step, image properties and the like.

SUMMARY OF THE INVENTION

An object of the present invention is to provide a photothermographic material that is able to form high image quality and is excellent in image stability while being excellent in handling performance of samples that have undergone image formation, by solving the problems of photosensitive materials to which an aqueous coating is applied through simultaneous application of at least two layers.

In a first aspect, the invention provides a photothermographic material comprising, on a support, an image forming layer containing at least a photosensitive silver halide, a non-photosensitive organic silver salt, a reducing agent and a binder, and a non-photosensitive outermost layer at a surface side of the support at which the image forming layer is provided, wherein the non-photosensitive organic silver salt contains 90% by mole or more of silver behenate, and a binder in the outermost layer contains 50% by weight or more of a hydrophobic polymer latex.

In a second aspect, the invention provides a photothermographic material comprising, on a support, an image forming layer containing at least a photosensitive silver halide, a non-photosensitive organic silver salt, a reducing agent and a binder, and a non-photosensitive outermost layer at a surface side of the support at which the image forming layer is provided, wherein the outermost layer contains a polymer latex, and a layer adjacent to the outermost layer contains a binder which can lose fluidity upon a decrease in temperature.

In a third aspect, the invention provides a photothermographic material comprising, on a support, an image forming layer containing at least a photosensitive silver halide, a non-photosensitive organic silver salt, a reducing agent and a binder, and a non-photosensitive outermost layer at a surface side of the support at which the image forming layer is provided, wherein the outermost layer contains a polymer latex, and a coating solution for forming the outermost layer can lose fluidity upon a decrease in temperature.

For improving the water resistance of the surface of the photothermographic material, which has been a problem of the related art, and improving stability (sensitivity stability and color transfer), the inventors have used the non-photosensitive organic silver salt containing 90% by mole or more of silver behenate, and the binder containing 50% by weight of the hydrophobic polymer latex in the outermost layer at the surface side at which the image forming layer is provided, thereby completing the aforementioned first aspect of the invention.

The binder containing 50% by weight or more of the hydrophobic polymer latex was used for improving water resistance. However, since the hydrophobic polymer latex has no setting ability as described above, it is quite liable to affect a layer adjacent to the outermost layer. The image forming layer is not an exception, and may cause deterioration of storability.

It was found through intensive studies that using the non-photosensitive organic silver salt containing 90% by mole or more of silver behenate is quite effective for stabilizing sensitivity and image stability such as color transfer, even if the binder containing the hydrophobic polymer latex is used in the outermost layer.

DETAILED DESCRIPTION OF THE INVENTION

1. Layer Construction

The photothermographic material of the present invention comprises at least one the image forming layer, and a non-photosensitive outermost layer at a surface side at which the image forming layer is provided.

The non-photosensitive layer is usually categorized, from its arrangement, into (a) a layer provided on the image forming layer (at the distal side from the support), (b) an intermediate layer provided between a plurality of image forming layers or between the image forming layer and a surface protective layer, (c) an undercoat layer provided between the image forming layer and the support, and (d) a back layer provided on a surface opposite from the image forming layer.

The invention is characterized by the non-photosensitive layer categorized in (a). The non-photosensitive outermost layer is provided at the same surface side as the image forming layer and at the most distal position from the support (i.e., a more distal position than the image forming layer).

The invention may also comprise (a) a second non-photosensitive layer, (b) the intermediate layer, (c) the undercoat layer and (d) the back layer, as non-photosensitive layers in addition to the outermost layer. These layers may be independent monolayers, or may be composed of a plurality of layers.

A layer that functions as an optical filter may be provided, as the non-photosensitive layer (a) or (b). An anti-halation layer may also be also provided in the photosensitive material as the layer (c) or (d).

The photothermographic material of the invention is preferably of one-face type having the image forming layer on only one surface of the support. A back layer is preferably provided on the opposite surface (referred to a back surface hereinafter) from the surface of the support having the image forming layer. While a binder contained in an outermost layer of the back surface may be the same as the binder contained in the outermost layer at the image forming layer side, it is not restricted thereto, and 50% by weight or more of the polymer contained in the outermost layer of the back surface may be different from the polymer contained in the outermost layer at the image forming layer side.

The non-photosensitive organic silver salt containing 90% by mole or more of silver behenate is used in the first embodiment of the invention, and the binder in the outermost layer at the image forming layer side contains 50% by weight or more of the hydrophobic polymer latex.

Water resistance of the photosensitive material is improved by using the binder containing 50% by weight or more of the hydrophobic polymer latex. However, since the hydrophobic polymer latex has no setting ability, it is liable to affect the layer adjacent to the outermost layer. The image forming layer is not exception, and storability of the image forming layer may be deteriorated. It was found through intensive studies that using the non-photosensitive organic silver salt containing 90% by mole or more of silver behenate is quite effective for stabilizing sensitivity and storability such as color transfer even when the binder containing the hydrophobic polymer latex is used in the outermost layer.

The outermost layer used under any one of the following three conditions (or under a plurality of the following conditions) is particularly effective in the invention.

(1) The non-photosensitive organic silver salt contained in the image forming layer comprises 90% by mole, and preferably 95% by mole, of silver behenate.

(2) The image forming layer contains at least one kind of development accelerator.

(3) At least one image forming layer and the non-photosensitive layer contains at least one metalo-phthalocyanine compound.

In the second embodiment of the invention, the outermost layer, which is a non-photosensitive layer, at the surface side of the image forming layer contains the polymer latex, and the layer adjacent to the outermost layer contains a binder having setting ability. Setting ability means that the binder is gelled by decreasing the temperature to make the binder lose fluidity. Since the coating solution, after being applied on the support by heating, can be prevented from being fluid by cooling by taking advantage of this gelling property, the coating surface may be uniform with no irregularities left behind on the surface by air at the drying step.

In other words, the surface of the photothermographic material can be prevented from being sticky by using the hydrophobic polymer as the binder used for the outermost layer. However, the difficulty of uniformly applying the hydrophobic binder on the surface without causing any irregularities must be solved since the hydrophobic polymer has no setting ability. For solving the problem, the binder having the setting ability is used at the layer adjacent to the outermost layer in order to improve uniformity of the coating surface of the outermost layer. Consequently, contradictory problems of coating property and suppression of surface stickiness have been solved.

While using the hydrophobic polymer for suppressing surface stickiness has been understood to be effective in the related art, there have been no technologies for fully utilizing the hydrophobic polymer because it has no setting ability. The function for suppressing stickiness, and the function for providing setting ability have been separated in the invention. These respective functions are separately given to at least two layers, and the entire photothermographic material is designed as an excellent material having both functions. In addition, each function is made to be readily manifested by allowing at least two layers to independently function. For example, while various methods for removing fluidity, such as providing a thick layer having setting ability, adding a large quantity of gelling agent, and increasing the cross-linking density of gelatin, may be selected, the thickness of the layer and the amount of addition of additives should be adjusted considering compatibility among the additives when one layer is made to be responsible for all these functions. Consequently, ther is a tendency for it to become difficult for each function to be manifested.

The idea of separating the functions into different layers has not been conceived of in the related art, and is a quite unique idea.

In the third embodiment of the invention, a gelling agent is added to the outermost layer so that it functions as a setting agent in order to prevent the surface of the photothermographic material from being fluid during the drying step. Consequently, uniformity of the surface of the coating layer at the outermost layer is remarkably improved to enable the contradictory problems of property of coating surface and suppression of stickiness to be simultaneously solved.

Increasing the amount of addition of the gelling agent makes the surface sticky, although the surface condition of the coating layer is improved due to low fluidity. Accordingly, it is important to determine the amount of addition of the gelling agent. It was confirmed to be important by the inventors that the amount of addition of the gelling agent is in the ranges described below.

It was also confirmed that using a gelation accelerator is effective for solving the problem of the invention by minimizing the amount of addition of the gelling agent, thereby completing the invention described below. It was also found to be effective if the gelation accelerator is added in a different layer from the gelling agent, instead of in the same layer containing the gelling agent.

While the gelling agent and the characteristics of the hydrophobic polymer have been known in the art, there has been neither an idea to use them in a surface protective layer of a photothermographic material, nor any knowledge of the degree of the effect of concomitant use of them in a surface protective layer. There have been also no technologies for improved use of these materials in a surface protective layer.

It is an innovative idea of the invention to use the hydrophobic polymer and the gelling agent together in the outermost layer. In addition, the invention provides an effective method of use in the outermost layer for improving the surface property and for suppressing stickiness of the surface.

In a fourth embodiment of the invention, a binder in the outermost layer contains 50% by weight or more of polymer latex, and any one of layers at the surface side of the support at which the outermost layer is provided contains a fluorocarbon compound comprising a fluoroalkyl group with at least 2 carbon atoms and no more than 12 fluorine atoms.

The inventors have succeeded in improving water resistance of the surface of the photothermographic material by employing the hydrophobic polymer as a main component of the binder used at the outermost layer. However, while the hydrophobic polymer is added together with an emulsifier since the hydrophobic polymer is contained in the coating solution as a polymer latex dispersed in water, the dispersed state may be disturbed by environmental conditions. The coating surface is affected by aggregation of the hydrophobic polymer unless it is uniformly dispersed. Accordingly, the inventors found to add a fluorocarbon compound having a fluoroalkyl group with at least 2 carbon atoms and no more than 12 fluorine atoms, in order to solve the contradictory problems of property of coating surface and water resistance of the surface.

In a fifth embodiment, the invention provides a photothermographic material comprising an outermost layer binder containing 50% by weight or more of at least one of a polymer latex and a water-soluble polymer that is not derived from an animal protein; a binder at a layer adjacent to the outermost layer containing 50% by weight or more of a water-soluble polymer derived from an animal protein; and dispersed matting agent particles dispersed in advance with the water-soluble polymer that is not derived from an animal protein in at least at one of the outermost layer and a layer adjacent to the outermost layer.

The inventors have succeeded in preventing the dispersed particles from being precipitated while improving image quality and handling in transportation, by including the dispersed matting agent particles dispersed in advance with the water-soluble polymer that is not derived from an animal protein, in at least one of the outermost layer and a layer adjacent to the outermost layer.

It was confirmed that providing a layer containing the matting agent and a layer containing gelatin having a setting ability in adjacent relation with each other causes adhesion failure in the thermal developing process by facilitating precipitation of the matting agent. Since the gelatin containing layer has a low pH value while the matting agent containing layer is neutral, it is presumed that the matting agent is aggregated with each other by placing these layers in direct contact with each other due to a decrease of pH of the matting agent containing layer. Accordingly, it was found that the coating surface state is deteriorated when the matting agent containing layer is disposed in direct contact with the gelatin containing layer. Therefore, the invention was completed by finding that the coating solution may be applied after dispersing the matting agent with a water-soluble polymer that is not derived from an animal protein.

The invention was also completed by finding that adding a surfactant in the matting agent dispersion prevents aggregation of the matting agent due to a charging effect of the surfactant, whereby the matting agent is unlikely to be precipitated. It was also found that, among surfactant, the anionic surfactant described below is particularly effective for solving the problems of the invention.

Although a surfactant has conventionally been used for a photothermographic material, there has been no idea that the charging effect of the surfactant is quite effective for suppressing condensation of a matting agent. Particularly, there has been no recognition that the matting agent is aggregated by placing a mating agent containing layer in direct contact with a gelatin containing layer. Naturally, it has been not supposed that this aggregation causes adhesion failure in the thermal developing process. Accordingly, the invention, which focuses on these problems, is quite remarkable and is quite advantageous for producing the photothermographic material.

2. Composition Element of each Layer (Hydrophobic Latex Polymer)

In the invention, preferred embodiment of the polymers includes hydrophobic polymers such as acrylic polymers, poly(ester), rubber (e.g., SBR resin), poly(urethane), poly (vinyl chloride), poly(vinyl acetate), poly(vinylidene chloride), poly(olefin), and the like. As the polymers above, usable are straight chain polymers, branched polymers, or crosslinked polymers; also usable are the so-called homopolymers in which single monomer is polymerized, or copolymers in which two or more types of monomers are polymerized. In the case of a copolymer, it may be a random copolymer or a block copolymer. The molecular weight of these polymers is, in number average molecular weight, in a range of from 5,000 to 1,000,000, preferably from 10,000 to 200,000. Those having too small molecular weight exhibit insufficient mechanical strength on forming the image forming layer, and those having too large molecular weight are also not preferred because the filming properties result poor. A crosslinking polymer latex is particularly preferably used.

In the photothermographic material of the invention, the polymer latex used as the binder is a dispersion in which water-insoluble fine particles of hydrophobic polymer are dispersed in aqueous solvent. Examples of dispersed states may include such in which polymer is emulsified in dispersion solvent, such that is emulsion polymerized, or such that is dispersed by forming micelles.

As such polymer latexes, descriptions can be found in "Gosei Jushi Emulsion (Synthetic resin emulsion)" (Taira Okuda and Hiroshi Inagaki, Eds., published by Kobunshi Kankoukai (1978)), "Gosei Latex no Ouyou (Application of synthetic latex)" (Takaaki Sugimura, Yasuo Kataoka, Soichi Suzuki, and Keiji Kasahara, Eds., published by Kobunshi Kankoukai (1993)), and "Gosei Latex no Kagaku (Chemistry of synthetic latex)" (Soichi Muroi, published by Kobunshi Kankoukai (1970)).

The average particle size of the dispersed particles is preferably in a range of from 1 nm to 50,000 nm, more preferably, 5 nm to 1,000 nm. There is no particular limitation concerning particle size distribution of the dispersed particles, and may be widely distributed or may exhibit a monodisperse particle size distribution.

As for a polymer latex, a so-called core/shell latex can be used besides a normal latex having a uniform structure. In this case, it is preferred that core and shell have glass transition temperature different from each other. As for the glass transition temperature (Tg) of polymer in the polymer latex used for the binder, the range of temperature of the polymer used for is different from that of the polymer used for the image forming layer.

The Tg of the binder used for the protective layer including the outermost layer and the back layer is preferably 20° C. to 100° C., more preferably, 20° C. to 70° C., from the perspective of the film strength and preventing contact troubles, because the layers contact with apparatus. The Tg of the binder used for the image forming layer is preferably −30° C. to 80° C., more preferably 0° C. to 80° C., further preferably 10° C. to 70° C., most preferably 15° C. to 60° C., in order to accelerate dispersion of photographic materials and to obtain excellent photographic properties like high maximum density (high Dmax) and low fog level.

Specific examples of preferred polymer latex are given below, which are expressed by the starting monomers with % by weight given in parenthesis. The molecular weight is given in number average molecular weight. In the case polyfunctional monomer is used, the concept of molecular weight is not applicable because they build a crosslinked structure. Hence, they are denoted as "crosslinking", and the molecular weight is omitted. Tg represents glass transition temperature.

P-1; Latex of -MMA(70)-EA(27)-MAA(3)-(molecular weight 37000, Tg 61° C.)

P-2; Latex of -MMA(70)-2EHA(20)-St(5)-AA(5)-(molecular weight 40000, Tg 59° C.)

P-3; Latex of -St(50)-Bu(47)-MAA(3)-(crosslinking, Tg −17° C.)

P-4; Latex of -St(68)-Bu(29)-AA(3)-(crosslinking, Tg 17° C.)

P-5; Latex of -St(71)-Bu(26)-AA(3)-(crosslinking, Tg 24° C.)

P-6; Latex of -St(70)-Bu(27)-IA(3)-(crosslinking)

P-7; Latex of -St(75)-Bu(24)-AA(1)-(crosslinking, Tg 29° C.)

P-8; Latex of -St(60)-Bu(35)-DVB(3)-MAA(2)-(crosslinking)

P-9; Latex of -St(70)-Bu(25)-DVB(2)-AA(3)-(crosslinking)

P-10; Latex of -VC(50)-MMA(20)-EA(20)-AN(5)-AA(5)-(molecular weight 80000)

P-11; Latex of -VDC(85)-MMA(5)-EA(5)-MAA(5)-(molecular weight 67000)

P-12; Latex of -Et(90)-MAA(10)-(molecular weight 12000)

P-13; Latex of -St(70)-2EHA(27)-AA(3)-(molecular weight 130000, Tg 43° C.)

P-14; Latex of -MMA(63)-EA(35)-AA(2)-(molecular weight 33000, Tg 47° C.)

P-15; Latex of -St(70.5)-Bu(26.5)-AA(3)-(crosslinking, Tg 23° C.)

P-16; Latex of -St(69.5)-Bu(27.5)-AA(3)-(crosslinking, Tg 20.5° C.)

In the structures above, abbreviations represent monomers as follows. MMA: methyl metacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes above are commercially available, and polymers below are usable. As examples of acrylic polymers, there can be mentioned Cevian A-4635, 4718, and 4601 (all manufactured by Daicel Chemical Industries, Ltd.), Nipol Lx811, 814, 821, 820, and 857 (all manufactured by Nippon Zeon Co., Ltd.), and the like; as examples of poly(ester), there can be mentioned FINETEX ES650, 611, 675, and 850 (all manufactured by Dainippon Ink and Chemicals, Inc.), WD-size and WMS (all manufactured by Eastman Chemical Co.), and the like; as examples of poly (urethane), there can be mentioned HYDRAN AP10, 20, 30, and 40 (all manufactured by Dainippon Ink and Chemicals, Inc.), and the like; as examples of rubber, there can be mentioned LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like; as examples of poly(vinyl chloride), there can be mentioned G351 and G576 (all manufactured by Nippon Zeon Co., Ltd.), and the like; as examples of poly(vinylidene chloride), there can be mentioned L502 and L513 (all manufactured by Asahi Chemical Industry Co., Ltd.), and the like; as examples of poly(olefin), there can be mentioned Chemipearl S120 and SA100 (all manufactured by Mitsui Petrochemical Industries, Ltd.), and the like.

The polymer latex above may be used alone, or may be used by blending two types or more depending on needs.

In the present invention, it is preferred that the layer having photographic components is arranged by drying after coating an aqueous coating solution. However, herein "aqueous" means that the solvent of coating solution (dispersion medium) contains water at 60% by weight or more. As the component of coating solution except for water, the water-miscible organic solvent such as methanol, ethanol, isopropyl alcohol, methyl cellosolve, ethyl cellosolve, dimethylformamide, ethyl acetate, diacetone alcohol, furfuryl alcohol, benzyl alcohol, diethylene glycol monoethyl ether, oxyethyl phenyl ether can be used.

The total binder amount of the outermost layer and the light insensitive layer containing this outermost layer in the present invention is preferably 0.2 g/m$^2$ to 6.0 g/m$^2$ and more preferably 0.5 g/m$^2$ to 4.0 g/m$^2$. The total binder amount of the image forming layer in the present invention is preferably 0.2 g/m$^2$ to 30 g/m$^2$ and more preferably 1.0 g/m$^2$ to 15 g/m$^2$. The total binder amount of the back layer in the present invention is preferably 0.01 g/m$^2$ to 3 g/m$^2$ and more preferably 0.05 g/m$^2$ to 1.5 g/m$^2$.

In each layer, a crosslinking agent for the crosslinking, a surfactant to improve the coating property and the like may be added. There is a case where each of these layers is set to be two or more layers. In the case where the image forming layer has two or more layers, the polymer latex is preferably used as the binder for all layers. The protective layer is arranged on the image forming layer and there is the case that the protective layer has two or more layers. And, in the present invention, the polymer latex is used at 50% by weight or more with respect to the binder of outermost layer. Further, the back layer is the layer arranged on the outer side than the undercoat layer of the back side and there is the case that the back layer has two or more layers. And, it is preferred that the polymer latex is used in at least one layer, particularly preferably in the back layer of outermost layer.

The minimum film-forming temperature (MFT) is preferably −30° C. to 90° C. and more preferably 0° C. to 70° C. To control the minimum film-forming temperature, an auxiliary film-forming agent may be added. The auxiliary film-forming agent is called as a temporally plasticizer and is the compound (usually an organic solvent) which makes a minimum film-forming temperature of polymer latex decrease and for instance, is described in the above "GOUSEI LATEX NO KAGAKU" (Souichi Muroi, published by Koubunshi Kankoukai in 1970). The preferred auxiliary film-forming agents are following compounds, but the compounds for use of the present invention are not limited the following specific examples.

Z-1: benzyl alcohol

Z-2: 2,2,4-trimethylpentanediol-1,3-monoisobutylate

Z-3: 2-dimethylaminoethanol

Z-4: diethylene glycol

Especially, when a protective layer is formed as an outermost layer, it is preferred to add an auxiliary film-forming agent. The addition amount is preferably 1% by weight to 30% by weight with respect to the solid of polymer latex in the coating solution for use of a protective layer and more preferably 5% by weight to 20% by weight. As the water-soluble polymer of dispersion stabilizer contained in the image forming layer and the outermost layer in the present invention, polyvinyl alcohol, methyl cellulose, hydroxypropyl cellulose, carboxymethyl cellulose, hydroxypropyl methylcellulose and the like are preferably used. Polyvinyl alcohol is especially preferred.

In the outermost layer in the present invention, the water-soluble polymer may be used as a binder with the hydrophobic polymer latex as far as within the range not over 50% by weight of total binder amount of the outermost layer.

As the water-soluble polymer, the water-soluble polymer derived from animal protein such as gelatin and glue well known in the art and the other water-soluble polymer that is not derived from animal protein are described. In the present invention, the water-soluble polymer that is not derived from animal protein is preferably used.

And it is preferred that the water-soluble polymer is contained 50% by weight or more as the binder of the layer adjacent to the outermost layer, in order to improve the coating property. It is more preferred that the water-soluble polymer is contained 70% by weight or more.

(Water-Soluble Polymer that is not Derived from Animal Protein)

Water-soluble polymer which is not derived from animal protein in the present invention is natural polymer (polysaccharide series, microorganism series and animal series) except for animal protein such as gelatin and the like, semi-synthetic polymer (cellulose series, starch series and alginic acid series), synthetic polymer (vinyl series and others) and corresponds to synthetic polymer such as polyvinyl alcohol described below and natural or semi-synthetic polymer made by cellulose and the like derived from plant as a raw material.

1) Polyvinyl Alcohols

The water-soluble polymer that is not derived from animal protein in the present invention is preferably polyvinyl alcohols.

As the polyvinyl alcohols (PVA) preferably used in the present invention, there are compounds that have various degree of saponification, degree of polymerization, degree of neutralization, modified compound and copolymer with various monomers as described below.

As fully saponified compound, it can be selected among PVA-105 [polyvinyl alcohol (PVA) content: 94.0% by weight or more, degree of saponification: 98.5±0.5 mol %, content of sodium acetate: 1.5% by weight or less, volatile constituent: 5.0% by weight or less, viscosity (4% by weight at 20° C.): 5.6±0.4 CPS], PVA-110 [PVA content: 94.0% by weight, degree of saponification: 98.5±0.5 mol %, content of sodium acetate: 1.5% by weight, volatile constituent: 5.0% by weight, viscosity (4% by weight at 20° C.): 11.0±0.8 CPS], PVA-117 [PVA content: 94.0% by weight, degree of saponification: 98.5±0.5 mol %, content of sodium acetate: 1.0% by weight, volatile constituent: 5.0% by weight, viscosity (4% by weight at 20° C.): 28.0±3.0 CPS], PVA-117H [PVA content: 93.5% by weight, degree of saponification: 99.6±0.3 mol %, content of sodium acetate: 1.85% by weight, volatile constituent: 5.0% by weight, viscosity (4% by weight at 20° C.): 29.0±0.3 CPS], PVA-120 [PVA content: 94.0% by weight, degree of saponification: 98.5±0.5 mol %, content of sodium acetate: 1.0% by weight, volatile constituent: 5.0% by weight, viscosity (4% by weight at 20° C.): 39.5±4.5 CPS], PVA-124 [PVA content: 94.0% by weight, degree of saponification: 98.5±0.5 mol %, content of sodium acetate: 1.0% by weight, volatile constituent: 5.0% by weight, viscosity (4% by weight at 20° C.): 60.0±6.0 CPS], PVA-124H [PVA content: 93.5% by weight, degree of saponification: 99.6±0.3 mol %, content of sodium acetate: 1.85% by weight, volatile constituent: 5.0% by weight, viscosity (4% by weight at 20° C.): 61.0±6.0 CPS], PVA-CS [PVA content: 94.0% by weight, degree of saponification: 97.5±0.5 mol %, content of sodium acetate: 1.0% by weight, volatile constituent: 5.0% by weight, viscosity (4% by weight at 20° C.): 27.5±3.0 CPS], PVA-CST [PVA content: 94.0% by weight, degree of saponification: 96.0±0.5 mol %, content of sodium acetate: 1.0% by weight, volatile constituent: 5.0% by weight, viscosity (4% by weight at 20° C.): 27.0±3.0 CPS], PVA-HC [PVA content: 90.0% by weight, degree of saponification: 99.85 mol % or more, content of sodium acetate: 2.5% by weight, volatile constituent: 8.5% by weight, viscosity (4% by weight at 20° C.): 25.0±3.5 CPS] (above all trade names, produced by Kuraray Co., Ltd.), and the like.

As partial saponified compound, it can be selected among PVA-203 [PVA content: 94.0% by weight, degree of saponification: 88.0±1.5 mol %, content of sodium acetate: 1.0% by weight, volatile constituent: 5.0% by weight, viscosity (4% by weight at 20° C.): 3.4±0.2 CPS], PVA-204[PVA content: 94.0% by weight, degree of saponification: 88.0±1.5 mol %, content of sodium acetate: 1.0% by weight, volatile constituent: 5.0% by weight, viscosity (4% by weight at 20° C.): 3.9±0.3 CPS], PVA-205 [PVA content: 94.0% by weight, degree of saponification: 88.0±1.5 mol %, content of sodium acetate: 1.0% by weight, volatile substance: 5.0% by weight, viscosity (4% by weight at 20° C.): 5.0±0.4 CPS], PVA-210 [PVA content: 94.0% by weight, degree of saponification: 88.0±1.0 mol %, content of sodium acetate: 1.0% by weight, volatile constituent: 5.0% by weight, viscosity (4% by weight at 20° C.): 9.0±1.0 CPS], PVA-217 [PVA content: 94.0% by weight, degree of saponification: 88.0±1.0 mol %, content of sodium acetate: 1.0% by weight, volatile constituent: 5.0% by weight, viscosity (4% by weight at 20° C.): 22.5±2.0 CPS], PVA-220 [PVA content: 94.0% by weight, degree of saponification: 88.0±1.0 mol %, content of sodium acetate: 1.0% by weight, volatile constituent: 5.0% by weight, viscosity (4% by weight at 20° C.): 30.0±3.0 CPS], PVA-224 [PVA content: 94.0% by weight, degree of saponification: 88.0±1.5 mol %, content of sodium acetate: 1.0% by weight, volatile constituent: 5.0% by weight, viscosity (4% by weight at 20° C.): 44.0±4.0 CPS], PVA-228 [PVA content: 94.0% by weight, degree of saponification: 88.0±1.5 mol %, content of sodium acetate: 1.0% by weight, volatile constituent: 5.0% by weight, viscosity (4% by weight at 20° C.): 65.0±5.0 CPS], PVA-235 [PVA content: 94.0% by weight, degree of saponification: 88.0±1.5 mol %, content of sodium acetate: 1.0% by weight, volatile constituent: 5.0% by weight, viscosity (4% by weight at 20° C.): 95.0±15.0 CPS], PVA-217EE [PVA content: 94.0% by weight, degree of saponification: 88.0±1.0 mol %, content of sodium acetate: 1.0% by weight, volatile constituent: 5.0% by weight, viscosity (4% by weight at 20° C.): 23.0±3.0 CPS], PVA-217E [PVA content: 94.0% by weight, degree of saponification: 88.0±1.0 mol %, content of sodium acetate: 1.0% by weight, volatile constituent: 5.0% by weight, viscosity (4% by weight at 20° C.): 23.0±3.0 CPS], PVA-220E [PVA content: 94.0% by weight, degree of saponification: 88.0±1.0 mol %, content of sodium acetate: 1.0% by weight, volatile constituent: 5.0% by weight, viscosity (4% by weight at 20° C.): 31.0±4.0 CPS], PVA-224E [PVA content: 94.0% by weight, degree of saponification: 88.0±1.0 mol %, content of sodium acetate: 1.0% by weight, volatile constituent: 5.0% by weight, viscosity (4% by weight at 20° C.): 45.0±5.0 CPS], PVA-403 [PVA content: 94.0% by weight, degree of saponification: 80.0±1.5 mol %, content of sodium acetate: 1.0% by weight, volatile constituent: 5.0% by weight, viscosity (4% by weight at 20° C.): 3.1±0.3 CPS], PVA-405 [PVA content: 94.0% by weight, degree of saponification: 81.5±1.5 mol %, content of sodium acetate: 1.0% by weight, volatile constituent: 5.0% by weight, viscosity (4% by weight at 20° C.): 4.8±0.4 CPS], PVA-420 [PVA content: 94.0% by weight, degree of saponification: 79.5±1.5 mol %, content of sodium acetate: 1.0% by weight, volatile constituent: 5.0% by weight], PVA-613 [PVA content: 94.0% by weight, degree of saponification: 93.5±1.0 mol %, content of sodium acetate: 1.0% by weight, volatile constituent: 5.0% by weight, viscosity (4% by weight at 20° C.): 16.5±2.0 CPS], L-8 [PVA content: 96.0% by weight, degree of saponification: 71.0±1.5 mol %, content of sodium acetate: 1.0% by weight (ash), volatile constituent: 3.0% by weight, viscosity (4% by weight at 20° C.): 5.4±0.4 CPS] (above all are trade names, produced by Kuraray Co., Ltd.), and the like.

The above values were measured in the manner described in JISK-6726-1977.

As modified polyvinyl alcohol, it can be selected among cationic modified compound, anionic modified compound, modified compound by -SH compound, modified compound by alkylthio compound and modified compound by silanol. Further the modified polyvinyl alcohol described in "POVAL"(Koichi Nagano et. al., edited by Koubunshi Kankoukai) can be used.

As this modified polyvinyl alcohol (modified PVA), there are C-118, C-318, C-318-2A, C-506 (above all are trade names, produced by Kuraray Co., Ltd.) as C-polymer, HL-12E, HL-1203 (above all are trade name, produced by Kuraray Co., Ltd.) as HL-polymer, HM-03, HM-N-03 (above all are trade marks, produced by Kuraray Co., Ltd.) as HM-polymer, M-115 (trade mark, produced by Kuraray Co., Ltd.) as M-polymer, MP-102, MP-202, MP-203 (above all are trade mark, produced by Kuraray Co., Ltd.) as MP-polymer, MPK-1, MPK-2, MPK-3, MPK-4, MPK-5, MPK-6 (above all are trade marks, produced by Kuraray Co., Ltd.) as MPK-polymer, R-1130, R-2105, R-2130 (above all are trade marks, produced by Kuraray Co., Ltd.)

as R-polymer, V-2250 (trade mark, produced by Kuraray Co., Ltd.) as V-polymer and the like.

Viscosity of aqueous solution of polyvinyl alcohol can be controlled or stabilized by addition of small amount of solvent or inorganic salts, which are described in detail in above literature "POVAL" (Koichi Nagano et. al., edited by Koubunshi Kankoukai, page 144 to 154). The typical example preferably is to imcorporate boric acid to improve the surface quality of coating. The addition amount of boric acid preferably is 0.01% by weight to 40% by weight with respect to polyvinyl alcohol.

It is also described in above-mentioned "POVAL" that the crystallization degree of polyvinyl alcohol is improved and waterproof property is improved by thermal treatment. The binder used for the outermost layer in the invention can be heated at coating-drying process or can be additionally thermal treatment after drying, therefore polyvinyl alcohol, which can be improved in waterproof property during those processes, is particularly preferable among water-soluble polymers.

Furthermore it is preferred that a waterproof improving agent such as those described in above "POVAL" (page 25 to 261) is added. As examples, there are aldehydes, methylol compounds (e.g., N-methylolurea, N-methylolmelamine and the like), active vinyl compounds (divinylsulfones and their derivatives and the like), bis(β-hydroxyethylsulfones), epoxy compounds (epichlorohydrins and their derivatives and the like), polyvalent carboxylic acids (dicarboxylic acids, polyacrylic acid as polycarboxylic acids, methyl vinyl ether/maleic acid copolymers, isobutylene/maleic anhydride copolymers and the like), diisocyanates, and inorganic crosslinking agents (Cu, B, Al, Ti, Zr, Sn, V, Cr and the like).

In the present invention, inorganic crosslinking agents are preferable as a waterproof improving agent. Among these inorganic crosslinking agents, boric acids and their derivative are preferred and boric acid is particularly preferable.

Specific examples of boric acid derivatives are set forth below.

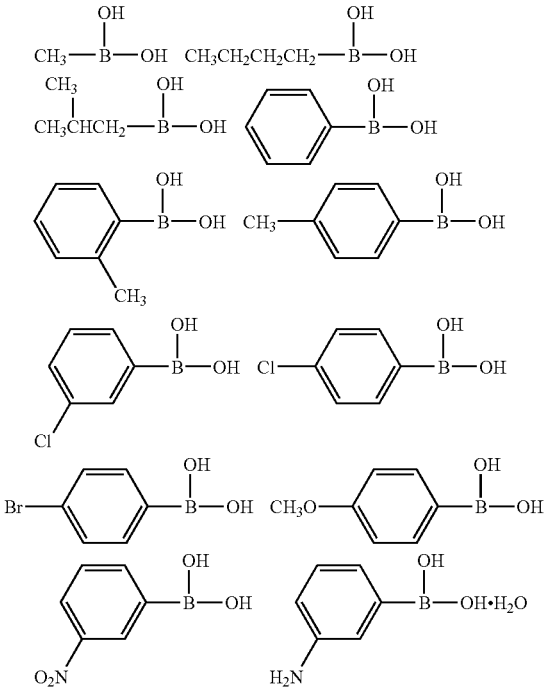

-continued

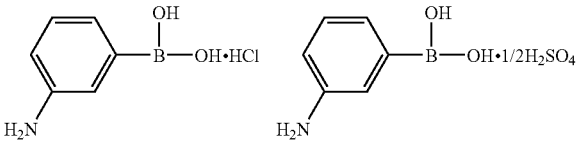

These waterproof improving agents are preferably used in the addition amount range of 0.01% by weight to 40% by weight with respect to polyvinyl alcohol.

2) Other Water-Soluble Polymer that is not Derived from Animal Protein

Water-soluble polymers which are not derived from animal protein in the present invention, besides above polyvinyl alcohols are described below. In the present invention, the polymers derived from animal protein mean natural or chemically modified water-soluble polymers such as glue, casein, gelatin, egg white and the like.

As typical examples, plant polysaccharides, such as gum arabic, κ-carrageenan, ι-carrageenan, λ-carrageenan, guar gum (Supercol produced by SQUALON Co. and the like), locust bean gum, pectin, tragacanth gum, corn starch (Purity-21 produced by National Starch & Chemical Co. and the like), starch phosphate (National 78-1898 produced by National Starch & Chemical Co. and the like) are included.

Also as polysaccharides derived from microorganism, xanthan gum (Keltrol T produced by KELCO Co. and the like), dexstran (Nadex 360 produced by National Starch & Chemical Co. and the like) and as animal polysaccharides, sodium chondroitin sulfate (Cromoist CS produced by CRODA Co. and the like) and the like are included.

And as cellulose polymer, ethyl cellulose (Cellofas WLD produced by I.C.I. Co. and the like), carboxymethyl cellulose (CMC produced by Daicel Chemical Industries, Ltd. and the like), hydroxyethyl cellulose (HEC produced by Daicel Chemical Industries, Ltd. and the like), hydroxypropyl cellulose (Klucel produced by AQUQLON Co. and the like), methyl cellulose (Viscontran produced by HENKEL Co. and the like), nitrocellulose (Isopropyl Wet produced by HELCLES Co. and the like) and cationized cellulose (Crodacel QM produced by CRODA Co. and the like) are included. As alginic acid series, sodium alginate, (Keltone produced by KELCO Co. and the like), propylene glycol alginate and the like and as other classification, cationized guar gum (Hi-care 1000 produced by ALCOLAC Co. and the like) and sodium hyaluronate (Hyalure produced by Lifecare Biomedial Co. and the like) are included.

As others, agar, furcelleran, guar gum, karaya gum, larch gum, guar seed gum, psylium seed gum, kino's seed gum, tamarind gum, tara gum and the like are included. Among them, highly water-soluble compound is preferable and the compound in which can solution sol-gel conversion can occur within 24 hours at a temperature change in the range of 5° C. to 95° C. is preferably used.

In synthetic polymers, sodium polyacrylate, polyacrylic acid copolymers, polyacrylamide, polyacrylamide copolymers and the like as acryl series, polyvinyl pyrrolidone, polyvinyl pyrrolidone copolymers and the like as vinyl series and polyethylene glycols, polypropylene glycols, polyvinyl ethers, polyethylene imines, polystyrene sulfonic acid and its copolymers, polyacrylic acid and its copolymer, polyvinyl sulfanic acid and its copolymers, maleic acid copolymers, maleic acid monoester copolymers, acryloylmethylpropane sulfonic acid and its copolymers, and the like are included.

Highly water absorbable polymers described in U.S. Pat. No. 4,960,681, JP-A No. 62-245260 and the like, namely such as homopolymers of vinyl monomer having —COOM or —$SO_3M$ (M represents a hydrogen atom or an alkali metal) or copolymers of their vinyl monomers or other vinyl monomers (e.g., sodium methacrylate, ammonium methacrylate and Sumikagel L-5H produced by SUMITOMO KAGAKU Co.) can be also used.

Among these, sodium alginate, dextran, dextrin, methyl cellulose, carboxymethyl cellulose, hydroxyethyl cellulose, hydroxypropyl cellulose, polyvinyl alcohol, polyacrylamide, polyvinyl pyrrolidone, polyethylene glycol, polypropylene glycol, polystyrene sulfonic acid and its copolymers, polyacrylic acid and its copolymers, copolymers of monoester maleic acid, acryloylmethylpropane sulfonic acid and its copolymers, and the like are preferably used as the water-soluble polymer. These compounds are described in detail in "SHIN•SUIYOUSEI POLYMER NO OUYOU TO SHIJOU" (edited by Shinji Nagatomo, published in Nov. 4, 1988 from C.M.C. Co,).

Coating amount of these water-soluble polymers preferably is 0.1 g/$m^2$ to 3.0 g/$m^2$ per one $m^2$ of support and more preferably 0.25 g/$m^2$ to 2.0 g/$m^2$. In the case, wherein the water-soluble polymer is added in the outermost layer on the back side, similar coating amount (per one layer) is preferred.

And it is preferred that the concentration of the water-soluble polymer in coating solution is arranged to have suitable viscosity value for simultaneous multilayer coating after the addition, but it is not specifically limited. Generally, the concentration of the water-soluble polymer in solution is 0.01% by weight to 30% by weight, more preferably 0.05% by weight to 20% by weight, most preferably 0.1% by weight to 10% by weight. The viscosity gain obtained by these addition preferably is 1 mPa·s to 200 mPa·s with respect to the previous viscosity, more preferably 5 mPa·s to 100 mPa·s. The viscosity above mentioned was measured with B-type rotating viscosity meter at 25° C. The glass transition temperature of water-soluble polymer preferably used in the present invention is not especially limited, but preferably is 60° C. to 220° C. in term of the brittleness such as the belt mark by thermal development, the dust adhering the sample making and the like, more preferably 70° C. to 200° C., further preferably 80° C. to 180° C. and most preferably 90° C. to 170° C.

(Binder which can Lose Fluidity)

In the present invention, a binder which can lose fluidity upon a decrease in temperature is used in the layer adjacent to the outermost layer. The binder which can lose fluidity means a water-soluble polymer derived from animal proteins described below or water-soluble polymers and hydrophobic polymers which are not derived from animal protein to which a gelling agent is added.

By gelation, the layer formed by coating loses fluidity, so the surface of image forming layer is hard to be effected by air for drying, at the drying step after coating step, and the photothermographic material with uniformly coated surface can be obtained.

Herein, it is important that a coating solution does not been gelled at a coating step. It is convenient for operation that the coating solution has fluidity at the coating step and loses fluidity by gelation before the drying step after coating step.

Viscosity of the said coating solution at a coating step is preferably 5 mPa·s to 200 mPa·s, more preferably 10 mPa·s to 100 mPa·s.

In the present invention, an aqueous solvent is used as a solvent for a coating solution. The aqueous solvent as referred herein, signifies water or the mixture of water and 70% by weight or less of a water-miscible organic solvent. As water-miscible organic solvents, there can be mentioned, for example, alcohols such as methyl alcohol, ethyl alcohol, propyl alcohol, and the like; cellosolves such as methyl cellosolve, ethyl cellosolve, butyl cellosolve, and the like; ethyl acetate, dimethylformamide, and the like.

Though it is difficult to measure the viscosity of formed layer at the time before the drying step and after coating step (at this point, the gelation occurs), it is guessed that the viscosity is almost 200 mPa·s to 5,000 mPa·s, preferably 500 mPa·s to 5,000 mPa·s.

The gelation temperature is not specifically limited, however to consider the easy work operation of coating, the gelation temperature is preferably nearly about a room temperature. Because at this temperature, it is easy to make the fluidity increase for easy coating of a coating solution and the fluidity can be maintained (that is namely the temperature level, in which the elevated temperature can be maintained easily) and this is the temperature that the cooling can be easily operated to make the fluidity of formed layer lose after coating. The preferable gelation temperature is 0° C. to 40° C., more preferably 0° C. to 35° C.

The temperature of coating solution at coating step is not specifically limited as far as the temperature is set higher than a gelation temperature, and the cooling temperature at the point before drying step and after coating step is not specifically limited as far as the temperature is set lower than a gelation temperature. However, when the difference between the temperature of coating solution and a cooling temperature is small, the problem that the gelation starts during a coating step occurs and an uniform coating can not be performed. On the other hand, when the temperature of coating solution is set too high to make this temperature difference large, it causes the problem that the solvent of coating solution is evaporated and viscosity is changed. Therefore, the difference of temperature is preferably set up in a range from 5° C. to 50° C., more preferably 10° C. to 40° C.

(Water-Soluble Polymer Derived from Animal Protein)

In the present invention, the polymer derived from animal protein means natural or chemically modified water-soluble polymer such as glue, casein, gelatin, egg white and the like.

It preferably is gelatin, in which are acid treated gelatin and alkali treated gelatin (lime extracted gelatin and the like) depending on a synthetic method and any of them can be preferably used. The molecular weight of gelatin used is preferably 10,000 to 1,000,000. Modified gelatin of an amino group or a carboxy group of gelatin (e.g., phthalated gelatin and the like) can be also used.

In an aqueous gelatin solution, solation occurs when gelatin is heated to 30° C. or more, and gelation occurs and gelatin solution loses fluidity when it is cooled to 30° C. or less. As this sol-gel exchange occurs reversibly, an aqueous gelatin solution as coating solution has the set property. That means, gelatin solution loses fluidity when it is cooled to 30° C. or less.

The content of water-soluble polymer derived from animal protein is 1% by weight to 20% by weight with respect to the total coating solution, preferably 2% by weight to 12% by weight.

(Various Additives)

In the present invention, the outermost layer can include various additives such as a matting agent, a hardener, a fluorocarbon surfactant, an anti-glazing agent, a filter dye and the like.

1) Matting Agent

The outermost layer is the most preferable as the layer containing a matting agent in the side of image forming layer, but there is also a case that a matting agent is added in either layer located on the nearer to a support than the outermost layer. "The protective layer" containing the outermost layer can be formed as two layers depending on the situation and can be designed to be consistent with the coating property, production suitability and image quality by the selection of the layer to add the additives related to the development, a pH controlling agent of a layer surface, an anti-static agent, an UV absorber, a slipping agent, a surfactant and the like.

Especially, a matting agent is preferably used as a particle dispersion of matting agent dispersed by water-soluble polymer that is not derived from animal protein in advance. And it is more preferable to add additives described below to the particle dispersion of the matting agent.

The matting agent in the present invention is generally water insoluble organic or inorganic fine particle. The arbitrary matting agent can be used and for example, the organic matting agent described in U.S. Pat. Nos. 1,939,213, 2,701,245, 2,322,037, 3,262,782, 3,539,344 and 3,767,448, and the like, the inorganic matting agent described in the specifications of U.S. Pat. Nos. 1,260,772, 2,192,241, 3,257,206, 3,370,951, 3,523,022 and 3,769,020, and the like. These are well known in the said industry.

As the organic compound usable as a matting agent, aqueous dispersed vinyl polymers such as polymethyl acrylate, polymethyl methacrylate, polyacrylonitrile, acrylonitrile/α-methylstyrene copolymer, polystyrene, styrene/divinylbenzene copolymer, polyvinyl acetate, polyethylene carbonate, polytetrafluoroethylene and the like, cellulose derivatives such as methylcellulose, cellulose acetate, cellulose acetate propionate and the like, starch derivatives such as carboxy starch, carboxynitrophenyl starch, reaction product of urea—formaldehyde—starch and the like, hardened gelatin by known hardener and the like, hardened gelatin as a fine hollow capsule particle by a coacervated hardening are preferably used.

As examples of inorganic compound, silicon dioxide, titanium dioxide, magnesium dioxide, aluminium oxide, barium sulfate, calcium carbonate, silver chloride and silver bromide desensitized by known method, glass, diatomaceous earth and the like are preferably used. The different kind of compound can be used by mixing with the above matting agent if necessary. There is no limitation according to the size and form of matting agent, an arbitrary particle size can be used. In this invention, particle size of matting agent is preferably 0.1 μm to 30 μm. The particle size is more preferably 0.3 μm to 20 μm, and further preferably 0.5 μm to 10 μm. And the size distribution can be any of narrow and wide. The size frequency distribution is preferably 50% or less, more preferably 40% or less and still more preferably 30% or less. Herein, the size frequency distribution means the value represented by (standard deviation of particle size)/(average value of particle size)×100. And the combination use of two kinds of matting agent, which has lower coefficient of variation and the ratio of average grain size lager than three is preferable.

On the other side, as a matting agent effects greatly to haze and surface gloss, it is preferred that the particle size, the shape and the size distribution are arranged in the suitable condition in proportion to the need at the making time of the matting agent or at the mixing time of the plural matting agents.

Preferable examples of matting agent used in the present invention are described below, however this invention is not limited in the compounds described below.

M-1: polyethylene particle: specific gravity: 0.90 (Flow beads LE-1080 produced by SUMITOMOSEIKA Co.)

M-2: polyethylene particle: specific gravity: 0.93 (Flow beads EA-209 produced by SUMITOMOSEIKA Co.)

M-3: polyethylene particle: specific gravity: 0.96 (Flow beads HE-3040 produced by SUMITOMOSEIKA Co.)

M-4: silicon particle: specific gravity: 0.97

M-5: silicon particle: specific gravity: 1.00 (E-701 produced by TORAY DAW SILICON Co.)

M-6: silicon particle: specific gravity: 1.03

M-7: polystyrene particle: specific gravity: 1.05 (SB-6 produced SEKISUIKASEIHINKOUGYOU Co.)

M-8: poly(St/MAA=97/3) copolymer particle: specific gravity: 1.05

M-9: poly(St/MAA=90/10) copolymer particle: specific gravity: 1.06

M-10: poly(St/MMA/MAA=50/40/10) copolymer particle: specific gravity: 1.09

M-11: crosslinking polyethylene particle: specific gravity: 0.92

M-12: crosslinking polyethylene particle: specific gravity: 0.95

M-13: crosslinking polyethylene particle: specific gravity: 0.98

M-14: crosslinking silicon grain particle: specific gravity: 0.99

M-15: crosslinking silicon grain particle: specific gravity: 1.02

M-16: crosslinking silicon grain particle: specific gravity: 1.04

M-17: poly(St/DVB=90/10) particle: specific gravity 1.06 (SX-713 produced by SOKENKAGAKU Co.)

M-18: poly(St/DVB=80/20) particle: specific gravity 1.06 (SX-713 produced by SOKENKAGAKU Co.)

M-19: poly(St/DVB=70/30) particle: specific gravity 1.07 (SX-713 produced by SOKENKAGAKU Co.)

M-20: copoly(St/MAA/DVB=87/3/10) particle: specific gravity 1.06 (SX-713 α produced by SOKENKAGAKU Co.)

M-21: copoly(St/MAA/DVB=80/10/10) particle: specific gravity 1.07 (SX-713 α produced by SOKENKAGAKU Co.)

M-22: copoly(St/MMA/MAA/DVB=40/40/10/10) particle: specific gravity 1.10

The content of a matting agent is set within a range in which the expected effect of the present invention can be exhibited and the original function of the layer containing a matting agent can not be prevented too much. The addition amount of the matting agent is preferably in the range 1 $mg/m^2$ to 400 $mg/m^2$, more preferably 5 $mg/m^2$ to 300 $mg/m^2$ with respect to the coating amount per one $m^2$ of the photosensitive material.

When the matting agent is contained in the image forming layer surface, it is generally that the amount of matting agent is within the range not to occur star dust trouble and the Beck smoothness is preferably set 500 seconds or more and 10000 seconds or less, more preferably 500 seconds or more and 2000 seconds or less. When the matting agent is contained in the back layer, Beck smoothness is preferably set 2000 seconds or less and 10 seconds or more, more preferably 1500 seconds or less and 50 seconds or more. And Beck smoothness in the present specification is calculated by JIS P8119 and TAPPI T479.

The matting agent contained in the outermost layer located on the side of image forming layer and the adjacent layer to outermost layer is used as matting particle dispersion by pre-dispersion with water-soluble polymer that is not derived from animal protein. There are two dispersion methods.

(a) an arranging method of matting agent dispersion to make a polymer droplet by emulsified dispersion in an aqueous medium of polymer solution prepared in advance (e.g., dissolved in a low boiling point organic solvent) as a matting agent and then to remove a boiling point organic solvent in the emulsion (b) a method to arrange the dispersion of fine particle of polymer and the like prepared in advance as a matting agent in an aqueous medium not to get lumpy.

In the present invention, the method (b) that takes into consideration for environment not to exhaust a low boiling point solvent in air is preferable.

The dispersion method of the matting agent described above can disperse mechanically using the known high speed starring method (e.g., Disbar homogenizer, a homomixer, a turbine mixer, a homogenizer and the like) and an ultrasonic homogenizer in the beforehand presence of aqueous medium containing water-soluble polymer that is not derived from animal protein as a auxiliary dispersing agent in an aqueous solvent. At the dispersion, to prevent the occurrence of vesicular, the dispersion method which disperses in the depressed condition less than atomospheric pressure can be used with. The auxiliary dispersing agent is generally dissolved in an aqueous solvent beforehand the addition of a matting agent, however can be added as a water dispersion made by polymerized matting agent (without drying process). The auxiliary dispersing agent can be added in the dispersion solution during dispersion and can be added for the stabilization of physical property after dispersion. In each case, it is generally that the solvent (e.g., water alcohol and the like) is coexisted. At the before and after of dispersion or during dispersion, pH can be controlled by suitable pH controlling agent.

Besides the mechanical dispersion method, the stability of matting agent dispersion after dispersion may be increased by the pH control. And at dispersion, a very small quantity of organic solvent having a low boiling point can be used and in general, the organic solvent is removed after finishing of the fine particulate process.

The arranged dispersion can be stored with starring to prevent the sedimentation of a matting agent at storage or can be stored in the highly viscosity condition using hydrophilic colloide (e.g., the case of jelly condition by using gelatin and the like). And to prevent the propagation of bacterium, the addition of preservative is preferable.

The water-soluble polymer that is not derived from animal protein is preferably added and dispersed 5% by weight to 300% by weight, more preferably 10% by weight to 200% by weight respect to the matting agent.

A surfactant makes the dispersion state stable, therefore it is preferred that a surfactant is added to the matting particle dispersion in the present invention. The surfactant used herein is not particularly limited, but the known compound can be used. As the conventionally used auxiliary dispersion agent, an anionic dispersing agent such as alkylphenoxyethoxyethanesulfonate, polyoxyethylenealkylphenylether sulfonate, alkylbenzenesulfonate, alkylnaphthalene sulfonate, alkylsulfonate, alkylsulfosuccinate, sodium oleilmethyltauride, condensed polymerization compound of naphthalenesulfonic acid and formaldehyde, polyacrylic acid, polymethacrylic acid, copolymer of maleic acid and acrylic acid, carboxymethyl cellulose, cellulose sulfate and the like, and a nonionic dispersing agent such as polyoxyethylenealkyl ether, sorbitane ester of aliphatic acid, polyoxyethylenesorbitane ester of aliphatic acid, a block polymer of polyalkyleneoxide and the like and a cationic dispersing agent and a betaine type dispersing agent are described. Especially, an anionic surfactant such as sodium triisopropylnaphthalenesulfonate (a mixture in which the substituent positions of three isopropyl groups are different) and the like is preferable.

As examples of fungicide which can be added in a dispersion, sodium salt of benzothiazolinone, p-hydroxybenzoate (methyl ester, butyl ester and the like) can be added. Preferred addition amount is 0.005% by weight to 0.1% by weight with respect to the dispersion solution.

And a fluorocarbon compound is preferably used and among them the defined fluorocarbon compounds shown below are particularly preferable.

2) Fluorocarbon Compound

It is preferred that a photothermographic material in the present invention contains a fluorocarbon compound having a fluoroalkyl group which has at least two carbon atoms and no more than 12 fluorine atoms, in at least one of the outermost layer and the layer adjacent to the outermost layer. The fluorocarbon compound in the present invention can be used as a surfactant. This fluorocarbon compound may preferably be added to the matting agent dispersion described above.

The fluorocarbon compound in the present invention can have any structure, as far as it has a fluoroalkyl group described above (after now, fluorine substituted alkyl group is called as 'Rf'). And the fluorocarbon compound may have at least one or more Rf, and can have two or more Rf. The fluorocarbon having two or more Rf is preferred.

As specific examples of Rf, the following compounds can be described, but Rf is not limited thereto.

—$C_2F_5$ group, —$C_3F_7$ group, —$C_4F_9$ group, —$C_5F_{11}$ group, —$CH_2$—$C_4F_9$ group, —$C_4F_8$—H group, —$C_2H_4$—$C_4F_9$ group, —$C_4H_8$—$C_4F_9$ group, —$C_6H_{12}$—$C_4F_9$ group, —$C_8H_{16}$—$C_4F_9$ group, —$C_4H_8$—$C_2F_5$ group, —$C_4H_8$—$C_3F_7$ group, —$C_4H_8$—$C_5F_{11}$ group, —$C_8H_{16}$—$C_2F_5$ group, —$C_2H_4$—$C_4F_8$—H group, —$C_4H_8$—$C_4F_8$—H group, —$C_6H_{12}$—$C_4F_8$—H group, —$C_6H_{12}$—$C_2F_4$—H group, —$C_8H_{16}$—$C_2F_4$—H group, —$C_2H_4$—$C_4F_8$—H group, —$C_4H_8$—$C_4F_8$—H group, —$C_6H_{12}$—$C_4F_8$—H group, —$C_6H_{12}$—$C_2F_4$—H group, —$C_8H_{16}$—$C_2F_4$—H group, —$C_6H_{12}$—$C_4F_8$—$CH_3$ group, —$C_2H_4$—$C_3F_7$ group, —$C_2H_4$—$C_5F_{11}$ group, —$C_4H_8$—$CF(CF_3)_2$ group, —$CH_2CF_3$ group, —$C_4H_8$—$CH(C_2F_5)$ group, —$C_4H_8$—$CH(CF_3)_2$ group, —$C_4H_8$—$C(CF_3)_3$ group, —$CH_2$—$C_4F_8$—H group, —$CH_2$—$C_6F_{12}$—H group Rf has 12 or less fluorine atoms, preferably 3 to 11 fluorine atoms, and more preferably 5 to 9 fluorine atoms. And Rf has two or more carbon atoms, preferably 4 to 16 carbon atoms, and more preferably 5 to 12 carbon atoms.

The structure of Rf is not particularly limited as for as Rf has two or more carbon atoms and 12 or less fluorine atoms, however, the group represented by the following general formula (FW) is preferred.

-Rc-Re—W General formula (FW)

In general formula (FW), Rc represents an alkylene group having 1 to 4 carbon atoms, preferably 1 to 3 carbon atoms, more preferably 1 to 2 carbon atoms.

An alkylene group represented by Rc may be a linear or a branched chain.

Re represents a perfluoroalkylene group having 2 to 6 carbon atoms, preferably 2 to 4 carbon atoms. Herein, the perfluoroalkylene group means an alkylene group where all hydrogen atoms of an alkylene group are replaced by fluorine atoms. The perfluoroalkylene group described above may be a linear or a branched chain, or a cyclic structure.

W represents a hydrogen atom, a fluorine atom and an alkyl group, preferably a hydrogen atom and a fluorine atom, most preferably a fluorine atom.

The fluorocarbon compound in the present invention can have a cationic hydrophilic group.

The cationic hydrophilic group means the group which becomes an anion when it is dissolved in water. As specific examples, tertiary ammonium, alkyl pyridium, alkyl imidazolium, primary to thirdly aliphatic amines and the like are described.

As a cation, an organic cationic substituent is preferably and an organic cationic group containing a nitrogen atom or a phosphorous atom is more preferred. And a pyridinium cation or an ammonium cation is further more preferred.

A salt forming anion may be any of an inorganic anion or an organic anion. As an inorganic anion, iodide ion, bromide ion, chloride ion and the like are described. As an organic anion, p-toluenesulfonic acid ion, p-toluenesulfonate ion, benzenesulfonate ion, methanesulfonate ion, trifluoromethanesulfoate ion and the like are described.

In the present invention, the preferred cationic fluorocarbon compound is represented by the following general formula (F1).

General formula (F1)

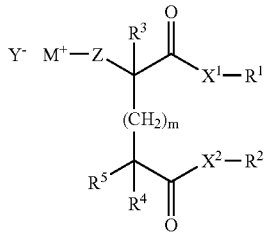

In general formula (F1), $R^1$ and $R^2$ each represent a substituted or a non-substituted alkyl group, however, at least one of $R^1$ and $R^2$ is a fluoroalkyl group (Rf) described above. It is preferred that both of $R^1$ and $R^2$ are Rf. $R^3$, $R^4$ and $R^5$ each independently represent a hydrogen atom or a substituent. $X^1$, $X^2$ and Z each independently represent a divalent linking group or a single bond, and $M^+$ represents a cationic substituent. $Y^-$ represents a counter anion, however, when the charge results in 0 in a molecule, $Y^-$ is not necessary. m represents 0 or 1.

In general formula (F1) described above, when $R^1$ and $R^2$ each represents a substituted or a non-substituted alkyl group except Rf, above alkyl group has one or more carbon atoms and may be any of a linear, a branched or a cyclic structure. Above substituent can include, a halogen atom except fluorine, an alkenyl group, an aryl group, an alkoxyl group, a carboxylate group, a carbonamide group, a carbamoyl group, an oxycarbonyl group, a phosphate group and the like.

In the case where $R^1$ and $R^2$ each represents an alkyl group except Rf, namely an alkyl group not substituted by fluorine atom, the alkyl group is a substituted or a non-substituted alkyl group having 1 to 24 carbon atoms, more preferably a substituted or a non-substituted alkyl group having 6 to 24 carbon atoms. As preferable examples of a non-substituted alkyl group having 6 to 24 carbon atoms, a n-hexyl group, a n-heptyl group, a n-octyl group, a tert-octyl group, a 2-ethylhexyl group, a n-nonyl group, a 1,1,3-trimethylhexyl group, a n-decyl group, a n-dodecyl group, a cetyl group, a hexadecyl group, a 2-hexyldecyl group, a octadecyl group, a eicosyl group, a 2-octyldodecyl group, a docosyl group, a tetracosyl group, a 2-decyltetradecyl group, a tricosyl group, a cyclohexyl group, a cycloheptyl group and the like are described. And as preferable examples of substituted alkyl group having 6 to 24 total carbon atoms, a 2-hexenyl group, a oleyl group, a linoleyl group, a linolenyl group, a benzyl group, a β-phenethyl group, a 2-methoxyethyl group, a 4-phenylbutyl group, a 4-acetoxyethyl group, a 6-phenoxyhexyl group, a 12-phenyldodecyl group, a 18-phenyloctadecyl group, a 12-(p-chlorophenyl)dodecyl group, a 2-(diphenyl phosphate)ethyl group and the like are described.

As the alkyl group, except Rf, represented by $R^1$ and $R^2$, a substituted or a non-substituted alkyl group having 6 to 18 carbon atoms is more preferred. As preferable examples of non-substituted alkyl group having 6 to 18 carbon atoms, a n-hexyl group, cyclohexyl group, a n-heptyl group, a n-octyl group, a 2-ethylhexyl group, a n-nonyl group, a 1,1,3-trimethylhexyl group, a n-decyl group, a n-dodecyl group, a cetyl group, hexadecyl group, a 2-hexyldecyl group, an octadecyl group, a 4-tert-butylcyclohexyl group and the like are described. And as preferable examples of subsutituted alkyl group having 6 to 18 total carbon atoms, a phenethyl group, a 6-phenoxyhexyl group, a 12-phenyldodecyl group, an oleyl group, a linoleyl group, a linolenyl group and the like are described.

As the alkyl group, except Rf, represented by $R^1$ and $R^2$, a n-hexyl group, a cyclohexyl group, a n-heptyl group, a n-octyl group, a 2-ethylhexyl group, a n-nonyl group, a 1,1,3-trimethylhexyl group, a n-decyl group, a n-dodecyl group, a cetyl group, a hexadecyl group, a 2-hexyldecyl group, an octadecyl group, an oleyl group, a linoleyl group and a linolenyl group is especially preferred. The non-substituted linear, cyclic or branched alkyl group having 8 to 16 carbon atoms is most preferred.

In general formula (F1) described above, $R^3$, $R^4$ and $R^5$ each independently represents a hydrogen atom and a substituent. As the examples of said substituent, an alkyl group (preferably an alkyl group having 1 to 20 carbon atoms, more preferably an alkyl group having 1 to 12 carbon atoms, especially preferably an alkyl group having 1 to 8 carbon atoms, e.g., a methyl group, an ethyl group, an isopropyl group, a tert-butyl group, a n-octyl group, a n-decyl group, a n-hexadecyl group, a cyclopropyl group, a cyclopentyl group, a cyclohexyl group and the like are described.), an alkenyl group (preferably an alkenyl group having 2 to 20 carbon atoms, more preferably an alkenyl group having 2 to 12 carbon atoms, especially preferably an alkenyl group having 2 to 8 carbon atoms, e.g., a vinyl group, an allyl group, a 2-butenyl group, a 3-pentenyl group and the like are described.), an alkyl group (preferably an alkyl group having 2 to 20 carbon atoms, more preferably an alkyl group having 2 to 12 carbon atoms, especially preferably an alkyl group having 2 to 8 carbon atoms, e.g., an propagyl group, 3-pentynyl group and the like are described.), an aryl group (preferably an aryl group having 6 to 30 carbon atoms, more preferably an aryl group having 6 to 20 carbon atoms, especially preferably an aryl group having 6 to 12 carbon atoms, e.g., a phenyl group, a p-methylphenyl group, a naphthyl group and the like are described.), a substituted or a non-substituted amino group (preferably an amino group having 0 to 20 carbon atoms, more preferably an amino group having 0 to 10 carbon atoms, especially preferably an amino group having 0 to 6 carbon atoms, e.g., a non-substituted amino group, a methyl amino group, a dimethylamino group, a diethylamino group, a dibenzylamino group and the like are described.), an alkoxy group (preferably an alkoxy group having 1 to 20 carbon atoms, more preferably an alkoxy group having 1 to 12 carbon atoms, especially preferably an alkoxy group having 1 to 8 carbon atoms, e.g., a methoxy group, an ethoxy group, a butoxy group and the like are described.), an aryloxy group (preferably an aryloxy group having 6 to 20 carbon atoms, more preferably an aryloxy group having 6 to 16 carbon atoms, especially preferably an aryloxy group having 6 to 12 carbon atoms, e.g., a phenoxy group, a 2-naphthyloxy group and the like are described.), an acyl group (preferably an acyl group having 1 to 20 carbon atoms, more preferably an acyl group having 1 to 16 carbon atoms, especially preferably an acyl group having 1 to 12 carbon atoms, e.g., an acetyl group, a benzoyl group, a formyl group, a pivaloyl group and the like are described.), an alkoxycarbonyl group (preferably an alkoxycarbonyl group having 2 to 20 carbon atoms, more preferably an alkoxycarbonyl group having 2 to 16 carbon atoms, especially preferably an alkoxycarbonyl group having 2 to 12 carbon atoms, e.g., a methoxycarbonyl group, an ethoxycarbonyl group and the like are described.), an aryloxycarbonyl group (preferably an aryloxycarbonyl group having 7 to 20 carbon atoms, more preferably an aryloxycarbonyl group having 7 to 16 carbon atoms, especially preferably an aryloxycarbonyl group having 7 to 10 carbon atoms, e.g., a phenyloxycarbonyl group and the like are described.), an acyloxy group (preferably an acyloxy group having 2 to 20 carbon atoms, more preferably an acyloxy group having 2 to 16 carbon atoms, especially preferably an acyloxy group having 2 to 10 carbon atoms, e.g., an acetoxy group, a benzoyloxy group and the like are described.), an acylamino group (preferably an acylamino group having 2 to 20 carbon atoms, more preferably an acylamino group having 2 to 16 carbon atoms, especially preferably an acylamino group having 2 to 10 carbon atoms, e.g., an acetylamino group, a benzoylamino group and the like are described.), an alkoxycarbonylamino group (preferably an alkoxycarbonylamino group having 2 to 20 carbon atoms, more preferably an alkoxycarbonylamino group having 2 to 16 carbon atoms, especially preferably an alkoxycarbonylamino group having 2 to 12 carbon atoms, e.g., a methoxycarbonylamino group and the like are described.), an aryloxycarbonylamino group (preferably an aryloxycarbonylamino group having 7 to 20 carbon atoms, more preferably an aryloxycarbonylamino group having 7 to 16 carbon atoms, especially preferably an aryloxycarbonylamino group having 7 to 12 carbon atoms, e.g., a phenyloxycarbonylamino group and the like are described.), a sulfonylamino group (preferably a sulfonylamino group having 1 to 20 carbon atoms, more preferably a sulfonylamino group having 1 to 16 carbon atoms, especially preferably a sulfonylamino group having 1 to 12 carbon atoms, e.g., a metanesulfonylamino group, a benzenesulfonylamino group, and the like are described.), a sulfamoyl group (preferably a sulfamoyl group having 0 to 20 carbon atoms, more preferably a sulfamoyl group having 0 to 16 carbon atoms, especially preferably a sulfamoyl group having 0 to 12 carbon atoms, e.g., a sulfamoyl group, a methylsulfamoyl group, a dimethylsulfamoyl group, a phenylsulfamoyl group and the like are described.), a carbamoyl group (preferably a carbamoyl group having 1 to 20 carbon atoms, more preferably a carbamoyl group having 1 to 16 carbon atoms, especially preferably a carbamoyl group having 1 to 12 carbon atoms, e.g., a non-substituted carbamoyl group, a methylcarbamoyl group, a diethylcarbamoyl group, a phenylcarbamoyl group and the like are described.), an alkylthio group (preferably an alkylthio group having 1 to 20 carbon atoms, more preferably an alkylthio group having 1 to 16 carbon atoms, especially preferably an alkylthio group having 1 to 12 carbon atoms, e.g., a methylthio group, an ethylthio group and the like are described.), an arylthio group (preferably an arylthio group having 6 to 20 carbon atoms, more preferably an arylthio group having 6 to 16 carbon atoms, especially preferably an arylthio group having 6 to 12 carbon atoms, e.g., a phenylthio group and the like are described.), a sulfonyl group (preferably a sulfonyl group having 1 to 20 carbon atoms, more preferably a sulfonyl group having 1 to 16 carbon atoms, especially preferably a sulfonyl group having 1 to 12 carbon atoms, e.g., a mesyl group, a tosyl group and the like are described.), a sulfinyl group (preferably a sulfinyl group having 1 to 20 carbon atoms, more preferably a sulfinyl group having 1 to 16 carbon atoms, especially preferably a sulfinyl group having 1 to 12 carbon atoms, e.g., a methanesulfinyl group, a benzenesulfinyl group and the like are described.), an ureido group (preferably an ureido group having 1 to 20 carbon atoms, more preferably an ureido group having 1 to 16 carbon atoms, especially preferably an ureido group having 1 to 12 carbon atoms, e.g., a non-substituted ureido group, a methylureido group, a phenylureido group and the like are described.), a phosphonamido group (preferably a phosphonamido group having 1 to 20 carbon atoms, more preferably a phosphonamido group having 1 to 16 carbon atoms, especially preferably a phosphonamido group having 1 to 12 carbon atoms, e.g., a diethylphosphonamido group, a phenylphosphonamido and the like are described.), a hydroxy group, a mercapto group, a halogen atom (e.g., fluorine atom, chlorine atom, bromine atom and iodine atom), a cyano group, a sulfo group, a carboxyl group, a nitro group, a hydroxamic acid group, a sulfino group, a hydrazino group, an imino group, a heterocyclic group (preferably a heterocyclic group having 1 to 30 carbon atoms, more preferably a heterocyclic group having 1 to 12 carbon atoms, e.g., a heterocyclic group having a hetero atom such as nitrogen atom, oxygen atom, sulfur atom and the like, e.g., an imidazolyl group, a pyridyl group, a quinolyl group, a furyl group, a piperidyl group, a morpholino group, a benzoxazolyl group, a benzimidazolyl group, a benzthiazolyl group and the like are described.), a silyl group (preferably a silyl group having 3 to 40 carbon atoms, more preferably a silyl group having 3 to 30 carbon atoms, especially preferably a silyl group having 3 to 24 carbon atoms, e.g., a trimethlysilyl group, a triphenylsilyl group and the like are described.) and the like are described. These substituents may be further substitiuted. And in the case that two or more subsutituents are there, each may be the same or different. And if possible, these may combine each other to form a ring.

As $R^3$, $R^4$ and $R^5$, an alkyl group and a hydrogen atom are preferred and a hydrogen atom is more preferred.

In general formula (F1) described above, $X^1$ and $X^2$ each represents a divalent linking group or a single bond. There is no limitation regarding the divalent linking group described above, but an allylene group, —O—, —S— or —$NR^{31}$— ($R^{31}$ represents a hydrogen atom or a substituent and this substituent is the same as the examples which $R^3$, $R^4$ and $R^5$ each represents, and as $R^{31}$, an alkyl group, Rf described above or a hydrogen atom is preferred and a hydrogen atom is more preferred) or the group obtained by those combinations is preferred and —O—, —S— or —$NR^{31}$— is more preferred. As $X^1$ and $X^2$, —O— or —$NR^{31}$— is more preferred and —O— is especially preferred.

In general formula (F1) described above, Z represents a divalent linking group or a single bond. There is no limitation regarding the divalent linking group described above, but an alkylene, an allylene group, —C(=O)—, —O—, —S—, —S(=O)—, —$S(=O)_2$— or —$NR^{32}$— ($R^{32}$ represents a hydrogen atom or a substituent and this substituent is the same as the examples which $R^3$, $R^4$ and $R^5$ each represents, and as $R^{32}$, an alkyl group, or a hydrogen atom is preferred and a hydrogen atom is more preferred) or the group obtained by those combinations is preferred. As Z, an alkylene group having 1 to 8 carbon atoms, —C(=O)—, —O—, —S—, —S(=O)—, —$S(=O)_2$— or —$NR^{32}$— or the group obtained by those combinations is more preferred. Following examples are described.

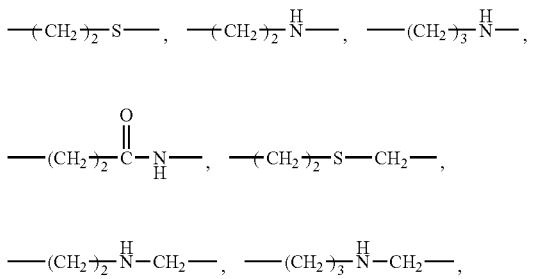

In the formula (F1) described above, $M^+$ represents a cationic subsutituent. As $M^+$, an organic cationic substituent is preferred and an organic cationic substituent having a nitrogen atom or a phosphor atom is more preferred. Further more, a pyridinium cation or an ammonium cation is preferred and a trialkyl ammonium cation represented by following general formula (F2) is more preferred.

General formula (F2)

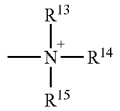

In general formula (F2), $R^{13}$, $R^{14}$ and $R^{15}$ each independently represent a substituted or a non-substituted alkyl group. As the said substituent, the subsutituents as a substituent of $R^4$ and $R^5$ described above can be applied. And when it is possible, $R^{13}$, $R^{14}$ and $R^{15}$ can form a ring by binding each other. As $R^{13}$, $R^{14}$ and $R^{15}$, an alkyl group having 1 to 12 carbon atoms is preferred and an alkyl group having 1 to 6 carbon atoms is more preferred and methyl group, ethyl group and methylcarboxyl group are still more preferred and methyl group is especially preferred.

In general formula (F1), $Y^-$ represents a counter anion and may be an inorganic anion or an organic anion. And when the charge results in 0 in a molecule, $Y^-$ is not necessary. As preferable inorganic anion, iodine ion, bromine ion, chloride ion and the like are described and as preferable organic anion, p-toluenesulfonate ion, benzenesulfonate ion, methanesulfonate ion, trifluoromethanesulfoate ion and the like are described. As $Y^-$, iodine ion, p-toluenesulfonate ion and benzenesulfonate ion are preferred and p-toluenesulfonic acid is more preferred.

In general formula (F1) described above, m represents 0 or 1 and 0 is preferred.

Among the compounds described by general formula (F1), the compound represented by general formula (F1-a) is preferred.

General formula (F1-a)

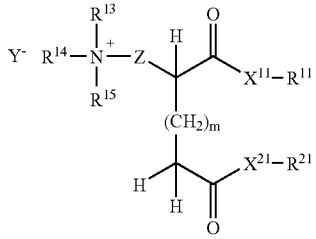

In the formula, $R^{11}$ and $R^{21}$ each independently represent a substituted or a non-substituted alkyl group, but at least one of $R^1$ and $R^2$ represents Rf described above and $R^{11}$ and $R^{21}$ have 19 or less carbon atoms in total. $R^{13}$, $R^{14}$ and $R^{15}$ each independently represent a substituted or a non-substituted alkyl group and can form a ring by binding each other. $X^{11}$ and $X^{21}$ each independently represent —O—, —S— or —$NR^{31}$—, $R^{31}$ represents a hydrogen atom or a substituent, and z represents a divalent linking group or a single bond. $Y^-$ represents a counter anion, however, when the charge results in 0 in a molecule, $Y^-$ is not necessary. m represents 0 or 1. In the formula, Z and $Y^-$ are the same as those in general formula (F1) and the preferred range is also the same. $R^{13}$, $R^{14}$, $R^{15}$ and m are the same as those in general formula (F1) and the preferred range is also the same.

In the formula, $X^{11}$ and $X^{12}$ each represent —O—, —S— or —$NR^{31}$— ($R^{31}$ represents a hydrogen atom or a substituent and as the said substituent, the substituent described as that of $R^3$, $R^4$ and $R^5$ can be applied and as $R^{31}$, an alkyl group, Rf described above or a hydrogen atom is preferred and a hydrogen atom is more preferred). As $X^{11}$ and $X^{21}$, —O— and —NH— are more preferable and —O— is still more preferred.

In the formula described above, $R^{11}$ and $R^{21}$ are the same as $R^1$ and $R^2$ in general formula (F1) and the preferred range is also the same. However, $R^{11}$ and $R^{21}$ have 19 or less carbon atoms in total, and m is 0 or 1.

Specific example of the compound represented by the above general formula (F1) can be described, but the present invention is not limited by following specific examples. In the following structure donations of compounds, unless otherwise indicated, an alkyl group and a perfluoroalkyl group mean a linear structure. Also, in the structure donations, 2EH means 2-ethylhexyl.

FS-1
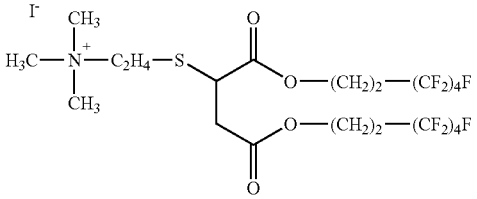
FS-2
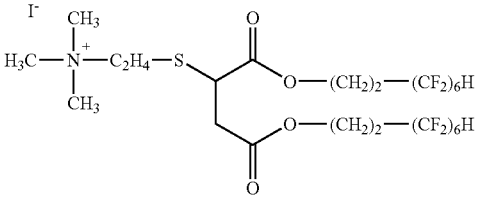
FS-3
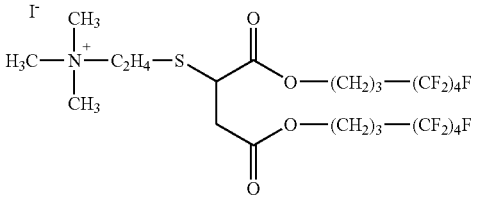
FS-4
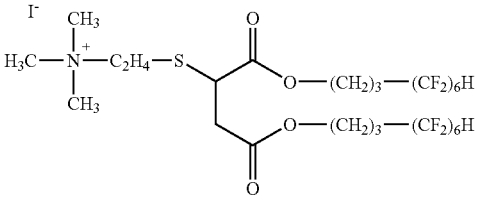
FS-5
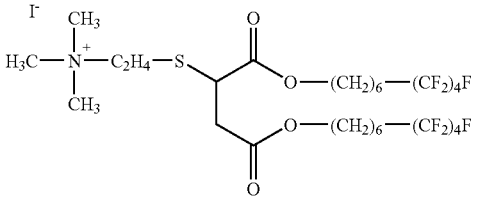
FS-6
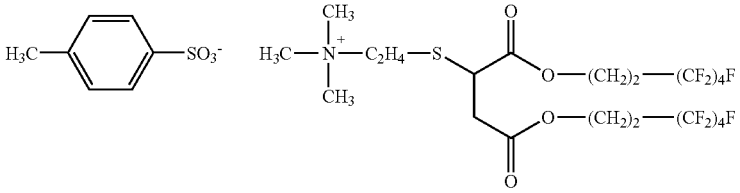
FS-7
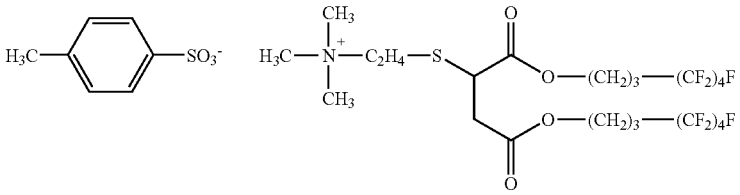
FS-8
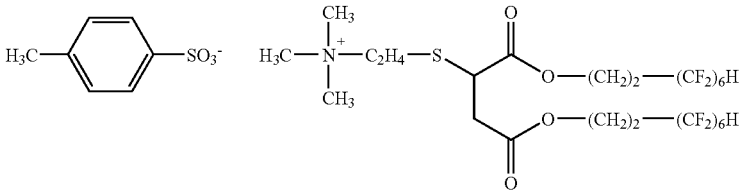
FS-9
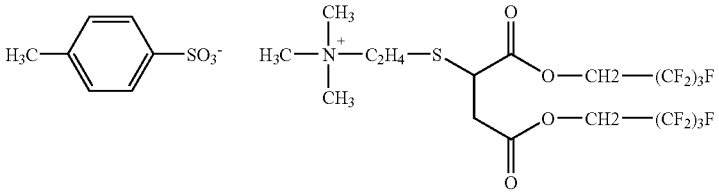

-continued
FS-10
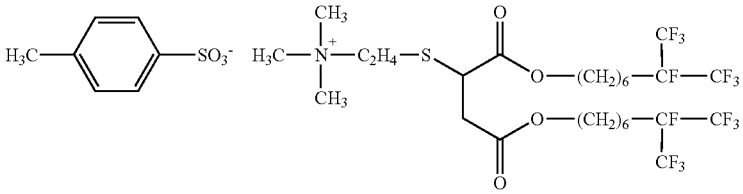
FS-11
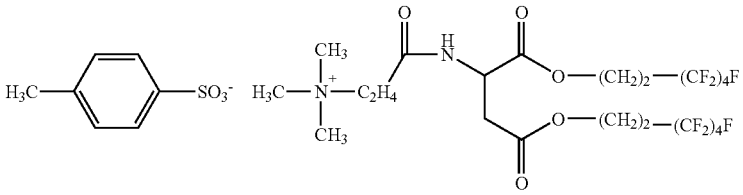
FS-12
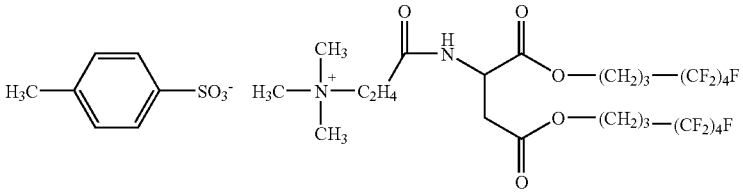
FS-13
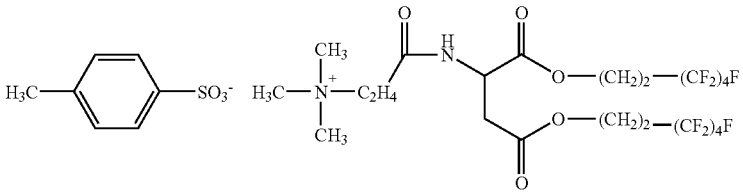
FS-14
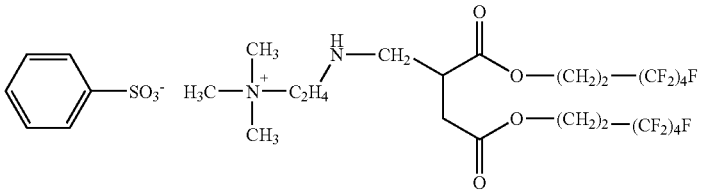
FS-15
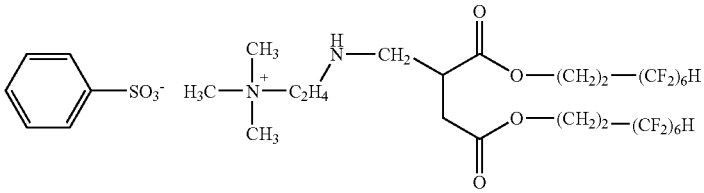
FS-16
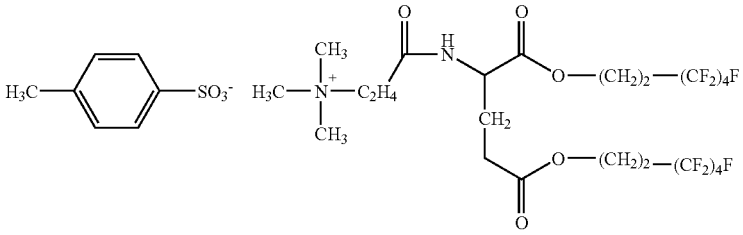

-continued
FS-17
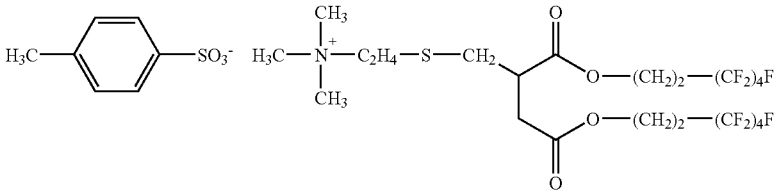
FS-18
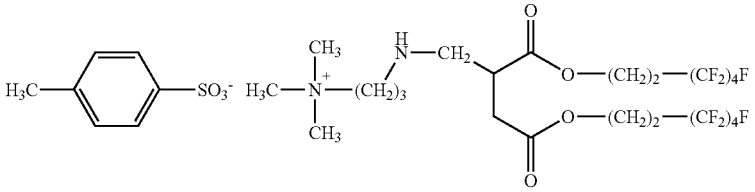
FS-19
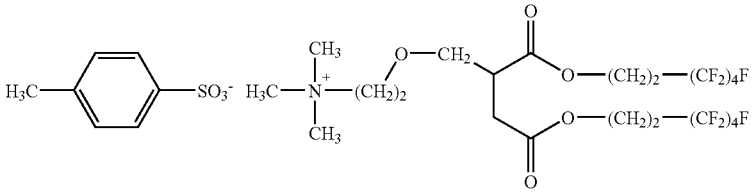
FS-20
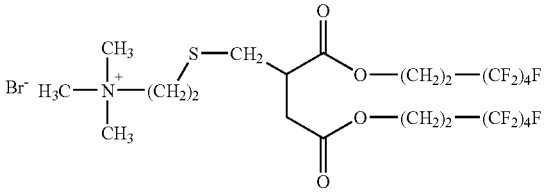
FS-21
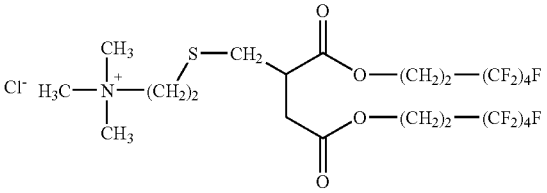
FS-22
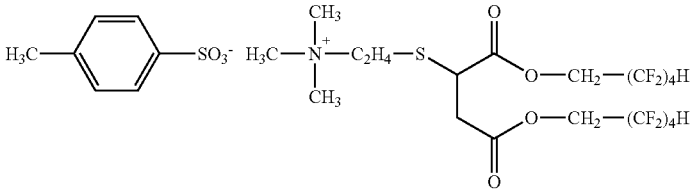
FS-23
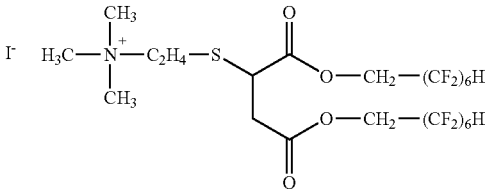
FS-24
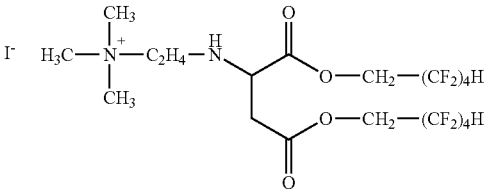
FS-25
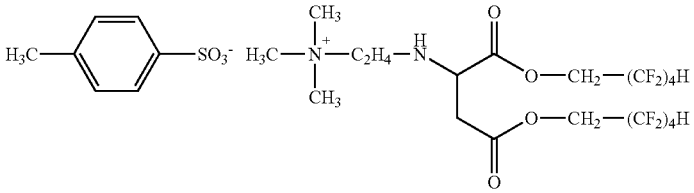

-continued
FS-26
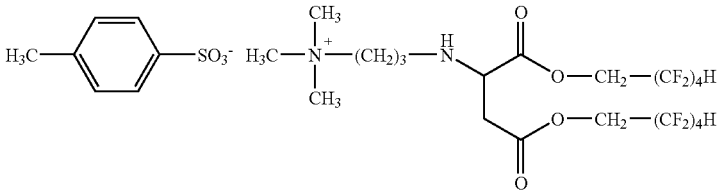
FS-27
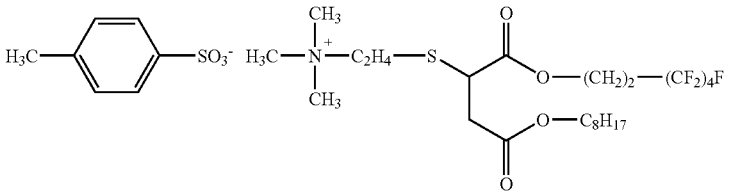
FS-28
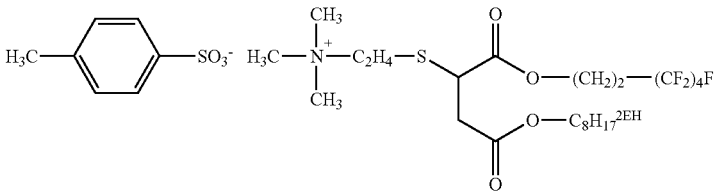
FS-29
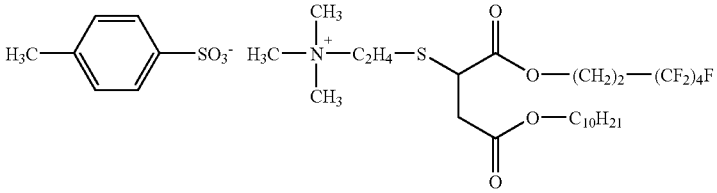
FS-30
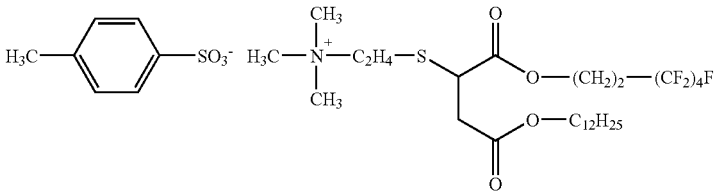
FS-31
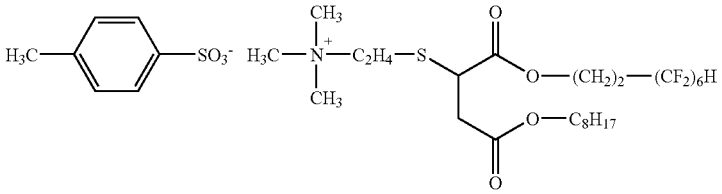
FS-32
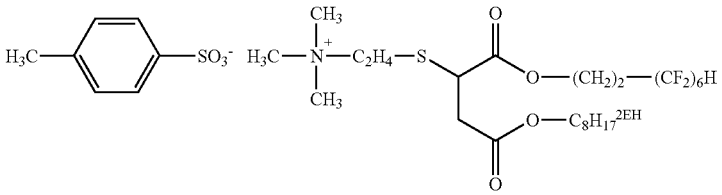
FS-33
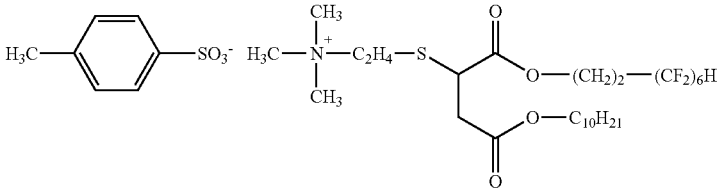

-continued
FS-34
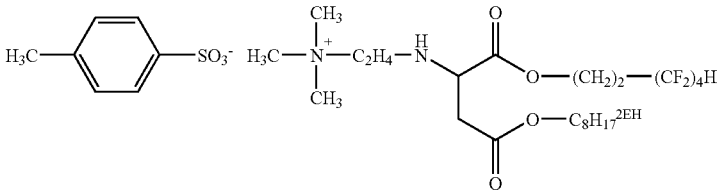
FS-35
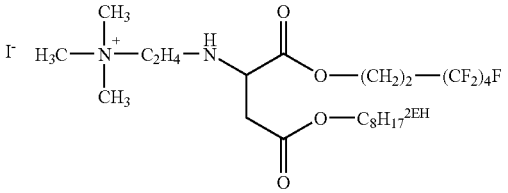
FS-36
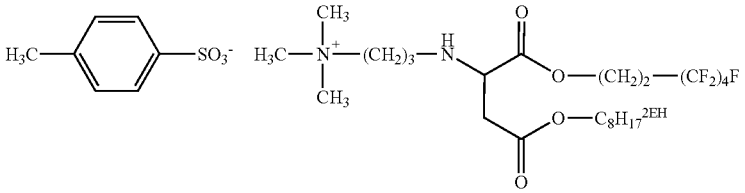
FS-37
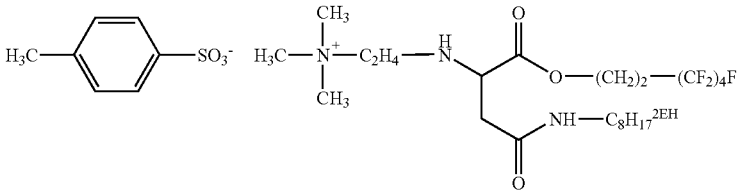
FS-38
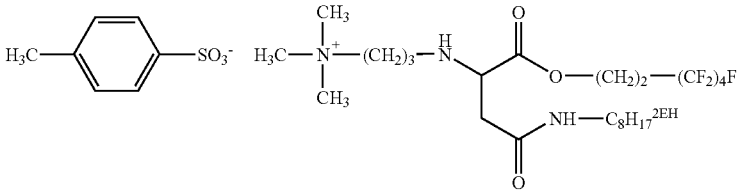
FS-40
FS-39
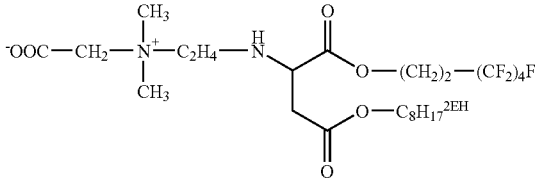
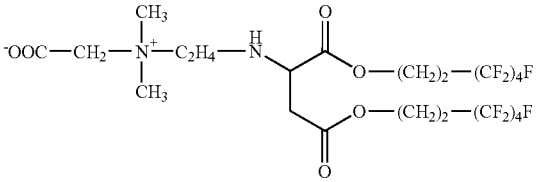
FS-41
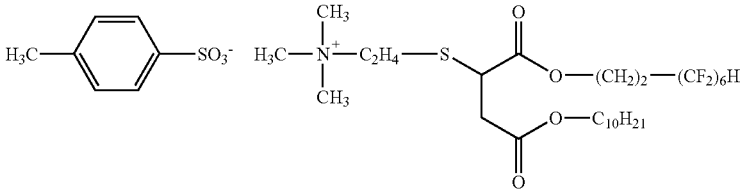

-continued
FS-42
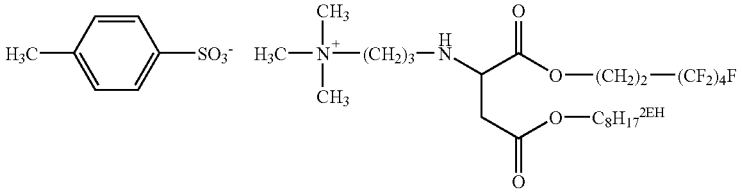
FS-43
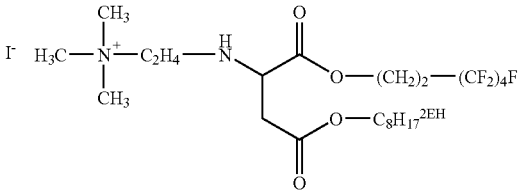
FS-44
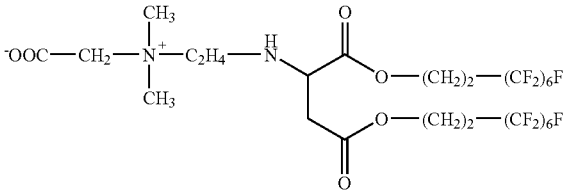
FS-45
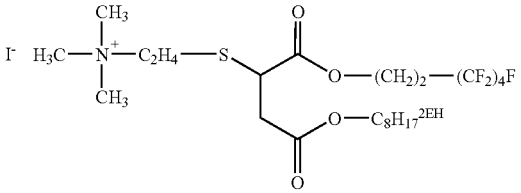
FS-46
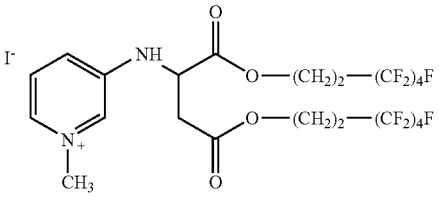
FS-47
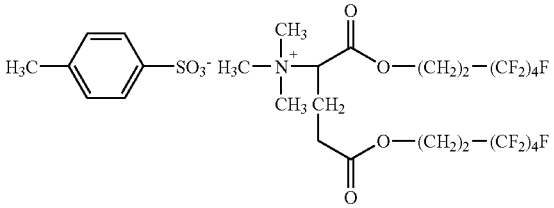
FS-48
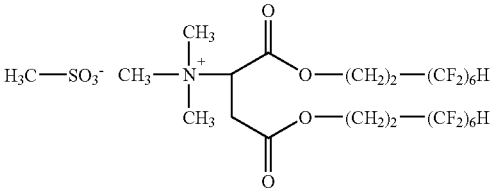
FS-49
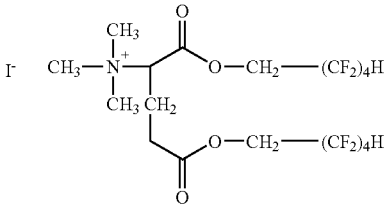
FS-50
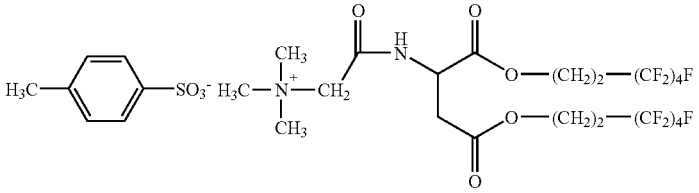
FS-51
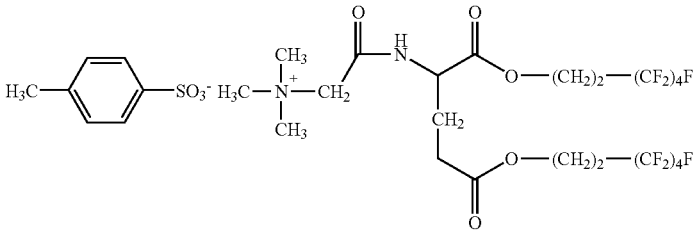

-continued
FS-52
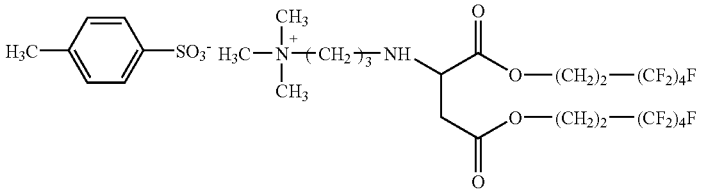
FS-53
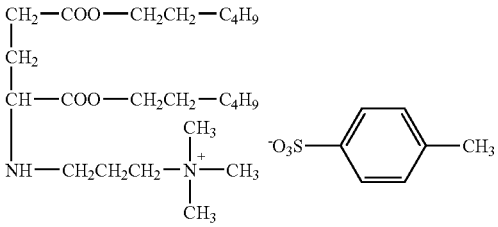
FS-54
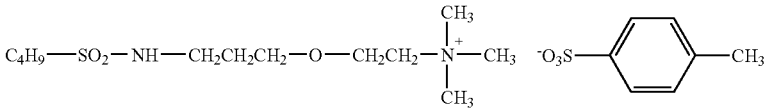
FS-55
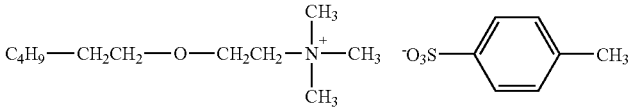
FS-56
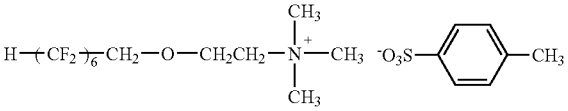
FS-57
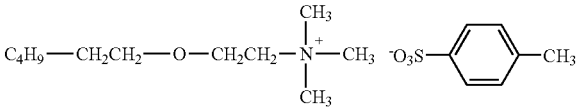
FS-58
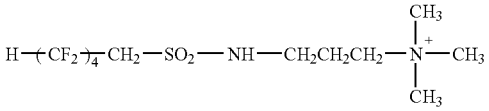
FS-59
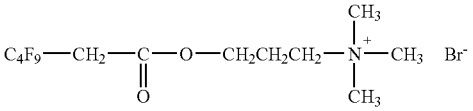
FS-60
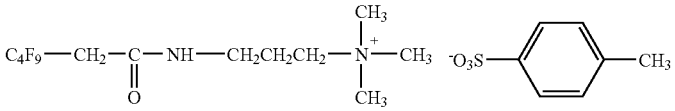
FS-61
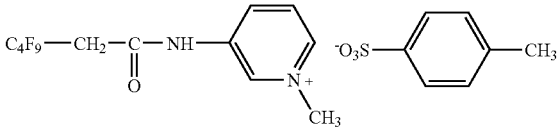
FS-62
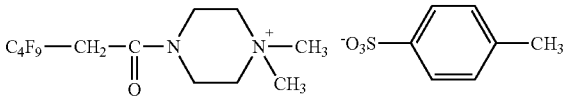
FS-63
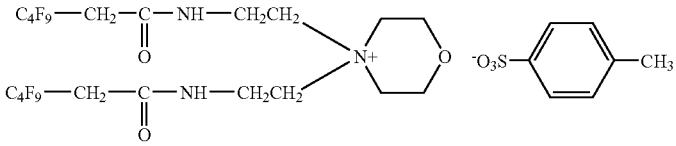
FS-64
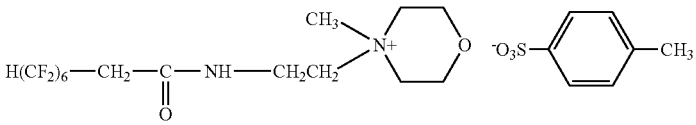

-continued

FS-65

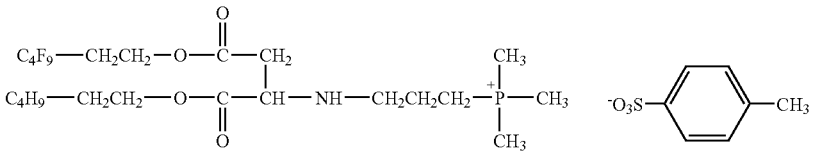

FS-66

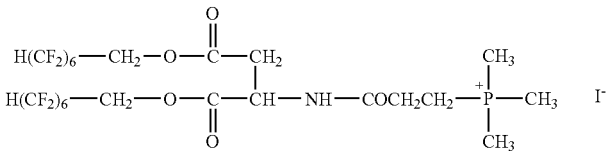

Next, an example of general synthesis of compounds represented by above general formula (F1) and (F1-a) in the present invention is shown, but the present invention is not limited in these.

The compounds of the present invention can be synthesized by using fumaric acid derivatives, maleic acid derivatives, itaconic acid derivatives, glutamic acid derivatives, aspartic acid derivatives and the like as the starting materials. For example, in the case where fumaric acid derivatives, maleic acid derivatives and itaconic acid derivatives are used as the starting material, the compounds in the present invention can be synthesized by the cationization with an alkylating agent after the Michael addition reaction to these double bonds with the nucleophilic agents.

The fluorocarbon compound in the present invention can have an anionic hydrophilic group.

The anionic hydrophilic group means an acidic group having pKa of 7 or less and an alkali metal salt or an ammonium salt thereof. Specifically, a sulfo group, a carboxyl group, phosphonic acid group, carbamoylsulfamoyl group, sulfamoylsulfamoyl group, acylsulfamoyl group or these salts can be described. Among these, a sulfo group, a carboxyl group, phosphonic acid group and these salts are preferred and a sulfo group and a salt thereof is more preferred. As the cations to form a salt, lithium, sodium, potassium, cesium, ammonium, tetramethylammonium, tetrabutylammonium, methylpyridinium and the like can be described. Lithium, sodium, potassium and ammonium are preferred.

The preferred fluorocarbon compound having an anionic hydrophilic group in the present invention can be represented by the following general formula (F3)

General formula (F3)

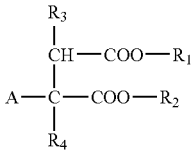

In the formula, $R^1$ and $R^2$ each independently represent an alkyl group, but at least either of them represents Rf. In the case where $R^1$ and $R^2$ represent an alkyl group except a fluoroalkyl group, an alkyl group having 2 to 18 carbon atoms is preferred and an alkyl group having 4 to 12 carbon atoms is more preferred. $R^3$ and $R^4$ each independently represent a hydrogen atom or a substituted or a non-substituted alkyl group.

Special examples of a fluoroalkyl group represented by $R^1$ and $R^2$ are the groups described above and the preferred structure is also that represented by general formula (F1) described above. And preferred structures among them are also the same as the description of fluoroalkyl group described above. Each alkyl group represented by $R^1$ and $R^2$ is preferably a fluoroalkyl group described above.

A substituted or a non-substituted alkyl group represented by $R^3$ and $R^4$ may be a linear, a branched or a heterocyclic sutructure. The substituent described above may be any substituent, but is preferably an alkenyl group, an aryl group, an alkoxy group, a halogen atom (preferably chlorine), a carboxylate group, a carbonamido group, a carbamoyl group, an oxycarbonyl group, a phosphate group and the like.

A represents $-L_b-SO_3M$, and M represents a cation. Herein, as preferred examples of the cation represented as M, an alkali metal ion (lithium ion, sodium ion, potassium ion and the like), an alkali earth metal ion (barium ion, calcium ion and the like), ammonium ion and the like are described. Among these, lithium ion, sodium ion, potassium ion and ammonium ion are preferred and lithium ion, sodium ion and potassium ion are more preferred and these can be suitably selected in terms of the total number of carbon atoms, a substituent of the compound in general formula (F3) and the branch degree of alkyl group and the like. In the case where $R^1$, $R^2$ $R^3$ and $R^4$ have 16 or more carbon atoms in total, lithium ion for M is excellent in terms of being consistent with solubility (particularly in water) and antistatic activity or a coating uniformity.

$L_b$ represents a single bond and a substituted or a non-substituted alkylene group and the subsutituent is preferably that described in the case of $R^3$. In the case where $L_b$ is an alkylene group, $L_b$ has preferably 2 or less carbon atoms. $L_b$ is preferably a single bond or a $—CH_2—$ group and most preferably a $—CH_2—$ group.

The compound described by above general formula (F3) is more preferably combined with the above preferable embodiment each other.

Specific examples of the fluorocarbon compound for use in the present invention are set forth below, but the present invention is not limited by the following specific examples.

Unless otherwise indicated, an alkyl group and a perfluoroalkyl group in the structure donation of following examples mean a linear structure.

(F-1)

$$NaO_3S-CH(CH_2-COO-C_8H_{17})-COO-CH_2CH_2C_4F_9$$

(F-2)

$$NaO_3S-CH(CH_2-COO-C_4H_9)-COO-CH_2CH_2C_4F_9$$

(F-3)

$$NaO_3S-CH(CH_2-COO-CH_2CH(C_2H_5)C_4H_9)-COO-CH_2CH_2C_4F_9$$

(F-4)

$$NaO_3S-CH(CH_2-COO-C_{12}H_{25})-COO-CH_2CH_2C_4F_9$$

(F-5)

$$NaO_3S-CH(CH_2-COO-C_8H_{17})-COO-CH_2(CF_2CF_2)_2H$$

(F-6)

$$NaO_3S-CH(CH_2-COO-C_8H_{17})-COO-CH_2(CF_2CF_2)_3H$$

(F-7)

$$NaO_3S-CH(CH_2-COO-CH_2CH_2C_4F_9)-COO-C_6H_{13}$$

(F-8)

$$NaO_3S-CH(CH_2-COO-CH_2(CF_2CF_2)_2H)-COO-CH_2CH(C_2H_5)C_4H_9$$

(F-9)

$$NaO_3S-CH(CH_2-COO-C_8H_{17})-COO-CH_2C_5F_{11}$$

(F-10)

$$NaO_3S-CH(CH_2-COO-C_4H_9)-COO-CH_2CH_2(CF_2CF_2)_3H$$

(F-11)

$$NaO_3S-CH(CH_2-COO-C_{10}H_{21})-COO-C_4F_9$$

(F-12)

$$NaO_3S-CH(CH_2-COO-(CH_2CH_2O)_n-C_4H_9)-COO-CH_2CH_2C_4F_9$$

n = 5~15

(F-13)

$$NaO_3SCH_2-CH(CH_2-COO-C_8H_{17})-COO-CH_2CH_2C_4F_9$$

(F-14)

$$NaO_3SCH_2-CH(CH_2-COO-CH_2CH_2C_4F_9)-COO-C_{12}H_{25}$$

(F-15)

$$NaO_3SCH_2-CH(CH_2-COO-C_8H_{17})-COO-CH_2(CF_2CF_2)_2H$$

(F-16)

$$NaO_3SCH_2-CH(CH_2-COO-CH_2(CF_2CF_2)_3H)-COO-CH_2CH(C_2H_5)C_4H_9$$

(F-17)

$$NaO_3S-CH(CH_2-COO-CH_2CH_2C_4F_9)-COO-CH_2CH_2C_4F_9$$

-continued (F-18)

$$NaO_3S-CH(CH_2-COO-CH_2CH_2C_3F_7)-COO-CH_2CH_2C_3F_7$$

(F-19)

$$NaO_3S-CH(CH_2-COO-CH_2CH_2C_5F_{11})-COO-CH_2CH_2C_5F_{11}$$

(F-20)

$$NaO_3S-CH(CH_2-COO-CH_2C_4F_9)-COO-CH_2C_4F_9$$

(F-21)

$$NaO_3S-CH(CH_2-COO-C_4F_9)-COO-C_4F_9$$

(F-22)

$$NaO_3S-CH(CH_2-COO-C_4F_9)-COO-CH_2CH_2C_4F_9$$

(F-23)

$$NaO_3S-CH(CH_2-COO-CH_2CH_2CF(CF_3)_2)-COO-CH_2CH_2CF(CF_3)_2$$

(F-24)

$$NaO_3S-CH(CH_2-COO-CH_2CH_2C_2F_5)-COO-CH_2CH_2C_4F_9$$

(F-25)

$$NaO_3S-CH(CH_2-COO-CH_2(CF_2CF_2)_2H)-COO-CH_2(CF_2CF_2)_2H$$

(F-26)

$$NaO_3S-CH(CH_2-COO-CH_2(CF_2CF_2)_3H)-COO-CH_2(CF_2CF_2)_3H$$

(F-27)

$$NaO_3S-CH(CH_2-COO-CH_2CF_2CF_2H)-COO-CH_2(CF_2CF_2)_3H$$

(F-28)

$$NaO_3S-CH(CH_2-COO-(CH_2CH_2O)nC_4F_9)-COO-(CH_2CH_2O)nC_4F_9$$

n = 5~15

(F-29)

$$NaO_3SCH_2-CH(CH_2-COO-CH_2CH_2C_4F_9)-COO-CH_2CH_2C_4F_9$$

(F-30)

$$NaO_3SCH_2-CH(CH_2-COO-CH_2CH_2C_3F_7)-COO-CH_2CH_2C_3F_7$$

(F-31)

$$NaO_3SCH_2-CH(CH_2-COO-CH_2CH_2C_5F_{11})-COO-CH_2CH_2C_5F_{11}$$

(F-32)

$$NaO_3SCH_2-CH(CH_2-COO-CH_2CH_2C_6F_{12}H)-COO-CH_2CH_2C_6F_{12}H$$

(F-33)

$$NaO_3SCH_2-CH(CH_2-COO-CH_2(CF_2CF_2)_2H)-COO-CH_2(CF_2CF_2)_2H$$

(F-34)

$$NaO_3SCH_2-CH(CH_2-COO-CH_2(CF_2CF_2)_3H)-COO-CH_2(CF_2CF_2)_3H$$

(F-35)

$$NaO_3SCH_2-CH(CH_2-COO-CH_2CF_2CF_2H)-COO-CH_2(CF_2CF_2)_3H$$

(F-36)

$$NaO_3SCH_2-CH(CH_2-COO-CH_2CH_2CF(CF_3)_2)-COO-CH_2CH_2CF(CF_3)_2$$

-continued (F-37)

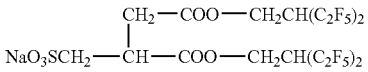

(F-38)

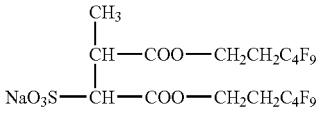

(F-39)

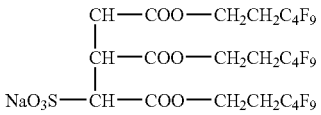

(F-40)

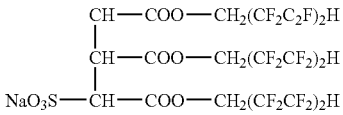

(F-41)

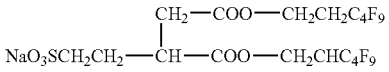

(F-42)

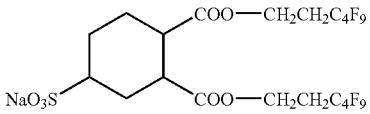

(F-43)

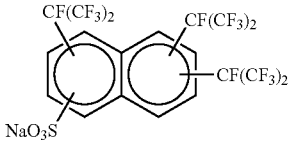

(F-44)

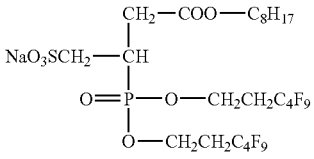

(F-45)

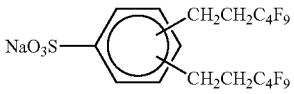

(F-46)

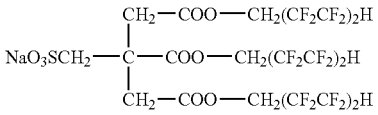

(F-47)

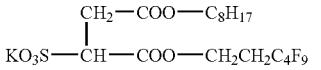

(F-48)

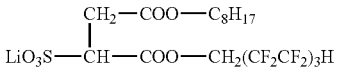

(F-49)

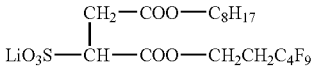

(F-50)

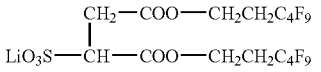

-continued (F-51)

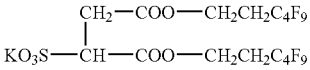

(F-52)

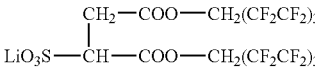

(F-53)

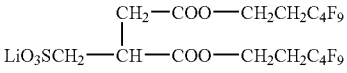

(F-54)

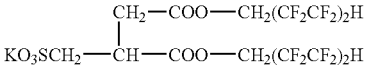

(F-55)

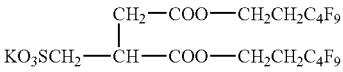

(F-56)

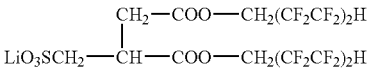

The fluorocarbon compound in the present invention can have a nonionic hydrophilic group. The nonionic hydrophilic group means the water-soluble group without dissociation as ion. Specific examples include poly (oxyethylene) alkylether, multivalent alcohol and the like can be described, but is not limited in these.

The preferred nonionic fluorocarbon compound in the present invention can be represented by the following general formula (F4).

General formula (F4)

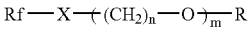

In general formula (F4), Rf is a fluoroalkyl group described above and as specific examples, the substituents described above can be described and as the preferred structure, the above structure described in general formula (F1) can be also be described. And the preferred structure in it is also the same as the description of Rf described above.

X in general formula (F4) represents a divalent linking group and is not especially limited. For examples,

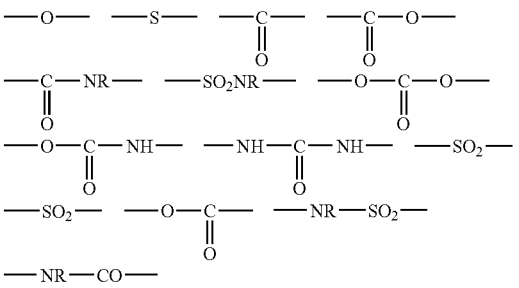

and the like are described.

In general formula (F4), n represents an integral number 2 or 3, and m represents an integral number 1 to 30. R represents a hydrogen atom, an alkyl group, an aryl group, a heterocyclic group, Rf or the group having one or more Rf.

Specific examples of the nonionic fluorocarbon compound for use in the present invention are described below, but the present invention is not limited by following specific examples.

FN-1

$C_4F_9CH_2CH_2O—(CH_2CH_2O)_n—H$ n = 5~15

FN-2

$H(CF_2)_6CH_2O—(CH_2CH_2O)_n—H$ n = 5~15

FN-3

$C_4F_9CH_2COO—(CH_2CH_2O)_n—H$ n = 5~15

FN-4

$C_4F_9CH_2CONH—(CH_2CH_2O)_n—H$ n = 5~15

FN-5

$C_4F_9CH_2SO_2NH—(CH_2CH_2O)_n—H$ n = 5~15

FN-6

$C_4F_9CH_2CH_2NHCOO—(CH_2CH_2O)_n—H$ n = 5~15

FN-7

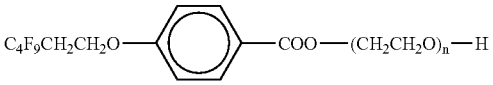

n = 5~15

FN-8

$H(CF_2)_4CH_2O—(CH_2CH_2CH_2O)_n—H$ n = 5~15

FN-9

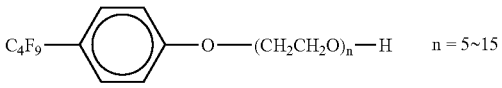

n = 5~15

FN-10

$C_4F_9CH_2CH_2O—(CH_2CH_2O)_{n1}—(CH_2CH_2CH_2O)_{n2}—(CH_2CH_2O)_{n3}—H$ n1 = 5~10
n2 = 5~10
n3 = 5~10

FN-11

$C_4F_9CH_2CH_2O—(CH_2CH_2O)_n—CH_2$ n = 10~20

FN-12

$C_4F_9CH_2CH_2O—(CH_2CH_2O)_n—C_4H_9$ n = 10~20

FN-13

$C_4F_9CH_2CH_2O—(CH_2CH_2O)_n—CH_2CH_2C_4H_9$ n = 10~20

FN-14

$$\begin{array}{l} CH_2COO—(CH_2CH_2O)_n—CH_2CH_2C_4H_9 \\ | \\ CH_2COO—(CH_2CH_2O)_n—CH_2CH_2C_4H_9 \end{array}$$ n = 5~10

FN-15

$$\begin{array}{l} CH_2COO—(CH_2CH_2O)_n—CH_2CH_2C_4H_9 \\ | \\ CHCOO—(CH_2CH_2O)_n—CH_2CH_2C_4H_9 \\ | \\ CH_2COO—(CH_2CH_2O)_n—CH_2CH_2C_4H_9 \end{array}$$ n = 5~10

FN-16

$$\begin{array}{l} CH_2O—(CH_2CH_2O)_n—CH_2CH_2C_4H_9 \\ | \\ CHO—(CH_2CH_2O)_n—CH_2CH_2C_4H_9 \\ | \\ CH_2O—(CH_2CH_2O)_n—CH_2CH_2C_4H_9 \end{array}$$ n = 5~10

FN-17

$H—C_6F_{12}CH_2O—(CH_2CH_2O)_n—CH_2C_6F_{12}—H$ n = 5~10

FN-18

$$\begin{array}{l} \quad\quad CH_2O—(CH_2CH_2O)_n—CH_2(CF_2)_4H \\ \quad\quad | \\ C_2H_5—C—CH_2O—(CH_2CH_2O)_n—CH_2(CF_2)_4H \\ \quad\quad | \\ \quad\quad CH_2O—(CH_2CH_2O)_n—CH_2(CF_2)_4H \end{array}$$ n = 5~10

The fluorocarbon compound is preferably used, in the present invention, in a coating component to form either layer of the side having the image forming layer. Among them, it is useful that the fluorocarbon compound is used for forming the outermost layer of photothermographic material, because of showing effective antistatic activity and coating uniformity and also useful for stock stability and improving the dependency on the using environment.

The addition amount of the fluorocarbon compound in the present invention is not especially limited and is arbitrarily determined corresponding to the structure and the using place of the fluorocarbon compound and the series and an amount of other additive contained in a component. For example, in the case where the fluorocarbon compound is used in the coating solution for the outermost layer of photothermographic material, the coating amount of the fluorocarbon compound in a coating solution is preferably 0.1 $mg/m^2$ to 100 $mg/m^2$, more preferably 0.5 $mg/m^2$ to 20 $mg/m^2$.

In the present invention, the fluorocarbon compound may be used as either single use of one kind or the mixture of two kinds or more. In the case of where two kinds or more are used by mixing, the fluorocarbon compound, besides the fluorocarbon compound in the present invention, can be used by mixing. Additionally, the surfactant, besides a fluorocarbon compound, can be used with the fluorocarbon compound in the present invention.

(Binder which can be Used for the Layer Adjacent to the Outermost Layer)

In the invention, it is preferred to use a binder which gelatinizes by decrease in temperature for the layer adjacent to the outermost layer. The binder which gelatinize means a water-soluble polymer derived from animal protein described above, or a water-soluble or a hydrophobic polymer that is not derived from animal protein in which gelling agent is added.

As the layer formed by coating loses the fluidity by gelation, the surface of the image forming layer is hard to be effected by air for drying at the drying process after coating process, so the photothermographic material with uniform coating surface can be obtained.

Herein, it is important that the coating solution does not gelatinize at a coating process. To consider the easy work operation, the coating solution has fluidity at the coating process and loses fluidity by gelation before the drying process after coating process.

Viscosity of the said coating solution at coating process is preferably in the range from 5 mPa·s to 200 mPa·s, more preferably 10 mPa·s to 100 mPa·s.

In the present invention, an aqueous solvent system is used as the solvent of a coating solution. An aqueous solvent means water or the mixture of water and 70% by weght or less of water-miscible organic solvent. As the examples of water-miscible solvent, alcohols such as methyl alcohol, ethyl alcohol, propyl alcohol and the like, cellosolves such as methyl cellosolve, ethyl cellosolve, butyl cellosolve and the like, ethyl acetate, dimethylformamide and the like can be described.

Though it is difficult to measure the viscosity of coat forming layer before the drying process after coating process (at this point, the gelation occurs), it is guessed that the viscosity is almost 200 mPa·s to 5000 mP·s, preferably 500 mPa·s to 5000 mPa·s.

The gelation temperature is not specifically limited, however to consider the easy work operation of coating, the gelation temperature is preferably nearly about a room temperature. Because at this temperature, it is easy to make the fluidity increase for easy coating of a coating solution and the fluidity can be maintained (that is namely the temperature level, in which the elevated temperature can be maintained easily) and this is the temperature that the cooling can be easily operated to make the fluidity of formed layer lose after coating. As a preferable gelation temperature, it is 0° C. to 40° C., more preferably 0° C. to 35° C.

The temperature of coating solution at a coating point is not specifically limited when the temperature is set up higher than a gelation temperature and the cooling temperature at the point before drying process after coating is not specifically limited when the temperature is set up lower than a gelation temperature. However, when the temperature difference between the temperature of coating solution and a cooling temperature is set up small, it occurs the problem that the gelation starts during a coating process and an uniform coating can not be performed. And when the temperature is set up too high to make these temperature differences large, it causes the problem that the solvent of coating solution is evaporated and viscosity is changed. Therefore, the temperature difference between the temperature of the coating solution at coating and the cooling temperature is desined to be set up preferably 5° C. to 50° C., more preferably 10° C. to 40° C.

(Gelling Agent)

The gelling agent in the present invention is a compound which can gelate when it is added in the water-soluble polymer or the hydrophobic polymer that is not derived from animal protein and cooled, or a compound which can gelate when it is further used with the galation accelerator. The fluidity is remarkably decreased by the occurrence of gelation.

The following water-soluble polysaccharides can be described as the specific examples of gelling agent. Namely these are at least one kind selected among agar, κ-carrageenan, ι-carrageenan, alginic acid, alginate, agarose, furcellaran, jellan gum, glucono-δ-lactone, azotobactor vinelandii gum, xanthan gum, pectin, guar gum, locust bean gum, tara gum, cassia gum, glucomannan, tragacanth gum, karaya gum, pullulan, gum arabic, arabinogalactan, dextran, sodium carboxymethyl celulose, methyl celulose, cyalume seed gum, starch, chitin, chitosan and curdlan.

As the compounds which can gelate by cooling after melted by heating, agar, carrageenan, jellan gum and the like are included.

Among these gelling agents, κ-carrageenan (e.g., K-9F produced by DAITO Co.: K-15, 21, 22, 23, 24 and I-3 produced by NITTA GELATIN Co.), ι-carrageenan and agar is preferable and κ-carrageenan is most preferable.

The gelling agent is preferably used in the range from 0.01% by weight to 10.0% by weight, preferably 0.02% by weight to 5.0% by weight, more preferably 0.05% by weight to 2.0% by weight with respect to the binder polymer.

The gelling agent is preferably used with a gelation accelerator. Gelation accelerator in the present invention is a compound which accelerates gelation by contact with a gelling agent, whereby the gelling function can be developed by specific combination with the gelling agent. In the present invention, the combinations of the gelling agent and the gelation accelerator such as shown below can be used.

1) The combination of alkali metal ions such as potassium ion and the like or alkali earth metal ions such as calcium ion, magnesium ion and the like as the gelation accelerator and carrageenan, alginate, azotobactor vinelandii gum, pectin, sodium carboxymethyl cellulose or the like as the gelling agent;

2) the combination of boric acid or other boron compounds as the gelation accelerator and guar gum, locust bean gum, tara gum, cassia gum or the like as the gelling agent;

3) the combination of acids or alkali compounds as the gelation accelerator and alginate, glucomannan, pectin, chitin, chitosan, curdlan or the like as the gelling agent;

4) the water-soluble polysaccharides which can form gel by reaction with the gelling agent is used as the galation accelerator. As typical examples, the combination of xanthan gum as the gelling agent and cassia gum as the gelation accelerator and the combination of carrageenan as the gelling agent and locust bean gum as the gelation accelerator; and the like are illustrated.

As the typical examples of the combination of these gelling agents and gelation accelerators, the following combinations a) to g) can be described.

a) Combination of κ-carrageenan and potassium b) Combination of ι-carrageenan and calcium c) Combination of low methoxyl pectin and potassium d) Combination of sodium alginate and potassium e) Combination of locust bean gum and xanthan gum f) Combination of jellan gum and acid g) Combination of locust bean gum and xanthan gum These combinations can be used simultaneously as the plural combinations.

Although these gelation accelerators can be added to the same layer in which the gelling agent is added, they can be preferably added in the different layer as to react. It is more preferable to add the galation accelerator to the layer not directly adjacent to the layer containing the gelling agent. Namely, it is more preferable to set a layer not containing any of the gelling agent and the gelation accelerator between the layer containing the gelling agent and the layer containing the gelation accelerator.

The gelation accelerator is used in the range from 0.1% by weight to 200% by weight, preferably 1.0% by weight to 100% by weight with respect to the gelling agent.

Now, the photothermographic material of the invention will be described in detail. The photothermographic material is preferable to be mono-sheet type (i.e., a type which can form image on the photothermographic material without using other sheets such as an image-receiving material). This invention is particularly useful for the photothermographic material which is exposed with red to infrared light.

(Organic Silver Salt)

1) Composition

The organic silver salt particle according to the invention is relatively stable to light but serves as to supply silver ions and forms silver images when heated to 80° C. or higher under the presence of an exposed photosensitive silver halide and a reducing agent. The organic silver salt may be any organic material containing a source capable of reducing silver ions. Such non-photosensitive organic silver salt is disclosed, for example, in JP-A Nos. 6-130543, 8-314078, 9-127643, 10-62899 (paragraph Nos. 0048 to 0049), 10-94074, and 10-94075, EP-A No. 0803764A1 (page 18, line 24 to page 19, line 37), EP-A Nos. 962812A1 and 1004930A2, JP-A Nos. 11-349591, 2000-7683, and 2000-72711, and the like. A silver salt of organic acid, particularly, a silver salt of long chained fatty acid carboxylic acid (number of carbon atoms having 10 to 30, preferably, 15 to 28) is preferable. Preferred examples of the silver salt of the organic acid can include, for example, silver lignocerate, silver behenate, silver arachidinic acid, silver stearate, silver oleate, silver laurate, silver capronate, silver myristate, silver palmitate, silver erucic acid and mixtures thereof. Among the organic silver salts, an organic silver salt with the silver behenate content of 90 mol % to 100 mol %, preferably 95 mol % to 100 mol %, is used. And, it is preferred to use an organic silver salt with the silver erucic acid content of 2 mol % or less, more preferably, 1 mol % or less, further preferably, 0.1 mol % or less.

2) Shape

There is no particular restriction on the shape of the organic silver salt usable in the invention and it may needle-like, bar-like, plate-like or flaky shape.

As the particle size distribution of the organic silver salt, mono-dispersion is preferred. In the mono-dispersion, the percentage for the value obtained by dividing the standard deviation for the length of minor axis and major axis by the minor axis and the major axis respectively is, preferably, 100% or less, more preferably, 80% or less and, further preferably, 50% or less. The shape of the organic silver salt can be measured by determining dispersion of an organic silver salt as transmission type electron microscopic images. Another method of measuring the mono-dispersion is a method of determining of the standard deviation of the volume weighted mean diameter of the organic silver salt in which the percentage for the value defined by the volume weight mean diameter (variation coefficient), is preferably, 100% or less, more preferably, 80% or less and, further preferably, 50% or less. The mono-dispersion can be determined from particle size (volume weighted mean diameter) obtained, for example, by a measuring method of irradiating a laser beam to an organic silver salt dispersed in a liquid, and determining a self correlation function of the fluctuation of scattered light to the change of time.

3) Preparation

Known methods and the like can be applied to manufacturing methods and dispersing methods of an organic acid silver used in the invention. Description of the manufacturing and dispersing methods can be found as reference in the following patent related documents, for example, JP-A No. 10-62899; EP Nos. 0803763 A1, 0962812 A1; JP-A Nos. 11-349591, 2000-7683, 2000-72711, 2001-163827, 2001-163889, 2001-163890, 11-203413; Japanese Patent Application Nos. 2000-90093, 2000-195621, 2000-191226, 2000-213813, 2000-214155, and the like.

When a photosensitive silver salt is present together during dispersion of the organic silver salt, fog increases and the sensitivity becomes remarkably lower, so that it is more preferred that the photosensitive silver salt is not substantially contained during dispersion. In the invention, the amount of the photosensitive silver salt to be disposed in the aqueous dispersion, is preferably, 1 mol % or less, more preferably, 0.1 mol % or less per one mol of the organic acid silver salt in the solution and, further preferably, positive addition of the photosensitive silver salt is not conducted.

In the invention, the photosensitive material can be prepared by mixing an aqueous dispersion of an organic silver salt and an aqueous dispersion of a photosensitive silver salt and the mixing ratio between the organic silver salt and the photosensitive silver salt can be selected depending on the purpose. The ratio of the photosensitive silver salt to the organic silver salt is, preferably, within a range from 1 mol % to 30 mol %, more preferably, within a range from 2 mol % to 20 mol % and, particularly preferably, 3 mol % to 15 mol %. A method of mix two or more kinds of aqueous dispersions of organic silver salts and two or more kinds of aqueous dispersions of photosensitive silver salts upon mixing is used preferably for controlling the photographic properties.

4) Addition Amount

While an organic silver salt in the invention can be used in a desired amount, a total coating amount of silver including silver halide is preferably in the range of from 0.1 g/m$^2$ to 5.0 g/m$^2$ in terms of Ag and more preferably in the range of from 0.3 g/m$^2$ to 3.0 g/m$^2$, further preferably in the range of from 0.5 g/m$^2$ to 2.0 g/m$^2$, in terms of Ag. Particularly, in order to improve image storability, the total coating amount is preferably 1.8 mg/m$^2$ or less, more preferably 1.6 mg/m$^2$ or less. In the case a preferable reducing agent in the invention is used, it is possible to obtain a sufficient image density by even such a low amount of silver.

(Reducing Agent)

The photothermographic material of the invention contains a reducing agent for the organic silver salt. The reducing agent may be any substance (preferably, organic substance) capable of reducing silver ions into metallic silver. Examples of the reducing agent are described in JP-A No. 11-65021 (column Nos. 0043 to 0045) and EP-A 0803764 A1 (p. 7, line 34 to p. 18, line 12).

In the invention, a so-called hindered phenolic reducing agent or a bisphenol agent having a substituent at the ortho-position to the phenolic hydroxyl group is preferred and the bisphenolic reducing agent is more preferred. Particularly, the compound represented by the following general formula (R) is preferred.

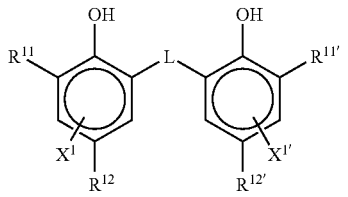

In the general formula (R) $R^{11}$ and $R^{11'}$ each independently represent an alkyl group having 1 to 20 carbon atoms. $R^{12}$ and $R^{12'}$ each independently represent a hydrogen atom or a group capable of substituting for a hydrogen atom on a benzene ring. L represents a —S— group or a —$CHR^{13}$— group. $R^{13}$ represents a hydrogen atom or an alkyl group having 1 to 20 carbon atoms. X and $X^1$ each independently represent a hydrogen atom or a group capable of substituting for a hydrogen atom on a benzene ring.

Each of the substituents is to be described specifically.

1) $R^{11}$ and $R^{11'}$ $R^{11}$ and $R^{11'}$ each independently represent a substituted or unsubstituted alkyl group having 1 to 20 carbon atoms. The substituent for the alkyl group has no particular restriction and can include, preferably, aryl group, hydroxy group, alkoxy group, aryloxy group, alkylthio group, arylthio group, acylamino group, sulfoneamide group, sulfonyl group, phosphoryl group, acyl group, carbamoyl group, ester group, and halogen atom.

2) $R^{12}$ and $R^{12'}$, X and $X^1$ $R^{12}$ and $R^{12'}$ each independently represent a hydrogen atom or a group capable of substituting for a hydorgen atom on a benzene ring.

X and $X^1$ each independently represent a hydrogen atom or a group capable of substituting for a hydorgen atom on a benzene ring. Each of the groups capable of substituting for a hydrogen atom on the benzene ring can include, preferably, alkyl group, aryl group, halogen atom, alkoxy group, and acylamino group.

3) L

L represents a —S— group or a —$CHR^{13}$— group. $R^{13}$ represents a hydrogen atom or an alkyl group having 1 to 20 carbon atoms in which the alkyl group may have a substituent.

Specific examples of the non-substituted alkyl group for $R^{13}$ can include, for example, methyl group, ethyl group, propyl group, butyl group, heptyl group, undecyl group, isopropyl group, 1-ethylpentyl group, and 2,4,4-trimethylpentyl group.

Examples of the substituent for the alkyl group can include, like substituent $R^{11}$, a halogen atom, an alkoxy group, alkylthio group, aryloxy group, arylthio group, acylamino group, sulfoneamide group, sulfonyl group, phosphoryl group, oxycarbonyl group, carbamoyl group, and sulfamoyl group.

4) Preferred Substituents $R^{11}$ and $R^{11'}$ are, preferably, a secondary or tertiary alkyl group having 3 to 15 carbon atoms and can include, specifically, isopropyl group, isobutyl group, t-butyl group, t-amyl group, t-octyl group, cyclohexyl group, cyclopentyl group, 1-methylcyclohexyl group, and 1-methylcyclopropyl group. $R^{11}$ and $R^{11'}$ each represents, more preferably, tertiary alkyl group having 4 to 12 carbon atoms and, among them, t-butyl group, t-amyl group, 1-methylcyclohexyl group are further preferred, t-butyl group being most preferred.

$R^{12}$ and $R^{12'}$ are, preferably, alkyl groups having 1 to 20 carbon atoms and can include, specifically, methyl group, ethyl group, propyl group, butyl group, isopropyl group, t-butyl group, t-amyl group, cyclohexyl group, 1-methylcyclohexyl group, benzyl group, methoxymethyl group and methoxyethyl group. More preferred are methyl group, ethyl group, propyl group, isopropyl group, and t-butyl group.

X and $X^1$ are, preferably, a hydrogen atom, halogen atom, or alkyl group, and more preferably, hydrogen atom.

L is preferably a group —$CHR^{13}$—.

$R^{13}$ is, preferably, a hydrogen atom or an alkyl group having 1 to 15 carbon atoms. The alkyl group is preferably methyl group, ethyl group, propyl group, isopropyl group and 2,4,4-trimethylpentyl group. Particularly preferred $R^{13}$ is a hydrogen atom, methyl group, propyl group or isopropyl group.

In a case where $R^{13}$ is a hydrogen atom, $R^{12}$ and $R^{12'}$ each represent, preferably, an alkyl group having 2 to 5 carbon atoms, ethyl group and propyl group being more preferred and ethyl group being most preferred.

In a case where $R^{13}$ is a primary or secondary alkyl group having 1 to 8 carbon atom, $R^{12}$ and $R^{12'}$ each represent preferably methyl group. As the primary or secondary alkyl group of 1 to 8 carbon atoms for $R^{13}$, methyl group, ethyl group, propyl group and isopropyl group are more preferred, and methyl group, ethyl group, and propyl group are further preferred.

In a case where each of $R^{11}$, $R^{11'}$ and $R^{12}$, $R^{12'}$ is methyl group, $R^{13}$ is preferably a secondary alkyl group. In this case, the secondary alkyl group for $R^{13}$ is preferably isopropyl group, isobutyl group and 1-ethylpentyl group, with isopropyl group being more preferred.

The reducing agent described above show various different thermal developing performances depending on the combination of $R^{11}$, $R^{11'}$ and $R^{12}$, $R^{12'}$, as well as $R^{13}$. Since the thermal developing performances can be controlled by using two or more kinds of reducing agents at various mixing ratios, it is preferred to use two or more kinds of reducing agents in combination depending on the purpose.

Specific examples of the compounds represented by general formula (R) according to the invention are shown below but the invention is not restricted to them.

(R-1)

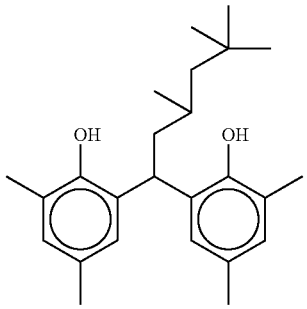

(R-2)

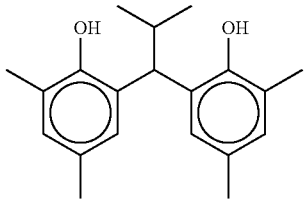

(R-3)

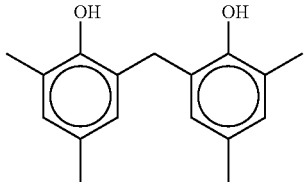

(R-4)

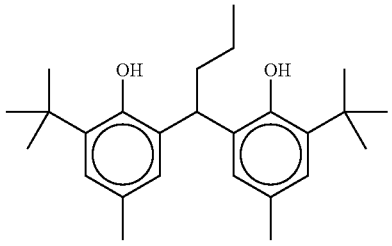

(R-5)

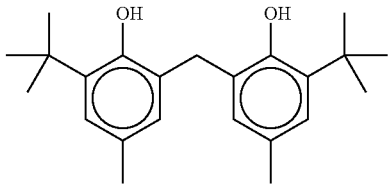

(R-6)

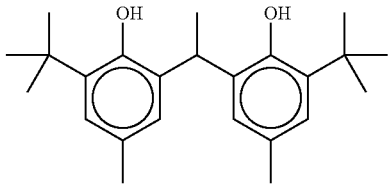

(R-7)

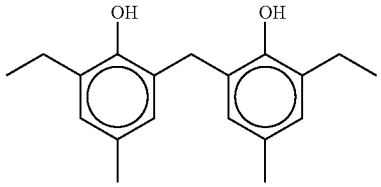

-continued
(R-8)
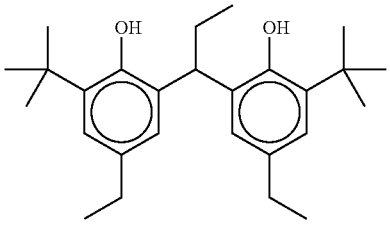
(R-9)
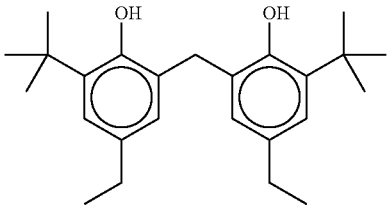
(R-10)
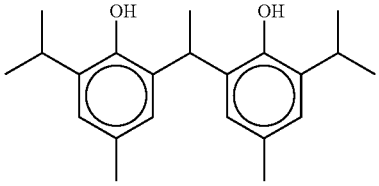
(R-11)
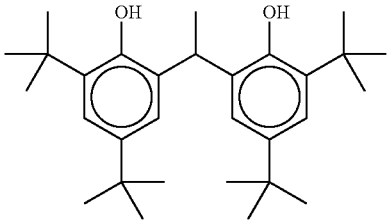
(R-12)
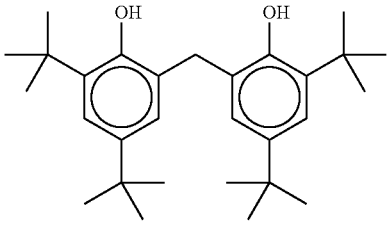
(R-13)
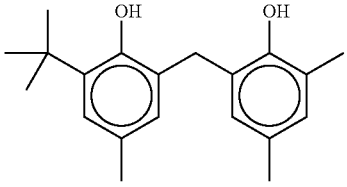
(R-14)
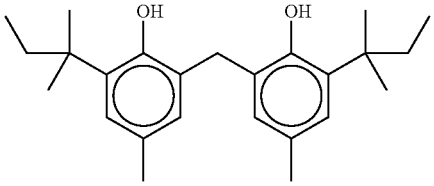
-continued
(R-15)
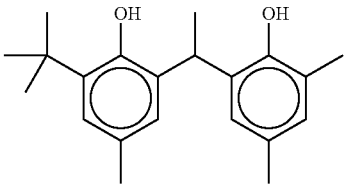
(R-16)
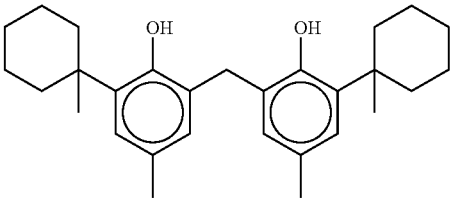
(R-17)
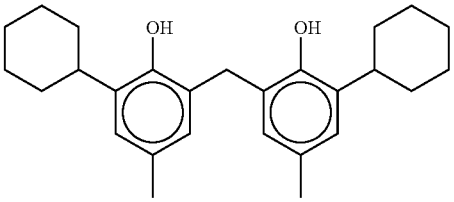
(R-18)
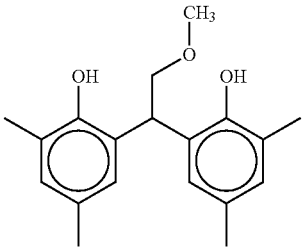
(R-19)
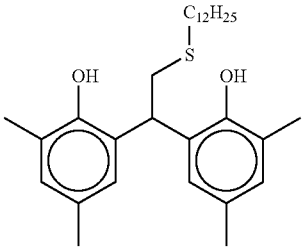
(R-20)
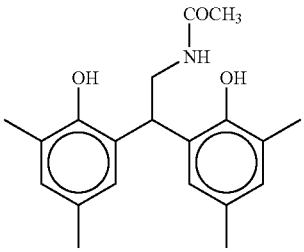
(R-21)
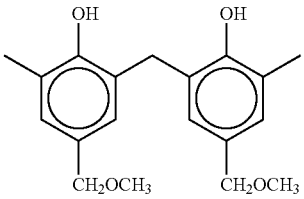

-continued
(R-22)
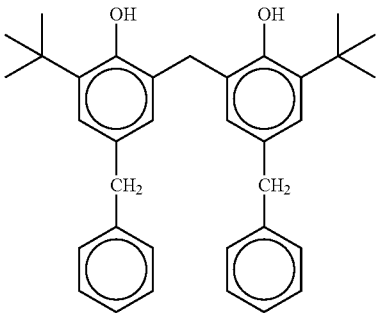
(R-23)
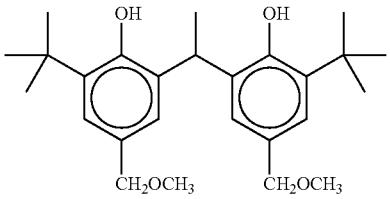
(R-24)
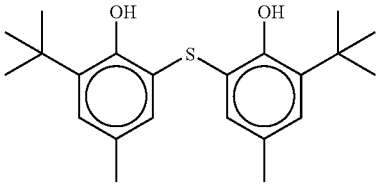
(R-25)
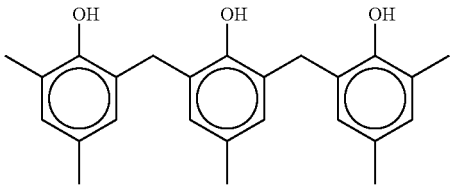
(R-26)
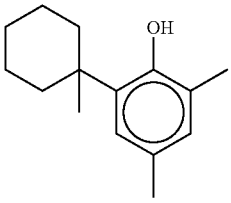
(R-27)
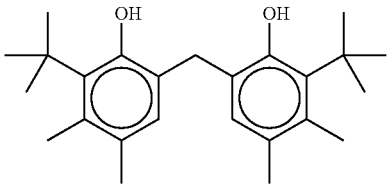
(R-28)
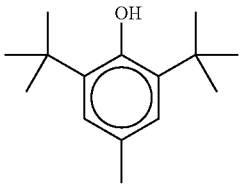
-continued
(R-29)
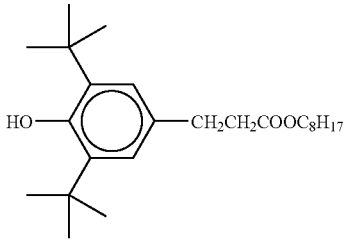
(R-30)
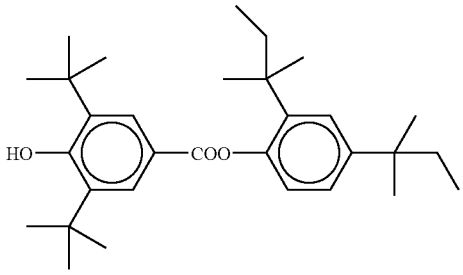
(R-31)
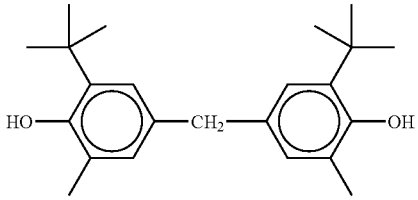
(R-32)
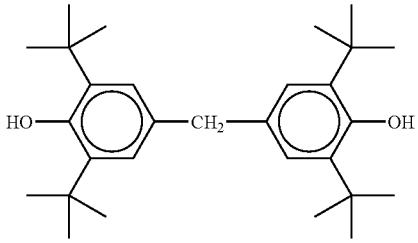
(R-33)
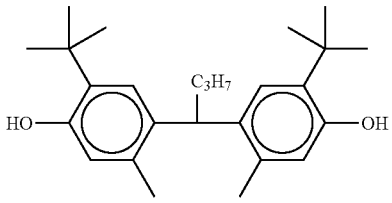
(R-34)
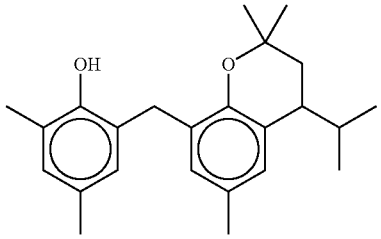
As preferred reducing agents of the invention other than those above, there can be mentioned compounds disclosed in JP-A Nos. 2001-188314, 2001-209145, 2001-350235, and 2002-156727.
In the invention, the addition amount of the reducing agent is, preferably, from 0.1 g/m$^2$ to 3.0 g/m$^2$, more preferably, 0.2 g/m$^2$ to 1.5 g/m$^2$ and, further preferably 0.3

$g/m^2$ to 1.0 $g/m^2$. It is, preferably, contained by 5 mol % to 50 mol %, more preferably, 8 mol % to 30 mol % and, further preferably, 10 mol % to 20 mol % per one mole of silver in the image forming layer. The reducing agent of the invention it is more preferably contained in the image forming layer.

In the invention, the reducing agent may be incorporated into photosensitive material by being added into the coating solution, such as in the form of a solution, an emulsion dispersion, a solid particle dispersion, and the like.

As a well known emulsion dispersion method, there can be mentioned a method comprising dissolving the reducing agent in an auxiliary solvent such as oil, for instance, dibutyl phthalate, tricresyl phosphate, glyceryl triacetate, diethyl phthalate, and the like, as well as ethyl acetate, cyclohexanone, and the like; from which an emulsion dispersion is mechanically produced.

As solid particle dispersion method, there can be mentioned a method comprising dispersing the powder of the reducing agent in a proper medium such as water, by means of ball mill, colloid mill, vibrating ball mill, sand mill, jet mill, roller mill, or ultrasonics, thereby obtaining solid dispersion. In this case, there can also be used a protective colloid (such as polyvinyl alcohol), or a surfactant (for instance, an anionic surfactant such as sodium triisopropylnaphthalenesulfonate (a mixture of compounds having the isopropyl groups in different substitution sites)). In the mills enumerated above, generally used as the dispersion media are beads made of zirconia and the like, and Zr and the like eluting from the beads may be incorporated in the dispersion. Although depending on the dispersing conditions, the amount of Zr and the like generally incorporated in the dispersion is in a range of from 1 ppm to 1000 ppm. It is practically acceptable so long as Zr is incorporated in an amount of 0.5 mg or less per 1 g of silver.

Preferably, a preservative (for instance, sodium benzoisothiazolinone salt) is added in the water dispersion.

In the invention, furthermore, the reducing agent is preferably used as solid dispersion, and is added in the form of fine particles having average particle size from 0.01 μm to 10 μm, and more preferably, from 0.05 μm to 5 μm and, further preferably, from 0.1 μm to 2 μm. In the invention, other solid dispersions are preferably used with this particle size range.

(Development Accelerator)

In the photothermographic material of the invention, sulfoneamide phenolic compounds represented by the general formula (A) described in the specification of JP-A No. 2000-267222, and specification of JP-A No. 2000-330234, hindered phenolic compound represented by the general formula (II) described in JP-A No. 2001-92075, hydrazine series compounds represented by general formula (I) described in the specification of JP-A No. 10-62895 and the specification of JP-A No. 11-15116, represented by general formula (D) of JP-A No. 2002-156727 and represented by general formula (1) described in the specification of Japanese Patent Application No. 2001-074278, and phenolic or naphthalic compounds represented by general formula (2) described in the specification of JP-A No. 2001-264929 are used preferably as the development accelerator and they are added preferably. The development accelerator described above is used within a range from 0.1 mol % to 20 mol %, preferably, within a range from 0.5 mol % to 10 mol % and, more preferably, within a range from 1 mol % to 5 mol % to the reducing agent. The introduction method to the photothermographic material can include, the same method as those for the reducing agent and, it is particularly preferred to add as a solid dispersion or an emulsion dispersion. In a case of adding as an emulsion dispersion, it is preferred to add as an emulsion dispersion dispersed by using a high boiling solvent which is solid at a normal temperature and an auxiliary solvent at a low boiling point, or to add as a so-called oilless emulsion dispersion not using the high boiling solvent.

In the present invention, it is more preferred to use, among the development accelerators described above, hydrazine compounds represented by general formula (D) described in the specification of JP-A No. 2002-156727, and phenolic or naphtholic compounds represented by general formula (2) described in the specification of JP-A No. 2001-264929.

Particularly preferred development accelerators of the invention are compounds represented by the following general formulae (A-I) and (A-II).

$Q_1$-NHNH-$Q_2$ General formula (A-I)

(in which $Q_1$ represents an aromatic group or heterocyclic group coupling at a carbon atom to —NHNH-$Q_2$ and $Q_2$ represents a carbamoyl group, acyl group, alkoxycarbonyl group, aryloxycarbonyl group, sulfonyl group or sulfamoyl group).

In general formula (A-I), the aromatic group or heterocyclic group represented by $Q_1$ is, preferably, 5 to 7 membered unsaturated rings. Preferred examples are benzene ring, pyridine ring, pyrazine ring, pyrimidine ring, pyridazine ring, 1,2,4-triazine ring, 1,3,5-triazine ring, pyrrole ring, imidazole ring, pyrazole ring, 1,2,3-triazole ring, 1,2,4-triazole ring, tetrazole ring, 1,3,4-thiadiazole ring, 1,2,4-thiadiazole ring, 1,2,5-thiadiazole ring, 1,3,4-oxadiazole ring, 1,2,4-oxadiazole ring, 1,2,5-oxadiazole ring, thiazole ring, oxazole ring, isothiazole ring, isooxazole ring, and thiophene ring. Condensed rings in which the rings described above are condensed to each other are also preferred.

The rings described above may have substituents and in a case where they have two or more substituent groups, the substituents may be identical or different with each other. Examples of the substituents can include halogen atom, alkyl group, aryl group, carboamide group, alkylsulfoneamide group, arylsulfonamide group, alkoxy group, aryloxy group, alkylthio group, arylthio group, carbamoyl group, sulfamoyl group, cyano group, alkylsulfonyl group, arylsulfonyl group, alkoxycarbonyl group, aryloxycarbonyl group and acyl group. In a case where the substituents are groups capable of substituting, they may have further substituents and examples of preferred substituents can include halogen atom, alkyl group, aryl group, carbonamide group, alkylsulfoneamide group, arylsulfoneamide group, alkoxy group, aryloxy group, alkylthio group, arylthio group, acyl group, alkoxycarbonyl group, aryloxycarbonyl group, carbamoyl group, cyano group, sulfamoyl group, alkylsulfonyl group, arylsulfonyl group and acyloxy group.

The carbamoyl group represented by $Q_2$ is a carbamoyl group preferably having 1 to 50 carbon atoms and, more preferably, of 6 to 40 carbon atoms, for example, not-substituted carbamoyl, methyl carbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-(2,4-tert-pentylphenoxy)propyl} carbamoyl, N-(2-hexyldecyl)carbamoyl, N-phenylcarbamoyl, N-(4-dodecyloxyphenyl)carbamoyl, N-(2-chloro-5-dodecyloxycarbonylphenyl)carbamoyl, N-naphthylcarbaoyl, N-3-pyridylcarbamoyl and N-benzylcarbamoyl.

The acyl group represented by $Q_2$ is an acyl group, preferably, having 1 to 50 carbon atoms and, more preferably, 6 to 40 carbon atoms and can include, for example, formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl. Alkoxycarbonyl group represented by $Q_2$ is an alkoxycarbonyl group, preferably, of 2 to 50 carbon atom and, more preferably, of 6 to 40 carbon atoms and can include, for example, methoxycarbonyl, ethoxycarbonyl, isobutyloxycarbonyl, cyclehexyloxycarbonyl, dodecyloxycarbonyl and benzyloxycarbonyl.

The aryloxy carbonyl group represented by $Q_2$ is an aryloxycarbonyl group, preferably, having 7 to 50 carbon atoms and, more preferably, of 7 to 40 carbon atoms and can include, for example, phenoxycarbonyl, 4-octyloxyphenoxycarbonyl, 2-hydroxymethylphenoxycarbonyl, and 4-dodecyloxyphenoxycarbonyl. The sulfonyl group represented by $Q_2$ is a sulfonyl group, preferably, of 1 to 50 carbon atoms and, more preferably, of 6 to 40 carbon atoms and can include, for example, methylsulfonyl, butylsulfonyl, octylsulfonyl, 2-hexadecylsulfonyl, 3-dodecyloxypropylsulfonyl, 2-octyloxy-5-tert-octylphenyl sulfonyl, and 4-dodecyloxyphenyl sulfonyl.

The sulfamoyl group represented by $Q_2$ is sulfamoyl group, preferably, having 0 to 50 carbon atoms, more preferably, 6 to 40 carbon atoms and can include, for example, not-substituted sulfamoyl, N-ethylsulfamoyl group, N-(2-ethylhexyl)sulfamoyl, N-decylsulfamoyl, N-hexadecylsulfamoyl, N-{3-(2-ethylhexyloxy) propyl}sulfamoyl, N-(2-chloro-5-dodecyloxycarbonylphenyl)sulfamoyl, and N-(2-tetradecyloxyphenyl)sulfamoyl. The group represented by $Q_2$ may further have a group mentioned as the example of the substituent of 5 to 7-membered unsaturated ring represented by $Q_1$ at the position capable of substituting. In a case where the group has two or more substituents, such substituents may be identical or different with each other.

Then, preferred range for the compounds represented by formula (A-I) is to be described. 5 to 6 membered unsaturated ring is preferred for $Q_1$, and benzene ring, pyrimidine ring, 1,2,3-triazole ring, 1,2,4-triazole ring, tetrazole ring, 1,3,4-thiadiazole ring, 1,2,4-thiadiazole ring, 1,3,4-oxadiazole ring, 1,2,4-oxadiazole ring, thioazole ring, oxazole ring, isothiazole ring, isooxazole ring and a ring in which the ring described above is condensed with a benzene ring or unsaturated hetero ring are further preferred. Further, $Q_2$ is preferably a carbamoyl group and, particularly, a carbamoyl group having hydrogen atom on the nitrogen atom is particularly preferred.

General formula (A-II)

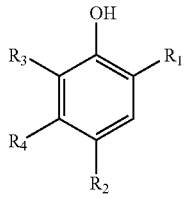

In general formula (A-II), $R_1$ represents an alkyl group, acyl group, acylamino group, sulfoneamide group, alkoxycarbonyl group, and carbamoyl group. $R_2$ represents a hydrogen atom, halogen atom, alkyl group, alkoxy group, aryloxy group, alkylthio group, arylthio group, acyloxy group and carbonate ester group. $R_3$, $R_4$ each represents a group capable of substituting for a hydrogen atom on a benzene ring which is mentioned as the example of the substituent for general formula (A-I). $R_3$ and $R_4$ may join to each other to form a condensed ring.

$R_1$ is, preferably, an alkyl group having 1 to 20 carbon atoms (for example, methyl group, ethyl group, isopropyl group, butyl group, tert-octyl group, or cyclohexyl group), acylamino group (for example, acetylamino group, benzoylamino group, methylureido group, or 4-cyanophenylureido group), carbamoyl group (for example, n-butylcarbamoyl group, N,N-diethylcarbamoyl group, phenylcarbamoyl group, 2-chlorophenylcarbamoyl group, or 2,4-dichlorophenylcarbamoyl group), acylamino group (including ureido group or urethane group) being more preferred. $R_2$ is, preferably, a halogen atom (more preferably, chlorine atom, bromine atom), alkoxy group (for example, methoxy group, butoxy group, n-hexyloxy group, n-decyloxy group, cyclohexyloxy group or benzyloxy group), and aryloxy group (phenoxy group or naphthoxy group).

$R_3$ is, preferably a hydrogen atom, halogen atom or an alkyl group having 1 to 20 carbon atoms, the halogen atom being most preferred. $R_4$ is preferably a hydrogen atom, alkyl group or an acylamino group, with the alkyl group or the acylamino group being more preferred. Examples of the preferred substituent thereof are identical with those for $R_1$. In a case where $R_4$ is an acylamino group, $R_4$ may preferably be joined with $R_3$ to form a carbostyryl ring.

In a case where $R_3$ and $R_4$ in general formula (A-II) are joined to each other to form a condensed ring, a naphthalene ring is particularly preferred as the condensed ring. The same substituent as the example of the substituent referred to for general formula (A-I) may be joined to the naphthalene ring. In a case where the general formula (A-II) is a naphtholic compound, $R_1$, is, preferably, a carbamoyl group. Among them, benzoyl group is particularly preferred. $R_2$ is, preferably, an alkoxy group or aryloxy group and, particularly preferably an alkoxy group.

Preferred specific examples for the development accelerator of the invention are to be described below. The invention is not restricted to them.

(A-1)

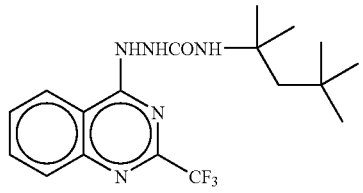

(A-2)

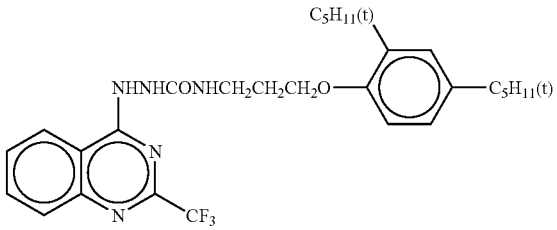

(A-3)

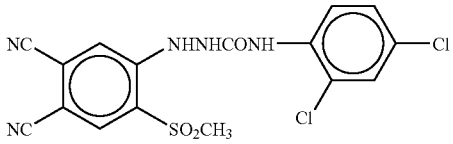

-continued (A-4)

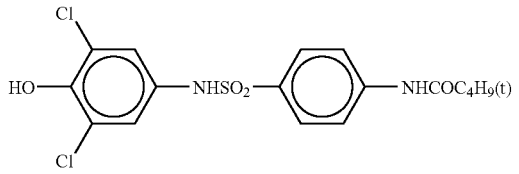

(A-5)

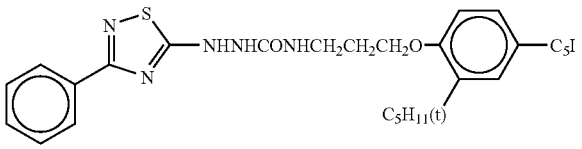

(A-6)

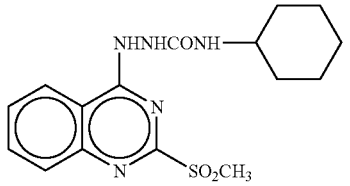

(A-7)

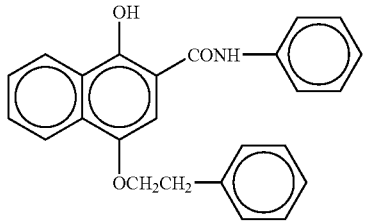

(A-8)

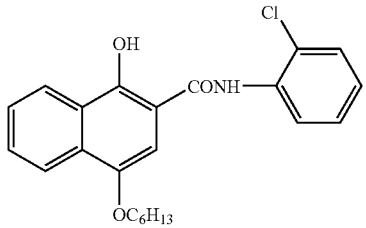

(A-9)

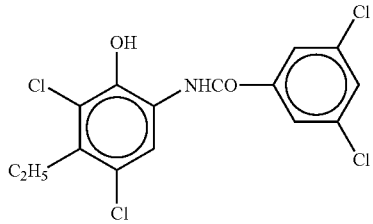

(A-10)

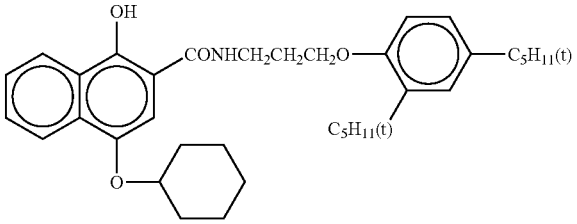

(Hydrogen Bonding Compound)

In the invention, in the case that the reducing agent has an aromatic hydroxyl group (—OH) or an amino group (—NHR, R represents each one of hydrogen atom and alkyl group), particularly in the case that the reducing agent is a bisphenol described above, it is preferred to use in combination, a non-reducing compound having a group capable of reacting with these groups of the reducing agent, and that is also capable of forming a hydrogen bond therewith.

As a group forming a hydrogen bond with a hydroxyl group or an amino group, there can be mentioned a phosphoryl group, a sulfoxido group, a sulfonyl group, a carbonyl group, an amido group, an ester group, an urethane group, an ureido group, a tertiary amino group, a nitrogen-containing aromatic group, and the like. Particularly preferred among them is phosphoryl group, sulfoxido group, amido group (not having >N—H moiety but being blocked in the form of >N—Ra (where, Ra represents a substituent other than H)), urethane group (not having >N—H moiety but being blocked in the form of >N—Ra (where, Ra represents a substituent other than H)), and ureido group (not having >N—H moiety but being blocked in the form of >N—Ra (where, Ra represents a substituent other than H)).

In the invention, particularly preferred as the hydrogen bonding compound is the compound expressed by general formula (DH) shown below.

General formula (DH)

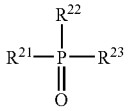

In general formula (DH), $R^{21}$ to $R^{23}$ each independently represent an alkyl group, an aryl group, an alkoxy group, an aryloxy group, an amino group, or a heterocyclic group, which may be substituted or not substituted. In the case $R^{21}$ to $R^{23}$ contain a substituent, examples of the substituents include a halogen atom, an alkyl group, an aryl group, an alkoxy group, an amino group, an acyl group, an acylamino group, an alkylthio group, an arylthio group, a sulfonamido group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., methyl group, ethyl group, isopropyl group, t-butyl group, t-octyl group, phenyl group, a 4-alkoxyphenyl group, a 4-acyloxyphenyl group, and the like.

Specific examples of an alkyl group expressed by $R^{21}$ to $R^{23}$ include methyl group, ethyl group, butyl group, octyl group, dodecyl group, isopropyl group, t-butyl group, t-amyl group, t-octyl group, cyclohexyl group, 1-methylcyclohexyl group, benzyl group, phenetyl group, 2-phenoxypropyl group, and the like. As aryl groups, there can be mentioned phenyl group, cresyl group, xylyl group, naphthyl group, 4-t-butylphenyl group, 4-t-octylphenyl group, 4-anisidyl group, 3,5-dichlorophenyl group, and the like. As alkoxyl groups, there can be mentioned methoxy group, ethoxy group, butoxy group, octyloxy group, 2-ethylhexyloxy group, 3,5,5-trimethylhexyloxy group, dodecyloxy group, cyclohexyloxy group, 4-methylcyclohexyloxy group, benzyloxy group, and the like. As aryloxy groups, there can be mentioned phenoxy group, cresyloxy group, isopropylphenoxy group, 4-t-butylphenoxy group, naphthoxy group, biphenyloxy group, and the like. As amino groups, there can be mentioned are dimethylamino group, diethylamino group, dibutylamino group, dioctylamino group, N-methyl- N-hexylamino group, dicyclohexylamino group, diphenylamino group, N-methyl-N-phenylamino, and the like.

Preferred as $R^{21}$ to $R^{23}$ are an alkyl group, an aryl group, an alkoxy group, and an aryloxy group. Concerning the effect of the invention, it is preferred that at least one or more of $R^{21}$ to $R^{23}$ are an alkyl group or an aryl group, and more preferably, two or more of them are an alkyl group or an aryl group. From the viewpoint of low cost availability, it is preferred that $R^{21}$ to $R^{23}$ are of the same group.

Specific examples of hydrogen bonding compounds represented by general formula (DH) of the invention and others are shown below, but it should be understood that the invention is not limited thereto.

(D-1)

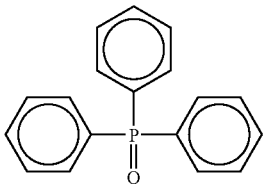

(D-2)

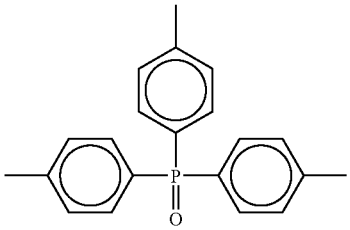

(D-3)

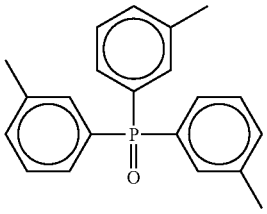

(D-4)

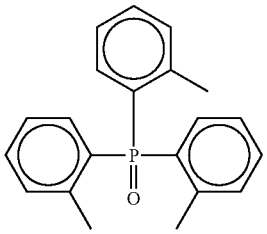

(D-5)

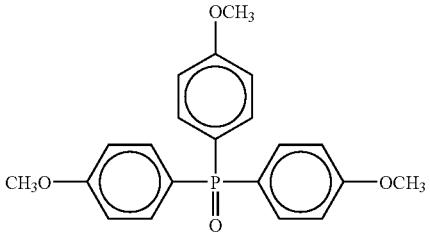

-continued (D-6)

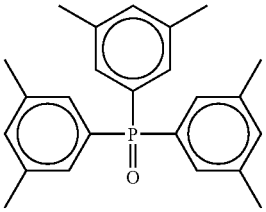

(D-7)

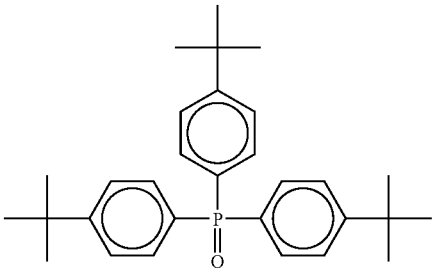

(D-8)

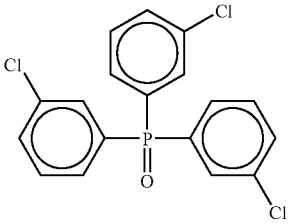

(D-9)

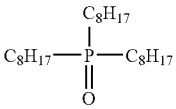

(D-10)

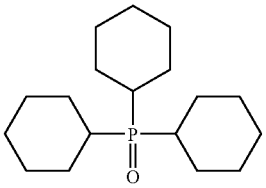

(D-11)

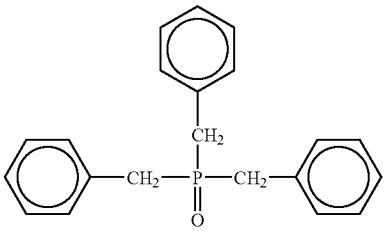

(D-12)

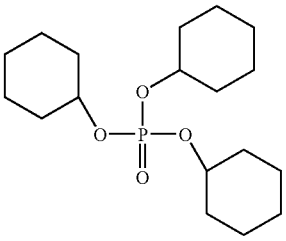

-continued (D-13)

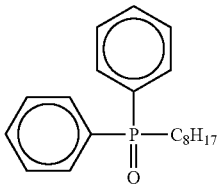

(D-14)

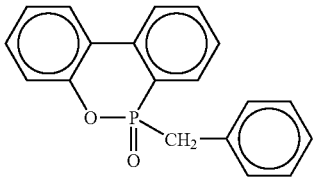

(D-15)

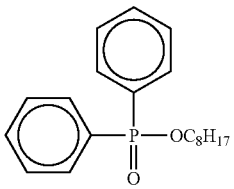

(D-16)

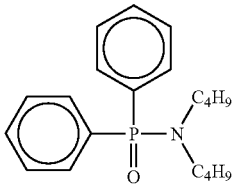

(D-17)

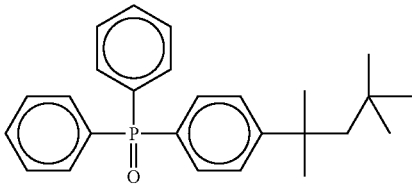

(D-18)

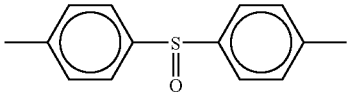

(D-19)

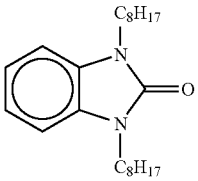

(D-20)

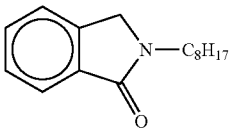

(D-21)

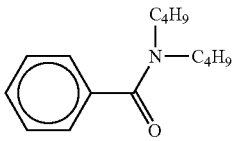

Specific examples of hydrogen bonding compounds other than those enumerated above can be found in those described in EP-A No. 1096310 and in Japanese Patent Application Nos. 2000-270498 and 2001-124796.

The compound expressed by general formula (DH) used in the invention can be used in the photosensitive material by being incorporated into the coating solution in the form of solution, emulsion dispersion, or solid-dispersed fine particle dispersion similar to the case of reducing agent, however, it is preferred to be used after it is prepared in the form of solid-dispersed fine particle dispersion. In the solution, the compound expressed by general formula (DH) forms a hydrogen-bonded complex with a compound having a phenolic hydroxyl group or an amino group, and can be isolated as a complex in crystalline state depending on the combination of the reducing agent and the compound expressed by general formula (DH).

It is particularly preferred to use the crystal powder thus isolated in the form of a solution by dissolving it into a coating solvent, because it provides stable performance. Further, it is also preferred to use a method of leading to form complex during dispersion by mixing the reducing agent and the compound expressed by general formula (DH) in the form of powders and dispersing them with a proper dispersion solvent using sand grinder mill and the like.

The compound expressed by general formula (DH) is preferably used in a range of from 1 mol % to 200 mol %, more preferably from 10 mol % to 150 mol %, and further preferably, from 20 mol % to 100 mol %, with respect to the reducing agent.

(Silver Halide)

1) Halogen Composition

For the photosensitive silver halide used in the invention, there is no particular restriction on the halogen composition and silver chloride, silver bromochloride, silver bromide, silver bromoiodide, silver chlorobromoiodide and silver iodide can be used. Among them, silver bromide, silver bromoiodide and silver iodide are preferred. The distribution of the halogen composition in a grain may be uniform or the halogen composition may be changed stepwise, or it may be changed continuously. Further, a silver halide grain having a core/shell structure can be used preferably. Preferred structure is a twofold to fivefold structure and, more preferably, core/shell grain having a twofold to fourfold structure can be used. Further, a technique of localizing silver bromide or silver iodide to the surface of a silver chloride, silver bromide or silver bromochloride grains can also be used preferably.

2) Grain Formation Method

The method of forming a photosensitive silver halide is well known in the art, and for example, methods described in Research Disclosure No. 170929, June 1978 and U.S. Pat. No. 3,700,458 can be used, and specifically, a method is used in which a photosensitive silver halide is prepared by mixing a silver supplying compound and a halogen supplying compound into a solution of gelatin or other polymers, and then, mixing with an organic silver salt. Further, a method described in JP-A No. 11-119374, paragraph Nos. 0217 to 0224 and a method described in JP-A Nos. 11-352627 and 2000-347335 are also preferable.

3) Grain Size

The grain size of the photosensitive silver halide is preferably small with an aim of suppressing clouding after image formation and, specifically, it is 0.20 μm or less, more preferably, 0.01 μm to 0.15 μm and, further preferably, 0.02 μm to 0.12 μm. The grain size as used herein means an average diameter of a circle converted such that it has a same area as a projection area of the silver halide grain (projection area of a main plane in a case of a tabular grain).

4) Grain Shape

The shape of the silver halide grain can include, for example, cubic, octahedral, plate-like, spherical, rod-like or potato-like shape. The cubic grain is particularly preferred in the invention. A silver halide grain rounded at corners can also be used preferably. While there is no particular restriction on the index of plane (Mirror's index) of an crystal surface of the photosensitive silver halide grain, it is preferred that the ratio of [100] face is higher, in which the spectral sensitizing efficiency is higher in a case of adsorption of a spectral sensitizing dye. The ratio is preferably 50% or more, more preferably, 65% or more and, further preferably, 80% or more. The ratio of the Mirrors index [100] face can be determined by the method of utilizing the adsorption dependency of [111] face and [100] face upon adsorption of a sensitizing dye described by T. Tani; in J. Imaging Sci., 29, 165 (1985).

5) Heavy Metal

The photosensitive silver halide grain of the invention can contain metals or complexes of metals belonging to groups 8 to 10 of the periodic table (showing groups 1 to 18). The metal or the center metal of the metal complex from groups 8 to 10 of the periodic table is preferably rhodium, ruthenium or iridium. The metal complex may be used alone, or two or more kinds of complexes comprising identical or different species of metals may be used together. A preferred content is within a range from $1\times10^{-9}$ mol to $1\times10^{-3}$ mol per one mol of silver. The heavy metals, metal complexes and the addition method thereof are described in JP-A No. 7-225449, in paragraph Nos. 0018 to 0024 of JP-A No.11-65021 and in paragraph Nos. 0227 to 0240 of JP-A No. 11-119374.

In the present invention, a silver halide grain having a hexacyano metal complex is present on the outermost surface of the grain is preferred. The hexacyano metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. In the invention, hexacyano Fe complex is preferred.

Since the hexacyano complex exists in ionic form in an aqueous solution, paired cation is not important and alkali metal ion such as sodium ion, potassium ion, rubidium ion, cesium ion and lithium ion, ammonium ion, alkyl ammonium ion (for example, tetramethyl ammonium ion, tetraethyl ammonium ion, tetrapropyl ammonium ion, and tetra (n-butyl) ammonium ion), which are easily misible with water and suitable to precipitation operation of a silver halide emulsion are preferably used.

The hexacyano metal complex can be added while being mixed with water, as well as a mixed solvent of water and an appropriate organic solvent miscible with water (for example, alcohols, ethers, glycols, ketones, esters and amides) or gelatin.

The addition amount of the hexacyano metal complex is preferably from $1\times10^{-5}$ mol to $1\times10^{-2}$ mol and, more preferably, from $1\times10^{-4}$ mol to $1\times10^{-3}$ per one mol of silver in each case.

In order to allow the hexacyano metal complex to be present on the outermost surface of a silver halide grain, the hexacyano metal complex is directly added in any stage of: after completion of addition of an aqueous solution of silver nitrate used for grain formation, before completion of emulsion forming step prior to a chemical sensitization step, of conducting chalcogen sensitization such as sulfur sensitization, selenium sensitization and tellurium sensitization or noble metal sensitization such as gold sensitization, during washing step, during dispersion step and before chemical sensitization step. In order not to grow the fine silver halide grain, the hexacyano metal complex is rapidly added preferably after the grain is formed, and it is preferably added before completion of the emulsion forming step.

Addition of the hexacyano complex may be started after addition of 96% by weight of an entire amount of silver nitrate to be added for grain formation, more preferably started after addition of 98% by weight and, particularly preferably, started after addition of 99% by weight.

When any of the hexacyano metal complex is added after addition of an aqueous silver nitrate just before completion of grain formation, it can be adsorbed to the outermost surface of the silver halide grain and most of them form an insoluble salt with silver ions on the surface of the grain. Since the hexacyano iron (II) silver salt is a less soluble salt than AgI, re-dissolution with fine grains can be prevented and fine silver halide grains with smaller grain size can be prepared.

Metal atoms that can be contained in the silver halide grain used in the invention (for example, $[Fe(CN)_6]^{4-}$), desalting method of a silver halide emulsion and chemical sensitization method are described in paragraph Nos. 0046 to 0050 of JP-A No. 11-84574, in paragraph Nos. 0025 to 0031 of JP-A No. 11-65021, and paragraph Nos. 0242 to 0250 of JP-A No. 11-119374.

6) Gelatin

As the gelatin contained the photosensitive silver halide emulsion used in the invention, various kinds of gelatins can be used. It is necessary to maintain an excellent dispersion state of a photosensitive silver halide emulsion in an organic silver salt containing coating solution, and gelatin having a molecular weight of 10,000 to 1,000,000 is preferably used. It is also preferred to use a gelatin being treated to phthalize the substituent of gelatin. These gelatins may be used at grain formation or at the time of dispersion after desalting treatment and it is preferably used during grain formation.

7) Sensitizing Dye

As the sensitizing dye applicable in the invention, those capable of spectrally sensitizing silver halide grains in a desired wavelength region upon adsorption to silver halide grains having spectral sensitivity suitable to spectral characteristic of an exposure light source can be selected advantageously. The sensitizing dyes and the addition method are disclosed, for example, JP-A No. 11-65021 (paragraph Nos. 0103 to 0109), as a compound represented by the general formula (II) in JP-A No. 10-186572, dyes represented by the general formula (I) in JP-A No. 11-119374 (paragraph No. 0106), dyes described in U.S. Pat. Nos. 5,510,236 and 3,871,887 (Example 5), dyes disclosed in JP-A Nos. 2-96131 and 59-48753, as well as in page 19, line 38 to page 20, line 35 of EP-A No. 0803764A1, and in JP-A Nos. 2001-272747, 2001-290238 and 2002-23306. The sensitizing dyes described above may be used alone or two or more of them may be used in combination. The sensitizing dye is added into the silver halide emulsion preferably within a period after desalting step to coating step and, more preferably, in a period after desalting to the completion of chemical ripening.

In the invention, the sensitizing dye may be added at any amount according to the property of photosensitivity and fogging, but it is preferably added from $10^{-6}$ mol to 1 mol, and more preferably, from $10^{-4}$ mol to $10^{-1}$ mol per one mol of silver in each case.

The photothermographic material of the invention may also contain super sensitizers in order to improve spectral sensitizing effect. The super sensitizers usable in the invention can include those compounds described in EP-A No.

587,338, U.S. Pat. Nos. 3,877,943 and 4,873,184 and JP-A Nos. 5-341432, 11-109547, and 10-111543.

8) Chemical Sensitization

The photosensitive silver halide grain in the invention is preferably chemically sensitized by sulfur sensitization method, selenium sensitization method or tellurium sensitization method. As the compound used preferably for sulfur sensitization method, selenium sensitization method and tellurium sensitization method, known compounds, for example, compounds described in JP-A No. 7-128768 can be used. Particularly, tellurium sensitization is preferred in the invention and compounds described in the literature cited in paragraph No. 0030 in JP-A No. 11-65021 and compounds shown by the general formulae (II), (III), and (IV) in JP-A No. 5-313284 are more preferred.

The photosensitive silver halide grain in the invention is preferably chemically sensitized by gold sensitization method alone or in combination with the chalcogen sensitization described above. As the gold sensitizer, those having an pxidation number of gold of either +1 or +3 are preferred and those gold compounds used usually as the gold sensitizer are preferred. As typical examples, chloroauric acid, bromoauric acid, potassium chloroaurate, potassium bromoaurate, auric trichloride, potassium auric thiocyanate, potassium iodoaurate, tetracyanoauric acid, ammonium aurothiocyanate and pyridyl trichloro gold are preferred. Further, gold sensitizers described in U.S. Pat. No. 5,858,637 and Japanese Patent Application No. 2001-79450 are also used preferably.

In the invention, chemical sensitization can be applied at any time so long as it is after grain formation and before coating and it can be applied, after desalting, (1) before spectral sensitization, (2) simultaneously with spectral sensitization, (3) after spectral sensitization and (4) just before coating.

The amount of sulfur, selenium and tellurium sensitizer used in the invention may vary depending on the silver halide grain used, the chemical ripening condition and the like and it is used by about $10^{-8}$ mol to $10^{-2}$ mol, preferably, $10^{-7}$ mol to $10^{-3}$ mol per one mol of the silver halide.

The addition amount of the gold sensitizer may vary depending on various conditions and it is generally about $10^{-7}$ mol to $10^{-3}$ mol and, more preferably, $10^{-6}$ mol to $5\times10^{-4}$ mol per one mol of the silver halide.

There is no particular restriction on the condition for the chemical sensitization in the invention and, appropriately, pH is 5 to 8, pAg is 6 to 11 and temperature is at 40° C. to 95° C.

In the silver halide emulsion used in the invention, a thiosulfonic acid compound may be added by the method shown in EP-A No. 293917.

A reductive compound is used preferably for the photosensitive silver halide grain in the invention. As the specific compound for the reduction sensitization, ascorbic acid or thiourea dioxide is preferred, as well as use of stannous chloride, aminoimino methane sulfonic acid, hydrazine derivatives, borane compounds, silane compounds and polyamine compounds are preferred. The reduction sensitizer may be added at any stage in the photosensitive emulsion production process from crystal growth to the preparation step just before coating. Further, it is preferred to apply reduction sensitization by ripening while keeping pH to 7 or higher or pAg to 8.3 or lower for the emulsion, and it is also preferred to apply reduction sensitization by introducing a single addition portion of silver ions during grain formation.

9) Compound that can be One-Electron-Oxidized to Provide a One-Electron Oxidation Product which Releases One or More Electrons The photothermographic material of the invention preferably contains a compound that can be one-electron-oxidized to provide a one-electron oxidation product which releases one or more electrons.

As the compound that can be one-electron-oxidized to provide a one-electron oxidation product which releases one or more electrons is a compound selected from the following types 1 to 5.

(Type 1) a compound that can be one-electron-oxidized to provide a one-electron oxidation product which further releases at least two electrons, due to being subjected to a subsequent bond cleavage reaction;

(Type 2) a compound that has at least two groups adsorbable to the silver halide and can be one-electron-oxidized to provide a one-electron oxidation product which further releases one electron, due to being subjected to a subsequent bond cleavage reaction;

(Type 3) a compound that can be one-electron-oxidized to provide a one-electron oxidation product, which further releases at least one electron after being subjected to a subsequent bond formation;

(Type 4) a compound that can be one-electron-oxidized to provide a one-electron oxidation product which further releases at least one electron after a subsequent intramolecular ring cleavage reaction; and (Type 5) a compound represented by X—Y, in which X represents a reducing group and Y represents a leaving group, and convertable by one-electron-oxidizing the reducing group to a one-electron oxidation product which can be converted into an X radical by eliminating the leaving group in a subsequent X—Y bond cleavage reaction, one electron being released from the X radical.

Each compound of Type 1 and Types 3 to 5 preferably is a "compound having a sensitizing dye moiety" or a "compound having an adsorbable group to the silver halide". More preferred is a "compound having an adsorbable group to the silver halide". Each compound of Types 1 to 4 more preferably is a "compound having a heterocyclic group containing nitrogen atoms substituted by two or more mercapto groups".

The compound of Type 1 to 5 will be described in detail below.

In the compound of Type 1, the term "the bond cleavage reaction" specifically means a cleavage reaction of a bond of carbon-carbon, carbon-silicon, carbon-hydrogen, carbon-boron, carbon-tin or carbon-germanium. Cleavage of a carbon-hydrogen bond may be followed after the cleavage reaction. The compound of Type 1 can be one-electron-oxidized to be converted into the one-electron oxidation product, and thereafter can release further two or more electrons, preferably three or more electrons with the bond cleavage reaction.

The compound of Type 1 is preferably represented by any one of general formulae (A), (B), (1), (2) and (3).

General formula (A)

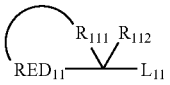

-continued

General formula (B)

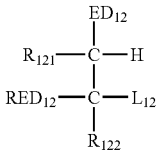

In general formula (A), $RED_{11}$ represents a reducing group that can be one-electron-oxidized, and $L_{11}$ represents a leaving group. $R_{112}$ represents a hydrogen atom or a substituent. $R_{111}$ represents a nonmetallic atomic group forming a tetrahydro-, hexahydro- or octahydro-derivative of a 5- or 6-membered aromatic ring including aromatic heterocycles.

In general formula (B), $RED_{12}$ represents a reducing group that can be one-electron-oxidized, and $L_{12}$ represents a leaving group. $R_{121}$ and $R_{122}$ each represent a hydrogen atom or a substituent. $ED_{12}$ represents an electron-donating group. In the general formula (B), $R_{121}$ and $RED_{12}$, $R_{121}$ and $R_{122}$, and $ED_{12}$ and $RED_{12}$ may bond together to form a ring structure, respectively.

In the compound represented by general formula (A) or (B), the reducing group of $RED_{11}$ or $RED_{12}$ is one-electron-oxidized, and thereafter the leaving group of $L_{11}$ or $L_{12}$ is spontaneously eliminated in the bond cleavage reaction. Further two or more, preferably three or more electrons can be released with the bond cleavage reaction.

General formula (1)

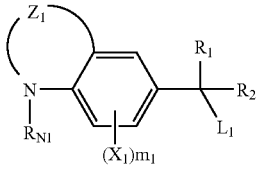

General formula (2)

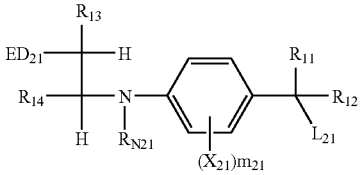

General formula (3)

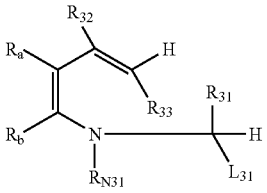

In general formula (1), $Z_1$ represents an atomic group forming a 6-membered ring with a nitrogen atom and 2 carbon atoms in a benzene ring; $R_1$, $R_2$ and $R_{N1}$ each represent a hydrogen atom or a substituent; $X_1$ represents a substituent capable of substituting for a hydrogen atom on a benzene ring; $m_1$ represents an integer of 0 to 3; and $L_1$ represents a leaving group. In general formula (2), $ED_{21}$ represents an electron-donating group; $R_{11}$, $R_{12}$, $R_{N21}$, $R_{13}$ and $R_{14}$ each represent a hydrogen atom or a substituent; $X_{21}$ represents a substituent capable of substituting for a hydrogen atom on a benzene ring; $m_{21}$ represents an integer of 0 to 3; and $L_{21}$ represents a leaving group. $R_{N21}$, $R_{13}$, $R_{14}$, $X_{21}$ and $ED_{21}$ may bond to each other to form a ring structure. In general formula (3), $R_{32}$, $R_{33}$, $R_{31}$, $R_{N31}$, $R_a$ and $R_b$ each represents a hydrogen atom or a substituent; and $L_{31}$ represents a leaving group. Incidentally, $R_a$ and $R_b$ bond together to form an aromatic ring when $R_{N31}$ is not an aryl group.

After the compound is one-electron-oxidized, the leaving group of $L_1$, $L_{21}$ or $L_{31}$ is spontaneously eliminated in the bond cleavage reaction. Further two or more, preferably three or more electrons can be released with the bond cleavage reaction.

First, the compound represented by general formula (A) will be described in detail below.

In general formula (A), the reducing group of $RED_{11}$ can be one-electron-oxidized and can bond to after-mentioned $R_{111}$ to form the particular ring structure. Specifically, the reducing group may be a divalent group provided by removing one hydrogen atom from the following monovalent group at a position suitable for ring formation.

The monovalent group may be an alkylamino group; an arylamino group such as an anilino group and a naphthylamino group; a heterocyclic amino group such as a benzthiazolylamino group and a pyrrolylamino group; an alkylthio group; an arylthio group such as a phenylthio group; a heterocyclic thio group; an alkoxy group; an aryloxy group such as a phenoxy group; a heterocyclic oxy group; an aryl group such as a phenyl group, a naphthyl group and an anthranil group; or an aromatic or nonaromatic heterocyclic group, containing at least one heteroatom selected from the group consisting of a nitrogen atom, a sulfur atom, an oxygen atom and a selenium atom, which has a 5- to 7-membered, monocyclic or condensed ring structure such as a tetrahydroquinoline ring, a tetrahydroisoquinoline ring, a tetrahydroquinoxaline ring, a tetrahydroquinazoline ring, an indoline ring, an indole ring, an indazole ring, a carbazole ring, a phenoxazine ring, a phenothiazine ring, a benzothiazoline ring, a pyrrole ring, an imidazole ring, a thiazoline ring, a piperidine ring, a pyrrolidine ring, a morpholine ring, a benzimidazole ring, a benzimidazoline ring, a benzoxazoline ring and a methylenedioxyphenyl ring. $RED_{11}$ is hereinafter described as the monovalent group for convenience. The monovalent groups may have a substituent.

Examples of the substituent include halogen atoms; alkyl groups including aralkyl groups, cycloalkyl groups, active methine groups, etc.; alkenyl groups; alkynyl groups; aryl groups; heterocyclic groups, which may bond at any position; heterocyclic groups containing a quaternary nitrogen atom such as a pyridinio group, an imidazolio group, a quinolinio group and an isoquinolinio group; acyl groups; alkoxycarbonyl groups; aryloxycarbonyl groups; carbamoyl groups; a carboxy group and salts thereof; sulfonylcarbamoyl groups; acylcarbamoyl groups; sulfamoylcarbamoyl groups; carbazoyl groups; oxalyl groups; oxamoyl groups; a cyano group; carbonimidoyl groups; thiocarbamoyl groups; a hydroxy group; alkoxy groups, which may contain a plurality of ethyleneoxy groups or propyleneoxy groups as a repetition unit; aryloxy groups; heterocyclic oxy groups; acyloxy groups; alkoxy or aryloxy carbonyloxy groups; carbamoyloxy groups; sulfonyloxy groups; amino groups; alkyl, aryl or heterocyclic amino groups; acylamino groups; sulfoneamide groups; ureide groups; thioureide groups; imide groups; alkoxy or aryloxy carbonylamino groups; sulfamoylamino groups; semicarbazide groups; thiosemicarbazide groups; hydrazino groups; ammonio groups; oxamoylamino groups; alkyl or aryl sulfonylureide groups; acylureide groups; acylsulfamoylamino groups; a nitro group; a mercapto group; alkyl, aryl or heterocyclic thio groups;

alkyl or aryl sulfonyl groups; alkyl or aryl sulfinyl groups; a sulfo group and salts thereof; sulfamoyl groups; acylsulfamoyl groups; sulfonylsulfamoyl groups and salts thereof; groups containing a phosphoric amide or phosphate ester structure; etc. These substituents may be further substituted by these substituents.

$RED_{11}$ is preferably an alkylamino group, an arylamino group, a heterocyclic amino group, an aryl group, an aromatic heterocyclic group, or nonaromatic heterocyclic group. $RED_{11}$ is more preferably an arylamino group (particularly an anilino group), or an aryl group (particularly a phenyl group). When $RED_{11}$ has a substituent, preferred as a substituent include halogen atoms, alkyl groups, alkoxy groups, carbamoyl groups, sulfamoyl groups, acylamino groups, sulfoneamide groups. When $RED_{11}$ is an aryl group, it is preferred that the aryl group has at least one "electron-donating group". The "electron-donating group" is a hydroxy group; an alkoxy group; a mercapto group; a sulfoneamide group; an acylamino group; an alkylamino group; an arylamino group; a heterocyclic amino group; an active methine group; an electron-excess, aromatic, heterocyclic group with a 5-membered monocyclic ring or a condensed-ring including at least one nitrogen atom in the ring such as an indolyl group, a pyrrolyl group, an imidazolyl group, a benzimidazolyl group, a thiazolyl group, a benzthiazolyl group and an indazolyl group; a nitrogen-containing, nonaromatic heterocyclic group that substitutes at the nitrogen atom, such as so-called cyclic amino group like pyrrolidinyl group, an indolinyl group, a piperidinyl group, a piperazinyl group and a morpholino group; etc.

The active methine group is a methine group having two "electron-withdrawing groups", and the "electron-withdrawing group" is an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group or a carbonimidoyl group. The two electron-withdrawing groups may bond together to form a ring structure.

In general formula (A), specific examples of $L_{11}$ include a carboxy group and salts thereof, silyl groups, a hydrogen atom, triarylboron anions, trialkylstannyl groups, trialkylgermyl groups and a $—CR_{C1}R_{C2}R_{C3}$ group. When $L_{11}$ represents a silyl group, the silyl group is specifically a trialkylsilyl group, an aryldialkylsilyl group, a triarylsilyl group, etc, and they may have a substituent.

When $L_{11}$ represents a salt of a carboxy group, specific examples of a counter ion to form the salt include alkaline metal ions, alkaline earth metal ions, heavy metal ions, ammonium ions, phosphonium ions, etc. Preferred as a counter ion are alkaline metal ions and ammonium ions, most preferred are alkaline metal ions such as $Li^+$, $Na^+$ and $K^+$.

When $L_{11}$ represents a $—CR_{C1}R_{C2}R_{C3}$ group, $R_{C1}$, $R_{C2}$ and $R_{C3}$ independently represent a hydrogen atom, an alkyl group, an aryl group, a heterocyclic group, an alkylthio group, an arylthio group, an alkylamino group, an arylamino group, a heterocyclic amino group, an alkoxy group, an aryloxy group or a hydroxy group. $R_{C1}$, $R_{C2}$ and $R_{C3}$ may bond to each other to form a ring structure, and may have a substituent. Incidentally, when one of $R_{C1}$, $R_{C2}$ and $R_{C3}$ is a hydrogen atom or an alkyl group, there is no case where the other two of them are a hydrogen atom or an alkyl group. $R_{C1}$, $R_{C2}$ and $R_{C3}$ are preferably an alkyl group, an aryl group (particularly a phenyl group), an alkylthio group, an arylthio group, an alkylamino group, an arylamino group, a heterocyclic group, an alkoxy group or a hydroxy group, respectively. Specific examples thereof include a phenyl group, a p-dimethylaminophenyl group, a p-methoxyphenyl group, a 2,4-dimethoxyphenyl group, a p-hydroxyphenyl group, a methylthio group, a phenylthio group, a phenoxy group, a methoxy group, an ethoxy group, a dimethylamino group, an N-methylanilino group, a diphenylamino group, a morpholino group, a thiomorpholino group, a hydroxy group, etc. Examples of the ring structure formed by $R_{C1}$, $R_{C2}$ and $R_{C3}$ include a 1,3-dithiolane-2-yl group, a 1,3-dithiane-2-yl group, an N-methyl-1,3-thiazolidine-2-yl group, an N-benzyl-benzothiazolidine-2-yl group, etc.

It is also preferred that the $—CR_{C1}R_{C2}R_{C3}$ group is the same as a residue provided by removing $L_{11}$ from general formula (A) as a result of selecting each of $R_{C1}$, $R_{C2}$ and $R_{C3}$ as above.

In general formula (A), $L_{11}$ is preferably a carboxy group or a salt thereof, or a hydrogen atom, more preferably a carboxy group or a salt thereof.

When $L_{11}$ represents a hydrogen atom, the compound represented by general formula (A) preferably has a base moiety. After the compound represented by general formula (A) is oxidized, the base moiety acts to eliminate the hydrogen atom of $L_{11}$ and to release an electron.

The base is specifically a conjugate base of an acid with a pKa value of approximately 1 to 10. For example, the base moiety may contain a structure of a nitrogen-containing heterocycle such as pyridine, imidazole, benzoimidazole and thiazole; aniline; trialkylamine; an amino group; a carbon acid such as an active methylene anion; a thioacetic acid anion; carboxylate ($—COO^-$); sulfate ($—SO_3^-$); amineoxide ($>N^+(O^-)—$); and derivatives thereof. The base is preferably a conjugate base of an acid with a pKa value of approximately 1 to 8, more preferably carboxylate, sulfate or amineoxide, particularly preferably carboxylate. When these bases have an anion, the compound of general formula (A) may have a counter cation. Examples of the counter cation include alkaline metal ions, alkaline earth metal ions, heavy metal ions, ammonium ions, phosphonium ions, etc. The base moiety may be at an optional position of the compound represented by general formula (A). The base moiety may be connected to $RED_{11}$, $R_{111}$ or $R_{112}$ in general formula (A), and to a substituent thereon.

In general formula (A), $R_{112}$ represents a substituent capable of substituting a hydrogen atom or a carbon atom therewith, provided that $R_{112}$ and $L_{11}$ do not represent the same group.

$R_{112}$ preferably represents a hydrogen atom, an alkyl group, an aryl group (such as a phenyl group), an alkoxy group (such as a methoxy group, a ethoxy group, a benzyloxy group), a hydroxy group, an alkylthio group, (such as a methylthio group, a butylthio group), and amino group, an alkylamino group, an arylamino group, a heterocyclic amino group or the like; and more preferably represents a hydrogen atom, an alkyl group, an alkoxy group, a hydroxy group, a phenyl group and an alkylamino group.

Ring structures formed by $R_{111}$ in general formula (A) are ring structures corresponding to a tetrahydro structure, a hexahydro structure, or an octahydro structure of a five-membered or six-membered aromatic ring (including an aromatic hetro ring), wherein a hydro structure means a ring structure in which partial hydrogenation is performed on a carbon-carbon double bond (or a carbon-nitrogen double bond) contained in an aromatic ring (an aromatic hetero ring) as a part thereof, wherein the tetrahydro structure is a structure in which 2 carbon-carbon double bonds (or carbon-nitrogen double bonds) are hydrogenated, the hexahydro structure is a structure in which 3 carbon-carbon double bonds (or carbon-nitrogen double bonds) are hydrogenated, and the octahydro structure is a structure in which 4 carbon-carbon double bonds (or carbon-nitrogen double bonds) are hydrogenated. Hydrogenation of an aromatic ring produces a partially hydrogenated non-aromatic ring structure.

Examples include a pyrrolidine ring, an imidazolidine ring, a thiazolidine ring, a pyrazolidine ring, an oxazolidine ring, a piperidine ring, a tetrahydropyridine ring, a tetrahydropyrimidine ring, a piperazine ring, a tetralin ring, a tetrahydroquinoline ring, a tetrahydroisoquinoline ring, a tetrahydroquinazoline ring and a tetrahydroquinoxaline ring, a tetrahydrocarbazole ring, an octahydrophenanthridine ring and the like. The ring structures may have any substituent therein.

More preferable examples of a ring structure forming $R_{111}$ include a pyrrolidine ring, an imidazolidine ring, a piperidine ring, a tetrahydropyridine ring, a tetrahydropyrimidine ring, a piperazine ring, a tetrahydroquinoline ring, a tetrahydroisoquinoline ring, a tetrahydroquinazoline ring, a tetrahydroquinoxaline ring and a tetracarbazole ring. Particularly preferable examples include a pyrrolidine ring, a piperidine ring, a piperazine ring, a tetrahydropyridine ring, a tetrahydroquinoline ring, a tetrahydroisoquinoline ring, a tetrahydroquinazoline ring and a tetrahydroquinoxaline ring; and most preferable examples include a pyrrolidine ring, a piperidine ring, a tetrahydropyridine ring, a tetrahydroquinoline ring and a tetrahydroisoquinoline ring.

In general formula (B), $RED_{12}$ and $L_{12}$ represent groups having the respective same meanings as $RED_{11}$ and $L_{11}$ in general formula (A), and have the respective same preferable ranges as $RED_{11}$ and $L_{11}$ in general formula (A). $RED_{12}$ is a monovalent group except a case where $RED_{12}$ forms the following ring structure and to be concrete, there are exemplified groups each with a name of a monovalent group described as $RED_{11}$. $RED_{121}$ and $L_{122}$ represent groups having the same meaning as $R_{112}$ in general formula (A), and have the same preferable range as $R_{112}$ in general formula (A). $ED_{12}$ represents an electron-donating group. Each pair of $R_{121}$ and $RED_{12}$; $R_{121}$ and $R_{122}$; or $ED_{12}$ and $RED_{12}$ may form a ring structure by bonding with each other.

An electron-donating group represented by $RED_{12}$ in general formula (B) is the same as an electron-donating group described as a substituent when $RED_{11}$ represents an aryl group. Preferable examples of $RED_{12}$ include a hydroxy group, an alkoxy group, a mercapto group, a sulfonamide group, an alkylamino group, an arylamino group, an active methine group, an electron-excessive aromatic heterocyclic group in a five-membered single ring or fused ring structure containing at least one nitrogen atom in a ring structure as part of the ring, a non-aromatic nitrogen containing hetrocyclic group having a nitrogen atom as a substitute, and a phenyl group substituted with an electron donating group described above, and more preferable examples thereof include a non-aromatic nitrogen containing heterocyclic group further substituted with a hydroxy group, a mercapto group, a sulfonamide group, an alkylamino group, an arylamino group, an active methine group, or a nitrogen atom; and a phenyl group substituted with an electron-donating group described above (for example, a p-hydroxyphenyl group, a p-dialkylaminophenyl group, an o- or p-dialkoxyphenyl group and the like).

In general formula (B), $R_{121}$ and $RED_{12}$; $R_{122}$ and $R_{121}$; or $ED_{12}$ and $RED_{12}$ may bond to each other to form a ring structure. A ring structure formed here is a non-aromatic carbon ring or hetero ring in a 5- to 7-membered single ring or fused ring structure which is substituted or unsubstituted. Concrete examples of a ring structure formed from $R_{121}$ and $RED_{12}$ include, in addition to the examples of the ring structure formed by $R_{111}$ in general formula (A), a pyrroline ring, an imidazoline ring, a thiazoline ring, a pyrazoline ring, an oxazoline ring, an indan ring, a morphorine ring, an indoline ring, a tetrahydro-1,4-oxazine ring, 2,3-dihydrobenzo-1,4-oxazine ring, a tetrahydro-1,4-thiazine ring, 2,3-dihydrobenzo-1,4-thiazine ring, 2,3-dihydrobenzofuran ring, 2,3-dihydrobenzothiophene ring and the like. In formation of a ring structure from $ED_{12}$ and $RED_{12}$, $ED_{12}$ is preferably an amino group, an alkylamino group or an arylamino group and concrete examples of the ring structure include a tetrahyropyrazine ring, a piperazine ring, a tetrahydroquinoxaline ring, a tetrahydroisoquinoline ring and the like. Concrete examples of a ring structure formed from $R_{122}$ and $R_{121}$ include a cyclohexane ring, a cyclopentane ring and the like.

Below, description will be given of general formulae (1) to (3).

In general formulae (1) to (3), $R_1$, $R_2$, $R_{11}$, $R_{12}$ and $R_{31}$ represent the same meaning as $R_{112}$ of general formula (A) and have the same preferable range as $R_{112}$ of general formula (A). $L_1$, $L_{21}$ and $L_{31}$ independently represents the same leaving groups as the groups shown as concrete examples in description of $L_{11}$ of general formula (A) and also have the same preferable range as $L_{11}$ of general formula (A). The substituents represented by $X_1$ and $X_{21}$ are the same as the examples of substituents of $RED_{11}$ of general formula (A) and have the same preferable range as $RED_{11}$ of general formula (A). $m_1$ and $m_2$ are preferably integers from 0 to 2 and more preferably integers of 0 or 1.

When $R_{N1}$, $R_{N21}$ and $R_{N31}$ each represents a substituent, preferred as a substituent include an alkyl group, an aryl group or a heterocyclic group, and may further have a substituent. Each of $R_{N1}$, $R_{N21}$ and $R_{N31}$ is preferably a hydrogen atom, an alkyl group or an aryl group, more preferably a hydrogen atom or an alkyl group.

When $R_{13}$, $R_{14}$, $R_{32}$, $R_{33}$, $R_a$ and $R_b$ independently represent a substituent, the substituent is preferably an alkyl group, an aryl group, an acyl group, an alkoxycarbonyl group, a carbamoyl group, a cyano group, an alkoxy group, an acylamino group, a sulfoneamide group, a ureide group, a thiouredide group, an alkylthio group, an arylthio group, an alkylsulfonyl group, an arylsulfonyl group, or a sulfamoyl group.

The 6-membered ring formed by $Z_1$ in general formula (1) is a nonaromatic heterocycle condensed with the benzene ring in general formula (1). The ring structure containing the nonaromatic heterocycle and the benzene ring to be condensed may be specifically a tetrahydroquinoline ring, a tetrahydroquinoxaline ring, or a tetrahydroquinazoline ring, which may have a substituent.

In general formula (2), $ED_{21}$ is the same as $ED_{12}$ in general formula (B) with respect to the meanings and preferred embodiments.

In general formula (2), any two of $R_{N21}$, $R_{13}$, $R_{14}$, $X_{21}$ and $ED_{21}$ may bond together to form a ring structure. The ring structure formed by $R_{N21}$ and $X_{21}$ is preferably a 5- to 7-membered, carbocyclic or heterocyclic, nonaromatic ring structure condensed with a benzene ring, and specific examples thereof include a tetrahydroquinoline ring, a tetrahydroquinoxaline ring, an indoline ring, a 2,3-dihydro-5,6-benzo-1,4-thiazine ring, etc. Preferred are a tetrahydroquinoline ring, a tetrahydroquinoxaline ring and an indoline ring.

When $R_{N31}$ is a group other than an aryl group in general formula (3), $R_a$ and $R_b$ bond together to form an aromatic ring. The aromatic ring is an aryl group such as a phenyl group and a naphthyl group, or an aromatic heterocyclic group such as a pyridine ring group, a pyrrole ring group, a quinoline ring group and an indole ring group, preferably an aryl group. The aromatic ring group may have a substituent.

In general formula (3), $R_a$ and $R_b$ preferably bond together to form an aromatic ring, particularly a phenyl group.

In general formula (3), $R_{32}$ is preferably a hydrogen atom, an alkyl group, an aryl group, a hydroxy group, an alkoxy group, a mercapto group or an amino group. When $R_{32}$ is a hydroxy group, $R_{33}$ is preferably an electron-withdrawing group. The electron-withdrawing group is the same as described above, preferably an acyl group, an alkoxycarbonyl group, a carbamoyl group or a cyano group.

The compound of Type 2 will be described below.

According to the compound of Type 2, the "bond cleavage reaction" is a cleavage reaction of a bond of carbon-carbon, carbon-silicon, carbon-hydrogen, carbon-boron, carbon-tin or carbon-germanium. Cleavage of a carbon-hydrogen bond may be caused with the cleavage reaction.

The compound of Type 2 has two or more, preferably 2 to 6, more preferably 2 to 4, adsorbent groups to the silver halide. The adsorbable group is further preferably a mercapto-substituted, nitrogen-containing, heterocyclic group. The number of the adsorbent groups is preferably 2 to 6, more preferably 2 to 4. The adsorbable group will hereinafter be described.

The compound of Type 2 is preferably represented by the following general formula (C).

General formula (C)

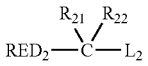

In the compound represented by general formula (C), the reducing group of $RED_2$ is one-electron-oxidized, and thereafter the leaving group of $L_2$ is spontaneously eliminated, thus a C (carbon atom)—$L_2$ bond is cleaved, in the bond cleavage reaction. Further one electron can be released with the bond cleavage reaction.

In general formula (C), $RED_2$ is the same as $RED_{12}$ in general formula (B) with respect to the meanings and preferred embodiments. $L_2$ is the same as $L_{11}$ in general formula (A) with respect to the meanings and preferred embodiments. Incidentally, when $L_2$ is a silyl group, the compound of general formula (C) has two or more mercapto-substituted, nitrogen-containing, heterocyclic groups as the adsorbent groups. $R_{21}$ and $R_{22}$ each represent a hydrogen atom or a substituent, and are the same as $R_{112}$ in general formula (A) with respect to the meanings and preferred embodiments. $RED_2$ and $R_{21}$ may bond together to form a ring structure.

The ring structure is a 5- to 7-membered, monocyclic or condensed, carbocyclic or heterocyclic, nonaromatic ring, and may have a substituent. Incidentally, there is no case where the ring structure corresponds to a tetrahydro-, hexahydro- or octahydro-derivative of an aromatic ring or an aromatic heterocycle. The ring structure is preferably such that corresponds to a dihydro-derivative of an aromatic ring or an aromatic heterocycle, and specific examples thereof include a 2-pyrroline ring, a 2-imidazoline ring, a 2-thiazoline ring, a 1,2-dihydropyridine ring, a 1,4-dihydropyridine ring, an indoline ring, a benzoimidazoline ring, a benzothiazoline ring, a benzoxazoline ring, a 2,3-dihydrobenzothiophene ring, a 2,3-dihydrobenzofuran ring, a benzo-α-pyran ring, a 1,2-dihydroquinoline ring, a 1,2-dihydroquinazoline ring, a 1,2-dihydroquinoxaline ring, etc. Preferred are a 2-imidazoline ring, a 2-thiazoline ring, an indoline ring, a benzoimidazoline ring, a benzothiazoline ring, a benzoxazoline ring, a 1,2-dihydro pyridine ring, a 1,2-dihydroquinoline ring, a 1,2-dihydroquinazoline ring and a 1,2-dihydroquinoxaline ring, more preferred are an indoline ring, a benzoimidazoline ring, a benzothiazoline ring and a 1,2-dihydroquinoline ring, particularly preferred is an indoline ring.

The compound of Type 3 will be described below.

According to the compound of Type 3, "bond formation" means that a bond of carbon-carbon, carbon-nitrogen, carbon-sulfur, carbon-oxygen, etc. is formed.

It is preferable that the one-electron oxidation product releases one or more electrons after an intramolecular bond-forming reaction between the one-electron-oxidized portion and a reactive site in the same molecular such as a carbon-carbon double bond, a carbon-carbon triple bond, an aromatic group and a benzo-condensed, nonaromatic heterocyclic group.

To be more detailed, a one-electron oxidized product (a cation radical species or a neutral radical species generated by elimination of a proton therefrom) formed by one electron oxidizing a compound of type 3 reacts with a reactive group described above coexisting in the same molecule to form a bond and form a radical species having a new ring structure therein. The radical species have a feature to release a second electron directly or in company with elimination of a proton therefrom. One of compounds of type 3 has a chance to further release one or more electrons, in a ordinary case two or more electrons, after formation of a two-electron oxidized product, after receiving a hydrolysis reaction in one case or after causing a tautomerization reaction accompanying direct migration of a proton in another case. Alternatively, compounds of type 3 also include a compound having an ability to further release one or more electron, in an ordinary case two or more electrons directly from a two-electron oxidized product, not by way of a tautomerization reaction.

The compound of Type 3 is preferably represented by the following general formula (D).

General formula (D)

In general formula (D), $RED_3$ represents a reducing group that can be one-electron-oxidized, and $Y_3$ represents a reactive group that reacts with the one-electron-oxidized $RED_3$, specifically an organic group containing a carbon-carbon double bond, a carbon-carbon triple bond, an aromatic group or a benzo-condensed, nonaromatic heterocyclic group. $L_3$ represents a linking group that connects $RED_3$ and $Y_3$.

In general formula (D), $RED_3$ has the same meanings as $RED_{12}$ in general formula (B). In general formula (D), $RED_3$ is preferably an arylamino group, a heterocyclic amino group, an aryloxy group, an arylthio group, an aryl group, or an aromatic or nonaromatic heterocyclic group that is preferably a nitrogen-containing heterocyclic group. $RED_3$ is more preferably an arylamino group, a heterocyclic amino group, an aryl group, or an aromatic or nonaromatic heterocyclic group. Preferred as the heterocyclic group are a tetrahydroquinoline ring group, a tetrahydroquinoxaline ring group, a tetrahydroquinazoline ring group, an indoline ring group, an indole ring group, a carbazole ring group, a phenoxazine ring group, a phenothiazine ring group, a benzothiazoline ring group, a pyrrole ring group, an imidazole ring group, a thiazole ring group, a benzoimidazole ring group, a benzoimidazoline ring group, a benzothiazoline ring group, a 3,4-methylenedioxyphenyl-1-yl group, etc.

Particularly preferred as $RED_3$ are an arylamino group (particularly an anilino group), an aryl group (particularly a phenyl group), and an aromatic or nonaromatic heterocyclic group.

The aryl group represented by $RED_3$ preferably has at least one electron-donating group. The term "electron-donating group" means the same as above-mentioned electron-donating group.

When $RED_3$ is an aryl group, more preferred as a substituent on the aryl group are an alkylamino group, a hydroxy group, an alkoxy group, a mercapto group, a sulfoneamide group, an active methine group, and a nitrogen-containing, nonaromatic heterocyclic group that substitutes at the nitrogen atom, furthermore preferred are an alkylamino group, a hydroxy group, an active methine group, and a nitrogen-containing, nonaromatic heterocyclic group that substitutes at the nitrogen atom, and the most preferred are an alkylamino group, and a nitrogen-containing, nonaromatic heterocyclic group that substitutes at the nitrogen atom.

When $Y_3$ is an organic group containing carbon-carbon double bond (for example a vinyl group) having a substituent, more preferred as the substituent are an alkyl group, a phenyl group, an acyl group, a cyano group, an alkoxycarbonyl group, a carbamoyl group and an electron-donating group. The electron-donating group is preferably an alkoxy group; a hydroxy group (that may be protected by a silyl group, and examples of the silyl-protected group include a trimethylsilyloxy group, a silyl-protected t-butyldimethylsilyloxy group, a triphenylsilyloxy group, a triethylsilyloxy group, a phenyldimethylsilyloxy group, etc); an amino group; an alkylamino group; an arylamino group; a sulfoneamide group; an active methine group; a mercapto group; an alkylthio group; or a phenyl group having the electron-donating group as a substituent.

Incidentally, when the organic group containing the carbon-carbon double bond has a hydroxy group as a substituent, $Y_3$ contains a moiety of $>C_1{=}C_2(-OH)-$, which may be tautomerized into a moiety of $>C_1H-C_2(=O)-$. In this case, it is preferred that a substituent on the $C_1$ carbon is an electron-withdrawing group, and as a result, $Y_3$ has a moiety of an active methylene group or an active methine group. The electron-withdrawing group, which can provide such a moiety of an "active methylene group" or an "active methine group", may be the same as above-mentioned electron-withdrawing group on the methine group of the "active methine group".

When $Y_3$ is an organic group containing a carbon-carbon triple bond (for example a ethynyl group) having a substituent, preferred as the substituent is an alkyl group, a phenyl group, an alkoxycarbonyl group, a carbamoyl group, an electron-donating group, etc.

When $Y_3$ is an organic group containing an aromatic group, preferred as the aromatic group are an aryl group, particularly a phenyl group, having an electron-donating group as a substituent, and an indole ring group. The electron-donating group is preferably a hydroxy group, which may be protected by a silyl group; an alkoxy group; an amino group; an alkylamino group; an active methine group; a sulfoneamide group; or a mercapto group.

When $Y_3$ is an organic group containing a benzo-condensed, nonaromatic heterocyclic group, preferred as the benzo-condensed, nonaromatic heterocyclic group are groups having an aniline moiety, such as an indoline ring group, a 1,2,3,4-tetrahydroquinoline ring group, a 1,2,3,4-tetrahydroquinoxaline ring group and a 4-quinolone ring group.

The reactive group of $Y_3$ is more preferably an organic group containing a carbon-carbon double bond, an aromatic group, or a benzo-condensed, nonaromatic heterocyclic group. Furthermore preferred are an organic group containing a carbon-carbon double bond; a phenyl group having an electron-donating group as a substituent; an indole ring group; and a benzo-condensed, nonaromatic heterocyclic group having an aniline moiety. The carbon-carbon double bond more preferably has at least one electron-donating group as a substituent.

It is also preferred that the reactive group represented by $Y_3$ contains a moiety the same as the reducing group represented by $RED_3$ as a result of selecting the reactive group as above.

$L_3$ represents a linking group that connects $RED_3$ and $Y_3$, specifically a single bond, an alkylene group, an arylene group, a heterocyclic group, —O—, —S—, —$NR_N$—, —C(=O)—, —$SO_2$—, —SO—, —P(=O)—, or a combination thereof. $R_N$ represents a hydrogen atom, an alkyl group, an aryl group or a heterocyclic group. The linking group represented by $L_3$ may have a substituent. The linking group represented by $L_3$ may bond to each of $RED_3$ and $Y_3$ at an optional position such that the linking group substitutes optional one hydrogen atom of each $RED_3$ and $Y_3$. Preferred examples of $L_3$ include a single bond; alkylene groups, particularly a methylene group, an ethylene group or a propylene group; arylene groups, particularly a phenylene group; a —C(=O)— group; a —O— group; a —NH— group; —N(alkyl)-groups; and divalent linking groups of combinations thereof.

When a cation radical ($X^+$.) provided by oxidizing $RED_3$ or a radical (X.) provided by eliminating a proton therefrom reacts with the reactive group represented by $Y_3$ to form a bond, it is preferable that they form a 3 to 7-membered ring structure containing the linking group represented by $L_3$. Thus, the radical ($X^+$. or X.) and the reactive group of Y are preferably connected though 3 to 7 atoms.

Next, the compound of Type 4 will be described below.

The compound of Type 4 has a reducing group-substituted ring structure. After the reducing group is one-electron-oxidized, the compound can release further one or more electrons with a ring structure cleavage reaction. The ring cleavage reaction proceeds as follows.

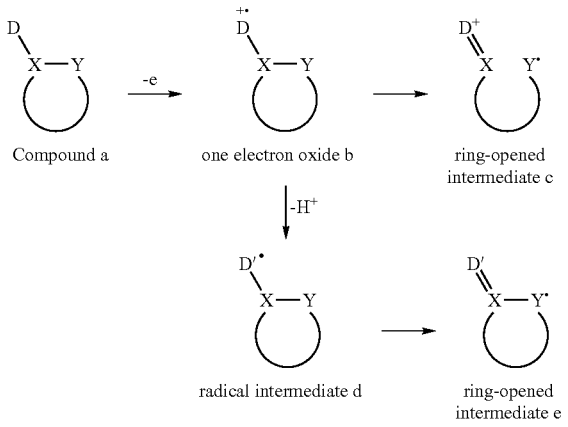

In the formula, compound a is the compound of Type 4. In compound a, D represents a reducing group, and X and Y each represent an atom forming a bond in the ring structure, which is cleaved after the one-electron oxidation. First, compound a is one-electron-oxidized to generate one-electron oxidation product b. Then, the X—Y bond is cleaved with conversion of the D-X single bond into a double bond, whereby ring-opened intermediate c is provided. Alternatively, there is a case where one-electron oxidation product b is converted into radical intermediate d with deprotonation, and ring-opened intermediate e is provided in the same manner. Subsequently, further one or more electrons are released form thus-provided ring-opened intermediate c or e.

The ring structure in the compound of Type 4 is a 3 to 7-membered, carbocyclic or heterocyclic, monocyclic or condensed, saturated or unsaturated, nonaromatic ring. The ring structure is preferably a saturated ring structure, more preferably 3- or 4-membered ring. Preferred examples of the ring structure include a cyclopropane ring, a cyclobutane ring, an oxirane ring, an oxetane ring, an aziridine ring, an azetidine ring, an episulphide ring and a thietane ring. More preferred are a cyclopropane ring, a cyclobutane ring, an oxirane ring, an oxetane ring and an azetidine ring, particularly preferred are a cyclopropane ring, a cyclobutane ring and an azetidine ring. The ring structure may have a substituent.

The compound of Type 4 is preferably represented by the following general formula (E) or (F).

General formula (E)

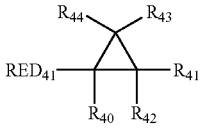

General formula (F)

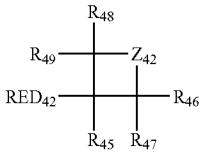

In general formulae (E) and (F), $RED_{41}$ and $RED_{42}$ are the same as $RED_{12}$ in general formula (B) with respect to the meanings and preferred embodiments, respectively. $R_{40}$ to $R_{44}$ and $R_{45}$ to $R_{49}$ each represents a hydrogen atom or a substituent. In general formula (F), $Z_{42}$ represents $—CR_{420}R_{421}—$, $—NR_{423}—$, or —O—. $R_{420}$ and $R_{421}$ each represents a hydrogen atom or a substituent, and $R_{423}$ represents a hydrogen atom, an alkyl group, an aryl group or a heterocyclic group.

In general formulae (E) and (F), each of $R_{40}$ and $R_{45}$ is preferably a hydrogen atom, an alkyl group or an aryl group, more preferably a hydrogen atom, an alkyl group or an aryl group. Each of $R_{41}$ to $R_{44}$ and $R_{46}$ to $R_{49}$ is preferably a hydrogen atom, an alkyl group, an alkenyl group, an aryl group, a heterocyclic group, an arylthio group, an alkylthio group, an acylamino group or a sulfoneamide group, more preferably a hydrogen atom, an alkyl group, an aryl group or a heterocyclic group, It is preferred that at least one of $R_{41}$ to $R_{44}$ is a donor group, and it is also preferred that both of $R_{41}$ and $R_{42}$, or both of $R_{43}$ and $R_{44}$ are an electron-withdrawing group. It is more preferred that at least one of $R_{41}$ to $R_{44}$ is a donor group. It is furthermore preferred that at least one of $R_{41}$ to $R_{44}$ is a donor group and $R_{41}$ to $R_{44}$ other than the donor group are selected from a hydrogen atom and an alkyl group.

A donor group referred to here is an "electron-donating group" or an aryl group substituted with at least one "electron-donating group." Preferable examples of donor groups include an alkylamino group, an arylamino group, a heterocyclicamino group, an electron-excessive aromatic heterocyclic group in a five-membered single ring or fused ring structure containing at least one nitrogen atom in a ring structure as part of the ring, a non-aromatic nitrogen containing hetrocyclic group having a nitrogen atom as a substitute and a phenyl group substituted with at least one electron-donating group. More preferable examples thereof include an alkylamino group, an aryamino group, an electron excessive aromatic heterocyclic group in a five-membered single ring or fused ring containing at least one nitrogen atom in a ring structure as a part (an indol ring, a pyrrole ring, a carbazole ring and the like), and a phenyl group substituted with an electron-donating group (a phenyl group substituted with three or more alkoxy groups, a phenyl group substituted with a hydroxy group, an alkylamino group, or an arylamino group and the like). Particularly preferable examples thereof include an aryamino group, an electron excessive aromatic heterocyclic group in a five-membered single ring or fused ring containing at least one nitrogen atom in a ring structure as a part (especially, a 3-indolyl group), and a phenyl group substituted with an electron-donating group (especially, a trialkoxyphenyl group and a phenyl group substituted with an alkylamino group or an arylamino group).

$Z_{42}$ is preferably $—CR_{420}R_{421}—$ or $—NR_{423}—$, more preferably $—NR_{423}—$. Each of $R_{420}$ and $R_{421}$ is preferably a hydrogen atom, an alkyl group, an aryl group, a heterocyclic group, an acylamino group or a sulfoneamino group, more preferably a hydrogen atom, an alkyl group, an aryl group or a heterocyclic group. $R_{423}$ is preferably a hydrogen atom, an alkyl group, an aryl group or an aromatic heterocyclic group, more preferably a hydrogen atom, an alkyl group or an aryl group.

The substituent represented by each of $R_{40}$ to $R_{49}$, $R_{420}$, $R_{421}$, and $R_{423}$ preferably has 40 or less carbon atoms, more preferably has 30 or less carbon atoms, particularly preferably 15 or less carbon atoms. The substituents of $R_{40}$ to $R_{49}$, $R_{420}$, $R_{421}$ and $R_{423}$ may bond to each other or to the other portion such as $RED_{41}$, $RED_{42}$ and $Z_{42}$, to form a ring.

In the compounds of Types 1 to 4 used in the invention, the adsorbable group to the silver halide is such a group that is directly adsorbed on the silver halide or promotes adsorption of the compound onto the silver halide. Specifically, the adsorbable group is a mercapto group or a salt thereof; a thione group (—C(═S)—); a heterocyclic group containing at least one atom selected from the group consisting of a nitrogen atom, a sulfur atom, a selenium atom and a tellurium atom; a sulfide group; a cationic group; or an ethynyl group. Incidentally, the adsorbable group in the compound of Type 2 is not a sulfide group.

The mercapto group or a salt thereof used as the adsorbable group may be a mercapto group or a salt thereof itself, and is more preferably a heterocyclic group, an aryl group or an alkyl group having a mercapto group or a salt thereof as a substituent. The heterocyclic group is a 5- to 7-membered, monocyclic or condensed, aromatic or nonaromatic, heterocyclic group. EXAMPLEs thereof include an imidazole ring group, a thiazole ring group, an oxazole ring group, a benzimidazole ring group, a benzthiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, a triazine ring group, etc. The heterocyclic group may contain a quaternary nitrogen atom, and in this case, the mercapto group bonding to the heterocyclic group may be dissociated into a mesoion. Such heterocyclic group may be an imidazolium ring group, a pyrazolium ring group, a thiazolium ring group, a triazolium ring group, a tetrazolium ring group, a thiadiazolium ring group, a pyridinium ring group, a pyrimidinium ring group, a triazinium ring group, etc. Preferred among them is a triazolium ring group such as a 1,2,4-triazolium-3-thiolate ring group. Examples of the aryl group include a phenyl group and a naphthyl group. Examples of the alkyl group include straight, branched or cyclic alkyl groups having 1 to 30 carbon atom. When the mercapto group forms a salt, a counter ion of the salt may be a cation of an alkaline metal, an alkaline earth metal, a heavy metal, etc. such as $Li^+$, $Na^+$, $K^+$, $Mg^{2+}$, $Ag^+$ and $Zn^{2+}$; an ammonium ion; a heterocyclic group containing a quaternary nitrogen atom; a phosphonium ion; etc.

Further, the mercapto group used as the adsorbable group may be tautomerized into a thione group. Specific examples of the thione group include a thioamide group (herein a —C(═S)—NH— group); and groups containing a structure of the thioamide group, such as linear or cyclic thioamide groups, a thiouredide group, a thiourethane group and a dithiocarbamic acid ester group. Examples of the cyclic thioamide group include a thiazolidine-2-thione group, an oxazolidine-2-thione group, a 2-thiohydantoin group, a rhodanine group, an isorhodanine group, a thiobarbituric acid group, a 2-thioxo-oxazolidine-4-one group, etc.

The thione group used as the adsorbent group, as well as the thione group derived from the mercapto group by tautomerization, may be a linear or cyclic, thioamide, thiouredide, thiourethane or dithiocarbamic acid ester group that cannot be tautomerized into the mercapto group or has no hydrogen atom at α-position of the thione group.

The heterocyclic group containing at least one atom selected from the group consisting of a nitrogen atom, a sulfur atom, a selenium atom and tellurium atom, which is used as the adsorbent group, is a nitrogen-containing heterocyclic group having a —NH— group that can form a silver imide (>NAg) as a moiety of the heterocycle; or a heterocyclic group having a —S— group, a —Se— group, a —Te— group or a ═N— group that can form a coordinate bond with a silver ion as a moiety of the heterocycle. Examples of the former include a benzotriazole group, a triazole group, an indazole group, a pyrazole group, a tetrazole group, a benzimidazole group, an imidazole group, a purine group, etc. Examples of the latter include a thiophene group, a thiazole group, an oxazole group, a benzothiazole group, a benzoxazole group, a thiadiazole group, an oxadiazole group, a triazine group, a selenazole group, a benzselenazole group, a tellurazole group, a benztellurazole group, etc. The former is preferable.

The sulfide group used as the adsorbable group may be any group with a —S— moiety, and preferably has a moiety of: alkyl or alkylene-S-alkyl or alkylene; aryl or arylene-S-alkyl or alkylene; or aryl or arylene-S-aryl or arylene. The sulfide group may form a ring structure, and may be a —S—S— group. Specific examples of the ring structure include groups with a thiolane ring, a 1,3-dithiolane ring, a 1,2-dithiolane ring, a thiane ring, a dithiane ring, a tetrahydro-1,4-thiazine ring (a thiomorpholine ring), etc. Particularly preferred as the sulfide groups are groups having a moiety of alkyl or alkylene-S-alkyl or alkylene.

The cationic group used as the adsorbable group is a quaternary nitrogen-containing group, specifically a group with an ammonio group or a quaternary nitrogen-containing heterocyclic group. Incidentally, there is no case where the cationic group partly composes an atomic group forming a dye structure, such as a cyanine chromophoric group. The ammonio group may be a trialkylammonio group, a dialkylarylammonio group, an alkyldiarylammonio group, etc., and examples thereof include a benzyldimethylammonio group, a trihexylammonio group, a phenyldiethylammonio group, etc. Examples of the quaternary nitrogen-containing heterocyclic group include a pyridinio group, a quinolinio group, an isoquinolinio group, an imidazolio group, etc. Preferred are a pyridinio group and an imidazolio group, and particularly preferred is a pyridinio group. The quaternary nitrogen-containing heterocyclic group may have an optional substituent. Preferred as the substituent in the case of the pyridinio group and the imidazolio group are alkyl groups, aryl groups, acylamino groups, a chlorine atom, alkoxycarbonyl groups and carbamoyl groups. Particularly preferred as the substituent in the case of the pyridinio group is a phenyl group.

The ethynyl group used as the adsorbable group means a —C≡CH group, in which the hydrogen atom may be substituted.

The adsorbable group may have an optional substituent.

Specific examples of the adsorbable group further include groups described in pages 4 to 7 of a specification of JP-A No. 11-95355.

Preferred as the adsorbable group used in the invention are mercapto-substituted, nitrogen-containing, heterocyclic groups such as a 2-mercaptothiadiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzthiazole group and a 1,5-dimethyl-1,2,4-triazolium-3-thiolate group; and nitrogen-containing heterocyclic groups having a —NH— group that can form a silver imide (>NAg) as a moiety of the heterocycle, such as a benzotriazole group, a benzimidazole group and an indazole group. Particularly preferred are a 5-mercaptotetrazole group, a 3-mercapto-1,2,4-triazole group and a benzotriazole group, and the most preferred are a 3-mercapto-1,2,4-triazole group and a 5-mercaptotetrazole group.

Among these compounds, it is particularly preferred that the compound has two or more mercapto groups as a moiety. The mercapto group (—SH) may be converted into a thione group in the case where it can be tautomerized. The compound may have two or more adsorbent groups containing above-mentioned mercapto or thione group as a moiety, such as a cyclic thioamide group, an alkylmercapto group, an arylmercapto group and a heterocyclic mercapto group. Further, the compound may have one or more adsorbable group containing two or more mercapto or thione groups as a moiety, such as a dimercapto-substituted, nitrogen-containing, heterocyclic group.

Examples of the adsorbable group containing two or more mercapto group, such as a dimercapto-substituted, nitrogen-containing, heterocyclic group, include a 2,4-dimercaptopyrimidine group, a 2,4-dimercaptotriazine group, a 3,5-dimercapto-1,2,4-triazole group, a 2,5-dimercapto-1,3-thiazole group, a 2,5-dimercapto-1,3-oxazole group, a 2,7-dimercapto-5-methyl-s-triazolo(1,5-A)-pyrimidine group, a 2,6,8-trimercaptopurine group, a 6,8-dimercaptopurine group, a 3,5,7-trimercapto-s-triazolotriazine group, a 4,6-dimercaptopyrazolo pyrimidine group, a 2,5-dimercapto-imidazole group, etc. Particularly preferred are a 2,4-dimercaptopyrimidine group, a 2,4-dimercaptotriazine group, and a 3,5-dimercapto-1,2,4-triazole group.

The adsorbable group may be connected to any position of the compound represented by each of general formulae (A) to (F) and (1) to (3). Preferred portions, which the adsorbable group bonds to, are $RED_{11}$, $RED_{12}$, $RED_2$ and $RED_3$ in general formulae (A) to (D), $RED_{41}$, $R_{41}$, $RED_{42}$, and $R_{46}$ to $R_{48}$ in general formulae (E) and (F), and optional portions other than $R_1$, $R_2$, $R_{11}$, $R_{12}$, $R_{31}$, $L_1$, $L_{21}$ and $L_{31}$ in general formulae (1) to (3). Further, more preferred portions are $RED_{11}$ to $RED_{42}$ in general formulae (A) to (F).

The spectral sensitizing dye moiety is a group containing a spectral sensitizing dye chromophore, a residual group provided by removing an optional hydrogen atom or substituent from a spectral sensitizing dye compound. The spectral sensitizing dye moiety may be connected to any position of the compound represented by each of general formulae (A) to (F) and (1) to (3). Preferred portion, which the spectral sensitizing dye moiety bonds to, are $RED_{11}$, $RED_{12}$, $RED_2$ and $RED_3$ in general formulae (A) to (D), $RED_{41}$, $R_{41}$, $RED_{42}$, and $R_{46}$ to $R_{48}$ in general formulae (E) and (F), and optional portions other than $R_1$, $R_2$, $R_{11}$, $R_{12}$, $R_{31}$, $L_1$, $L_{21}$ and $L_{31}$ in general formulae (1) to (3). Further, more preferred portions are $RED_{11}$ to $RED_{42}$ in general formulae (A) to (F). The spectral sensitizing dye is preferably such that typically used in color sensitizing techniques. Examples thereof include cyanine dyes, composite cyanine dyes, merocyanine dyes, composite merocyanine dyes, homopolar cyanine dyes, styryl dyes, and hemicyanine dyes. Typical spectral sensitizing dyes are disclosed in Research Disclosure, Item 36544, September 1994. The dyes can be synthesized by one skilled in the art according to procedures described in the above Research Disclosure and F. M. Hamer, *The Cyanine dyes and Related Compounds*, Interscience Publishers, New York, 1964. Further, dyes described in pages 4 to 7 of a specification of JP-A No. 11-95355 (U.S. Pat. No. 6,054,260) may be used in the invention.

The total number of carbon atoms in the compounds of Types 1 to 4 used in the invention is preferably 10 to 60, more preferably 15 to 50, furthermore preferably 18 to 40, particularly preferably 18 to 30.

When a silver halide photosensitive material using the compounds of Types 1 to 4 is exposed, the compound is one-electron-oxidized. After the subsequent reaction, the compound is further oxidized while releasing one electron, or two or more electrons depending on Type. An oxidation potential in the first one-electron oxidation is preferably 1.4 V or less, more preferably 1.0 V or less. This oxidation potential is preferably 0 V or more, more preferably 0.3 V or more. Thus, the oxidation potential is preferably approximately 0 V to 1.4 V, more preferably approximately 0.3 V to 1.0 V.

The oxidation potential may be measured by a cyclic voltammetry technique. Specifically, a sample is dissolved in a solution of acetonitrile/water containing 0.1 M lithium perchlorate=80/20 (volume %), nitrogen gas is passed through the resultant solution for 10 minutes, and then the oxidation potential is measured at 25° C. at a potential scanning rate of 0.1 V/second by using a glassy carbon disk as a working electrode, using a platinum wire as a counter electrode, and using a calomel electrode (SCE) as a reference electrode. The oxidation potential per SCE is obtained at peak potential of cyclic voltammetric curve.

In the case where the compound of Types 1 to 4 is one-electron-oxidized and release further one electron after the subsequent reaction, an oxidation potential in the subsequent oxidation is preferably −0.5 V to −2 V, more preferably −0.7 V to −2 V, furthermore preferably −0.9 V to −1.6 V.

In the case where the compound of Types 1 to 4 is one-electron-oxidized and release further two or more electrons after the subsequent reaction, oxidation potentials in the subsequent oxidation are not particularly limited. The oxidation potentials in the subsequent oxidation often cannot be measured precisely, because an oxidation potential in releasing the second electron cannot be clearly differentiated from an oxidation potential in releasing the third electron.

Next, the compound of Type 5 will be described.

The compound of Type 5 is represented by X—Y, in which X represents a reducing group and Y represents a leaving group. The reducing group represented by X can be one-electron-oxidized to provide a one-electron oxidation product, which can be converted into an X radical by eliminating the leaving group of Y with a subsequent X—Y bond cleavage reaction. The X radical can release further one electron. The oxidation reaction of the compound of Type 5 may be represented by the following formula.

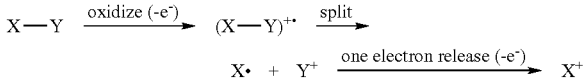

The compound of Type 5 exhibits an oxidation potential of preferably 0 V to 1.4 V, more preferably 0.3 V to 1.0 V. The radical X. generated in the formula exhibits an oxidation potential of preferably −0.7 V to −2.0 V, more preferably −0.9 V to −1.6 V.

The compound of Type 5 is preferably represented by the following general formula (G).

General formula (G)

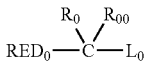

In general formula (G), $RED_0$ represents a reducing group, $L_0$ represents a leaving group, and $R_0$ and $R_{00}$ each represent a hydrogen atom or a substituent. $RED_0$ and $R_0$, and $R_0$ and $R_{00}$ may be bond together to form a ring structure, respectively. $RED_0$ is the same as $RED_2$ in general formula (C) with respect to the meanings and preferred embodiments. $R_0$ and $R_{00}$ are the same as $R_{21}$ and $R_{22}$ in general formula (C) with respect to the meanings and preferred embodiments, respectively. Incidentally, $R_0$ and $R_{00}$ are not the same as the leaving group of $L_0$ respectively, except for a hydrogen atom. $RED_0$ and $R_0$ may bond together to form a ring structure with examples and preferred embodiments the same as those of the ring structure formed by bonding $RED_2$ and $R_{21}$ in general formula (C). Examples of the ring structure formed by bonding $R_0$ and $R_{00}$ each other include a cyclopentane ring, a tetrahydrofuran ring, etc. In general formula (G), $L_0$ is the same as $L_2$ in general formula (C) with respect to the meanings and preferred embodiments.

The compound represented by general formula (G) preferably has an adsorbable group to the silver halide or a spectrally sensitizing dye moiety. However, the compound does not have two or more adsorbable groups when $L_0$ is a group other than a silyl group. Incidentally, the compound may have two or more sulfide groups as the adsorbent groups, not depending on $L_O$.

The adsorbable group to the silver halide in the compound represented by general formula (G) may be the same as those in the compounds of Types 1 to 4, and further may be the same as all of the compounds and preferred embodiments described as "an adsorbable group to the silver halide" in pages 4 to 7 of a specification of JP-A No. 11-95355.

The spectral sensitizing dye moiety in the compound represented by general formula (G) is the same as in the compounds of Types 1 to 4, and may be the same as all of the compounds and preferred embodiments described as "photoabsorptive group" in pages 7 to 14 of a specification of JP-A No. 11-95355.

Specific examples of the compounds of Types 1 to 5 used in the invention are illustrated below without intention of restricting the scope of the invention.

1

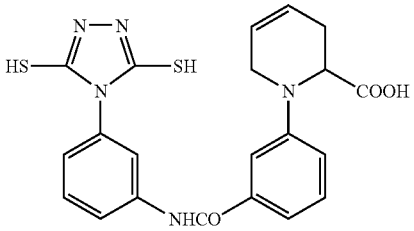

2

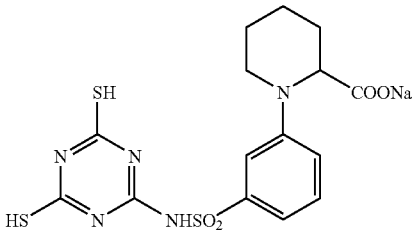

3

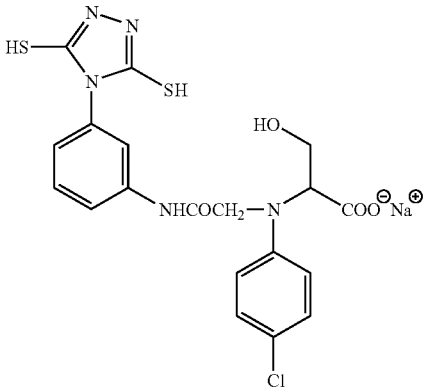

4

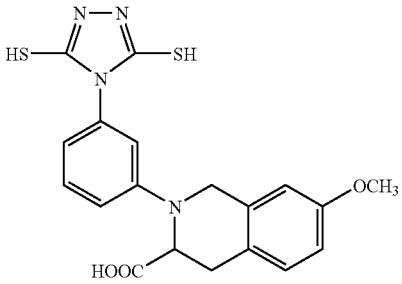

-continued

5

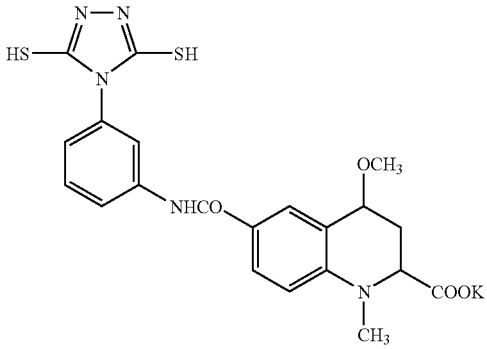

6

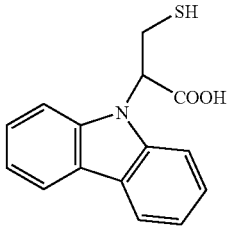

7

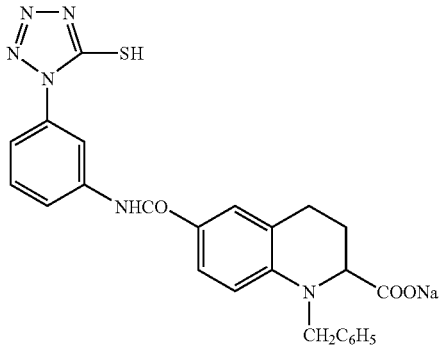

8

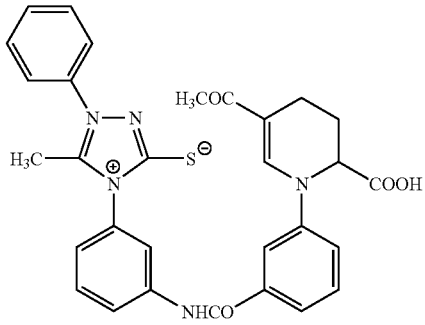

9

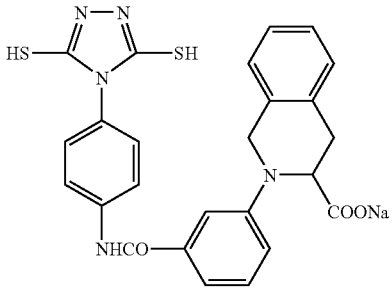

-continued
10
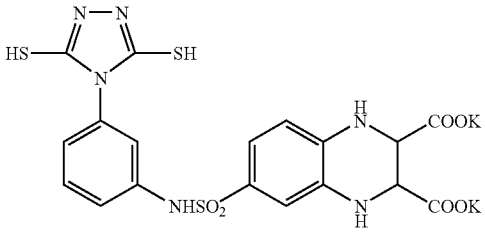
11
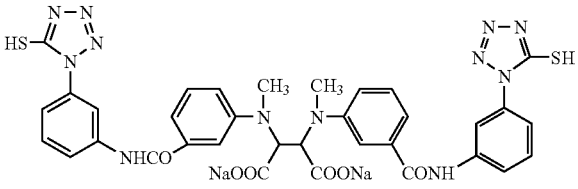
12
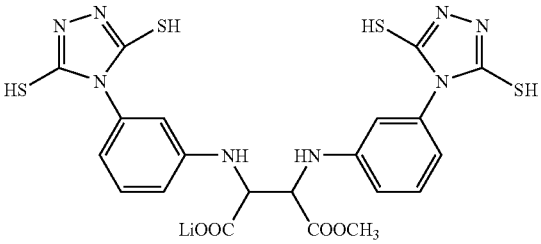
13
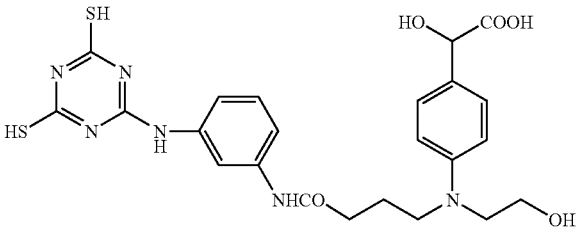
14
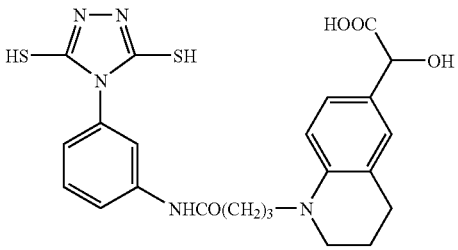
15
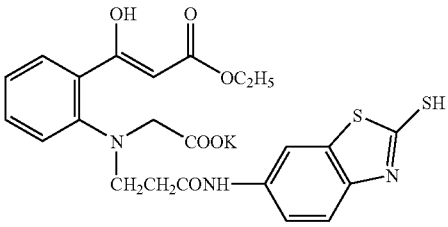
-continued
16
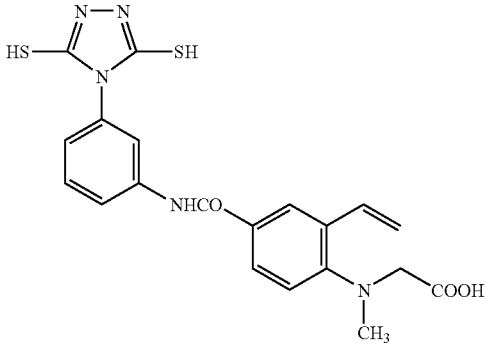
17
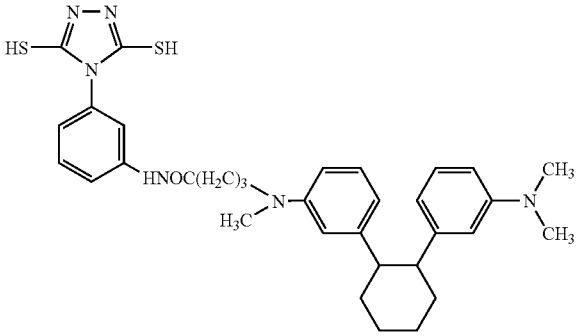
18
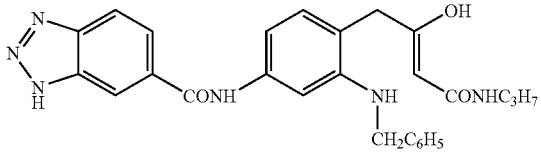
19
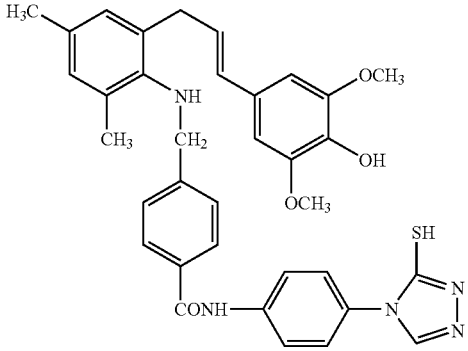
20
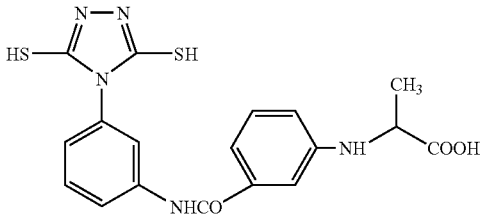

-continued
21
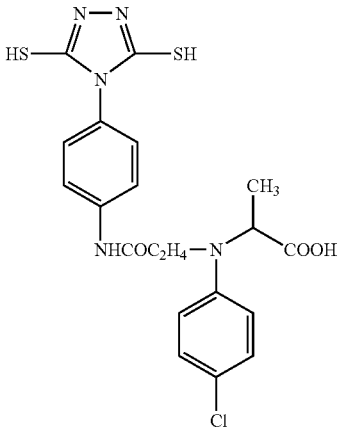
22
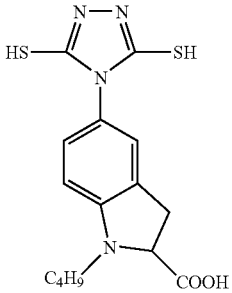
23
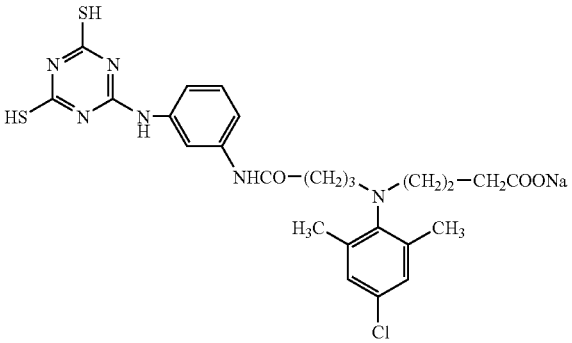
24
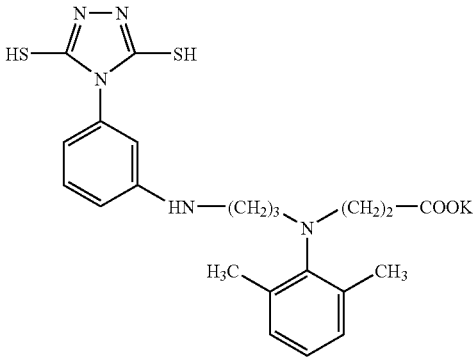
-continued
25
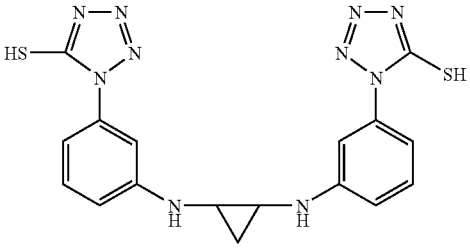
26
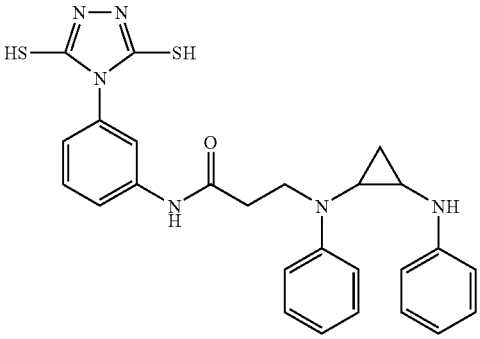
27
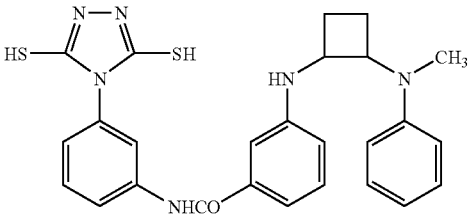
28
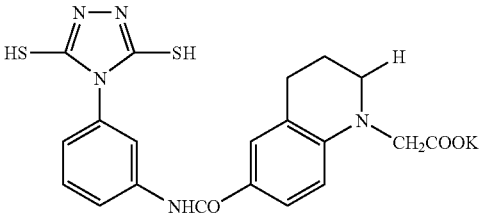
29
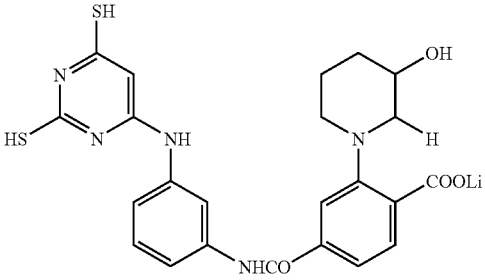
30
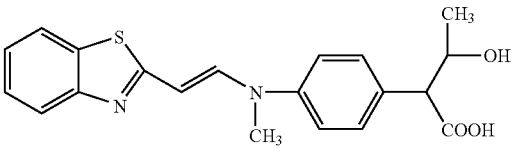

-continued
31
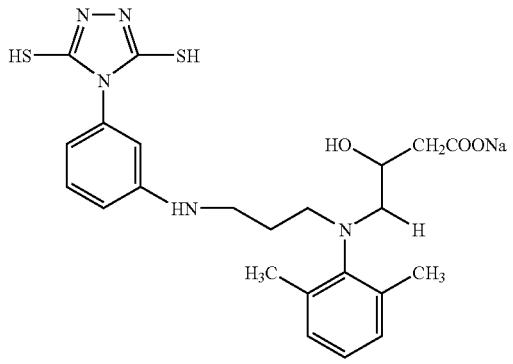
32
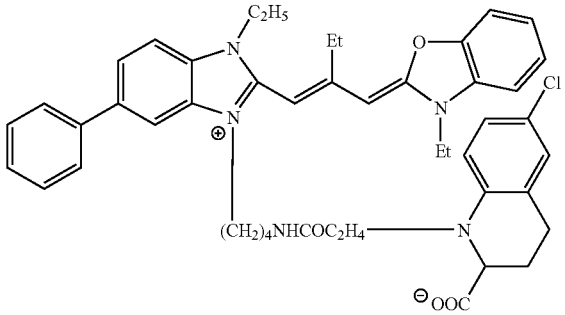
33
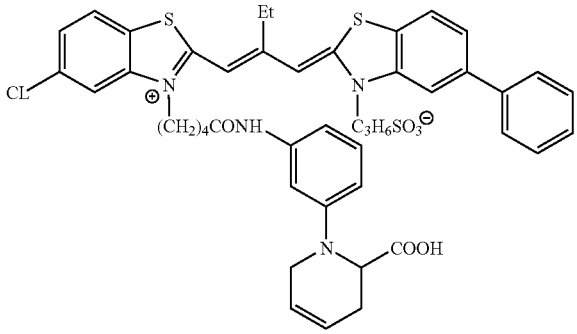
34
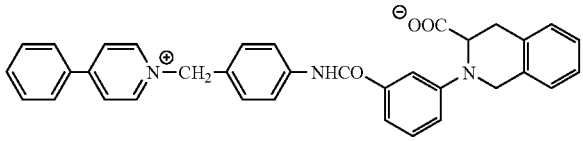
35
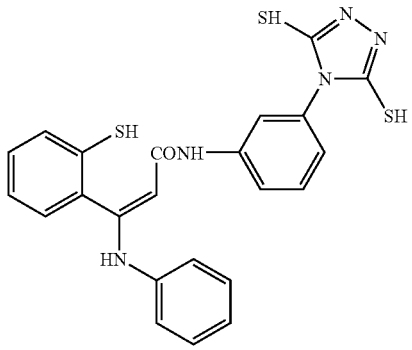
-continued
G-1
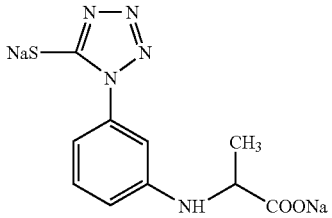
G-2
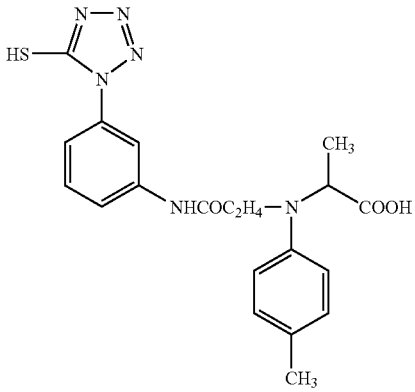
G-3
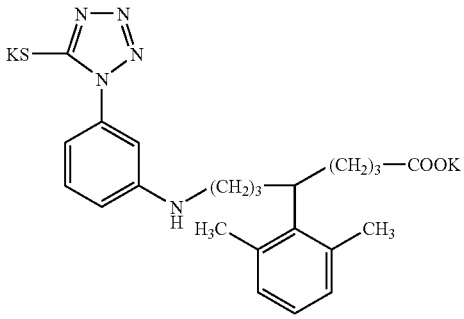
G-4
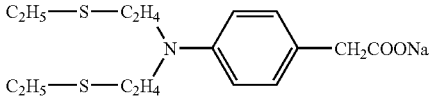
G-5
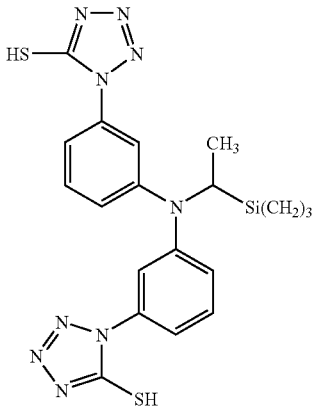
The compounds of Types 1 to 4 used in the invention are the same as compounds described in detail in Japanese Patent Application Nos. 2002-192373, 2002-188537, 2002-188536, 2001-272137 and 2002-192374, respectively. The specific examples of the compounds of Types 1 to 4 used in the invention further include compound examples disclosed in the specifications. Synthesis examples of the compounds of Types 1 to 4 used in the invention may be the same as described in the specifications.

Specific examples of the compound represented by general formula (G) further include examples of compound referred to as "one photon two electrons sensitizer" or "deprotonating electron-donating sensitizer" described in JP-A No. 9-211769 (Compound PMT-1 to S-37 in Tables E and F, pages 28 to 32); JP-A No. 9-211774; JP-A No. 11-95355 (Compound INV 1 to 36); JP-W No. 2001-500996 (Compound 1 to 74, 80 to 87, and 92 to 122); U.S. Pat. Nos. 5,747,235 and 5,747,236; EP No. 786692 A1 (Compound INV 1 to 35); EP No. 893732 A1; U.S. Pat. Nos. 6,054,260 and 5,994,051; etc.

The compounds of Types 1 to 5 may be used at any time during preparation of the photosensitive silver halide emulsion and production of the photothermographic material. For example, the compound may be used, in a photosensitive silver halide grains-forming step, in a desalination step, in a chemical sensitization step, before application, etc. The compound may be added in numbers, in these steps. The compound is preferably added, after the photosensitive silver halide grains-forming step and before the desalination step; in the chemical sensitization step (just before the chemical sensitization to immediately after the chemical sensitization); or before the application. The compound is more preferably added, just before the chemical sensitization step to before mixing with the non-photosensitive organic silver salt.

It is preferred that the compound of Types 1 to 5 used in the invention is dissolved in water, a water-soluble solvent such as methanol and ethanol, or a mixed solvent thereof, to be added. In the case where the compound is dissolved in water and solubility of the compound is increased by increasing or decreasing a pH value of the solvent, the pH value may be increased or decreased to dissolve and add the compound.

The compound of Types 1 to 5 used in the invention is preferably added to the image forming layer comprising the photosensitive silver halide and the non-photosensitive organic silver salt. The compound may be added to a surface protective layer, an intermediate layer, as well as the image forming layer comprising the photosensitive silver halide and the non-photosensitive organic silver salt, to be diffused to the image forming layer in the application step. The compound may be added before or after addition of a sensitizing dye. A mol value of the compound per one mol of the silver halide is preferably $1\times10^{-9}$ mol to $5\times10^{-1}$ mol, more preferably $1\times10^{-8}$ mol to $5\times10^{-2}$ mol, in a layer comprising the photosensitive silver halide emulsion.

10) Combined Use of a Plurality of Silver Halides

The photosensitive silver halide emulsion in the photosensitive material used in the invention may be used alone, or two or more kinds of them (for example, those of different average particle sizes, different halogen compositions, different crystal habits and of different conditions for chemical sensitization) may be used together. Gradation can be controlled by using a plural kinds of photosensitive silver halides of different sensitivity. The relevant techniques can include those described, for example, in JP-A Nos. 57-119341, 53-106125, 47-3929, 48-55730, 46-5187, 50-73627, and 57-150841. It is preferred to provide a sensitivity difference of 0.2 or more in terms of logE between each of the emulsions.

11) Coating Amount

The addition amount of the photosensitive silver halide, when expressed by the coating amount of silver per one $m^2$ of the photothermographic material, is preferably from 0.03 $g/m^2$ to 0.6 $g/m^2$, more preferably, 0.05 $g/m^2$ to 0.4 $g/m^2$ and, further preferably, 0.07 $g/m^2$ to 0.3 $g/m^2$. The photosensitive silver halide is preferably used by 0.01 mol to 0.5 mol, more preferably, 0.02 mol to 0.3 mol, further preferably 0.03 mol to 0.2 mol per one mol of the organic silver salt.

12) Mixing Photosensitive Silver Halide and Organic Silver Salt

The method and condition of mixing the silver halide and the organic silver salt can include a method of mixing a separately prepared photosensitive silver halide and an organic silver salt by a high speed stirrer, ball mill, sand mill, colloid mill, vibration mill, or homogenizer, or a method of mixing a photosensitive silver halide completed for preparation at any timing in the preparation of an organic silver salt and preparing the organic silver salt. And, a method of mix two or more kinds of aqueous dispersions of organic silver salts and two or more kinds of aqueous dispersions of photosensitive silver salts upon mixing is used preferably for controlling the photographic properties.

13) Mixing Silver Halide into Coating Solution

In the invention, the time of adding silver halide to the coating solution for the image forming layer is preferably in the range from 180 minutes before to just prior to the coating, more preferably, 60 minutes before to 10 seconds before coating. But there is no restriction for mixing method and mixing condition as far as the effect of the invention appears sufficient. As an embodiment of a mixing method, there is a method of mixing in the tank controlling the average residence time to be desired. The average residence time herein is calculated from addition flux and the amount of solution transferred to the coater. And another embodiment of mixing method is a method using a static mixer, which is described in 8th edition of "Ekitai kongou gijutu" by N. Harnby and M. F. Edwards, translated by Kouji Takahashi (Nikkankougyou shinbunsya, 1989).

(Binder)

Any type of polymer may be used as the binder for the image forming layer in the photosensitive material of the invention. Suitable as the binder are those that are transparent or translucent, and that are generally colorless, such as natural resin or polymer and their copolymers; synthetic resin or polymer and their copolymer; or media forming a film; for example, included are gelatin, rubber, poly (vinyl alcohol), hydroxyethyl cellulose, cellulose acetate, cellulose acetate butyrate, poly (vinyl pyrrolidone), casein, starch, poly(acrylic acid), poly(methylmethacrylic acid), poly(vinyl chloride), poly(methacrylic acid), styrene-maleic anhydride copolymers, styrene-acrylonitrile copolymers, styrene-butadiene copolymers, poly(vinyl acetal)(e.g., poly(vinyl formal) and poly(vinyl butyral)), poly(ester), poly(urethane), phenoxy resin, poly(vinylidene chloride), poly(epoxide), poly(carbonate), poly(vinyl acetate), poly(olefin), cellulose esters, and poly(amide). A binder may be used with water, an organic solvent or emulsion to form a coating solution.

In the invention, the Tg of the binder of the layer including organic silver salts is preferably from 0° C. to 80° C. (which is denoted high Tg binder hereinafter), more preferably, from 10° C. to 70° C., further preferably, from 15° C. to 60° C.

In the specification, Tg was calculated according to the following equation.

$$1/Tg=\Sigma(Xi/Tgi)$$

Where, the polymer is obtained by copolymerization of n monomer compounds (from i=1 to i=n); Xi represents the mass fraction of the ith monomer ($\Sigma Xi=1$), and Tgi is the glass transition temperature (absolute temperature) of the homopolymer obtained with the ith monomer. The symbol Σ stands for the summation from i=1 to i=n. Values for the glass transition temperature (Tgi) of the homopolymers derived from each of the monomers were obtained from J. Brandrup and E. H. Immergut, Polymer Handbook (3rd Edition)(Wiley-Interscience, 1989).

The polymer used for the binder may be two or more kinds of polymers if necessary. And, the polymer having Tg more than 20° C. and the polymer having Tg less than 20° C. can be used in combination. In a case that two types or more of polymers differing in Tg may be blended for use, it is preferred that the weight-average Tg is in the range mentioned above.

In the invention, it is preferred that the layer containing organic silver salt is formed by first applying a coating solution containing 30% by weight or more of water in the solvent and by then drying.

In the case the layer containing organic silver salt (image forming layer) is formed by first applying a coating solution containing 30% by weight or more of water in the solvent and by then drying, and furthermore, in the case the binder of the layer containing organic silver salt is soluble or dispersible in an aqueous solvent (water solvent), the performance can be ameliorated particularly in the case a polymer latex having an equilibrium water content of 2% by weight or lower under 25° C. and 60% RH is used. Most preferred embodiment is such prepared to yield an ion conductivity of 2.5 mS/cm or lower, and as such a preparation method, there can be mentioned a refining treatment using a separation function membrane after synthesizing the polymer.

The aqueous solvent in which the polymer is soluble or dispersible, as referred herein, signifies water or water containing mixed therein 70% by weight or less of a water-admixing organic solvent. As water-admixing organic solvents, there can be mentioned, for example, alcohols such as methyl alcohol, ethyl alcohol, propyl alcohol, and the like; cellosolves such as methyl cellosolve, ethyl cellosolve, butyl cellosolve, and the like; ethyl acetate, dimethylformamide, and the like.

The term aqueous solvent is also used in the case the polymer is not thermodynamically dissolved, but is present in a so-called dispersed state.

The term "equilibrium water content under 25° C. and 60% RH" as referred herein can be expressed as follows:

$$\text{Equilibrium water content under 25° C. and 60\% RH} = [(W1 - W0)/W0] \times 100 \text{ (\% by weight)}$$

where, W1 is the weight of the polymer in moisture-controlled equilibrium under the atmosphere of 25° C. and 60% RH, and W0 is the absolutely dried weight at 25° C. of the polymer.

For the definition and the method of measurement for water content, reference can be made to Polymer Engineering Series 14, "Testing methods for polymeric materials" (edited by The Society of Polymer Science, Japan, published by Chijin Shokan).

The equilibrium water content under 25° C. and 60% RH is preferably 2% by weight or lower, but is more preferably, 0.01% by weight to 1.5% by weight, and is further preferably, 0.02% by weight to 1% by weight.

The binders used in the invention are, particularly preferably, polymers capable of being dispersed in aqueous solvent. Examples of dispersed states may include a latex, in which water-insoluble fine particles of hydrophobic polymer are dispersed, or such in which polymer molecules are dispersed in molecular states or by forming micelles, but preferred are latex-dispersed particles. The average particle size of the dispersed particles is in a range of from 1 to 50,000 nm, preferably 5 nm to 1,000 nm, more preferably, 10 nm to 500 nm, and most preferably, 50 nm to 200 nm. There is no particular limitation concerning particle size distribution of the dispersed particles, and may be widely distributed or may exhibit a monodisperse particle size distribution. From the viewpoint of controlling the physical properties of the coating solution, preferred mode of usage includes mixing two or more types of particles each having monodisperse particle distribution.

In the invention, the preferred embodiment and examples of polymers capable of being dispersed in aqueous solvent are the same as that described in (Hydrophobic latex polymer) described above, and examples can be described the same as those described above. However, preferred polymer for the image forming layer may be different from that of non-photosensitive layer including the outermost layer.

The polymer latexes above may be used alone, or may be used by blending two types or more depending on needs.

<Preferred Latex>

Particularly preferred as the polymer latex for use in the invention is that of styrene-butadiene copolymer. The weight ratio of monomer unit for styrene to that of butadiene constituting the styrene-butadiene copolymer is preferably in a range of from 40:60 to 95:5. Further, the monomer unit of styrene and that of butadiene preferably accounts for 60% by weight to 99% by weight with respect to the copolymer. Moreover, the polymer latex of the invention contains acrylic acid or methacrylic acid, preferably, for 1% by weight to 6% by weight, and more preferably, for 2% by weight to 5% by weight, with respect to the total mass of the monomer unit of styrene and that of butadiene. The polymer latex of the invention preferably contains acrylic acid. The preferred range of the molecular weight is the same as that described above.

As the latex of styrene-butadiene copolymer preferably used in the invention, there can be mentioned P-3 to P-8 and P-15, or commercially available LACSTAR-3307B, 7132C, Nipol Lx416, and the like.

In the image forming layer of the photothermographic material according to the invention, if necessary, there can be added hydrophilic polymers such as gelatin, polyvinyl alcohol, methyl cellulose, hydroxypropyl cellulose, carboxymethyl cellulose, and the like. The hydrophilic polymers above are added at an amount of 30% by weight or less, preferably 20% by weight or less, with respect to the total weight of the binder incorporated in the layer containing organic silver salt.

According to the invention, the layer containing organic silver salt (namely, image forming layer) is preferably formed by using polymer latex for the binder. According to the amount of the binder for the layer containing organic silver salt, the weight ratio for total binder to organic silver salt (total binder/organic silver salt) is preferably in a range of 1/10 to 10/1, more preferably 1/3 to 5/1, further preferably 1/1 to 3/1.

The layer containing organic silver salt is, in general, a photosensitive layer (image forming layer) containing a photosensitive silver halide, i.e., the photosensitive silver salt; in such a case, the weight ratio for total binder to silver halide (total binder/silver halide) is in a range of from 400 to 5, more preferably, from 200 to 10.

In the case water solvent is used for the preparation, the total binder content in the image forming layer is preferably in a range of from 0.2 g/m$^2$ to 30 g/m$^2$, more preferably from 1 g/m$^2$ to 15 g/m$^2$. In the image forming layer of the invention, there may be added a crosslinking agent for crosslinking, or a surfactant and the like to improve coating properties.

<Preferred Solvent for Coating Solution>

In the invention, a solvent of a coating solution for a layer containing organic silver salt (wherein a solvent and water are collectively described as a solvent for simplicity) is preferably an aqueous solvent containing water at 30% by weight or more. Examples of solvents other than water may include any of water-miscible organic solvents such as methyl alcohol, ethyl alcohol, isopropyl alcohol, methyl cellosolve, ethyl cellosolve, dimethylformamide and ethyl acetate. A water content in a solvent is more preferably 50% by weight or more and still more preferably 70% by weight or more. Concrete examples of a preferable solvent composition, in addition to water=100, are compositions in which methyl alcohol is contained at ratios of water/methyl alcohol=90/10 and 70/30, in which dimethylformamide is further contained at a ratio of water/methyl alcohol/dimethylformamide=80/15/5, in which ethyl cellosolve is further contained at a ratio of water/methyl alcohol/ethyl cellosolve=85/10/5, and in which isopropyl alcohol is further contained at a ratio of water/methyl alcohol/isopropyl alcohol=85/10/5 (wherein the numerals presented above are values in % by weight).

(Antifoggant)

As an antifoggant, stabilizer and stabilizer precursor usable in the invention, there can be mentioned those disclosed as patents in paragraph number 0070 of JP-A No. 10-62899 and in line 57 of page 20 to line 7 of page 21 of EP-A No. 0803764A1, the compounds described in JP-A Nos. 9-281637 and 9-329864, in U.S. Pat. No. 6,083,681, and in EP-A No. 1048975. Furthermore, the antifoggant preferably used in the invention is an organic halogen compound, and those disclosed in paragraph Nos. 0111 to 0112 of JP-A No. 11-65021 can be enumerated as examples thereof. In particular, the organic halogen compound expressed by formula (P) in JP-A No. 2000-284399, the organic polyhalogen compound expressed by formula (II) in JP-A No. 10-339934, and organic polyhalogen compounds described in JP-A Nos. 2001-31644 and 2001-33911 are preferred.

1) Organic Polyhalogen Compound

Organic polyhalogen compounds preferably used in the invention are specifically described below. In the invention, preferred polyhalogen compounds are the compounds expressed by general formula (H) below:

$$Q\text{-}(Y)_N\text{—}C(Z_1)(Z_2)X \qquad \text{General formula (H)}$$

In general formula (H), Q represents an alkyl group, an aryl group, or a heterocyclic group; Y represents a divalent connecting group; N represents 0 or 1; $Z_1$ and $Z_2$ represent a halogen atom; and X represents hydrogen atom or an electron attracting group.

In general formula (H), Q is preferably an aryl group, or a heterocyclic group.

In general formula (H), in the case that Q is a heterocyclic group, Q is preferably a nitrogen containing heterocyclic group having 1 to 2 nitrogen atoms and particularly preferably 2-pyridyl group and 2-quinolyl group.

In general formula (H), in the case that Q is an aryl group, Q preferably is a phenyl group substituted by an electron-attracting group whose Hammett substitution coefficient σp yields a positive value. For the details of Hammett substitution coefficient, reference can be made to Journal of Medicinal Chemistry, Vol. 16, No. 11 (1973), pp. 1207 to 1216, and the like. As such electron-attracting groups, examples include, halogen atoms (fluorine atom (σp value: 0.06), chlorine atom (σp value: 0.23), bromine atom (σp value: 0.23), iodine atom (σp value: 0.18)), trihalomethyl groups (tribromomethyl (σp value: 0.29), trichloromethyl (σp value: 0.33), trifluoromethyl (σp value: 0.54)), a cyano group (σp value: 0.66), a nitro group (σp value: 0.78), an aliphatic aryl or heterocyclic sulfonyl group (for example, methanesulfonyl (σp value: 0.72)), an aliphatic aryl or heterocyclic acyl group (for example, acetyl (σp value: 0.50) and benzoyl (σp value: 0.43)), an alkinyl (e.g., C≡CH (σp value: 0.23)), an aliphatic aryl or heterocyclic oxycarbonyl group (e.g., methoxycarbonyl (σp value: 0.45) and phenoxycarbonyl (σp value: 0.44)), a carbamoyl group (σp value: 0.36), sulfamoyl group (σp value: 0.57), sulfoxido group, heterocyclic group, and phosphoryl group. Preferred range of the σp value is from 0.2 to 2.0, and more preferably, from 0.4 to 1.0. Preferred as the electron-attracting groups are carbamoyl group, an alkoxycarbonyl group, an alkylsulfonyl group, and an alkylphosphoryl group, and particularly preferred among them is carbamoyl group.

X preferably is an electron-attracting group, more preferably, a halogen atom, an aliphatic aryl or heterocyclic sulfonyl group, an aliphatic aryl or heterocyclic acyl group, an aliphatic aryl or heterocyclic oxycarbonyl group, carbamoyl group, or sulfamoyl group; particularly preferred among them is a halogen atom. Among halogen atoms, preferred are chlorine atom, bromine atom, and iodine atom; more preferred are chlorine atom and bromine atom; and particularly preferred is bromine atom.

Y preferably represents —C(=O)—, —SO—, or —$SO_2$—; more preferably, —C(=O)— or —$SO_2$—; and particularly preferred is —$SO_2$—. N represents 0 or 1, and preferred is 1.

Specific examples of the compounds expressed by general formula (H) of the invention are shown below.

(H-1)

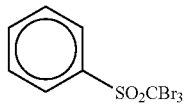

(H-2)

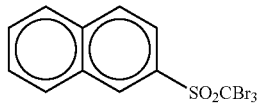

(H-3)

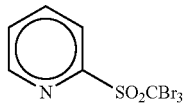

(H-4)

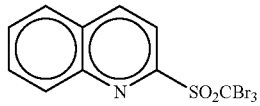

(H-5)

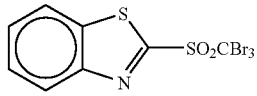

(H-6)

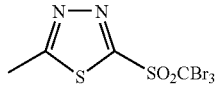

-continued
(H-7)
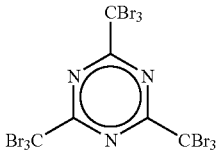
(H-8)
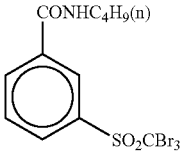
(H-9)
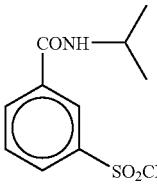
(H-10)
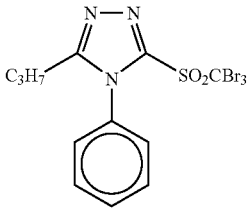
(H-11)
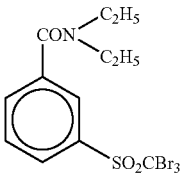
(H-12)
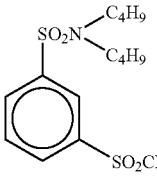
(H-13)
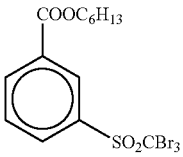
(H-14)
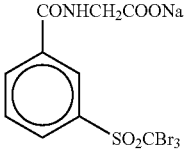
(H-15)
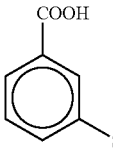
-continued
(H-16)
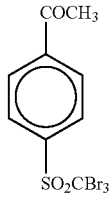
(H-17)
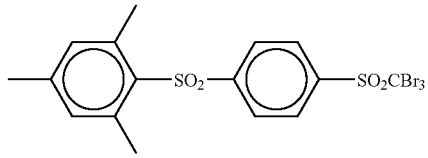
(H-18)
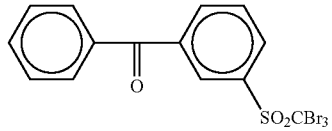
(H-19)
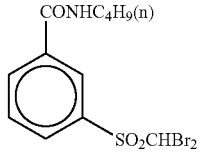
(H-20)
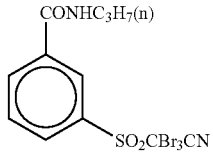
(H-21)
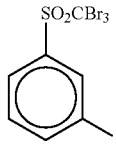
(H-22)
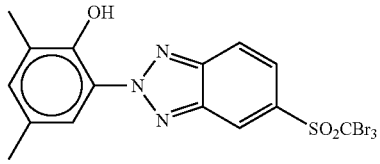
(H-23)
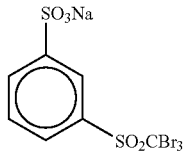
(H-24)
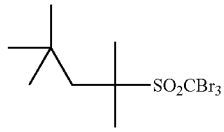
As preferred polyhalogen compounds of the invention other than those above, there can be mentioned compounds disclosed in JP-A Nos. 2001-31644, 2001-56526, and 2001-209145.

The compounds expressed by general formula (H) of the invention are preferably used in an amount of from $10^{-4}$ mol to 1 mol, more preferably, $10^{-3}$ mol to 0.5 mol, and most preferably, $10^{-2}$ mol to 0.2 mol, per one mol of non-photosensitive silver salt incorporated in the image forming layer.

In the invention, usable methods for incorporating the antifoggant into the photosensitive material are those described above in the method for incorporating the reducing agent; similarly, for the organic polyhalogen compound, it is preferably added in the form of a solid particle dispersion.

2) Other Antifoggants

As other antifoggants, there can be mentioned a mercury (II) salt described in paragraph number 0113 of JP-A No. 11-65021, benzoic acids described in paragraph number 0114 of the same literature, a salicylic acid derivative described in JP-A No. 2000-206642, a formaline scavenger compound expressed by general formula (S) in JP-A No. 2000-221634, a triazine compound related to Claim 9 of JP-A No. 11-352624, a compound expressed by general formula (III), 4-hydroxy-6-methyl-1,3,3a, 7-tetrazaindene and the like, as described in JP-A No. 6-11791.

The photothermographic material of the invention may further contain an azolium salt in order to prevent fogging. As azolium salts, there can be mentioned a compound expressed by general formula (XI) as described in JP-A No. 59-193447, a compound described in JP-B No. 55-12581, and a compound expressed by general formula (II) in JP-A No. 60-153039. The azolium salt may be added to any part of the photosensitive material, but as the addition layer, preferred is to select a layer on the side having thereon the photosensitive layer, and more preferred is to select a layer containing organic silver salt. The azolium salt may be added at any time of the process of preparing the coating solution; in the case the azolium salt is added into the layer containing the organic silver salt, any time of the process may be selected, from the preparation of the organic silver salt to the preparation of the coating solution, but preferred is to add the salt after preparing the organic silver salt and just before the coating. As the method for adding the azolium salt, any method using a powder, a solution, a fine-particle dispersion, and the like, may be used. Furthermore, it may be added as a solution having mixed therein other additives such as sensitizing agents, reducing agents, tone adjusting agents, and the like. In the invention, the azolium salt may be added at any amount, but preferably, it is added in a range of from $1\times10^{-6}$ mol to 2 mol, and more preferably, from $1\times10^{-3}$ mol to 0.5 mol per one mol of silver.

(Other Additives)

1) Mercapto Compounds, Disulfides and Thiones

In the invention, mercapto compounds, disulfide compounds, and thione compounds may be added in order to control the development by suppressing or enhancing development, to improve spectral sensitization efficiency, and to improve storage properties before and after development. Descriptions can be found in paragraph Nos. 0067 to 0069 of JP-A No. 10-62899, a compound expressed by general formula (I) of JP-A No. 10-186572 and specific examples thereof shown in paragraph Nos. 0033 to 0052, and in lines 36 to 56 in page 20 of EP No. 0803764A1. Among them, mercapto-substituted heterocyclic aromatic compound described in JP-A Nos. 9-297367, 9-304875, and 2001-100358, and in Japanese Patent Application Nos. 2001-104213 and 2001-104214, and the like, are particularly preferred.

2) Toner

In the photothermographic material of the present invention, the addition of a toner is preferred. The description of the toner can be found in JP-A No.10-62899 (paragraph Nos. 0054 to 0055), EP-A No. 0803764A1 (page21, lines 23 to 48), JP-A Nos. 2000-356317 and 2000-187298. Preferred are phthalazinones (phthalazinone, phthalazinone derivatives and metal salts thereof, e.g., 4-(1-naphthyl)phthalazinone, 6-chlorophthalazinone, 5,7-dimethoxyphthalazinone and 2,3-dihydro-1,4-phthalazinedione); combinations of phthalazinones and phthalic acids(e.g., phthalic acid, 4-methylphthalic acid, 4-nitrophthalic acid, diammonium phthalate, sodium phthalate, potassium phthalate and tetrachlorophthalic anhydride); phthalazines(phthalazine, phthalazine derivatives and metal salts thereof, e.g., 4-(1-naphthyl)phthalazine, 6-isopropylphthalazine, 6-ter-butylphthalazine, 6-chlorophthalazine, 5,7-dimethoxyphthalazine and 2,3-dihydrophthalazine); combinations of phthalazines and phthalic acids. Particularly preferred is a combination of phthalazines and phthalic acids. Among them, particularly preferable are the combination of 6-isopropylphthalazine and phthalic acid, and the combination of 6-isopropylphthalazine and 4-methylphthalic acid.

3) Plasticizer and Lubricant

Plasticizers and lubricants usable in the photothermographic material of the invention are described in paragraph No. 0117 of JP-A No. 11-65021. Lubricants are described in paragraph Nos. 0061 to 0064 of JP-A No. 11-84573 and in paragraph Nos. 0049 to 0062 of Japanese Patent Application No. 11-106881.

4) Dyes and Pigments

In the photothermographic material in the present invention, various dyes and pigments (e.g., C.I. Pigment Blue 60, C.I. Pigment Blue 64 and C.I. Pigment Blue 15:6) can be used in term of improvement of image tone, prevention of interference fringes at laser exposure and anti-irradiation.

The metalo-phthalocyanine compound is preferably used as the dye or the pigment in the present invention. Especially water-soluble metalo-phthalocyanine compound can be more preferably used.

"The metalo-phthalocyanine compound" which can be used in the present invention is explained.

The metalo-phthalocyanine compound is the metal complex of phthalocyanine nucleus not containing a metal and the center metal may be any metal atom such as Na, K, Be, Mg, Mn, Ca, Ba, Cd, Hg, Cr, Fe, Co, Ni, Zn, Pt, Pd, Cu, Ti, V, Si, Sr, Mo, B, Al, Pb, and Sn, as far as to form the complex stably, but preferably is a transition metal atom, wherein, as examples, chromium, manganese, iron, cobalt, nickel, cupper and zinc can be described and cupper is particularly preferable.

The metalo-phthalocyanine compound in the present invention may be substituted by a water-soluble group which bonds to a phthalocyanine carbocyclic aromatic ring directly or via a connecting group. A water-soluble group is a dissociation group having pKa 6 or less such as sulfonic acids or salts thereof and carboxylic acids or salts thereof and the like, and bonds to a phthalocyanine carbocyclic aromatic ring directly or via a connecting group. As typical examples of the water-soluble group, —$SO_2NHSO_2R$, —CONHCOOR, —$SO_2NHCOR$ and the like are described.

The compound, wherein a metalo-phthalocyanine compound is connected as a pendant to a main chain of water-soluble polymer can be also used.

The compound shown in following general formula (Pc-X) is water-insoluble metalo-phthalocyanine which can be used for blue background color.

General formula (Pc-X)

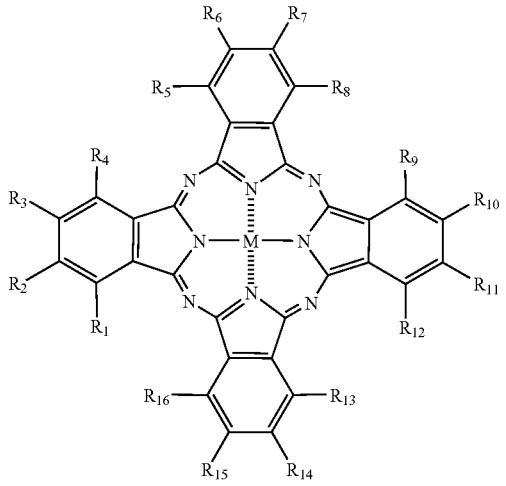

In general formula, M represents multivalence metal atom.

$R_1$, $R_4$, $R_5$, $R_8$, $R_9$, $R_{12}$, $R_{13}$ and $R_{16}$ each independently represent a hydrogen atom, a substituted or a non-substituted and a linear or a blanched alkyl group.

$R_2$, $R_3$, $R_6$, $R_7$, $R_{10}$, $R_{11}$, $R_{14}$ and $R_{15}$ each independently represent a hydrogen atom, a halogen atom, a substituted or a non-substituted and a linear or a branched alkyl group, a substituted or a non-substituted aryl group, a substituted or a non-substituted alkoxy group and a substituted or a non-substituted aryloxy group. $R_1$ to $R_{16}$ represent a atomic group necessary to form a substituted or a non-substituted aromatic or hetero aromatic ring by combination of one pair or more among the pair of $R_1$ and $R_2$, $R_2$ and $R_3$, $R_3$ and $R_4$, $R_5$ and $R_6$, $R_6$ and $R_7$, $R_7$ and $R_8$, $R_8$ and $R_9$, $R_9$ and $R_{10}$, $R_{10}$ and $R_{11}$, $R_{11}$ and $R_{12}$, $R_{13}$ and $R_{14}$, $R_{14}$ and $R_{15}$, and $R_{15}$ and $R_{16}$ which closes to each other.

And as the water-soluble phthalocyanine, an acid dye, a direct dye and a reactive dye described in SENRYO BINRAN (published by MARUZEN Co. in 1975) and COLOUR INDEX international third edition (published by The Society of Dye and Colourists in 1992) can be used as commercially available compound. As typical examples, C. I. Acid Blue 185, 197, 228, 242, 243, 249, 254, 255, 275, 279, 283, C. I. Direct Blue 86, 87, 189, 199, 262, 264, 276, C. I. Reactive Blue 3, 7, 11, 14, 15, 18, 21, 23, 25, 30, 35, 38, 41, 48, 57, 58, 63, 71, 72, 77, 80, 85, 88, 91, 92, 95, 105, 106, 107, 117, 118, 123, 124, 136, 140, 143, 148, 151, 152, 153, 190, 197, 207, 215, 227, 229, 231 and the like can be used.

As the typical commodity examples of the C. I. Direct Blue 86, Aizen Primula Turquoise Blue GLH (produced by HODOGAYA KAGAKU Co.), Cupro Cyanine Blue GL (produced by TOYO Inc Co.), Daivogen Turquoise Blue S (produced by DAINIPPON Inc Co.), Direct Fast Cyanine Blue GL (produced by TAKAOKA KAGAKU Co.), Kayafect Blue GT, Kayafect Blue T, Kayafect Turquoise Blue GL (above all produced by NIPPON KAYAKU Co.), Kiwa Turquoise Blue GL (produced by KIWA KAGAKU Co.), Nankai Direct Fast Cyanine Blue GL (produced by NANKAI SENRYO Co.), Phthalocyanine Blue G conc. (produced by USU KAGAKU Co.), Sanyo Turquoise Blue BLR (produced by SANYO SHIKISO Co.), Sanyo Cyanine Blue SBL conc.-B (produced by SANYO KAGAKU Co.), Sumilight Spura Turquoise Blue G conc., Sumilight Spura Turquoise Blue FB conc. (above all produced by SUMITOMO KAGAKU Co.), Sirius Spura Turquoise Blue GL (produced by Bayer Co.), Daizol Light Turquoise JL (produced by ICI Co.), Lurantin Light Turquoise Blue GL (produced by BASF Co.), Solar Turquoise Blue GLL (produced by SANDOZ Co.) and the like can be described.

As the typical commodity examples of C. I. Direct Blue 199, Solar Turquoise Blue FBL (produced by SANDOZ Co.), Lurantin Light Turquoise Blue FBL (produced by BASF Co.), Diazol Light Turquoise JRL (produced by ICI Co.), Levacell Fast Turquoise Blue BLN, Levacell Fast Turquoise Blue FBL (above all produced by Bayer Co.), Kayafect Turquoise RN (produced by NIPPON KAYAKU Co.) Sumilight Supra Turquoise Blue FB (produced by SUMITOMO KAGAKU Co.), Jay Direct Turquoise Blue CGL, Jay Direct Turquoise Blue FBL (above all produced by Jay Chemical Co.) and the like can be described.

As the phthalocyanine dye which has largely aggregated absorption and shows preferable image tone, the dye which has the substituent having hydrogen bonding property in a molecule such as a sulfamoyl group, a carbamoyl group and a hydroxy group is preferable and the dye represented by general formula Pc-1 is preferably described.

$MPc\ (SO_3H)n\ (SO_2NHR)m$ General formula Pc-1

In general formula Pc-1, Pc represents a phthalocyanine nucleus and R represents an alkyl group, an aryl group and a heterocyclic group and each of those may have a substituent. n represents an integral number 0 to 4 and m represents an integral number 1 to 4. M represents a hydrogen atom, a metal atom or an oxide, a hydroxide and a halide thereof.

As for M, Cu, Ni, Zn, Al and the like are preferable and Cu is most preferable. In general formula Pc-1, a sulfo group is represented as a dissociation form, but may be a salt. The phthalocyanine dye represented by general formula Pc-1 is water-soluble and has a hydrophilic group at least one in a molecule. In an ionic hydrophilic group, a sulfo group, a carboxyl group, a phosphono group, a tertialy ammonium group and the like are included. As the ionic hydrophilic group described above, a carboxyl group, a phosphono group and a sulfo group are preferable and a carboxyl group and a sulfo group are particularly preferable. A carboxyl group, a phosphomo group and a sulfo group may be a salt form thereof and as examples of versus counter ions to form a salt, ammonium ion, alkali metal ion (e.g., lithium ion, sodium ion and potassium ion) and an organic cathion (e.g., tetramethyl ammonium ion, tetrametyl guanidium ion and tetrametyl phosphonium ion) can be included.

Moreover, a reactive dye having a triazinyl group and a dye in which a reactive triazinyl group is hydrolyzed, are also preferable.

Further more, the phthalocyanine dye having a specific substituent on β-position represented by general formula Pc-2 described below such as described in JP-A Nos. 2000-303009, Japanese patent Application Nos. 2001-96610, 2001-226275, 2001-47013, 2001-57063 and 2001-76689 can be preferably used because it gives much aggregated absorption.

General formula Pc-2

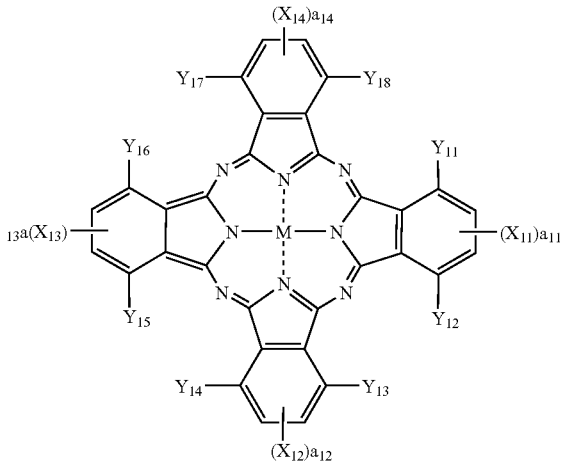

$X_{11}$ to $X_{14}$, $Y_{11}$ to $Y_{18}$ each independently represents —SO-Z, —$SO_2$-Z, —$SO_2NR^1R^2$, a sulfo group, —$CONR^1R^2$ and —$CO_2R^1$. Herein, Z represents a substituted or a non-substituted alkyl group, a substituted or a non-substituted cycloalkyl group, a substituted or a non-substituted alkenyl group, a substituted or a non-substituted alarkyl group, a substituted or a non-substituted aryl group and a substituted or a non-substituted heterocyclic group. $R^1$ and $R^2$ each independently represent a hydrogen atom, a substituted or a non-substituted alkyl group, a substituted or a non-substituted cycloalkyl group, a substituted or a non-substituted alkenyl group, a substituted or a non-substituted alarkyl group, a substituted or a non-substituted aryl group and a substituted or a non-substituted hetero cyclic group.

$Y_{11}$, $Y_{12}$, $Y_{13}$ and $Y_{14}$ each independently represent a monovalent substituent.

M is preferably Cu, Ni, Zn, Al and the like and most preferably Cu. $a_{11}$ to $a_{14}$ each independently represent an integral number 1 or 2 and it is preferably to satisfy $4 \leqq a_{11}+a_{12}+a_{13}+a_{14} \leqq 6$ and especially preferably $a_{11}=a_{12}=a_{13}=a_{14}=1$.

$X_{11}$, $X_{12}$, $X_{13}$ and $X_{14}$ each may represent a same substituent or the substituent which is a same kind of substituent but is partially different each other, such as the case that $X_{11}$, $X_{12}$, $X_{13}$ and $X_{14}$ each equals —$SO_2$-Z but Z thereof is different each other or may contain different substituent each other, such as the case where —$SO_2$-Z and —$SO_2NR^1R^2$ are substituted together.

The phthalocyanine dye represented by general formula Pc-2 is water-soluble and has at least one of the water-soluble group in a molecule. As the ionic water-soluble group, the group described in general formula Pc-1 can be described.

Examples of preferable dye represented by general formulae Pc-1 and Pc-2 are described below.

Following ionic water-soluble groups are all shown as a dissociation form but may be a salt thereof.

(I) C. I. Direct Blue 199

Dye represented by CuPc $(SO_3H)n$ $(SO_2NHR)m$ (I-1) n=1, m=3 R=$CH_2CH_2SO_3H$
(I-2) n=2, m=2 R=$CH_2CO_2H$
(I-3) n=3, m=1 R=$CH_2CH_2CO_2H$
(I-4) n=3, m=1 R=$CH_2CH_2OH$
(I-5) n=3, m=1 R=$CH_2CH(OH)CH_3$
(I-6) n=3, m=1 R=$CH_2CH_2OCH_2CH_2OH$ (II) Dye having $Y_{11}$ to $Y_{18}$=H and $a_{11}$ to $a_{14}$=1 in general formula Pc-2

(II-1) $X_{11}$ to $X_{14}$=$SO_2NHCH_2CH_2SO_3H$
(II-2) $X_{11}$ to $X_{14}$=$CONHCH_2CO_2H$
(II-3) $X_{11}$ to $X_{14}$=$SO_2CH_2CH_2CH_2SO_3H$
(II-4) $X_{11}$ to $X_{14}$=$SO_3H$
(II-5) $X_{11}$ to $X_{14}$=$CO_2H$
(II-6) $X_{11}$ to $X_{14}$=$CONHCH_2CH_2SO_3H$
(II-7) $X_{11}$ to $X_{14}$=$CONHCH_2SO_3H$
(II-8) $X_{11}$ to $X_{14}$=$SO_2CH_2CH$ (OH)$CH_2SOH$

Further more, the dyes described in Japanese Patent Application Nos. 2001-96610, 2001-226275, 2001-47013, 2001-57063 and 2001-76689 can be described.

In the present invention, the free ion which is the same as the center metal of metalo-phthalocyanine compound gives effects to the photographic property of the whole silver halide photographic material, therefore it is preferably contained in the said phoththermographic material within 200 mol % with respect to the content of phthalocyanine compound, more preferably 100 mol % or less and still more preferably 40 mol % or less.

In the present invention, metalo-phthalocyanine compound is preferably in the state having at least one of the following 3 properties in an absorption spectrum. The measurement is performed for example based on JISK 0115 'General rule of absorptiometric analysis'.

(1) Cyan dye having two absorption spectrum peaks at wavelengths of 590 nm to 640 nm and 650 nm to 710 nm.

(2) Cyan dye having an absorption spectrum peak at wavelength of 590 nm to 640 nm but not 650 mm to 710 nm (except for a shoulder not to form an absorption maximum).

(3) Cyan dye having an absorption spectrum peak at wavelength of 650 nm to 710 nm but not 590 mm to 640 nm (except for a shoulder not to form an absorption maximum).

Generally, it is well known that the position and the size of an absorption spectrum peak are changed by a kind and a number of substituent, even if the dyes have the same color index number.

It general, phthalocyanine dye has a monomer absorption peak at wavelength of 650 nm to 710, more preferably, 650 nm to 690 nm and an absorption peak of an aggregation form at wavelength of 590 nm to 650 nm, more preferably, 590 nm to 600 nm. When monomer absorption is too strong, the image tone changes greenish and it is not preferably to obtain a blueish tone favorable for medical photographic field.

For example, as the cyan dye of the case (1) has widely spreading absorption wavelength, various functions such as color-tone-adjusting, anti-irradiation, anti-halation, safe light filter and the like are very preferably provided in a phototgraphic material.

In an absorption spectrum in layer, the preferable ratio based on the following point of view can be shown, in the case where A represents an absorption peak at wavelength of 590 nm to 640 nm, B represents an absorption peak at wavelength of 650 nm to 710 nm.

Namely, for the purpose of little desensitization in a red sensitive photographic material, $B/A \leqq 1.0$ is preferable, more preferable, 0.9 or less, most preferable, 0.8 orless.

And in contrary, in the case of attach importance to antiirradiation and antihalation functions, $B/A>1.0$ is preferable, but it is preferable to satisfy the following inequality equation to balance these various functions.

Preferable ratio; $0.5<B/A<1.8$

Especially preferable ratio; $0.8<B/A<1.3$

In the phthalocyanine dye which has the absorption spectrum peaks at wavelengths of 590 nm to 640 nm and 650 nm to 710 nm, the ratio of 2 peak values differs by the compound series and are due to the position and number of subsituent.

And in the case of cyan dye such as (2), an absorption is sharp and visible absorption exists much, therefore it is preferable that the dye can function with a little amounts as a color-tone-adjusting, safe light filter and the like in a light sensitive material. The state without an absorption spectrum peak at wavelength of 650 nm to 710 nm also differs by the compound series and is due to a series, position and number of substituent.

And in the case of cyan dye such as (3), an absorption is sharp and visible absorption exists a little, therefore it is preferably that the dye can function with a little amounts as anti-irradiation function, anti-halation function and the like in a light sensitive material. The state without an absorption spectrum peak at wavelength of 590 nm to 640 nm also differs by the compound series and is due to a series, position and number of a substituent.

The absorbance of said metalo-phthalocyanine compound is preferable 0.3 or more and less than 1.2 as the maximum absorbance at 400 nm to 800 nm in the dilute solution where an aqueous solution of 2% by weight compound is diluted to 1000 times with water.

In the present invention, a metalo-phthalocyanine compound is preferably used for the manufacturing of light sensitive material as an aqueous solution or fine particle dispersion pre-arranged by water as a medium. In the said solution, the phthalocyanine compound in the present invention is contained 0.1% by weight to 30% by weight, preferably 0.5% by weight to 20% by weight, more preferably may be contained 1% by weight to 8% by weight. The said solution further may contain a water-soluble organic solvent and an auxiliary additive. The content of water-soluble organic solvent is 0% by weight to 30% by weight, preferably 5% by weight to 30% by weight and the content of auxiliary additive is 0% by weight to 5% by weight, preferably 0% by weight to 2% by weight.

In the present invention, at the arranging of aqueous solution or fine particle dispersion of metalo-phthalocyanine compound, as specific examples of a usable water-soluble solvent, C1 to C4 alcohols such as methanol, ethanol, propanol, iso-propanol, butanol, iso-butanol, sec-butanol, tert-butanol and the like, carbonamides such as N,N-dimethlyfolmamide, N,N-dimethyl acetamide and the like, lactams such as ϵ-caprolactam, N-methylpirrolidine-2-one and the like, urea, ring forming ureas such as 1,3-dimethylimidazoline-2-one, 1,3-dimethylhexahydropyrimido-2-one and the like, ketones or ketoalcohols such as acetone, methyl ethyl ketone, 2-methyl-2-hydroxypentane-4-one and the like, ethers such as tertahydrofuran, dioxan and the like, mono-, oligo- and polyalkylene glycols or thioglycols having C2 to C6 alkylene unit such as ethylene glycol, 1,2- or 1,3-propylene glycol, 1,2- or 1,4-butylene glycol, 1,6-hexylene glycol, diethylene glycol, triethylene glycol, dipropylene glycol, thiodiglycol, polyethylene glycol, polypropylene glycol and the like, polyols (triols) such as glycerine, hexane-1,2,6-triol and the like, C1 to C4 alkylethers of multi-valent alcohol such as ethylene glycol monomethylether, ethylene glycol monoethylether, diethylene glycol monoethylether, triethylene glycol monoethylether and the like, γ-butylolactone, dimethylsulfoxide and the like can be described. Two types or more of these water-soluble organic solvents can be used in combination.

In water-soluble organic solvent described above, urea, N-methylpyrrolidine-2-one, mono, di or trialkylene glycol having 2 to 4 alkylene units are preferable and mono, di or triethylene glycol, dipropylene glycol, dimethylsulfoxide and the like are more preferable. N-methlpyrrolidine-2-one, diethylene glycol, dimethysulfoxide, urea can be particularly preferably used. Urea is most preferable.

In the present invention, as a metalo-phthalocyanine dye is diluted by mixing the said aqueous solution with various chemicals at the making of photosensitive material, the method to make the aqueous organic solvent, besides the said aqueous solution, contain 1 mol to 500 mol per one mol of the said metal phtalocyanine compound is also preferably used.

To arrange the blueish image tone after thermal developing process, the addition amount of dye is determined by the combination with the color tone obtained by silver tone and other additive. Generally, the optical density (absorbance) measured at the objective wavelength (measured at 600 nm in the case of cyan dye) is used under 0.5. The optical density is 0.01 to 0.5, preferably 0.01 to 0.1 and more preferably 0.01 to 0.05. To obtain the optical density, the addition amount of dye is generally 0.5 mg/m$^2$ to 150 mg/m$^2$, preferably 0.5 mg/m$^2$ to 30 mg/m$^2$, and more preferably 0.5 mg/m$^2$ to 15 mg/m$^2$.

5) Ultra-High Contrast Promoting Agent

In order to form ultra-high contrast image suitable for use in graphic arts, it is preferred to add an ultra-high contrast promoting agent into the image forming layer. Details on the ultra-high contrast promoting agents, method of their addition and addition amount can be found in paragraph No. 0118, paragraph Nos. 0136 to 0193 of JP-A No. 11-223898, as compounds expressed by formulae (H), (1) to (3), (A), and (B) in Japanese Patent Application No. 11-87297, as compounds expressed by formulae (III) to (V) (specific compound: chemical No. 21 to chemical No. 24) in Japanese Patent Application No. 11-91652; as an ultra-high contrast accelerator, description can be found in paragraph No. 0102 of JP-A No. 11-65021, and in paragraph Nos. 0194 to 0195 of JP-A No. 11-223898.

In the case of using formic acid or formates as a strong fogging agent, it is preferably incorporated into the side having thereon the image forming layer containing photosensitive silver halide, at an amount of 5 mmol or less, preferably, 1 mmol or less per one mol of silver.

In the case of using an ultra-high contrast promoting agent in the photothermographic material of the invention, it is preferred to use an acid resulting from hydration of diphosphorus pentaoxide, or its salt in combination. Acids resulting from the hydration of diphosphorus pentaoxide or salts thereof include metaphosphoric acid (salt), pyrophosphoric acid (salt), orthophosphoric acid (salt), triphosphoric acid (salt), tetraphosphoric acid (salt), hexametaphosphoric acid (salt), and the like. Particularly preferred acids obtainable by the hydration of diphosphorus pentaoxide or salts thereof include orthophosphoric acid (salt) and hexametaphosphoric acid (salt). Specifically mentioned as the salts are sodium orthophosphate, sodium dihydrogen orthophosphate, sodium hexametaphosphate, ammonium hexametaphosphate, and the like.

The amount of usage of the acid obtained by hydration of diphoshorus pentaoxide or the salt thereof (i.e., the coverage per 1 m$^2$ of the photosensitive material) may be set as desired depending on the sensitivity and fogging, but preferred is an amount of 0.1 mg/m$^2$ to 500 mg/m$^2$, and more preferably, of 0.5 mg/M$^2$ to 100 mg/m$^2$.

The reducing agent, hydrogen bonding compound, development accelerating agent, and polyhalogen compounds according to the invention are preferably used as solid dispersions, and the method of preparing the solid dispersion is described in JP-A No. 2002-55405.

(Preparation of Coating Solution and Coating)

The temperature for preparing the coating solution for use in the image forming layer of the invention is preferably from 30° C. to 65° C., more preferably, from 35° C. or more to less than 60° C., and most preferably, from 35° C. to 55° C. Furthermore, the temperature of the coating solution for the image forming layer immediately after adding the polymer latex is preferably maintained in the temperature range from 30° C. to 65° C.

(Layer Constitution and other Constituting Components)

The image forming layer of the invention is constructed on a support by one or more layers. In the case of constituting the layer by a single layer, it comprises an organic silver salt, photosensitive silver halide, a reducing agent, and a binder, which may further comprise additional materials as desired if necessary, such as a toner, a coating aid, and other auxiliary agents. In the case of constituting the image forming layer from two layers or more, the first image forming layer (in general, a layer placed adjacent to the support) contains an organic silver salt and a photosensitive silver halide, and some of the other components must be incorporated in the second image forming layer or in both of the layers. The constitution of a multicolor photothermographic material may include combinations of two layers for those for each of the colors, or may contain all the components in a single layer as described in U.S. Pat. No. 4,708,928. In the case of multicolor photothermographic material, each of the image forming layers is maintained distinguished from each other by incorporating functional or non-functional barrier layer between each of the photosensitive layers as described in U.S. Pat. No. 4,460,681.

The photothermographic material according to he invention may have a non-photosensitive layer in addition to the image forming layer. The non-photosensitive layers can be classified depending on the layer arrangement into (a) a surface protective layer provided on the image forming layer (on the side farther from the support), (b) an intermediate layer provided among plural image forming layers or between the image forming layer and the protective layer, (c) an undercoat layer provided between the image forming layer and the support, and (d) a back layer provided to the side opposite to the image forming layer.

Furthermore, a layer that functions as an optical filter may be provided as (a) or (b) above. An antihalation layer may be provided as (c) or (d) to the photosensitive material.

1) Surface Protective Layer and Intermediate Layer

The photothermographic material of the invention may further comprise a surface protective layer with an object to prevent adhesion of the image forming layer. The surface protective layer may be a single layer, or plural layers. Description on the surface protective layer may be found in paragraph Nos. 0119 to 0120 of JP-A No. 11-65021, and in Japanese Patent Application No. 2000-171936.

The binder of the surface protective layer in the invention is as has been described above.

An intermediate layer is preferably provided between the surface protective layer and image forming layer for maintaining a good surface property of the coating. While the intermediate layer described in JP-A Nos. 10-186571, 11-119375 and 11-288058, at least two intermediate layers are preferably provided between the outermost layer and image forming layer in the invention. Since 50% by weight or more of the binder at the outermost layer comprises the latex having no setting ability, it is preferable that the intermediate layer at the side adjacent to the outermost layer contains a polymer having a setting ability (for example a water-soluble polymer derived from an animal such as gelatin, and a plant polysaccharide such as carrageenan).

2) Antihalation Layer

Descriptions on the antihalation layer can be found in paragraph Nos. 0123 to 0124 of JP-A No. 11-65021, in JP-A Nos. 11-223898, 9-230531, 10-36695, 10-104779, 11-231457, 11-352625, 11-352626, and the like.

The antihalation layer contains an antihalation dye having its absorption at the wavelength of the exposure light. In the case the exposure wavelength is in the infrared region, an infrared-absorbing dye may be used, and in such a case, preferred are dyes having no absorption in the visible region.

In the case of preventing halation from occurring by using a dye having absorption in the visible region, it is preferred that the color of the dye would not substantially reside after image formation, and is preferred to employ a means for bleaching color by the heat of thermal development; in particular, it is preferred to add a thermal bleaching dye and a base precursor to the non-photosensitive layer to impart function as an antihalation layer. Those techniques are described in JP-A No. 11-231457 and the like.

The amount of adding the thermal bleaching dye is determined depending on the usage of the dye. In general, it is used at an amount as such that the optical density (absorbance) exceeds 0.1 when measured at the desired wavelength. The optical density is preferably in a range of from 0.2 to 2. The usage of dyes to obtain optical density in the above range is generally from about 0.001 $g/m^2$ to 1 $g/m^2$.

By thermal bleaching the dye in such a manner, the optical density after thermal development can be lowered to 0.1 or lower. Two types or more of thermal bleaching dyes may be used in combination in a photothermographic material. Similarly, two types or more of base precursors may be used in combination.

In thermal bleaching process using such a thermal bleaching dye and a base precursor, preferred is to use a substance (for instance, diphenylsulfone, 4-chlorophenyl(phenyl)sulfone and 2-naphthyl benzoate, and the like), which is capable of lowering the melting point of a base precursor by 3° C. or more when mixed with a basic precursor as disclosed in JP-A No. 11-352626 from the viewpoint of thermal bleaching property or the like.

3) Back Layer

Back layers usable in the invention are described in paragraph Nos. 0128 to 0130 of JP-A No. 11-65021.

In the invention, coloring matters having maximum absorption in the wavelength range of from 300 nm to 450 nm may be added in order to improve a color tone of developed images and a deterioration of the images during aging. Such coloring matters are described in, for example, JP-A Nos. 62-210458, 63-104046, 63-103235, 63-208846, 63-306436, 63-314535 and 01-61745, and the like.

Such coloring matters are generally added in the range of from 0.1 $mg/m^2$ to 1 $g/m^2$, preferably to the back layer provided on the side opposite to the image forming layer.

In order to control the basic color tone, it is preferred to use a dye having an absorption peak in the wavelength range of from 580 to 680 nm. As a dye satisfying this purpose, preferred are oil-soluble azomethine dyes described in JP-A Nos. 4-359967 and 4-359968, or water-soluble phthalocyanine dyes described in Japanese Patent Application No. 2002-96797, which have low absorption intensity on the short wavelength side. The dyes for this purpose may be added to any of the layers, but more preferred is to add them in the non-photosensitive layer on the image forming plane side, or in the back plane side.

The photothermographic material of the invention is preferably a so-called one-side photosensitive material, which comprises at least one layer of a image forming layer containing silver halide emulsion on one side of the support, and a back layer on the other side.

4) Matting Agent

A matting agent may be preferably added to the photothermographic material of the invention in order to improve transportability. Description on the matting agent can be found in paragraphs Nos. 0126 to 0127 of JP-A No. 11-65021. The amount of adding the matting agents is preferably in the range from 1 $mg/m^2$ to 400 $mg/m^2$, more preferably, from 5 $mg/m^2$ to 300 $mg/m^2$, with respect to the coating amount per one $m^2$ of the photosensitive material.

There is no particular restriction on the shape of the matting agent usable in the invention and it may fixed form or non-fixed form. Preferred is to use those having fixed form and globular shape. Average particle size is preferably in the range of from 0.5 μm to 10 μm, more preferably, from 1.0 μm to 8.0 μm, and most preferably, from 2.0 μm to 6.0 μm. Furthermore, the particle distribution of the matting agent is preferably set as such that the variation coefficient may become 50% or lower, more preferably, 40% or lower, and most preferably, 30% or lower. The variation coefficient, herein, is defined by (the standard deviation of particle diameter)/(mean diameter of the particle)×100. Furthermore, it is preferred to use by blending two types of matting agents having low variation coefficient and the ratio of their mean diameters is more than 3.

The matness on the image forming layer surface is not restricted as far as star-dust trouble occurs, but the matness of 30 seconds to 2000 seconds is preferred, particularly preferred, 40 seconds to 1500 seconds as expressed by Beck's smoothness. Beck's smoothness can be calculated easily, by seeing Japan Industrial Standared (JIS) P8119 "The method of testing Beck's smoothness for papers and sheets using Beck's test apparatus", or TAPPI standard method T479.

The matness of the back layer surface in the invention is preferably in a range of 1200 seconds or less and 10 seconds or more; more preferably, 800 seconds or less and 20 seconds or more, as expressed by Beck smoothness.

In the invention, the matting agent is incorporated preferably in the outermost surface layer on the photosensitive layer plane or a layer functioning as the outermost surface layer, or a layer near to the outer surface, and a layer that functions as the so-called protective layer.

5) Surface pH

The surface pH of the photothermographic material according to the invention preferably yields a pH of 7.0 or lower, more preferably, 6.6 or lower, before thermal development treatment. Although there is no particular restriction concerning the lower limit, the lower limit of pH value is about 3, and the most preferred surface pH range is from 4 to 6.2. From the viewpoint of reducing the surface pH, it is preferred to use an organic acid such as phthalic acid derivative or a non-volatile acid such as sulfuric acid, or a volatile base such as ammonia for the adjustment of the surface pH. In particular, ammonia can be used favorably for the achievement of low surface pH, because it can easily vaporize to remove it before the coating step or before applying thermal development.

It is also preferred to use a non-volatile base such as sodium hydroxide, potassium hydroxide, lithium hydroxide, and the like, in combination with ammonia. The method of measuring surface pH value is described in paragraph No. 0123 of the specification of JP-A No. 2000-284399.

6) Hardener

A hardener can be used in each of image forming layer, protective layer, back layer, and the like. As examples of the hardener, descriptions of various methods can be found in pages 77 to 87 of T. H. James, "THE THEORY OF THE PHOTOGRAPHIC PROCESS, FOURTH EDITION" (Macmillan Publishing Co., Inc., 1977). Preferably used are, in addition to chromium alum, sodium salt of 2,4-dichloro-6-hydroxy-s-triazine, N,N-ethylene bis(vinylsulfonacetamide), and N,N-propylene bis(vinylsulfonacetamide), polyvalent metal ions described in page 78 of the above literature and the like, polyisocyanates described in U.S. Pat. No. 4,281,060, JP-A No. 6-208193 and the like, epoxy compounds of U.S. Pat. No. 4,791,042 and the like, and vinyl sulfone based compounds of JP-A No. 62-89048.

The hardener is added as a solution, and the solution is added to the coating solution for forming the protective layer 180 minutes before coating to just before coating, preferably 60 minutes before to 10 seconds before coating. However, so long as the effect of the invention is sufficiently exhibited, there is no particular restriction concerning the mixing method and the conditions of mixing. As specific mixing methods, there can be mentioned a method of mixing in the tank, in which the average stay time calculated from the flow rate of addition and the feed rate to the coater is controlled to yield a desired time, or a method using static mixer as described in Chapter 8 of N. Harnby, M. F. Edwards, A. W. Nienow (translated by Kouji Takahashi) "Liquid Mixing Technology" (Nikkan Kougyou Shinbun, 1989), and the like.

7) Surfactant

As the surfactant, the solvent, the support, antistatic agent or the electrically conductive layer, and the method for obtaining color images applicable in the invention, there can be mentioned those disclosed in paragraph Nos. 0132, 0133, 0134, 0135, and 0136, respectively, of JP-A No. 11-65021. The lubricant is described in paragraph Nos. 0061 to 0064 of JP-A No. 11-84573 and in paragraph Nos. 0049 to 0062 of Japanese Patent Application No. 11-106881.

In the invention, preferably used is fluorocarbon surfacant. Specific examples of fluorocarbon surfacants can be found in those described in JP-A Nos. 10-197985, 2000-19680, and 2000-214554. Polymer fluorocarbon surfacants described in JP-A 9-281636 can be also used preferably. For the photothermographic material in the invention, the fluorocarbon surfacants described in JP-A Nos. 2002-82411, 2001-242357, and 2001-264110 are preferably used. Especially, the usage of the fluorocarbon surfacants described in JP-A Nos. 2001-242357 and 2001-264110 in an aqueous coating solution is preferred viewed from the standpoint of capacity in static control, stability of the coating side state and sliding facility. The fluorocarbon surfactant described in JP-A No. 2001-264110 is mostly preferred because of high capacity in static control and that it needs small amount to use.

According to the invention, the fluorocarbon surfactant can be used on either side of image forming layer side or back layer side, but is preferred to use on the both sides. Further, it is particularly preferred to use in combination with electrically conductive layer including aforementioned metal oxides. In this case the amount of the fluorocarbon surfactant on the side of the electrically conductive layer can be reduced or removed.

The addition amount of the fluorocarbon surfactant is preferably in the range of 0.1 mg/m$^2$ to 100 mg/m$^2$ on each side of image forming layer and back layer, more preferably 0.3 mg/m$^2$ to 30 mg/m$^2$, further preferably 1 mg/m$^2$ to 10 mg/m$^2$. Especially, the fluorocarbon surfactant described in Japanese Patent Application No. 2001-264110 is effective, and used preferably in the range of 0.01 mg/m$^2$ to 10 mg/m$^2$, more preferably 0.1 mg/m$^2$ to 5 mg/m$^2$.

8) Antistatic Agent

The photothermographic material of the invention preferably contains an electrically conductive layer including metal oxides or electrically conductive polymers. The antistatic layer may serve as an undercoat layer, or a back surface protective layer, and the like, but can also be placed specially. As an electrically conductive material of the antistatic layer, metal oxides having enhanced electric conductivity by the method of introducing oxygen defects or different types of metallic atoms into the metal oxides are preferably for use. Examples of metal oxides are preferably selected from ZnO, $TiO_2$ and $SnO_2$. As the combination of different types of atoms, preferred are ZnO combined with Al, In; $SnO_2$ with Sb, Nb, P, halogen atoms, and the like; $TiO_2$ with Nb, Ta, and the like; Particularly preferred for use is $SnO_2$ combined with Sb. The amount of adding different types of atoms is preferably in a range of from 0.01 mol % to 30 mol %, and particularly preferably, in a range of from 0.1 mol % to 10 mol %. The shape of the metal oxides can include, for example, spherical, needle-like, or plate-like shape. The needle-like particles, with the rate of (the major axis)/(the minor axis) is more than 2.0, or more preferably, 3.0 to 50, is preferred viewed from the standpoint of the electric conductivity effect. The metal oxides is used preferably in the range from 1 mg/m$^2$ to 1000 mg/m$^2$, more preferably from 10 mg/m$^2$ to 500 mg/m$^2$, and further preferably from 20 mg/m$^2$ to 200 mg/m$^2$. The antistatic layer can be laid on either side of the image forming layer side or the back layer side, it is preferred to set between the support and the back layer. Examples of the antistatic layer in the invention include described in JP-A Nos. 11-65021, 56-143430, 56-143431, 58-62646, and 56-120519, and in paragraph Nos. 0040 to 0051 of JP-A No. 11-84573, U.S. Pat. No. 5,575,957, and in paragraph Nos. 0078 to 0084 of JP-A No. 11-223898.

9) Support

As the transparent support, favorably used is polyester, particularly, polyethylene terephthalate, which is subjected to heat treatment in the temperature range of from 130° C. to 185° C. in order to relax the internal strain caused by biaxial stretching and remaining inside the film, and to remove strain ascribed to heat shrinkage generated during thermal development. In the case of a photothermographic material for medical use, the transparent support may be colored with a blue dye (for instance, dye-1 described in the example of JP-A No. 8-240877), or may be uncolored. As to the support, it is preferred to apply undercoating technology, such as water-soluble polyester described in JP-A No. 11-84574, a styrene-butadiene copolymer described in JP-A No. 10-186565, a vinylidene chloride copolymer described in JP-A No. 2000-39684 and in paragraph Nos. 0063 to 0080 of Japanese Patent Application No. 11-106881, and the like. The moisture content of the support is preferably 0.5% by weight or less when coating for image forming layer and back layer is conducted on the support.

10) Other Additives

Furthermore, antioxidant, stabilizing agent, plasticizer, UV absorbent, or a coating aid may be added to the photothermographic material. Each of the additives is added to either of the photosensitive layer or the non-photosensitive layer. Reference can be made to WO No. 98/36322, EP-A No. 803764A1, JP-A Nos. 10-186567 and 10-18568, and the like.

11) Coating Method

The photothermographic material of the invention may be coated by any method. More specifically, various types of coating operations inclusive of extrusion coating, slide coating, curtain coating, immersion coating, knife coating, flow coating, or an extrusion coating using the type of hopper described in U.S. Pat. No. 2,681,294 are used. Preferably used is extrusion coating or slide coating described in pages 399 to 536 of Stephen F. Kistler and Petert M. Shweizer, "LIQUID FILM COATING" (Chapman & Hall, 1997), and most preferably used is slide coating. Example of the shape of the slide coater for use in slide coating is shown in FIG. 11*b*.1, page 427, of the same literature. If desired, two or more layers can be coated simultaneously by the method described in pages 399 to 536 of the same literature, or by the method described in U.S. Pat. No. 2,761,791 and British Patent No. 837,095. Particularly preferred in the invention is the method described in JP-A Nos. 2001-194748, 2002-153808, 2002-153803, and 2002-182333.

The coating solution for the layer containing organic silver salt in the invention is preferably a so-called thixotropic fluid. For the details of this technology, reference can be made to JP-A No. 11-52509. Viscosity of the coating solution for the layer containing organic silver salt in the invention at a shear velocity of 0.1S$^{-1}$ is preferably from 400 mPa·s to 100,000 mPa·s, and more preferably, from 500 mPa·s to 20,000 mPa·s. At a shear velocity of 1000S$^{-1}$, the viscosity is preferably from 1 mPa·s to 200 mPa·s, and more preferably, from 5 mPa·s to 80 mPa·s.

In the case of mixing two types of liquids on preparing the coating solution of the invention, known in-line mixer and in-plant mixer can be used favorably. Preferred in-line mixer of the invention is described in JP-A No. 2002-85948, and the in-plant mixer is described in JP-A No. 2002-90940.

The coating solution of the invention is preferably subjected to defoaming treatment to maintain the coated surface in a fine state. Preferred defoaming treatment method in the invention is described in JP-A No. 2002-66431.

In the case of applying the coating solution of the invention to the support, it is preferred to perform diselectrification in order to prevent the adhesion of dust, particulates, and the like due to charge up. Preferred example of the method of diselectrification for use in the invention is described in JP-A No. 2002-143747.

Since a non-setting coating solution is used for the image forming layer in the invention, it is important to precisely control the drying wind and the drying temperature. Preferred drying method for use in the invention is described in detail in JP-A Nos. 2001-194749 and 2002-139814.

In order to improve the film-forming properties in the photothermographic material of the invention, it is preferred to apply a heat treatment immediately after coating and drying. The temperature of the heat treatment is preferably in a range of from 60° C. to 100° C. at the film surface, and heating time is preferably in a range of from 1 second to 60 seconds. More preferably, heating is performed in a temperature range of from 70° C. to 90° C. at the film surface for a duration of from 2 seconds to 10 seconds. A preferred method of heat treatment for the invention is described in JP-A No. 2002-107872.

Furthermore, the production methods described in JP-A Nos. 2002-156728 and 2002-182333 are favorably used in the invention in order to stably and continuously produce the photothermographic material of the invention.

The photothermographic material is preferably of mono-sheet type (i.e., a type which can form image on the photothermographic material without using other sheets such as an image-receiving material).

12) Wrapping Material

In order to suppress fluctuation from occurring on the photographic property during a preservation of the photosensitive material of the invention before thermal development, or in order to improve curling or winding tendencies, it is preferred that a wrapping material having low oxygen transmittance and/or vapor transmittance is used. Preferably, oxygen transmittance is 50 ml/atm·$m^2$·day or lower at 25° C., more preferably, 10 ml/atm·$m^2$·day or lower, and most preferably, 1.0 ml/atm·$m^2$·day or lower. Preferably, vapor transmittance is 10 g/atm·$m^2$·day or lower, more preferably, 5 g/atm·$m^2$·day or lower, and most preferably, 1 g/atm·$m^2$·day or lower.

As specific examples of a wrapping material having low oxygen transmittance and/or vapor transmittance, reference can be made to, for instance, the wrapping material described in JP-A Nos.8-254793 and 2000-206653.

13) Other Applicable Techniques

Techniques which can be used for the photothermographic material of the invention also include those in EP803764A1, EP883022A1, WO98/36322, JP-A Nos. 56-62648, 58-62644, JP-A Nos. 09-43766, 09-281637, 09-297367, 09-304869, 09-311405, 09-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, JP-A Nos. 2000-187298, 2000-10229, 2000-47345, 2000-206642, 2000-98530, 2000-98531, 2000-112059, 2000-112060, 2000-112104, 2000-112064 and 2000-171936.

In instances of multi-color photothermographic materials, each photosensitive layer is in general, held distinctively each other by using a functional or nonfunctional barrier layer between each photosensitive layer as described in U.S. Pat. No. 4,460,681.

Constitution of the multi-color photothermographic material may include a combination of these two layers for each color. Alternatively, all ingredients may be included into a single layer as described in U.S. Pat. No. 4,708,928.

(Image Forming Method)

1) Exposure

As Laser beam according to the invention, He—Ne laser of red through infrared emission, red laser diode, or $Ar^+$, He—Ne, He—Cd laser of blue through green emission, blue laser diode are used. Preferred laser is red to infrared laser diode and the peak wavelength of laser beam is 600 nm to 900 nm, preferably 620 nm to 850 nm. In recent years, development has been made particularly on a light source module with an SHG (a second harmonic generator) and a laser diode integrated into a single piece whereby a laser output apparatus in a short wavelength region has come into the limelight. A blue laser diode enables high definition image recording and makes it possible to obtain an increase in recording density and a stable output over a long lifetime, which results in expectation of an expanded demand in the future. The peak wavelength of blue laser beam is 300 nm to 500 nm, preferably 400 nm to 500 nm.

Laser beam which oscillates in a longitudinal multiple modulation by a method such as high frequency superposition is also preferably employed.

2) Thermal Development

Although the development of the photothermographic material of the invention is usually performed by elevating the temperature of the photothermographic material exposed imagewise, any method may be used for this thermal development process. The temperature for the development is preferably 80° C. to 250° C., preferably 100° C. to 140° C., and more preferably 110° C. to 130° C. Time period for the development is preferably 1 second to 60 seconds, more preferably 3 seconds to 30 seconds, particularly preferably 5 seconds to 25 seconds, and most preferably 7 seconds to 15 seconds.

In the process for the thermal development, either drum type heaters or plate type heaters may be used. However, plate type heater processes are more preferred. Preferable process for the thermal development by a plate type heater may be a process described in JP-A NO. 11-133572, which discloses a thermal developing device in which a visible image is obtained by bringing a photothermographic material with a formed latent image into contact with a heating means at a thermal development region, wherein the heating means comprises a plate heater, and plurality of retainer rollers are oppositely provided along one surface of the plate heater, the thermal developing device is characterized in that thermal development is performed by passing the photothermographic material between the retainer rollers and the plate heater. It is preferred that the plate heater is divided into 2 to 6 portions, with the leading end having the lower temperature by 1° C. to 10° C. For example, 4 sets of plate heaters which can be independently subjected to the temperature control are used, and are controlled so that they respectively become 112° C., 119° C., 121° C., and 120° C. Such a process is also described in JP-A NO. 54-30032, which allows for excluding moisture and organic solvents included in the photothermographic material out of the system, and also allows for suppressing the change of shapes of the support of the photothermographic material upon rapid heating of the photothermographic material.

It is preferable that the heater is more stably controlled, and top part of one sheet of the photothermographic material is exposed and thermal development of the exposed portion is started before exposure of the end part of the sheet has completed, for downsizing the thermal developing apparatus and for shortening the thermal development time. Thermal development within 14 seconds is possible with this imager by using a three-steps of plate heaters controlled, for example, at 107° C., 121° C. and 121° C., respectively. And, output time of the first sheet is able to short about 60 sec.

3) System

Examples of a medical laser imager equipped with a light exposing part and a thermal developing part include Fuji Medical Dry Laser Imager FM-DP L. In connection with FM-DPL, description is found in Fuji Medical Review No. 8, pages 39 to 55. It goes without mentioning that those techniques may be applied as the laser imager for the photothermographic material of the invention. In addition, the present photothermographic material can be also applied as a photothermographic material for the laser imager used in "AD network" which was proposed by Fuji Film Medical Co., Ltd. as a network system accommodated to DICOM standard.

(Application of the Invention)

The image forming method in which the photothermographic material of the invention is used is preferably employed as image forming methods for photothermographic materials for use in medical imaging, photothermographic materials for use in industrial photographs, photothermographic materials for use in graphic arts, as well as for COM, through forming black and white images by silver imaging.

EXAMPLES

The present invention is specifically explained by way of Examples below, which should not be construed as limiting the invention thereto.

At first, the preparation of the support used for the Examples of the invention, and the materials used for coating are described below.

1. Preparation of PET Support

1) Film Manufacturing

PET having IV (intrinsic viscosity) of 0.66 (measured in phenol/tetrachloroethane=6/4 (weight ratio) at 25° C.) was obtained according to a conventional manner using terephthalic acid and ethylene glycol. The product was pelletized, dried at 130° C. for 4 hours, melted at 300° C. Thereafter, the mixture was extruded from a T-die and rapidly cooled to form a non-tentered film having such a thickness that the thickness should become 175 μm after tentered and thermal fixation.

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part was slit off, and both edges of the film were knurled. Then the film was rolled up at the tension of 4 kg/cm$^2$ to obtain a roll having the thickness of 175 μm.

2) Surface Corona Discharge Treatment

Both surfaces of the support were treated at room temperature at 20 m/minute using Solid State Corona Discharge Treatment Machine Model 6KVA manufactured by Piller GmbH. It was proven that treatment of 0.375 kV·A·minute/m$^2$ was executed, judging from the readings of current and voltage on that occasion. The frequency upon this treatment was 9.6 kHz, and the gap clearance between the electrode and dielectric roll was 1.6 mm.

3) Undercoating

<Preparation of Coating Solution for Undercoat Layer>

Formula (1) (for undercoat layer on the image forming layer side)

| | |
|---|---|
| Pesresin A-520 manufactured by Takamatsu Oil & Fat Co., Ltd. (30% by weight solution) | 59 g |
| polyethyleneglycol monononylphenylether (average ethylene oxide number = 8.5) 10% by weight solution | 5.4 g |

-continued

| | |
|---|---|
| MP-1000 manufactured by Soken Chemical & Engineering Co., Ltd. (polymer fine particle, mean particle diameter of 0.4 μm) | 0.91 g |
| distilled water | 935 mL |

Formula (2) (for first layer on the back surface)

| | |
|---|---|
| Styrene-butadiene copolymer latex (solid content of 40% by weight, styrene/butadiene weight ratio = 68/32) | 158 g |
| 8% by weight aqueous solution of 2,4-dichloro-6-hydroxy-S-triazine sodium salt | 20 g |
| 1% by weight aqueous solution of sodium laurylbenzenesulfonate | 10 mL |
| distilled water | 854 mL |

Formula (3) (for second layer on the back surface)

| | |
|---|---|
| $SnO_2$/SbO (9/1 weight ratio, mean particle diameter of 0.038 μm, 17% by weight dispersion) | 84 g |
| gelatin (10% by weight aqueous solution) | 89.2 g |
| METOLOSE TC-5 manufactured by Shin-Etsu Chemical Co., Ltd. (2% by weight aqueous solution) | 8.6 g |
| MP-1000 manufactured by Soken Chemical & Engineering Co., Ltd. | 0.01 g |
| 1% by weight aqueous solution of sodium dodecylbenzenesulfonate | 10 mL |
| NaOH (1% by weight) | 6 mL |
| Proxel (manufactured by Imperial Chemical Industries PLC) | 1 mL |
| distilled water | 805 mL |

<Undercoating>

Both surfaces of the biaxially tentered polyethylene terephthalate support having the thickness of 175 μm were subjected to the corona discharge treatment as described above. Thereafter, the aforementioned formula (1) of the coating solution for the undercoat was coated on one surface (image forming layer side) with a wire bar so that the amount of wet coating became 6.6 mL/m$^2$ (per one side), and dried at 180° C. for 5 minutes. Then, the aforementioned formula (2) of the coating solution for the undercoat was coated on the reverse face (back surface) with a wire bar so that the amount of wet coating became 5.7 mL/m$^2$, and dried at 180° C. for 5 minutes. Furthermore, the aforementioned formula (3) of the coating solution for the undercoat was coated on the reverse face (back surface) with a wire bar so that the amount of wet coating became 7.7 mL/m$^2$, and dried at 180° C. for 6 minutes. Thus, an undercoated support was produced.

2. Back Layer

1) Preparation of Coating Solution for Back Layer (Preparation of Dispersion of Solid Fine Particles (a) of Base Precursor)

A base precursor compound-1 in an amount of 2.5 kg, and 300 g of a surfactant (trade name: DEMOL N, manufactured by Kao Corporation), 800 g of diphenyl sulfone, 1.0 g of benzoisothiazolinone sodium salt and distilled water were added to give the total amount of 8.0 kg and mixed. The mixed liquid was subjected to beads dispersion using a horizontal sand mill (UVM-2: manufactured by IMEX Co., Ltd.). Process for dispersion included feeding the mixed liquid to UVM-2 packed with zirconia beads having the mean particle diameter of 0.5 mm with a diaphragm pump, followed by the dispersion at the inner pressure of 50 hPa or higher until desired mean particle diameter could be achieved.

The dispersion was continued until the ratio of the optical density at 450 nm and the optical density at 650 nm for the spectral absorption of the dispersion (D450/D650) became 3.0 upon spectral absorption measurement. Thus resulting dispersion was diluted with distilled water so that the concentration of the base precursor became 25% by weight, and filtrated (with a polypropylene filter having the mean fine pore diameter of 3 μm) for eliminating dust to put into practical use.

(Preparation of Dispersion of Solid Fine Particle of Dye)

A cyanine dye compound-1 in an amount of 6.0 kg, and 3.0 kg of sodium p-dodecylbenzenesulfonate, 0.6 kg of DEMOL SNB (a surfactant manufactured by Kao Corporation), and 0.15 kg of a defoaming agent (trade name: SURFYNOL 104E, manufactured by Nissin Chemical Industry Co., Ltd.) were mixed with distilled water to give the total liquid amount of 60 kg. The mixed liquid was subjected to dispersion with 0.5 mm zirconia beads using a horizontal sand mill (UVM-2: manufactured by IMEX Co., Ltd.).

The dispersion was dispersed until the ratio of the optical density at 650 nm and the optical density at 750 nm for the spectral absorption of the dispersion (D650/D750) became 5.0 or greater upon spectral absorption measurement. Thus resulting dispersion was diluted with distilled water so that the concentration of the cyanine dye became 6% by weight, and filtrated with a filter (mean fine pore diameter: 1 μm) for eliminating dust to put into practical use.

(Preparation of Coating Solution for Antihalation Layer)

A vessel was kept at 40° C., and thereto were added 40 g of gelatin, 20 g of monodispersed polymethyl methacrylate fine particles (mean particle size of 8 μm, standard deviation of particle diameter of 0.4), 0.1 g of benzoisothiazolinone and 490 mL of water to allow gelatin to be dissolved. Additionally, 2.3 mL of a 1 mol/L aqueous sodium hydroxide solution, 40 g of the aforementioned dispersion of the solid fine particle of the dye, 90 g of the aforementioned dispersion of the solid fine particles (a) of the base precursor, 12 mL of a 3% by weight aqueous solution of sodium polystyrenesulfonate, and 180 g of a 10% by weight solution of SBR latex were admixed. Just prior to the coating, 80 mL of a 4% by weight aqueous solution of N,N-ethylenebis (vinylsulfone acetamide) was admixed to give a coating solution for the antihalation layer.

2) Preparation of Coating Solution for Back Surface Protective Layer

A vessel was kept at 40° C., and thereto were added 40 g of gelatin, 35 mg of benzoisothiazolinone and 840 ml of water to allow gelatin to be dissolved. Additionally, 5.8 ml of a 1 mol/L aqueous sodium hydroxide solution, liquid paraffin emulsion at 1.5 g equivalent to liquid paraffin, 10 mL of a 5% by weight aqueous solution of di(2-ethylhexyl) sodium sulfosuccinate, 20 mL of a 3% by weight aqueous solution of sodium polystyrenesulfonate, 2.4 mL of a 2% by weight solution of a fluorochemical surfactant (F-1), 2.4 mL of a 2% by weight solution of a fluorocarbon surfactant (F-2), and 32 g of a 19% by weight solution of methyl methacrylate/styrene/butyl acrylate/hydroxyethyl methacrylate/acrylic acid copolymer (copolymer weight ratio of 57/8/28/5/2) latex were admixed. Just prior to the coating, 25 mL of a 4% by weight aqueous solution of N,N-ethylenebis (vinylsulfone acetamide) was admixed to give a coating solution for the back surface protective layer.

3) Coating of Back Layer

The back surface side of the undercoated support as described above was subjected to simultaneous double coating so that the coating solution for the antihalation layer gives the coating amount of gelatin of 0.52 g/m$^2$, and so that the coating solution for the back surface protective layer gives the coating amount of gelatin of 1.7 g/m$^2$, followed by drying to produce a back layer.

3. Preparation of Materials for Coating

1) Silver Halide Emulsion

<<Preparation of Silver Halide Emulsion-1>>

To 1421 mL of distilled water was added 3.1 mL of a 1% by weight potassium bromide solution. Further, a liquid added with 3.5 mL of sulfuric acid having the concentration of 0.5 mol/L and 31.7 g of phthalated gelatin was kept at 30° C. while stirring in a stainless steel reaction pot, and thereto were added total amount of: solution A prepared through diluting 22.22 g of silver nitrate by adding distilled water to give the volume of 95.4 mL; and solution B prepared through diluting 15.3 g of potassium bromide and 0.8 g of potassium iodide with distilled water to give the volume of 97.4 mL, over 45 seconds at a constant flow rate. Thereafter, 10 mL of a 3.5% by weight aqueous solution of hydrogen peroxide was added thereto, and 10.8 mL of a 10% by weight aqueous solution of benzimidazole was further added. Moreover, a solution C prepared through diluting 51.86 g of silver nitrate by adding distilled water to give the volume of 317.5 mL and a solution D prepared through diluting 44.2 g of potassium bromide and 2.2 g of potassium iodide with distilled water to give the volume of 400 mL were added. A controlled double jet method was executed through adding total amount of the solution C at a constant flow rate over 20 minutes, accompanied by adding the solution D while maintaining the pAg at 8.1. Hexachloroiridium (III) potassium salt was added to give $1\times10^{-4}$ mol per one mol of silver at 10 minutes post initiation of the addition of the solution C and the solution D in its entirety. Moreover, at 5 seconds after completing the addition of the solution C, a potassium iron (II) hexacyanide aqueous solution was added at a total amount of $3\times10^{-4}$ mol per one mol of silver. The mixture was adjusted to the pH of 3.8 with sulfuric acid at the concentration of 0.5 mol/L. After stopping stirring, the mixture was subjected to precipitation/desalting/water washing steps. The mixture was adjusted to the pH of 5.9 with sodium hydroxide at the concentration of one mol/L to produce a silver halide dispersion having the pAg of 8.0.

The silver halide dispersion was kept at 38° C. with stirring, and thereto was added 5 mL of a 0.34% by weight methanol solution of 1,2-benzoisothiazoline-3-one, followed by elevating the temperature to 47° C. at 40 minutes thereafter. At 20 minutes after elevating the temperature, sodium benzene thiosulfonate in a methanol solution was added at $7.6\times10^{-5}$ mol per one mol of silver. At additional 5 minutes later, a tellurium sensitizer C in a methanol solution was added at $2.9\times10^{-4}$ mol per one mol of silver and subjected to aging for 91 minutes. Thereafter, a methanol solution of a spectral sensitizer A and a spectral sensitizer B with a molar ratio of 3:1 was added thereto at $1.2\times10^{-3}$ mol in total of the spectral sensitizer A and B per one mol of silver. At one minute later, 1.3 mL of a 0.8% by weight N,N'-dihydroxy-N",N"-diethylmelamine in methanol was added thereto, and at additional 4 minutes thereafter, 5-methyl-2-mercaptobenzimidazole in a methanol solution at $4.8\times10^{-3}$ mol per one mol of silver, 1-phenyl-2-heptyl-5-mercapto-1,3,4-triazole in a methanol solution at $5.4\times10^{-3}$ mol per one mol of silver, and 1-(3-methylureidophenyl)-5-mercaptotetrazole in an aqueous solution at $8.5\times10^{-3}$ mol per one mol of silver were added to produce a silver halide emulsion-1.

Grains in thus prepared silver halide emulsion were silver iodide bromide grains having a mean sphere equivalent diameter of 0.042 μm, a variation coefficient of 20%, which uniformly include iodine at 3.5 mol %. Grain size and the like were determined from the average of 1000 grains using an electron microscope. The [100] face ratio of these grains was found to be 80% using a Kubelka-Munk method.

<<Preparation of Silver Halide Emulsion-2>>

Preparation of silver halide emulsion-2 was conducted in a similar manner to the process in the preparation of the silver halide emulsion-1 except that: the temperature of the liquid upon the nucleation process was altered from 30° C. to 47° C.; the solution B was changed to that prepared through diluting 15.9 g of potassium bromide with distilled water to give the volume of 97.4 mL; the solution D was changed to that prepared through diluting 45.8 g of potassium bromide with distilled water to give the volume of 400 mL; time period for adding the solution C was changed to 30 minutes; and potassium iron (II) hexacyanide was deleted. The precipitation/desalting/water washing/dispersion were carried out similarly to the silver halide emulsion-1. Furthermore, the spectral sensitization, chemical sensitization, and addition of 5-methyl-2-mercaptobenzimidazole and 1-phenyl-2-heptyl-5-mercapto-1,3,4-triazole was executed similarly to the emulsion-1 except that: the amount of the tellurium sensitizer C to be added was changed to $1.1\times10^{-4}$ mol per one mol of silver; the amount of the methanol solution of the spectral sensitizer A and a spectral sensitizer B with a molar ratio of 3:1 to be added was changed to $7.0\times10^{-4}$ mol in total of the spectral sensitizer A and the spectral sensitizer B per one mol of silver; the addition of 1-phenyl-2-heptyl-5-mercapto-1,3,4-triazole was changed to give $3.3\times10^{-3}$ mol per one mol of silver; and the addition of 1-(3-methylureidophenyl)-5-mercaptotetrazole was changed to give $4.7\times10^{-3}$ mol per one mol of silver to produce a silver halide emulsion-2. The emulsion grains in the silver halide emulsion-2 were pure cubic silver bromide grains having a mean sphere equivalent diameter of 0.080 μm and a variation coefficient of 20%.

<<Preparation of Silver Halide Emulsion-3>>

Preparation of a silver halide emulsion-3 was conducted in a similar manner to the process in the preparation of the silver halide emulsion-1 except that the temperature of the liquid upon the nucleation process was altered from 30° C. to 27° C. In addition, the precipitation/desalting/water washing/dispersion were carried out similarly to the silver halide emulsion-1. Silver halide emulsion-3 was obtained similarly to the emulsion-1 except that: the addition of the methanol solution of the spectral sensitizer A and the spectral sensitizer B was changed to the solid dispersion (aqueous gelatin solution) at a molar ratio of 1:1 with the amount to be added being $6.0\times10^{-3}$ mol in total of the spectral sensitizer A and spectral sensitizer B per one mol of silver; the amount of the tellurium sensitizer C to be added was changed to $5.2\times10^{-4}$ mol per one mol of silver; and bromoauric acid at $5\times10^{-4}$ mol per one mol of silver and potassium thiocyanate at $2\times10^{-3}$ mol per one mol of silver were added at 3 minutes following the addition of the tellurium sensitizer. The grains in the silver halide emulsion-3 were silver iodide bromide grains having a mean sphere equivalent diameter of 0.034 μm and a variation coefficient of 20%, which uniformly include iodine at 3.5 mol %.

<<Preparation of Mixed Emulsion A for Coating Solution>>

The silver halide emulsion-1 at 70% by weight, the silver halide emulsion-2 at 15% by weight and the silver halide emulsion-3 at 15% by weight were dissolved, and thereto was added benzothiazolium iodide at $7\times10^{-3}$ mol per one mol of silver with a 1% by weight aqueous solution. Further, water was added thereto to give the content of silver of 38.2 g per one kg of the mixed emulsion for a coating solution, and 1-(3-methylureidophenyl)-5-mercaptotetrazole was added to give 0.34 g per 1 kg of the mixed emulsion for a coating solution.

2) Preparation of Dispersion of Silver Salt of Fatty Acid

<<Preparation of Dispersion of Silver Salt of Fatty Acid A>>

87.6 kg of behenic acid (Henkel Co., trade name: Edenor C22-85R: the content of behenic acid being 88 mol %, lignoceric acid 2 mol %, arachidic acid 6 mol %, erucic acid 0.3 mol % and, others 3.7 mol %), 423 L of distilled water, 49.2 L of an aqueous sodium hydroxide solution at the concentration of 5 mol/L, 120 L of t-butyl alcohol were admixed, and subjected to a reaction with stirring at 75° C. for one hour to give a solution A of a sodium behenate. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution A of a sodium behenate and the total amount of the aqueous silver nitrate solution with sufficient stirring at a constant flow rate over 93 minutes and 15 seconds, and 90 minutes, respectively. Upon this operation, during first 11 minutes following the initiation of adding the aqueous silver nitrate solution, the added material was restricted to the aqueous silver nitrate solution alone. The addition of the solution A of a sodium behenate was thereafter started, and during 14 minutes and 15 seconds following the completion of adding the aqueous silver nitrate solution, the added material was restricted to the solution A of a sodium behenate alone. The temperature inside of the reaction vessel was then set to be 30° C., and the temperature outside was controlled so that the liquid temperature could be kept constant. In addition, the temperature of a pipeline for the addition system of the solution A of a sodium behenate was kept constant by circulation of warm water outside of a double wall pipe, so that the temperature of the liquid at an outlet in the leading edge of the nozzle for addition was adjusted to be 75° C. Further, the temperature of a pipeline for the addition system of the aqueous silver nitrate solution was kept constant by circulation of cool water outside of a double wall pipe. Position at which the solution A of a sodium behenate was added and the position at which the aqueous silver nitrate solution was added were arranged symmetrically with a shaft for stirring located at a center. Moreover, both of the positions were adjusted to avoid contact with the reaction liquid.

After completing the addition of the solution A of a sodium behenate, the mixture was left to stand at the temperature as it is for 20 minutes. The temperature of the mixture was then elevated to 35° C. over 30 minutes followed by aging for 210 minutes. Immediately after completing the aging, solid matters were filtered out with centrifugal filtration. The solid matters were washed with water until the electric conductivity of the filtrated water became 30 μS/cm. A silver salt of the fatty acids was thus obtained. The resulting solid matters were stored as a wet cake without drying.

When the shape of the resulting particles of the silver behenate was evaluated by an electron micrography, a flake crystal was revealed having a=0.14 μm, b=0.4 μm and c=0.6 μm on the average value, with a mean aspect ratio of 5.2, a mean sphere equivalent diameter of 0.52 μm and a variation coefficient of 15% (a, b and c are as defined aforementioned.).

To the wet cake corresponding to 260 kg of a dry solid matter content, were added 19.3 kg of polyvinyl alcohol (trade name: PVA-217) and water to give the total amount of 1000 kg. Then, slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1260 kg/cm$^2$ to give a dispersion of the silver behenate. For the cooling manipulation, coiled heat exchangers were equipped fore and aft of the interaction chamber respectively, and accordingly, the temperature for the dispersion was set to be 18° C. by regulating the temperature of the cooling medium.

<<Preparation of Dispersion of Silver Salt of Fatty Acid B>>

<Purification of Behenic Acid>

Behenic acid manufactured by Henkel Co. (trade name: Edenor C22-85R) in an amount of 100 kg was admixed with 1200 kg of isopropyl alcohol, and dissolved at 50° C. The mixture was filtrated through a 10 μm filter, and cooled to 30° C. to allow recrystallization. Cooling speed for the recrystallization was controlled to be 3° C./hour. The resulting crystal was subjected to centrifugal filtration, and washing was performed with 100 kg of isopropyl alcohol, followed by repeating the aforementioned recrystallization procedure twice additionally. Thereafter, the crystal was dried. Thus resulting crystal was esterified, and subjected to GC-FID analysis to give the results of the content of behenic acid being 96 mol %, lignoceric acid 2 mol % and arachidic acid 2 mol %. In addition, erucic acid was included at 0.001 mol %.

<Preparation of Dispersion of Silver Salt of Fatty Acid B>

88 kg of purified behenic acid, 422 L of distilled water, 49.2 L of an aqueous sodium hydroxide solution at the concentration of 5 mol/L, 120 L of t-butyl alcohol were admixed, and subjected to a reaction with stirring at 75° C. for one hour to give a solution B of a sodium behenate. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution B of a sodium behenate and the total amount of the aqueous silver nitrate solution with sufficient stirring at a constant flow rate over 93 minutes and 15 seconds, and 90 minutes, respectively. Upon this operation, during first 11 minutes following the initiation of adding the aqueous silver nitrate solution, the added material was restricted to the aqueous silver nitrate solution alone. The addition of the solution B of a sodium behenate was thereafter started, and during 14 minutes and 15 seconds following the completion of adding the aqueous silver nitrate solution, the added material was restricted to the solution B of a sodium behenate alone. The temperature inside of the reaction vessel was then set to be 30° C., and the temperature outside was controlled so that the liquid temperature could be kept constant. In addition, the temperature of a pipeline for the addition system of the solution B of a sodium behenate was kept constant by circulation of warm water outside of a double wall pipe, so that the temperature of the liquid at an outlet in the leading edge of the nozzle for addition was adjusted to be 75° C. Further, the temperature of a pipeline for the addition system of the aqueous silver nitrate solution was kept constant by circulation of cool water outside of a double wall pipe. Position at which the solution B of a sodium behenate was added, and the position at which the aqueous silver nitrate solution was added, were arranged symmetrically with a shaft for stirring located at a center. Moreover, both of the positions were adjusted to avoid contact with the reaction liquid.

After completing the addition of the solution B of a sodium behenate, the mixture was left to stand at the temperature as it is for 20 minutes. The temperature of the mixture was then elevated to 35° C. over 30 minutes followed by aging for 210 minutes. Immediately after completing the aging, solid matters were filtered out with centrifugal filtration. The solid matters were washed with water until the electric conductivity of the filtrated water became 30 μS/cm. A silver salt of the fatty acids was thus obtained. The resulting solid matters were stored as a wet cake without drying.

When the shape of the resulting particles of the silver behenate was evaluated by an electron micrography, a crystal was revealed having a=0.21 μm, b=0.4 μm and c=0.4 μm on the average value, with a mean aspect ratio of 2.1 and a variation coefficient of 11% (a, b and c are as defined aforementioned.).

To the wet cake corresponding to 260 kg of a dry solid matter content, were added 19.3 kg of polyvinyl alcohol (trade name: PVA-217) and water to give the total amount of 1000 kg. Then, slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1150 kg/cm$^2$ to give a dispersion of the silver behenate. For the cooling manipulation, coiled heat exchangers were equipped fore and aft of the interaction chamber respectively, and accordingly, the temperature for the dispersion was set to be 18° C. by regulating the temperature of the cooling medium.

3) Preparation of Reducing Agent Dispersion

<<Preparation of Reducing Agent-1 Dispersion>>

To 10 kg of a reducing agent-1 (2,2'-methylenebis-(4-ethyl-6-tert-butylphenol)) and 16 kg of a 10% by weight aqueous solution of modified polyvinyl alcohol (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 3 hours. Thereafter, 0.2 g of a benzoisothiazolinone sodium salt and water were added thereto, thereby adjusting the concentration of the reducing agent to be 25% by weight. This dispersion was subjected to thermal treatment at 60° C. for 5 hours to obtain a reducing agent-1 dispersion. Particles of the reducing agent included in thus resulting reducing agent dispersion had a median diameter of 0.40 μm, and a maximum particle diameter of 1.4 μm or less. The resultant reducing agent dispersion was subjected to filtration with a polypropylene filter having a pore size of 3.0 μm to remove foreign substances such as dust, and stored.

<<Preparation of Reducing Agent-2 Dispersion>>

To 10 kg of a reducing agent-2 (6,6'-di-t-butyl-4,4'-dimethyl-2,2'-butylidenediphenol)) and 16 kg of a 10% by weight aqueous solution of modified polyvinyl alcohol (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 3 hours and 30 minutes. Thereafter, 0.2 g of a benzoisothiazolinone sodium salt and water were added thereto, thereby adjusting the concentration of the reducing agent to be 25% by weight. This dispersion was warmed at 40° C. for one hour, followed by a subsequent thermal treatment at 80° C. for one hour to obtain a reducing agent-2 dispersion. Particles of the reducing agent included in thus resulting reducing agent-2 dispersion had a median diameter of 0.50 μm, and a maximum particle diameter of 1.6 μm or less. The resultant reducing agent-2 dispersion was subjected to filtration with a polypropylene filter having a pore size of 3.0 μm to remove foreign substances such as dust, and stored.

4) Preparation of Hydrogen Bonding Compound-1 Dispersion

To 10 kg of a hydrogen bonding compound-1 (tri(4-t-butylphenyl)phosphineoxide) and 16 kg of a 10% by weight aqueous solution of modified polyvinyl alcohol (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 4 hours. Thereafter, 0.2 g of a benzoisothiazolinone sodium salt and water were added thereto, thereby adjusting the concentration of the hydrogen bonding compound to be 25% by weight. This dispersion was warmed at 40° C. for one hour, followed by a subsequent thermal treatment at 80° C. for one hour to obtain a hydrogen bonding compound dispersion. Particles of the hydrogen bonding compound included in thus resulting hydrogen bonding compound-1 dispersion had a median diameter of 0.45 μm, and a maximum particle diameter of 1.3 μm or less. The resultant hydrogen bonding compound-1 dispersion was subjected to filtration with a polypropylene filter having a pore size of 3.0 μm to remove foreign substances such as dust, and stored.

5) Preparation of Development Accelerator-1 Dispersion

To 10 kg of a development accelerator-1 and 20 kg of a 10% by weight aqueous solution of modified polyvinyl alcohol (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 3 hours and 30 minuets. Thereafter, 0.2 g of a benzoisothiazolinone sodium salt and water were added thereto, thereby adjusting the concentration of the development accelerating agent to be 20% by weight. Accordingly, a development accelerator-1 dispersion was obtained. Particles of the development accelerator included in thus resulting development accelerator dispersion had a median diameter of 0.48 μm, and a maximum particle diameter of 1.4 μm or less. The resultant development accelerator dispersion was subjected to filtration with a polypropylene filter having a pore size of 3.0 μm to remove foreign substances such as dust, and stored.

Also concerning solid dispersions of a development accelerator-2 and a color-tone-adjusting agent-1, dispersion was executed in a similar manner to the development accelerator-1, and thus dispersions of 20% by weight and 15% by weight were respectively obtained.

6) Preparation of Polyhalogen Compound Dispersion

<<Preparation of Organic Polyhalogen Compound-1 Dispersion>>

An organic polyhalogen compound-1 (tribromomethane sulfonylbenzene) in an amount of 10 kg, 10 kg of a 20% by weight aqueous solution of modified polyvinyl alcohol (manufactured by Kuraray Co., Ltd., Poval MP203), 0.4 kg of a 20% by weight aqueous solution of sodium triisopropylnaphthalenesulfonate and 14 kg of water. were added, and thoroughly admixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 5 hours. Thereafter, 0.2 g of a benzoisothiazolinone sodium salt and water were added thereto, thereby adjusting the concentration of the organic polyhalogen compound to be 26% by weight. Accordingly, an organic polyhalogen compound-1 dispersion was obtained. Particles of the organic polyhalogen compound included in thus resulting polyhalogen compound dispersion had a median diameter of 0.41 μm, and a maximum particle diameter of 2.0 μm or less. The resultant organic polyhalogen compound dispersion was subjected to filtration with a polypropylene filter having a pore size of 10.0 μm to remove foreign substances such as dust, and stored.

<<Preparation of Organic Polyhalogen Compound-2 Dispersion>>

An organic polyhalogen compound-2 (N-butyl-3-tribromomethane sulfonylbenzoamide) in an amount of 10 kg, 20 kg of a 10% by weight aqueous solution of modified polyvinyl alcohol (manufactured by Kuraray Co., Ltd., Poval MP203) and 0.4 kg of a 20% by weight aqueous solution of sodium triisopropylnaphthalenesulfonate were added, and thoroughly admixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 5 hours. Thereafter, 0.2 g of a benzoisothiazolinone sodium salt and water were added thereto, thereby adjusting the concentration of the organic polyhalogen compound to be 30% by weight. This fluid dispersion was heated at 40° C. for 5 hours to obtain an organic polyhalogen compound-2 dispersion. Particles of the organic polyhalogen compound included in thus resulting polyhalogen compound dispersion had a median diameter of 0.40 μm, and a maximum particle diameter of 1.3 μm or less. The resultant organic polyhalogen compound dispersion was subjected to filtration with a polypropylene filter having a pore size of 3.0 μm to remove foreign substances such as dust, and stored.

<<Preparation of Organic Polyhalogen Compound-3 Dispersion>>

An organic polyhalogen compound-3 (2-tribromomethane sulfonylnaphthalene) in an amount of 10 kg, 10 kg of a 20% by weight aqueous solution of modified polyvinyl alcohol (manufactured by Kuraray Co., Ltd., Poval MP203), 0.4 kg of a 20% by weight aqueous solution of sodium triisopropylnaphthalenesulfonate and 16 kg of water were added, and thoroughly admixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 5 hours. Thereafter, 0.2 g of a benzoisothiazolinone sodium salt and water were added thereto, thereby adjusting the concentration of the organic polyhalogen compound to be 23.5% by weight. Accordingly, an organic polyhalogen compound-3 dispersion was obtained. Particles of the organic polyhalogen compound included in thus resulting polyhalogen compound dispersion had a median diameter of 0.36 μm, and a maximum particle diameter of 2.0 μm or less. The resultant organic polyhalogen compound dispersion was subjected to filtration with a polypropylene filter having a pore size of 10.0 μm to remove foreign substances such as dust, and stored.

7) Preparation of Phthalazine Compound-1 Solution

Modified polyvinyl alcohol MP203 manufactured by Kuraray Co., Ltd., in an amount of 8 kg was dissolved in 174.57 kg of water, and then thereto were added 3.15 kg of a 20% by weight aqueous solution of sodium triisopropylnaphthalenesulfonate and 14.28 kg of a 70% by weight aqueous solution of a phthalazine compound-1 (6-isopropyl phthalazine) to prepare a 5% by weight phthalazine compound-1 solution.

8) Preparation of Mercapto Compound

<<Preparation of an Aqueous Solution of Mercapto Compound-1>>

A mercapto compound-1 (1-(3-sulfophenyl)-5-mercaptotetrazole sodium salt) in an amount of 7 g was dissolved in 993 g of water to give a 0.7% by weight aqueous solution.

<<Preparation of an Aqueous Solution of Mercapto Compound-2>>

A mercapto compound-2 (1-(3-methylureidophenyl)-5-mercaptotetrazole) in an amount of 20 g was dissolved in 980 g of water to give a 2.0% by weight aqueous solution.

9) Preparation of Pigment-1 Dispersion

C.I. Pigment Blue 60 in an amount of 64 g and 6.4 g of DEMOL N manufactured by Kao Corporation were added to 250 g water and thoroughly mixed to give slurry. Zirconia beads having the mean particle diameter of 0.5 mm were provided in an amount of 800 g, and charged in a vessel with the slurry. Dispersion was performed with a dispersing machine (¼G sand grinder mill: manufactured by IMEX Co., Ltd.) for 25 hours. Thereto was added water to adjust so that the concentration of the pigment became 5% by weight to obtain a pigment-1 dispersion. Particles of the pigment included in thus resulting pigment dispersion had a mean particle diameter of 0.21 μm.

10) Preparation of SBR Latex Solution (Synthesis of SBR latex (Tg=17° C.)

To a polymerization tank of a gas monomer reaction apparatus (manufactured by Taiatsu Techno Corporation, TAS-2J type), were charged 287 g of distilled water, 7.73 g of a surface active agent (Pionin A-43-S (manufactured by TAKEMOTO OIL & FAT CO., LTD.): solid matter content of 48.5% by weight), 14.06 mL of 1 mol/L sodium hydroxide, 0.15 g of ethylenediamine tetraacetate tetrasodium salt, 255 g of styrene, 11.25 g of acrylic acid, and 3.0 g of tert-dodecyl mercaptan, followed by sealing of the reaction vessel and stirring at a stirring rate of 200 rpm. Degassing was conducted with a vacuum pump, followed by repeating nitrogen gas replacement several times. Tereto was injected 108.75 g of 1,3-butadiene, and the inner temperature was elevated to 60° C. Thereto was added a solution of 1.875 g of ammonium persulfate dissolved in 50 mL of water, and the mixture was stirred for 5 hours as it stands. The temperature was further elevated to 90° C., followed by stirring for 3 hours. After completing the reaction, the inner temperature was lowered to reach to the room temperature, and thereafter the mixture was treated by adding 1 mol/L sodium hydroxide and ammonium hydroxide to give the molar ration of $Na^+$ ion:$NH_4^+$ ion=1:5.3, and thus, the pH of the mixture was adjusted to 8.4. Thereafter, filtration with a polypropylene filter having the pore size of 1.0 μm was conducted to remove foreign substances such as dust followed by storage. Accordingly, SBR latex was obtained in an amount of 774.7 g. Upon the measurement of halogen ion by ion chromatography, concentration of chloride ion was revealed to be 3 ppm. As a result of the measurement of the concentration of the chelating agent by high performance liquid chromatography, it was revealed to be 145 ppm.

The aforementioned latex had the mean particle diameter of 90 nm, Tg of 17° C., solid matter concentration of 44% by weight, the equilibrium moisture content at 25° C., 60% RH of 0.6% by weight, ionic conductance of 4.80 mS/cm (measurement of the ionic conductance performed using a conductivity meter CM-30S manufactured by Toa Electronics Ltd. for the latex stock solution (44% by weight) at 25° C.).

11) Preparation of Aqueous Solution of Water-soluble Metalo-Phthalocyanine Dye-1

A solution containing 18.5 mol % of copper phthalocyanine derivative (C. I. Direct Blue 199) and 15 mol % of urea was prepared, and just before using the solution was diluted with water to give the content of copper phthalocyanine derivative (C. I. Direct Blue 199) being 2 mol %, to obtain an aqueous solution of water-soluble metalo-phthalocyanine dye-1.

Chemical structures of the compounds used in Examples of the invention are shown below.

Spectral Sensitizer A

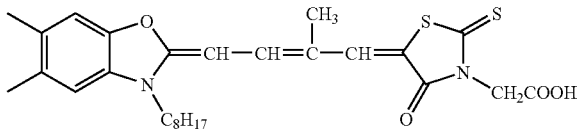

Spectral Sensitizer B

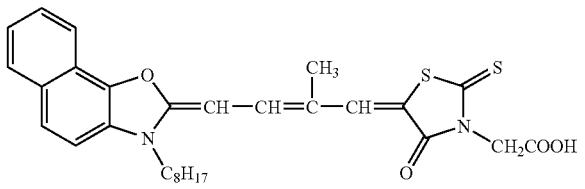

-continued
Tellurium Sensitizer C
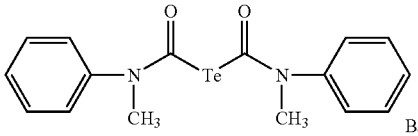
Base Precursor-1
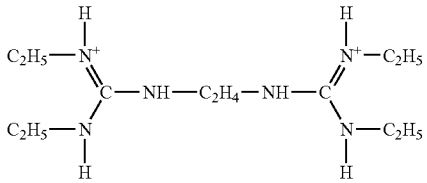
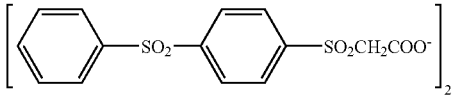
Cyanine Dye-1
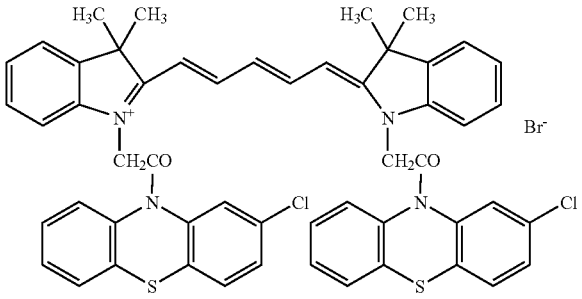
Blue Dye-2
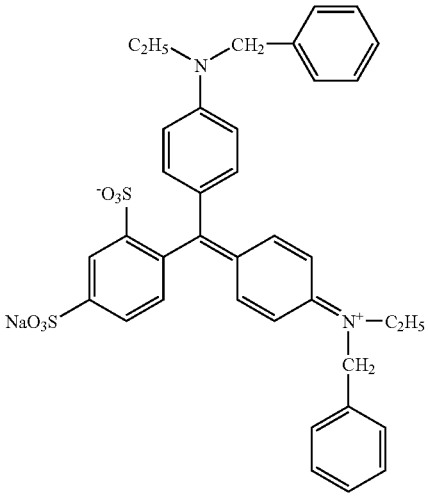
Blue Dye-1
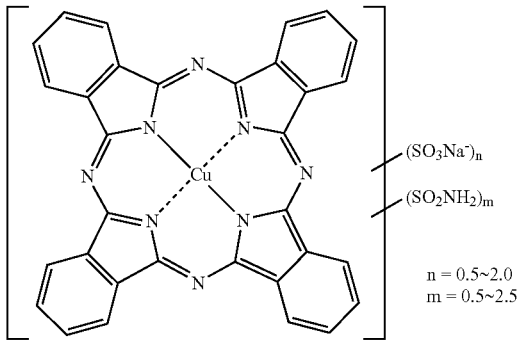
n = 0.5~2.0
m = 0.5~2.5
-continued
Yellow Dye-1
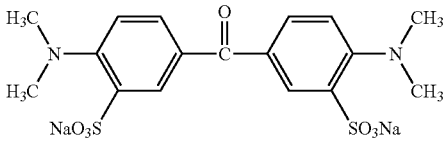
Reducing agent-1
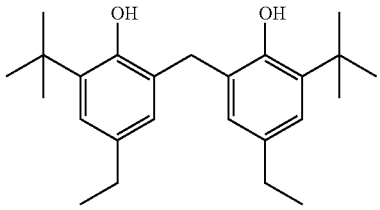
Reducing agent-2
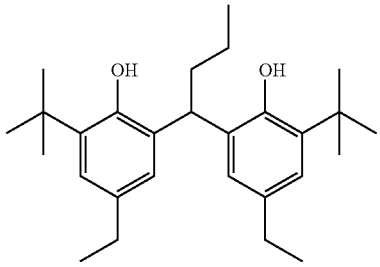
Hydrogen Bonding Compound-1
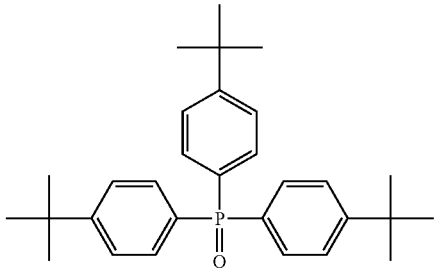
Polyhalogen Compound-1
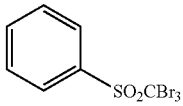
Polyhalogen Compound-2
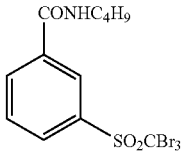
Mercapto Compound-1
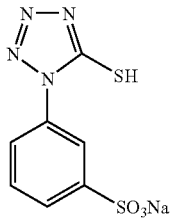

-continued

Mercapto Compound-2

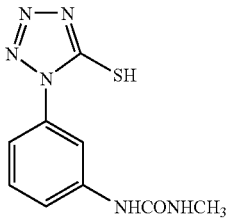

Phthalazine Compound-1

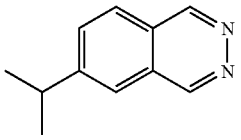

Development Accelerator-1

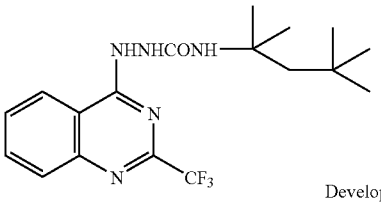

Development Accelerator-2

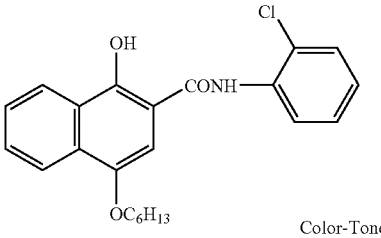

Color-Tone-Adjusting Agent-1

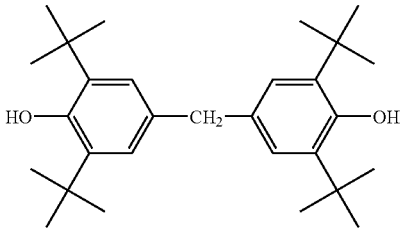

SF-1

$CF_3(CF_2)_nCH_2CH_2SCH_2CH_2COOLi$ mixture of n = 5~11

SF-2

$CF_3(CF_2)_nCH_2CH_2O(CH_2CH_2O)_mH$ mixture of n = 5~11 and m = 5~15

SF-3

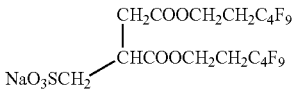

SF-4

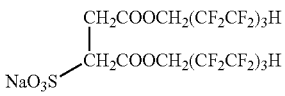

Example 1

1. Preparation of Coating Solutions

1) Preparation of Coating Solution for Image Forming Layer-1

The dispersion A of the silver salt of fatty acid obtained as described above in an amount of 1000 g, 135 mL of water, 35 g of the pigment-1 dispersion, 19 g of the organic polyhalogen compound-1 dispersion, 58 g of the organic polyhalogen compound-2 dispersion, 162 g of the phthalazine compound-1 solution, 1060 g of the SBR latex (Tg: 17° C.) solution, 75 g of the reducing agent-1 dispersion, 75 g of the reducing agent-2 dispersion, 106 g of the hydrogen bonding compound-1 dispersion, 4.8 g of the development accelerator-1 dispersion, 9 mL of the mercapto compound-1 aqueous solution, and 27 mL of the mercapto compound-2 aqueous solution were serially added. The coating solution for the image forming layer prepared by adding 118 g of the silver halide mixed emulsion A thereto followed by thorough mixing just prior to the coating was fed directly to a coating die, and was coated.

Viscosity of the coating solution for the image forming layer was measured with a B type viscometer from Tokyo Keiki, and was revealed to be 25 [mPa·s] at 40° C. (No. 1 rotor, 60 rpm).

Viscosity of the coating solution at 38° C. when it was measured using RheoStress RS150 manufactured by Haake was 32,35,33,26, and 17 [mPa·s], respectively, at the shearing rate of 0.1, 1, 10, 100, 1000 [1/second].

The amount of zirconium in the coating solution was 0.32 mg per one g of silver.

2) Preparation of Coating Solution for Image Forming Layer-2

The dispersion B of the silver salt of fatty acid obtained as described above in an amount of 1000 g, 135 mL of water, 36 g of the pigment-1 dispersion, 25 g of the organic polyhalogen compound-1 dispersion, 39 g of the organic polyhalogen compound-2 dispersion, 171 g of the phthalazine compound-1 solution, 1060 g of the SBR latex (Tg: 17° C.) solution, 153 g of the reducing agent-2 dispersion, 55 g of the hydrogen bonding compound-1 dispersion, 4.8 g of the development accelerator-1 dispersion, 5.2 g of the development accelerator-2 dispersion, 2.1 g of the color-tone-adjusting agent-1 dispersion, and 8 mL of the mercapto compound-2 aqueous solution were serially added. The coating solution for the image forming layer prepared by adding 140 g of the silver halide mixed emulsion A thereto followed by thorough mixing just prior to the coating was fed directly to a coating die, and was coated.

Viscosity of the coating solution for the image forming layer was measured with a B type viscometer from Tokyo Keiki, and was revealed to be 40 [mPa·s] at 40° C. (No. 1 rotor, 60 rpm).

Viscosity of the coating solution at 38° C. when it was measured using RheoStress RS150 manufactured by Haake was 30, 43, 41, 28, and 20 [mPa·s], respectively, at the shearing rate of 0.1, 1, 10, 100, 1000 [1/second].

The amount of zirconium in the coating solution was 0.30 mg per one g of silver.

3) Preparation of Coating Solution for Image Forming Layer-3

This is the coating solution for a sample in comparision with that of the invention.

The 5% by weight dispersion of pigment obtained as described above in an amount of 3.0 g, 100 g of dispersion of silver salt of fatty acid A, 25.0 g of a 25% by weight dispersion of the reducing agent-1, 1.95 g of the organic polyhalogen compound-3 dispersion, 6.0 g of the organic polyhalogen compound-1 dispersion, 108.1 g of a 40% by weight solution of the SBR latex (Tg: 24° C.) (which was filtrated with ultrafiltration (UF) and pH was adjusted), 17.1 ml of a 5% by weight solution of the phthalazine compound were serially added. The coating solution for the image forming layer prepared by adding 10.6 g of the silver halide mixed emulsion A thereto followed by thorough mixing just prior to the coating was fed directly to a coating die to provide 67 mL/m$^2$, and was coated.

Viscosity of the coating solution for the image forming layer was measured with a B type viscometer from Tokyo Keiki, and was revealed to be 85 [mPa·s] at 40° C. (No. 1 rotor, 60 rpm).

Viscosity of the coating solution at 25° C. when it was measured using RFS fluid spectrometer manufactured by Rheometrix Far-East Co. Ltd. was 1500, 220, 70, 40, and 20 [mPa·s], respectively, at the shearing rate of 0.1, 1, 10, 100, 1000 [1/second].

4) Preparation of Coating Solution for Intermediate Layer-1

To 1000 g of polyvinyl alcohol PVA-205 (manufactured by Kuraray Co., Ltd.), 163 g of the pigment-1 dispersion, 33 g of an aqueous solution of water-soluble metalo-phthalocyanine dye-1, 27 mL of a 5% by weight aqueous solution of di(2-ethylhexyl) sodium sulfosuccinate and 4200 mL of a 19% by weight solution of methyl methacrylate/styrene/butyl acrylate/hydroxyethyl methacrylate/acrylic acid copolymer (weight ratio of the copolymerization of 57/8/28/5/2) latex, were added 27 mL of a 5% by weight aqueous solution of aerosol OT (manufactured by American Cyanamid Co.), 135 mL of a 20% by weight aqueous solution of ammonium secondary phthalate and water to give total amount of 10000 g. The mixture was adjusted with NaOH to give the pH of 7.5. Accordingly, the coating solution for the intermediate layer was prepared, and was fed to a coating die to provide 8.9 mL/m$^2$.

Viscosity of the coating solution was 58 [mPa·s] which was measured with a B type viscometer at 40° C. (No. 1 rotor, 60 rpm).

5) Preparation of Coating Solution for Intermediate Layer-2

To 1000 g of polyvinyl alcohol PVA-205 (manufactured by Kuraray Co., Ltd.), 163 g of the pigment-1 dispersion, 278 g of a 1% by weight aqueous solution of a blue dye-2, 27 mL of a 5% by weight aqueous solution of di(2-ethylhexyl) sodium sulfosuccinate and 4200 mL of a 19% by weight solution of methyl methacrylate/styrene/butyl acrylate/hydroxyethyl methacrylate/acrylic acid copolymer (weight ratio of the copolymerization of 57/8/28/5/2) latex, were added 27 mL of a 5% by weight aqueous solution of aerosol OT (manufactured by American Cyanamid Co.), 135 mL of a 20% by weight aqueous solution of ammonium secondary phthalate and water to give total amount of 10000 g. The mixture was adjusted with NaOH to give the pH of 7.5. Accordingly, the coating solution for the intermediate layer was prepared, and was fed to a coating die to provide 8.9 mL/m$^2$.

Viscosity of the coating solution was 58 [mPa·s] which was measured with a B type viscometer at 40° C. (No. 1 rotor, 60 rpm).

6) Preparation of Coating Solution for First Layer of Surface Protective Layers

In 840 mL of water were dissolved 100 g of inert gelatin and 10 mg of benzoisothiazolinone, and thereto were added 180 g of a 19% by weight solution of methyl methacrylate/styrene/butyl acrylate/hydroxyethyl methacrylate/acrylic acid copolymer (weight ratio of the copolymerization of 57/8/28/5/2) latex, 46 mL of a 15% by weight methanol solution of phthalic acid and 5.4 mL of a 5% by weight aqueous solution of di(2-ethylhexyl) sodium sulfosuccinate, and were mixed. Immediately before coating, 40 mL of a 4% by weight chrome alum which had been mixed with a static mixer was fed to a coating die so that the amount of the coating solution became 26.1 mL/m$^2$.

Viscosity of the coating solution was 20 [mPa·s] which was measured with a B type viscometer at 40° C. (No. 1 rotor, 60 rpm).

7) Preparation of Coating Solution for Second Layer of Surface Protective Layers-1

In 800 mL of water were dissolved 100 g of inert gelatin and 10 mg of benzoisothiazolinone, and thereto were added 180 g of a 19% by weight solution of methyl methacrylate/styrene/butyl acrylate/hydroxyethyl methacrylate/acrylic acid copolymer (weight ratio of the copolymerization of 57/8/28/5/2) latex, 40 mL of a 15% by weight methanol solution of phthalic acid, 5.5 mL of a 1% by weight solution of a fluorocarbon surfactant (SF-1), 5.5 mL of a 1% by weight aqueous solution of a fluorocarbon surfactant (SF-2), 28 mL of a 5% by weight aqueous solution of di(2-ethylhexyl) sodium sulfosuccinate, 4 g of polymethyl methacrylate fine particles (mean particle diameter of 0.7 μm) and 21 g of polymethyl methacrylate fine particles (mean particle diameter of 4.5 μm), and were mixed to give a coating solution for the surface protective layer, which was fed to a coating die so that the coating amount of gelatin could be the amount shown in Table 1.

Viscosity of the coating solution was 19 [mPa·s] which was measured with a B type viscometer at 40 (No. 1 rotor, 60 rpm).

8) Preparation of Coating Solution for Second Layer of Surface Protective Layers-2

In 950 mL of water were added 15 g of polyvinyl alcohol (manufactured by Kuraray Co., Ltd., trade name: Kuraray Poval PV-235) and 100 mg of benzoisothiazolinone, and sufficiently dissolved at 90° C. The solution was subjected to filteration with nylon cloth filter having a pore size of 200 μm to remove impurities. To the solution in an amount of 300 g were added 2 mL of a 10% by weight aqueous solution of sodium triisopropylnaphthalenesulfonate, 140 mL of a 40% by weight solution of latex (P-14: Tg47° C.), 43 mL of a 1% by weight solution of a fluorocarbon surfactant (SF-1), 116 mL of a 1% by weight aqueous solution of di(2-ethylhexyl) sodium sulfosuccinate, and 2.6 g of polystyrene fine particles (mean particle diameter of 6.0 μm) as a matting agent.

Viscosity of the coating solution was 30 [mPa·s] which was measured with a B type viscometer at 40° C. (No. 1 rotor, 60 rpm).

9)Preparations of Coating Solution for Second Layer of Surface Protective Layers-3 to 26

Preparations of coating solution for second layer of surface protective layers-3 to -26 were conducted similar to the preparation of coating solution for second layer of surface protective layers-2 except that using latexes shown in Table 1 instead of using the latex (P-14).

TABLE 1

| Coating solution for second layer of surface protective layers | Binder | | | |
|---|---|---|---|---|
| | Kind of binder | Addition amount (g) (solid contents) | Kind of binder | Addition amount (g) |
| 1 | Gelatin | 100 | MMA/St/BA/HEM/AA | 34.2 |
| 2 | P-14 | 56 | PVA-235 | 15 |
| 3 | P-1 | 58 | PVA-235 | 15 |

TABLE 1-continued

| Coating solution for second layer of surface protective layers | Binder | | | |
|---|---|---|---|---|
| | Kind of binder | Addition amount (g) (solid contents) | Kind of binder | Addition amount (g) |
| 4 | P-2 | 57 | PVA-235 | 15 |
| 5 | P-5 | 56 | PVA-235 | 16 |
| 6 | P-4 | 56 | PVA-235 | 15 |
| 7 | P-7 | 60 | PVA-235 | 16 |
| 8 | P-13 | 60 | PVA-235 | 16 |
| 9 | P-15 | 58 | PVA-235 | 15 |
| 10 | P-14 | 28 | PVA-235 | 14 |
| | P-15 | 30 | | |
| 11 | P-17 | 55 | PVA-235 | 16 |
| 12 | P-18 | 56 | PVA-235 | 16 |
| 13 | P-19 | 56 | PVA-235 | 15 |
| 14 | P-21 | 54 | PVA-235 | 15 |
| 15 | P-22 | 55 | PVA-235 | 14 |
| 16 | P-23 | 60 | PVA-235 | 13 |
| 17 | P-24 | 59 | PVA-235 | 14 |
| 18 | P-25 | 61 | PVA-235 | 16 |
| 19 | P-26 | 54 | PVA-235 | 18 |
| 20 | P-27 | 56 | PVA-235 | 14 |
| 21 | P-31 | 58 | PVA-235 | 15 |
| 22 | P-32 | 59 | PVA-235 | 16 |
| 23 | P-35 | 56 | PVA-235 | 16 |
| 24 | P-36 | 56 | PVA-235 | 15 |
| 25 | P-41 | 58 | PVA-235 | 15 |

notes)
MMA: methyl metacrylate,
St: styrene,
BA: butyl acrylate
HEM: hydroxyethyl metacrylate,
AA: acrylic acid 2. Preparation of Photothermographic Material-1 to -35

1) Preparation of Photothermographic Material-1 to -35

Reverse surface of the support to the back surface was subjected to simultaneous overlaying coating by a slide bead coating method in order of the coating solution for image forming layer, coating solution for intermediate layer, coating solution for first layer of the surface protective layer and coating solution for second layer of the surface protective layer starting from the undercoated face, and thus a sample of the photothermographic material was produced. The coating solutions used are shown in Table 2. In this method, the temperature of the coating solution was adjusted to 31° C. for the image forming layer and intermediate layer, to 36° C. for the first layer of the surface protective layer, and to 37° C. for the second layer of the surface protective layer.

The coating amount of each compound for the image forming layer (g/m$^2$) is as follows.

| | |
|---|---|
| Silver salt of fatty acid | 5.42 |
| Pigment (C. I. Pigment Blue 60) | 0.036 |
| Polyhalogen compound-1 | 0.12 |
| Polyhalogen compound-2 | 0.25 |
| Phthalazine Compound-1 | 0.18 |
| SBR latex | 9.70 |
| Reducing agent-1 | 0.40 |
| Reducing agent-2 | 0.40 |
| Hydrogen bonding compound-1 | 0.58 |
| Development accelerator-1 | 0.02 |
| Mercapto compound-1 | 0.002 |
| Mercapto compound-2 | 0.012 |
| Silver halide (on the basis of Ag content) | 0.10 |

The coating amounts of the first and second layers of surface protective layers are shown in Table 2. Conditions for coating and drying are as follows.

Coating was performed at the speed of 160 m/min. The clearance between the leading end of the coating die and the support being 0.10 mm to 0.30 mm, and with the pressure in the vacuum chamber set to be lower than atmospheric pressure by 196 Pa to 882 Pa. The support was decharged by ionic wind.

In the subsequent cooling zone, the coating solution was cooled by wind having the dry-bulb temperature of 10° C. to 20° C. Thereafter, transportation with no contact was carried out, and the coated support was dried with an air of the dry-bulb of 23° C. to 45° C. and the wet-bulb of 15° C. to 21° C. in a helical type contactless drying apparatus. After drying, moisture conditioning was performed at 25° C. in the humidity of 40% RH to 60% RH. Then, the film surface was heated to 70° C. to 90° C. After heating, the film surface was cooled to 25° C.

Thus prepared photothermographic material had the matness of 550 seconds on the image forming layer side surface, and 130 seconds on the back surface as Beck's smoothness. In addition, measurement of the pH of the film surface on the image forming layer side surface gave the result of 6.0.

TABLE 2

| Sample No. | Coating solution for image forming layer | Coating solution for intermediate layer | Coating solution for first layer of surface protective layers | | Coating solution for second layer of surface protective layers (outermost layer) | |
|---|---|---|---|---|---|---|
| | | | No. | Coating amount (mL/m$^2$) | No. | Coating amount (mL/m$^2$) |
| 1 | 1 | 1 | 1 | 33.3 | 1 | 8.3 |
| 2 | 1 | 1 | 1 | 50.0 | 1 | 8.3 |
| 3 | 1 | 1 | 1 | 66.6 | 1 | 8.3 |
| 4 | 1 | 1 | 1 | 66.6 | — | — |
| 5 | 1 | 1 | 1 | 33.3 | 2 | 8.3 |
| 6 | 1 | 1 | 1 | 33.3 | 2 | 16.6 |
| 7 | 1 | 1 | 1 | 50.0 | 2 | 16.6 |
| 8 | 1 | 1 | 1 | 66.6 | 2 | 16.6 |
| 9 | 1 | 1 | 1 | 50.0 | 3 | 16.6 |
| 10 | 1 | 1 | 1 | 50.0 | 4 | 16.6 |

TABLE 2-continued

| Sample No. | Coating solution for image forming layer | Coating solution for intermediate layer | Coating solution for first layer of surface protective layers | | Coating solution for second layer of surface protective layers (outermost layer) | |
|---|---|---|---|---|---|---|
| | | | No. | Coating amount (mL/m$^2$) | No. | Coating amount (mL/m$^2$) |
| 11 | 1 | 1 | 1 | 50.0 | 5 | 16.6 |
| 12 | 1 | 1 | 1 | 50.0 | 6 | 16.6 |
| 13 | 1 | 1 | 1 | 50.0 | 7 | 16.6 |
| 14 | 1 | 1 | 1 | 50.0 | 8 | 16.6 |
| 15 | 1 | 1 | 1 | 50.0 | 9 | 16.6 |
| 16 | 1 | 1 | 1 | 50.0 | 10 | 16.6 |
| 17 | 1 | 1 | 1 | 50.0 | 11 | 16.6 |
| 18 | 1 | 1 | 1 | 50.0 | 12 | 16.6 |
| 19 | 1 | 1 | 1 | 50.0 | 13 | 16.6 |
| 20 | 1 | 1 | 1 | 50.0 | 14 | 16.6 |
| 21 | 1 | 1 | 1 | 50.0 | 15 | 16.6 |
| 22 | 1 | 1 | 1 | 50.0 | 16 | 16.6 |
| 23 | 1 | 1 | 1 | 50.0 | 17 | 16.6 |
| 24 | 1 | 1 | 1 | 50.0 | 18 | 16.6 |
| 25 | 1 | 1 | 1 | 50.0 | 19 | 16.6 |
| 26 | 1 | 1 | 1 | 50.0 | 20 | 16.6 |
| 27 | 1 | 1 | 1 | 50.0 | 21 | 16.6 |
| 28 | 1 | 1 | 1 | 50.0 | 22 | 16.6 |
| 29 | 1 | 1 | 1 | 50.0 | 23 | 16.6 |
| 30 | 1 | 1 | 1 | 50.0 | 24 | 16.6 |
| 31 | 1 | 1 | 1 | 50.0 | 25 | 16.6 |
| 32 | 3 | 1 | 1 | 50.0 | 2 | 16.6 |
| 33 | 1 | 1 | 1 | 50.0 | 1 | 16.6 |
| 34 | 3 | 2 | 1 | 50.0 | 2 | 16.6 |
| 35 | 3 | 2 | 1 | 50.0 | 1 | 16.6 |

2) Preparation of Photothermographic Material-36

Preparation of photothermographic material-36 was conducted in the similar manner to that of photothermographic material-2 except that: using coating solution for image forming layer-2 instead of using coating solution for image forming layer-1, and changing the coating amount of second layer of surface protective layer from 8.3 mL/m$^2$ to 16.6 mL/m$^2$.

The coating amount of each compound for the image forming layer (g/m$^2$) is as follows.

| | |
|---|---|
| Silver salt of fatty acid | 5.27 |
| Pigment (C. I. Pigment Blue 60) | 0.036 |
| Polyhalogen compound-1 | 0.14 |
| Polyhalogen compound-2 | 0.28 |
| Phthalazine compound-1 | 0.18 |

-continued

| | |
|---|---|
| SBR latex | 9.43 |
| Reducing agent-2 | 0.77 |
| Hydrogen bonding compound-1 | 0.28 |
| Development accelerator-1 | 0.019 |
| Development accelerator-2 | 0.016 |
| Color-tone-adjusting agent-1 | 0.006 |
| Mercapto compound-2 | 0.003 |
| Silver halide (on the basis of Ag content) | 0.13 |

3) Preparations of Photothermographic Material-37 to -59

Preparations of photothermographic material-37 to -59 were conducted in the similar manner to that of photothermographic material-36 except that changing the coating solution of second layer of surface protective layers to the solution shown in Table 3.

TABLE 3

| Sample No. | Coating solution for image forming layer | Coating solution for intermediate layer | Coating solution for first layer of surface protective layers | | Coating solution for second layer of surface protective layers (outermost layer) | |
|---|---|---|---|---|---|---|
| | | | No. | Coating amount (mL/m$^2$) | No. | Coating amount (mL/m$^2$) |
| 36 | 2 | 1 | 1 | 50 | 1 | 16.6 |
| 37 | 2 | 1 | 1 | 50 | 3 | 16.6 |
| 38 | 2 | 1 | 1 | 50 | 4 | 16.6 |
| 39 | 2 | 1 | 1 | 50 | 5 | 16.6 |

TABLE 3-continued

| Sample No. | Coating solution for image forming layer | Coating solution for intermediate layer | Coating solution for first layer of surface protective layers | | Coating solution for second layer of surface protective layers (outermost layer) | |
|---|---|---|---|---|---|---|
| | | | No. | Coating amount (mL/m$^2$) | No. | Coating amount (mL/m$^2$) |
| 40 | 2 | 1 | 1 | 50 | 6 | 16.6 |
| 41 | 2 | 1 | 1 | 50 | 7 | 16.6 |
| 42 | 2 | 1 | 1 | 50 | 8 | 16.6 |
| 43 | 2 | 1 | 1 | 50 | 9 | 16.6 |
| 44 | 2 | 1 | 1 | 50 | 10 | 16.6 |
| 45 | 2 | 1 | 1 | 50 | 11 | 16.6 |
| 46 | 2 | 1 | 1 | 50 | 12 | 16.6 |
| 47 | 2 | 1 | 1 | 50 | 13 | 16.6 |
| 48 | 2 | 1 | 1 | 50 | 14 | 16.6 |
| 49 | 2 | 1 | 1 | 50 | 15 | 16.6 |
| 50 | 2 | 1 | 1 | 50 | 16 | 16.6 |
| 51 | 2 | 1 | 1 | 50 | 17 | 16.6 |
| 52 | 2 | 1 | 1 | 50 | 18 | 16.6 |
| 53 | 2 | 1 | 1 | 50 | 19 | 16.6 |
| 54 | 2 | 1 | 1 | 50 | 20 | 16.6 |
| 55 | 2 | 1 | 1 | 50 | 21 | 16.6 |
| 56 | 2 | 1 | 1 | 50 | 22 | 16.6 |
| 57 | 2 | 1 | 1 | 50 | 23 | 16.6 |
| 58 | 2 | 1 | 1 | 50 | 24 | 16.6 |
| 59 | 2 | 1 | 1 | 50 | 25 | 16.6 |

4. Evaluation of Photographic Properties

1) Preparation

The resulting sample was cut into a half-cut size (43 cm in length×35 cm in width), and was wrapped with the following packaging material under an environment of 25° C. and 50% RH, and stored for 2 weeks at an ambient temperature.

2) Packaging Material

PET 10 μm/PE 12 μm/aluminum foil 9 μm/Ny 15 μm/polyethylene 50 μm containing carbon at 3% by weight, oxygen permeability: 0.02 mL/atm·m$^2$·25° C.·day, vapor permeability: 0.10 g/atm·m$^2$·25° C.·day.

3) Exposure and Thermal Development

As for photothermographic material-1 to -35, exposure was performed using a Fuji medical dry laser imager FM-DP L (mounting a laser diode emitting a light with an wavelength of 660 nm at a maximum energy of 60 mW (IIIB)), and thermal development was performed in conditions that 4 panel heaters were set to be 112° C.-119° C.-121° C.-121° C., and a total thermal development time was set to 14 sec at an increased transport speed. Evaluation on an image obtained was performed with a densitometer.

Except photothermographic material-4 which was prepared as a comparitive example, the output images of each samples were excellent in contrast.

4) Evaluation of the Amount of Swelling

The thickness of the layer at the image forming layer side of the photothermographic material after processing was measured with respect to the photomographic material-1 to -8, and the thickness of one minute after dripping water on the image forming layer side was measured. The highlight portion of the image was measured at 25° C. The amount of swelling was defined to be the increment of thickness by dripping water. The results are shown in Table 4.

TABLE 4

| Sample No. | Amount of swelling (μm) |
|---|---|
| 1 | 13 |
| 2 | 15 |
| 3 | 17 |
| 4 | NG |
| 5 | 3 |
| 6 | 2 |
| 7 | 2 |
| 8 | 2 |

The results above show that the amount of swelling is restricted by the outermost layer in the photomographic material of the invention even when the thickness of the hydrophilic layer between the support and outermost layer is increased. Measurements were impossible in the photothermographic material-4 prepared as a comparative example since the layer was broken during the measurement.

5) Variation of Sensitivity after Aging

An image was output on each of the photothermographic material-1 to -59 by the same method as in the evaluation of the photographic property above by opening the package after aging the packaged photothermographic materials at 50° C. for 7 days followed by resuming the temperature at 25° C. The sensitivity of the image obtained was calculated by the following equation as a variation ratio ΔS (%) relative to the sensitivity before aging at 50° C. for 7 days.

$$\Delta S=[(\text{sensitivity at 50° C. after 7 days})-(\text{sensitivity at 50° C. before aging})]/(\text{sensitivity before aging at 50° C.})\times 100$$

The sensitivity was calculated as a value of logarithm of an inverse number of the amount of exposure that gives an optical density of 1.0 of each image.

The results are shown in Table 5. All the photothermographic materials of the invention showed small variations of sensitivity.

TABLE 5

| Sample No. | Variation of sensitivity after aging Δ S (%) | Color transfer |
|---|---|---|
| 1 | 11 | 1 |
| 2 | 11 | 1 |
| 3 | 11 | 2 |
| 4 | 11 | 1 |
| 5 | 3 | 4 |
| 6 | 4 | 4 |
| 7 | 4 | 4 |
| 8 | 3 | 4 |
| 9 | 2 | 4 |
| 10 | 3 | 4 |
| 11 | 4 | 4 |
| 12 | 4 | 4 |
| 13 | 3 | 4 |
| 14 | 2 | 4 |
| 15 | 3 | 4 |
| 16 | 4 | 4 |
| 17 | 3 | 4 |
| 18 | 3 | 4 |
| 19 | 4 | 4 |
| 20 | 5 | 4 |
| 21 | 4 | 4 |
| 22 | 3 | 4 |
| 23 | 4 | 4 |
| 24 | 4 | 4 |
| 25 | 4 | 4 |
| 26 | 4 | 4 |
| 27 | 5 | 4 |
| 28 | 3 | 4 |
| 29 | 4 | 4 |
| 30 | 5 | 4 |
| 31 | 4 | 4 |
| 32 | 10 | 1 |
| 33 | 10 | 1 |
| 34 | 10 | 1 |
| 35 | 14 | 2 |

TABLE 6

| Sample No. | Variation of sensitivity after aging Δ S (%) | Color transfer |
|---|---|---|
| 36 | 11 | 1 |
| 37 | 4 | 4 |
| 38 | 2 | 4 |
| 39 | 3 | 4 |
| 40 | 3 | 4 |
| 41 | 4 | 4 |
| 42 | 2 | 4 |
| 43 | 3 | 4 |
| 44 | 4 | 4 |
| 45 | 3 | 4 |
| 46 | 2 | 4 |
| 47 | 3 | 4 |
| 48 | 3 | 4 |
| 49 | 4 | 4 |
| 50 | 4 | 4 |
| 51 | 3 | 4 |
| 52 | 3 | 3 |
| 53 | 3 | 3 |
| 54 | 3 | 4 |
| 55 | 2 | 3 |
| 56 | 2 | 4 |
| 57 | 3 | 3 |
| 58 | 2 | 3 |
| 59 | 4 | 4 |

6) Evalualuation of Color Transfer

The surface at the image forming layer side (25 cm×10 cm) of each photothermographic material-1 to -59 was carefully rubbed with a hand wearing a cotton groove three times after thermal development under the condition above, and the degree of coloring of the groove was sensually evaluated by the following ranks by visual.

Rank 4: no coloring after each of three times of rubbing

Rank 3: no coloring until two times of coloring

Rank 2: no coloring at the first time of rubbing

Rank 1: evident coloring in all the tree times of rubbing (Ranks 3 and 4 are practically allowable evaluation)

The results are shown in Tables 5 and 6.

The photothermographic material of the invention is improved with respect to color transfer, showing that the material is excellent in handling performance of the sample after forming the image.

The results above show that the photothermographic material of the invention shows a small variation of sensitivity, is improved in color transfer, and is excellent in handling performance after forming the image.

Example 2

1. Preparation of Coating Solutions

1) Preparation of Coating Solution for Image Forming Layer

The dispersion A of the silver salt of fatty acid obtained as described above in an amount of 1000 g, 135 mL of water, 35 g of the pigment-1 dispersion, 19 g of the organic polyhalogen compound-1 dispersion, 58 g of the organic polyhalogen compound-2 dispersion, 162 g of the phthalazine compound-1 solution, 1060 g of the SBR latex (Tg: 17° C.) solution, 75 g of the reducing agent-1 dispersion, 75 g of the reducing agent-2 dispersion, 106 g of the hydrogen bonding compound-1 dispersion, 4.8 g of the development accelerator-1 dispersion, 9 mL of the mercapto compound-1 aqueous solution and 27 mL of the mercapto compound-2 aqueous solution were serially added. The coating solution for the image forming layer prepared by adding 118 g of the silver halide mixed emulsion A thereto followed by thorough mixing just prior to the coating was fed directly to a coating die.

2) Preparation of Coating Solution for Intermediate Layer-11

To 1000 g of polyvinyl alcohol PVA-205 (manufactured by Kuraray Co., Ltd.), 163 g of the pigment-1 dispersion, 33g of an aqueous solution of a blue dye-1 (manufactured by Nippon Kayaku Co., Ltd.: Kayafect turquoise RN liquid 150), 27 mL of a 5% by weight aqueous solution of di(2-ethylhexyl) sodium sulfosuccinate and 4200 mL of a 19% by weight solution of methyl methacrylate/styrene/butyl acrylate/hydroxyethyl methacrylate/acrylic acid copolymer (weight ratio of the copolymerization of 57/8/28/5/2) latex, were added 27 mL of a 5% by weight aqueous solution of aerosol OT (manufactured by American Cyanamid Co.), 135 mL of a 20% by weight aqueous solution of ammonium secondary phthalate and water to give total amount of 10000 g. The mixture was adjusted with NaOH to give the pH of 7.5. Accordingly, the coating solution for the intermediate layer was prepared, and was fed to a coating die to provide 8.9 mL/m$^2$.

Viscosity of the coating solution was 58 [mPa·s] which was measured with a B type viscometer at 40° C. (No. 1 rotor, 60 rpm).

3) Preparation of Coating Solution for Outermost Layer

<<Preparation of Coating Solution for Outermost Layer-1>>

In 800 mL of water were dissolved 100 g of inert gelatin and 10 mg of benzoisothiazolinone, and thereto were added 40 mL of a 15% by weight methanol solution of phthalic acid, 5.5 mL of a 1% by weight solution of fluorocarbon surfactant (SF-3), 5.5 mL of a 1% by weight aqueous solution of fluorocarbon surfactant (SF-4), 28 mL of a 5% by weight aqueous solution of di(2-ethylhexyl) sodium sulfosuccinate, 4 g of polymethyl methacrylate fine particles (mean particle diameter of 0.7 μm) and 21 g of polymethyl methacrylate fine particles (mean particle diameter of 4.5 μm) and were mixed to give a coating solution for the outermost layer, which was fed to a coating die.

Viscosity of the coating solution was 19 [mPa·s] which was measured with a B type viscometer at 40° C. (No. 1 rotor, 60 rpm).

<<Preparation of Coating Solution for Outermost Layer-2>>

Preparation of coating solution for outermost layer-2 was conducted in the similar manner to that of coating solution for outermost layer-1 except that using a 19% by weight solution of methyl methacrylate/styrene/butyl acrylate/hydroxyethyl methacrylate/acrylic acid copolymer (weight ratio of the copolymerization of 57/8/28/5/2) latex instead of using inert gelatin.

<<Preparation of Coating Solution for Outermost Layer-3>>

Preparation of coating solution for outermost layer-3 was conducted in the similar manner to that of coating solution for outermost layer-1 except that using a 20% by weight aqueous solution of SBR latex used for the image forming layer (diluted by water) instead of using inert gelatin.

4) Preparation of Coating Solution for Layer Adjacent to Outermost Layer

<<Preparation of Coating Solution for Layer Adjacent to Outermost Layer-1>>

In 840 mL of water were dissolved 100 g of polyvinyl alcohol PVA-217 (manufactured by Kuraray Co. Ltd.) and 10 mg of benzoisothiazolinone, and thereto were added 46 mL of a 15% by weight methanol solution of phthalic acid and 5.4 mL of a 5% by weight aqueous solution of di(2-ethylhexyl) sodium sulfosuccinate. Immediately before coating, 40 mL of a 4% by weight chrome alum which had been mixed with a static mixer was fed to a coating die so that the amount of the coating solution became 26.1 mL/m$^2$.

Viscosity of the coating solution was 20 [mPa·s] which was measured with a B type viscometer at 40° C. (No. 1 rotor, 60 rpm).

<<Preparation of Coating Solution for Layer Adjacent to Outermost Layer-2>>

Preparation of coating solution for layer adjacent to outermost layer-2 was conducted in the similar manner to that of coating solution for layer adjacent to outermost layer-1 except that using inert gelatin instead of using polyvinyl alcohol PVA-217.

<<Preparation of Coating Solution for Layer Adjacent to Outermost Layer-3>>

Preparation of coating solution for layer adjacent to outermost layer-3 was conducted in the similar manner to that of coating solution for layer adjacent to outermost layer-1 except that adding κ-carrageenan in amount of 0.5% by weight with respect to the coating solution.

2. Preparation of Photothermographic Material

1) Preparation of Photothermographic Material-101 to -107

Reverse surface of the support to the back surface was subjected to simultaneous overlaying coating by a slide bead coating method in order of the coating solution for image forming layer, coating solution for intermediate layer, coating solution for layer adjacent to outermost layer and coating solution for outermost layer starting from the support to outer side, and thus samples of the photothermographic material-101 to -107 were produced. The coating solutions used and those components are shown in Table 7. In this method, the temperature of the coating solution was adjusted to 37° C. for the image forming layer, intermediate layer and the layer adjacent to the outermost layer, to 38° C. for the outermost layer.

The coating amount of each compound for the image forming layer (g/m$^2$) is as follows.

| | |
|---|---|
| Silver salt of fatty acid A | 5.42 |
| Pigment (C. I. Pigment Blue 60) | 0.036 |
| Polyhalogen compound-1 | 0.12 |
| Polyhalogen compound-2 | 0.25 |
| Phthalazine Compound-1 | 0.18 |
| SBR latex | 9.70 |
| Reducing agent-1 | 0.40 |
| Reducing agent-2 | 0.40 |
| Hydrogen bonding compound-1 | 0.58 |
| Development accelerator-1 | 0.02 |
| Mercapto compound-1 | 0.002 |
| Mercapto compound-2 | 0.012 |
| Silver halide (on the basis of Ag content) | 0.10 |

Conditions for coating and drying are similar to Example 1.

3. Evaluation of Phtographic Properties

1) Preparation

It was done similar to Example 1.

2) Exposure and Thermal Development

Exposure was performed on each sample using a Fuji medical dry laser imager FM-DP L (mounting a laser diode emitting a light with an wavelength of 660 nm at a maximum energy of 60 mW (IIIB)), and thermal development was performed in conditions that 4 panel heaters were set to be 112° C.-119° C.-121° C.-121° C., and a total thermal development time was set to 24 sec at an increased transport speed. Evaluation on an image obtained was performed with a densitometer.

Sensitivity was measured and expressed by the common logarithm of exposure value which gives the image density of 1.0. Dmax is maximum density degree of color formation.

3) Evaluation of the Property of Coating Surface

The entire surface of each sample was uniformly exposed so that the density is 1.5, and was thermal developed under the same condition as evaluating the photographic property. The sample was evaluated by the number of application lines per one unit width of application. The application line shows defective application, and the smaller number of the lines indicates better application.

The evaluation criteria is as follows:

◎: no lines are observed;

○: a small number of lines with a low density are observed;

Δ: a small number of lines with a high density are observed; and

X: application lines are observed on the entire surface.

4) Evaluation of Water Resistance of the Surface

100 μl of water was dripped on the surface of the photothermographic material, and water drops were wiped off with a sheet of filter paper one minute after. Remaining water was completely dried, and water marks were evaluated as follows:

⊙: no water marks at all;

○: slight water marks are observed by observing with reflected light;

Δ: the traces of rubbing are evident;

X: the surface of the coating layer peeled off (the ranks ⊙ and ○ are practically allowable).

5) Results

Results are shown in Table 7.

TABLE 7

| | Outermost layer | | | Layer adjacent to outermost layer | | |
|---|---|---|---|---|---|---|
| Sample No. | Coating solution | Binder | Tg (° C.) | Coating solution | Binder | Gelation |
| 101 | 1 | gelatin | — | 2 | gelatin | ○ |
| 102 | 1 | gelatin | — | 1 | PVA | x |
| 103 | 2 | latex 1 | 59 | 1 | PVA | x |
| 104 | 2 | latex 1 | 59 | 2 | gelatin | ○ |
| 105 | 2 | latex 1 | 59 | 3 | PVA + κ-carrageenan | ○ |
| 106 | 3 | latex 2 | 17 | 2 | gelatin | ○ |
| 107 | 3 | latex 2 | 17 | 3 | PVA + κ-carrageenan | ○ |

| Sample No. | Water resistance | Property of coating surface | Photographic properties Dmax | Photographic properties Sensitivity |
|---|---|---|---|---|
| 101 | x | ⊙ | 100 | 0 |
| 102 | x | ⊙ | 98 | −0.01 |
| 103 | ⊙ | x | 100 | 0.01 |
| 104 | ⊙ | ⊙ | 102 | 0 |
| 105 | ⊙ | ○ | 102 | 0.01 |
| 106 | ⊙ | ⊙ | 101 | −0.01 |
| 107 | ⊙ | ○ | 99 | −0.01 |

Dmax is expressed as a relative value with respect to sample No. 101, and sensivity is expressed as difference between that of sample No. 101 and each sample.

The results above show that the photothermographic material of the invention is excellent in coating surface property, the surface is not sticky, and the photothermographic material is excellent in photographic properties.

Example 3

(Preparations of Coating Solution of Layer Adjacent to Outermost Layer-4 and -5)

Preparation of coating solution for layer adjacent to outermost layer-4 was conducted in the similar manner to that of coating solution for layer adjacent to outermost layer-3 in Example 2 except that adding sodium alginate instead of κ-carrageenan. And preparation of coating solution for layer adjacent to outermost layer-5 was conducted in the similar manner to that of coating solution for layer adjacent to outermost layer-3 in Example 2 except that adding locust bean gum instead of κ-carrageenan.

(Preparations Preparations of Coating Solution for Intermediate Layer-12 to -14)

Preparations of coating solution for intermediate layer-12 to -14 was conducted in the similar manner to that of coating solution for intermediate layer-11 instead of adding gelation accelerator as follows:

Coating solution for intermediate layer-12: adding potassium nitrate as a gelation accelerator so that the coating amount becomes 10% by weight with respect to the coating amount of the gelling agent (κ-carrageenan) in the coating solution of outermost layer-3.

Coating solution for intermediate layer-13: adding calcium nitrate as a gelation accelerator so that the coating amount becomes 10% by weight with respect to the coating amount of the gelling agent (sodium alginate) in the coating solution of outermost layer-4.

Coating solution for intermediate layer-14: adding calcium nitrate as a gelation accelerator so that the coating amount becomes 10% by weight with respect to the coating amount of the gelling agent (locust bean gum) in the coating solution of outermost layer-5.

(Preparations of Sample-108 to 110)

Preparations of sample-108 to -110 were conducted in the similar manner to that of sample-105 in Example 2 except that using a coating solution of intermediate layer shown in Table 8.

(Result of Evaluation)

Evaluations were done similar to Example 2. The results are shown in Table 8.

TABLE 8

| | Outermost layer | | Layer adjacent to outermost layer | | Intermediate layer |
|---|---|---|---|---|---|
| Sample No. | Coating solution | Binder | Coating solution | Binder | Gelation accelerator |
| 105 | B | latex 1 | 3 | PVA + κ-carrageenan | — |
| 108 | B | latex 1 | 3 | PVA + κ-carrageenan | potassium nitrate |
| 109 | B | latex 1 | 4 | PVA + sodium alginate | calcium chloride |
| 110 | B | latex 1 | 5 | PVA + locust bean gum | xanthan gum |

| Sample No. | Water resistance | Property of coating surface | Photographic properties Dmax | Photographic properties Sensitivity |
|---|---|---|---|---|
| 105 | ⊙ | ○ | 102 | 0.01 |
| 108 | ⊙ | ⊙ | 101 | 0 |
| 109 | ⊙ | ⊙ | 100 | 0.01 |
| 110 | ⊙ | ⊙ | 102 | 0.01 |

As shown in Table 8, using the gelling agent and gelation accelerator of the invention, the property of coating surface of the photothermograhic material is improved and the photothermograhic material shows excellent photographic properties.

Example 4

1. Preparation of Coating Solution

1) Preparation of Coating Solution for Image Forming Layer

The dispersion A of the silver salt of fatty acid obtained as described above in an amount of 1000 g, 135 mL of water, 35 g of the pigment-1 dispersion, 19 g of the organic polyhalogen compound-1 dispersion, 58 g of the organic polyhalogen compound-2 dispersion, 162 g of the phthalazine compound-1 solution, 1060 g of the SBR latex (Tg: 17° C.) solution, 75 g of the reducing agent-1 dispersion, 75 g of the reducing agent-2 dispersion, 106 g of the hydrogen bonding compound-1 dispersion, 4.8 g of the development accelerator-1 dispersion, 3.5 g of the development accelerator-2 dispersion, 1.8 g of the color-tone-adjusting agent-1 dispersion, 9 mL of the mercapto compound-1 aqueous solution and 27 mL of the mercapto compound-2 aqueous solution were serially added. The coating solution for the image forming layer prepared by adding 118 g of the silver halide mixed emulsion A thereto followed by thorough mixing just prior to the coating was fed directly to a coating die.

2) Preparation of Coating Solution for Intermediate Layer A-1

To 1000 g of polyvinyl alcohol PVA-205 (manufactured by Kuraray Co., Ltd.), 163 g of the pigment-1 dispersion, 33 g of an aqueous solution of a blue dye-1 (manufactured by Nippon Kayaku Co., Ltd.: Kayafect turquoise RN liquid 150), 27 mL of a 5% by weight aqueous solution of di(2-ethylhexyl) sodium sulfosuccinate and 4200 mL of a 19% by weight solution of methyl methacrylate/styrene/butyl acrylate/hydroxyethyl methacrylate/acrylic acid copolymer (weight ratio of the copolymerization of 57/8/28/5/2) latex, were added 27 mL of a 5% by weight aqueous solution of aerosol OT (manufactured by American Cyanamid Co.), 135 mL of a 20% by weight aqueous solution of ammonium secondary phthalate and water to give total amount of 10000 g. The mixture was adjusted with NaOH to give the pH of 7.5. Accordingly, the coating solution for the intermediate layer was prepared, and was fed to a coating die to provide 8.9 mL/m$^2$.

Viscosity of the coating solution was 58 [mPa·s] which was measured with a B type viscometer at 40° C. (No 1 rotor, 60 rpm).

3) Preparation of Coating Solution for Intermediate Layer B-1

In 840 mL of water were dissolved 100 g of inert gelatin and 10 mg of benzoisothiazolinone, and thereto were added 180 g of a 19% by weight solution of methyl methacrylate/styrene/butyl acrylate/hydroxyethyl methacrylate/acrylic acid copolymer (weight ratio of the copolymerization of 57/8/28/5/2) latex, 46 mL of a 15% by weight methanol solution of phthalic acid and 5.4 mL of a 5% by weight aqueous solution of di(2-ethylhexyl) sodium sulfosuccinate, and were mixed. Immediately before coating, 40 mL of a 4% by weight chrome alum which had been mixed with a static mixer was fed to a coating die so that the amount of the coating solution became 26.1 mL/m$^2$.

Viscosity of the coating solution was 20 [mPa·s] which was measured with a B type viscometer at 40° C. (No. 1 rotor, 60 rpm).

4) Preparations of Coating Solution of Outermost Layer

<<Preparation of Coating Solution for Outermost Layer-11>>

In 800 mL of water were dissolved 100 g of inert gelatin and 10 mg of benzoisothiazolinone, and thereto were added 40 mL of a 15% by weight methanol solution of phthalic acid, 5.5 mL of a 1% by weight solution of fluorocarbon surfactant (F-1), 5.5 mL of a 1% by weight aqueous solution of fluorocarbon surfactant (F-2), 28 mL of a 5% by weight aqueous solution of di(2-ethylhexyl) sodium sulfosuccinate, 4 g of polymethyl methacrylate fine particles (mean particle diameter of 0.7 μm) and 21 g of polymethyl methacrylate fine particles (mean particle diameter of 4.5 μm) and were mixed to give a coating solution for the outermost layer-11, which was fed to a coating die so that the amount of the coating solution became 8.9 mL/m$^2$.

Viscosity of the coating solution was 19 [mPa·s] which was measured with a B type viscometer at 40° C. (No. 1 rotor, 60 rpm).

<<Preparation of Coating Solution for Outermost Layer-12>>

Preparation of coating solution for outermost layer-12 was conducted in the similar manner to that of coating solution for outermost layer-11 except that using 180 g of a 19% by weight solution of methyl methacrylate/styrene/butyl acrylate/hydroxyethyl methacrylate/acrylic acid copolymer (weight ratio of the copolymerization of 57/8/28/5/2) latex (latex 1) instead of using inert gelatin.

<<Preparation of Coating Solution for Outermost Layer-13>>

Preparation of coating solution for outermost layer-13 was conducted in the similar manner to that of coating solution for outermost layer-12 except that adding κ-carrageenan in amount of 0.5% by weight with respect to the coating solution.

2. Preparation of Photothermographic Material

1) Preparation of Photothermographic Material-201 to -203

Reverse surface of the support to the back surface was subjected to simultaneous overlaying coating by a slide bead coating method in order of the coating solution for image forming layer, coating solution for intermediate layer A, coating solution for intermediate layer B and coating solution for outermost layer starting from the support to outer side, and thus samples of the photothermographic material-201 to -203 were produced. The coating solutions used and those components are shown in Table 9. In this method, the temperature of the coating solution was adjusted to 36° C. for the image forming layer and intermediate layer A, to 37° C. for intermediate layer B, and to 38° C. for the outermost layer.

The coating amount of each compound for the image forming layer (g/m$^2$) is as follows.

| | |
|---|---|
| Silver salt of fatty acid A | 5.42 |
| Pigment (C. I. Pigment Blue 60) | 0.036 |
| Polyhalogen compound-1 | 0.12 |
| Polyhalogen compound-2 | 0.25 |
| Phthalazine Compound-1 | 0.18 |
| SBR latex | 9.70 |
| Reducing agent-1 | 0.40 |
| Reducing agent-2 | 0.40 |
| Hydrogen bonding compound-1 | 0.58 |
| Development accelerator-1 | 0.02 |
| Development accelerator-2 | 0.015 |
| Color-tone-adjusting agent-1 | 0.008 |
| Mercapto compound-1 | 0.002 |
| Mercapto compound-2 | 0.012 |
| Silver halide (on the basis of Ag content) | 0.10 |

Conditions for coating and drying are similar to Example 1.

3. Evaluation of Phtographic Properties

1) Preparation

It was done similar to Example 1.

2) Exposure and Thermal Development

Exposure was performed on each sample using a Fuji medical dry laser imager FM-DP L (mounting a laser diode emitting a light with an wavelength of 660 nm at a maximum energy of 60 mW (IIIB)), and thermal development was performed in conditions that 3 panel heaters were set to be 108° C.-119° C.-121° C., and a total thermal development time was set to 13.5 sec at an increased transport speed. Evaluation on an image obtained was performed with a densitometer.

Sensitivity was measured and expressed by the common logarithm of exposure value which gives the image density of 1.0.

Dmin is a density of unexposed area.

3) Evaluation of the Property of Coating Surface

It was done similar to Example 2.

4) Evaluation of Water Resistance of the Surface

It was done similar to Example 2.

5) Results

Results are shown in Table 9.

TABLE 9

| Sample No. | Outermost layer: Coating solution | Outermost layer: Binder | Water resistance | Property of coating surface |
|---|---|---|---|---|
| 201 | 11 | gelatin | x | ⊙ |
| 202 | 12 | latex 1 | ⊙ | x |
| 203 | 13 | latex 1 + gelling agent | ⊙ | ○ |

| Sample No. | Photographic properties: Dmax | Photographic properties: Sensitivity |
|---|---|---|
| 201 | 100 | 0 |
| 202 | 102 | 0.01 |
| 203 | 101 | −0.01 |

Dmax is expressed as a relative value with respect to sample No. 201, and sensivity is expressed as difference between that of sample No.201 and each sample.

The results above show that the photothermographic material of the invention is excellent in coating surface property, the surface is not sticky, and the photothermographic material is excellent in photographic properties.

Example 5

Instead of the combination of coating solution for outermost layer-13 (using κ-carrageenan as a gelling agent) and coating solution for intermediate layer A-1 which is used in Example 4, coating solution for outermost layer and coating solution for intermediate layer were prepared as described below, and samples were prepared with the combination shown in Table 12.

(Preparations of Coating Solution for Outermost Layer-14 to -23)

Preparations of coating solution for outermost layer-14 to -23 were conducted in the similar manner to that of coating solution for outermost layer-13 in Example 1 except that using a gelling agent shown in Table 10 instead of using κ-carrageenan.

TABLE 10

| Gelling agent | Concentration in coating solution |
|---|---|
| κ-carrageenan | 0.4% |
| ι-carrageenan | 0.8% |
| sodium alginate | 1.0% |
| locust bean gum | 1.0% |
| agar | 0.3% |
| low methoxyl pectin | 0.5% |
| jellan gum | 0.4% |
| gum arabic | 1.0% |
| propyleneglycol alginic acid | 1.4% |
| sodium carboxymethyl cellulose | 2.0% |
| dexstran | 2.0% |

(Preparations of Coating Solution for Intermediate Layer A-2 to -4)

Preparations of coating solution for intermediate layer A-2 to -4 were conducted in the similar manner to that of coating solution for intermediate layer A-1 except that adding a galation accelerator as shown in Table 11.

TABLE 11

| Coating solution for intermediate layer A | Gelation accelerator | Concentration in coating solution |
|---|---|---|
| 1 | — | 0% |
| 2 | potassium nitrate | 0.04% |
| 3 | potassium nitrate | 0.10% |
| 4 | calcium nitrate | 0.10% |
| 5 | xanthan gum | 0.10% |

(Preparation of Sample-204 to -214)

Preparations of sample-204 to -214 were conducted in the similar manner to that of sample-203 in Example 4 except that using the coating solutions shown in Table 12 for outermost layer and for intermediate layer A.

(Results of Evaluations)

Evaluations were done similar to Example 4. Results are shown in Table 12.

TABLE 12

| Sample No. | Outermost layer: Coating solution | Outermost layer: Gelling agent | Intermediate layer A: Coating solution | Intermediate layer A: Gelation accelerator |
|---|---|---|---|---|
| 203 | 13 | κ-carrageenan | 1 | — |
| 204 | 13 | κ-carrageenan | 2 | potassium nitrate |
| 205 | 14 | ι-carrageenan | 3 | potassium nitrate |
| 206 | 15 | sodium alginate | 4 | calcium nitrate |
| 207 | 16 | locust bean gum | 5 | xanthan gum |
| 208 | 17 | agar | 1 | — |
| 209 | 18 | low methoxyl pectin | 4 | calcium nitrate |
| 210 | 19 | jellan gum | 4 | calcium nitrate |
| 211 | 20 | gum Arabic | 1 | — |
| 212 | 21 | propyleneglycol alginic acid | 1 | — |
| 213 | 22 | sodium carboxymethyl cellulose | 1 | — |
| 214 | 23 | dexstran | 1 | — |

TABLE 12-continued

| Sample No. | Water resistance | Property of coating surface | Photographic properties Dmax | Photographic properties Sensitivity |
|---|---|---|---|---|
| 203 | ◎ | ○ | 101 | −0.01 |
| 204 | ◎ | ◎ | 100 | 0 |
| 205 | ◎ | ◎ | 102 | −0.02 |
| 206 | ◎ | ◎ | 99 | −0.02 |
| 207 | ◎ | ◎ | 101 | 0.01 |
| 208 | ◎ | ◎ | 102 | 0.01 |
| 209 | ◎ | ◎ | 101 | −0.01 |
| 210 | ◎ | ◎ | 100 | −0.01 |
| 211 | ◎ | ○ | 100 | 0 |
| 212 | ◎ | ○ | 100 | 0.01 |
| 213 | ◎ | ○ | 102 | 0.02 |
| 214 | ◎ | ○ | 101 | 0.01 |

Dmax is expressed as a relative value with respect to sample No. 204, and sensivity is expressed as difference between that of sample No. 204 and each sample.

As shown in Table 12, using the gelling agent and gelation accelerator of the invention, the property of coating surface of the photothermograhic material is improved and the photothermograhic material shows excellent photographic properties.

Example 6

(Preparations of Coating Solution for Outermost Layer-24 to -32)

Preparations of coating solution for outermost layer-24 to -32 were conducted in the similar manner to that of coating solution for outermost layer-13 in Example 4 except changing the latex to the latex of the invention shown in Table 13.

(Preparations of Sample-215 to -223)

Preparations of sample-215 to -223 were conducted in the similar manner to that of sample-204 in Example 5 except that changing the coating solution for outermost layer to the coating solution shown in Table 13.

(Results of Evaluation)

Evaluations were done similar to Example 4. Results are shown in Table 13.

TABLE 13

| Sample No. | Outermost layer Coating solution | Outermost layer Binder | Water resistance | Property of coating surface |
|---|---|---|---|---|
| 204 | 13 | latex1 + κ-carrageenan | ◎ | ◎ |
| 215 | 24 | P-2 + κ-carrageenan | ◎ | ◎ |
| 216 | 25 | P-3 + κ-carrageenan | ◎ | ◎ |
| 217 | 26 | P-6 + κ-carrageenan | ◎ | ◎ |
| 218 | 27 | P-9 + κ-carrageenan | ◎ | ◎ |
| 219 | 28 | P-12 + κ-carrageenan | ◎ | ◎ |
| 220 | 29 | P-14 + κ-carrageenan | ◎ | ◎ |
| 221 | 30 | Cevian A-4718 + κ-carrageenan | ◎ | ◎ |
| 222 | 31 | Nipol Lx820 + κ-carrageenan | ◎ | ◎ |
| 223 | 32 | HYDRAN AP40 + κ-carrageenan | ◎ | ◎ |

TABLE 13-continued

| Sample No. | Photographic properties Dmax | Photographic properties Sensitivity |
|---|---|---|
| 204 | 101 | −0.01 |
| 215 | 104 | 0.01 |
| 216 | 102 | 0.02 |
| 217 | 104 | 0.01 |
| 218 | 101 | 0 |
| 219 | 103 | 0.02 |
| 220 | 100 | 0.03 |
| 221 | 104 | 0.01 |
| 222 | 102 | 0.02 |
| 223 | 102 | 0.02 |

note)

Cevian A-4718: an acrylic polymer latex manufactured by Daicel Chemical Industries, Ltd.

Nipol Lx820: an acrylic polymer latex manufactured by Nippon Zeon Co., Ltd.

HYDRAN AP40: a polyurethane latex manufactured by Dainippon Ink and Chemicals, Inc.

As shown in Table 13, even changing the kind of latex, using the gelling agent and gelation accelerator of the invention, the property of coating surface of the photothermograhic material is improved and the photothermograhic material shows excellent photographic properties.

Example 7

1. Preparations of Coating Solutions

1) Preparation of Coating Solution for Image Forming Layer

The dispersion A of the silver salt of fatty acid obtained as described above in an amount of 1000 g, 135 mL of water, 35 g of the pigment-1 dispersion, 19 g of the organic polyhalogen compound-1 dispersion, 58 g of the organic polyhalogen compound-2 dispersion, 162 g of the phthalazine compound-1 solution, 1060 g of the SBR latex (Tg: 17° C.) solution, 75 g of the reducing agent-1 dispersion, 75 g of the reducing agent-2 dispersion, 106 g of the hydrogen bonding compound-1 dispersion, 4.8 g of the development accelerator-1 dispersion, 9 mL of the mercapto compound-1 aqueous solution, and 27 mL of the mercapto compound-2 aqueous solution were serially added. The coating solution for the image forming layer prepared by adding 118 g of the silver halide mixed emulsion A thereto followed by thorough mixing just prior to the coating was fed directly to a coating die, and was coated.

Viscosity of the coating solution for the image forming layer was measured with a B type viscometer from Tokyo Keiki, and was revealed to be 25 [mPa·s] at 40° C. (No. 1 rotor, 60 rpm).

Viscosity of the coating solution at 38° C. when it was measured using RheoStress RS150 manufactured by Haake was 32,35,33,26, and 17 [mPa·s], respectively, at the shearing rate of 0.1, 1, 10, 100, 1000 [1/second].

The amount of zirconium in the coating solution was 0.32 mg per one g of silver.

2) Preparations of Coating Solution of Outermost Layer

<<Preparation of Coating Solution for Outermost Layer-41>>

In 800 mL of water were dissolved 100 g of inert gelatin and 10 mg of benzoisothiazolinone, and thereto were added 40 mL of a 15% by weight methanol solution of phthalic acid, 28 mL of a 5% by weight aqueous solution of di(2-ethylhexyl) sodium sulfosuccinate, 4 g of polymethyl methacrylate fine particles (mean particle diameter of 0.7 μm) and 21 g of polymethyl methacrylate fine particles (mean particle diameter of 4.5 μm) and were mixed to give a coating solution for the outermost layer-41, which was fed to a coating die so that the wet coating amount became 8.3 mL/m$^2$.

Viscosity of the coating solution was 20 [mPa·s] which was measured with a B type viscometer at 40° C. (No. 1 rotor, 60 rpm).

<<Preparation of Coating Solution for Outermost Layer-42>>

Preparation of coating solution for outermost layer-42 was conducted in the similar manner to that of coating solution for outermost layer-41 except that using 180 g of a 19% by weight solution of methyl methacrylate/styrene/butyl acrylate/hydroxyethyl methacrylate/acrylic acid copolymer (weight ratio of the copolymerization of 57/8/28/5/2) latex instead of using inert gelatin, and except that not using a 15% by weight methanol solution of phthalic acid, and further except that the coating solution was fed to a coating die so that the wet coating amount became 16.7 mL/m$^2$.

<<Preparation of Coating Solution for Outermost Layer-43>>

Preparation of coating solution for outermost layer-43 was conducted in the similar manner to that of coating solution for outermost layer-42 except that further adding 35 mL of a 1% by weight solution of fluorocarbon surfactant (shown in Table 14).

<<Preparation of Coating Solution for Outermost Layer-44>>

Preparation of coating solution for outermost layer-44 was conducted in the similar manner to that of coating solution for outermost layer-43 except that using equivalent 19% by weight aqueous solution of styrene-butadiene latex (P-7) instead of the aqeous solution of latex used in the preparation of coating solution for outermost layer-43.

3) Preparation of Coating Solution for Intermediate Layer-21

To 1000 g of polyvinyl alcohol PVA-205 (manufactured by Kuraray Co., Ltd.), 163 g of the pigment-1 dispersion, 33 g of an aqueous solution of a blue dye-1 (manufactured by Nippon Kayaku Co., Ltd.: Kayafect turquoise RN liquid 150), 27 mL of a 5% by weight aqueous solution of di(2-ethylhexyl) sodium sulfosuccinate and 4200 mL of a 19% by weight solution of methyl methacrylate/styrene/butyl acrylate/hydroxyethyl methacrylate/acrylic acid copolymer (weight ratio of the copolymerization of 57/8/28/5/2) latex, were added 27 mL of a 5% by weight aqueous solution of aerosol OT (manufactured by American Cyanamid Co.), 135 mL of a 20% by weight aqueous solution of ammonium secondary phthalate and water to give total amount of 10000 g. The mixture was adjusted with NaOH to give the pH of 7.5. Accordingly, the coating solution for the intermediate layer was prepared, and was fed to a coating die to provide 8.9 mL/m$^2$.

viscosity of the coating solution was 58 [mPa·s] which was measured with a B type viscometer at 40° C. (No. 1 rotor, 60 rpm).

4) Preparation of Coating Solution for Layer Adjacent to Outermost Layer

<<Preparation of Coating Solution for Layer Adjacent to Outermost Layer-11>>

In 840 mL of water were dissolved 100 g of polyvinyl alcohol PVA-217 (manufactured by Kuraray Co. Ltd.) and 10 mg of benzoisothiazolinone, and thereto were added 46 mL of a 15% by weight methanol solution of phthalic acid and 5.4 mL of a 5% by weight aqueous solution of di(2-ethylhexyl) sodium sulfosuccinate. Immediately before coating, 40 mL of a 4% by weight chrome alum which had been mixed with a static mixer was fed to a coating die so that the amount of the coating solution became 26.1 mL/m$^2$.

Viscosity of the coating solution was 19 [mPa·s] which was measured with a B type viscometer at 40° C. (No. 1 rotor, 60 rpm).

<<Preparation of Coating Solution for Layer Adjacent to Outermost Layer-12>>

Preparation of coating solution for layer adjacent to outermost layer-12 was conducted in the similar manner to that of coating solution for layer adjacent to outermost layer-11 except that using inert gelatin instead of using polyvinyl alcohol PVA-217.

<<Preparation of Coating Solution for Layer Adjacent to Outermost Layer-13>>

Preparation of coating solution for layer adjacent to outermost layer-13 was conducted in the similar manner to that of coating solution for layer adjacent to outermost layer-11 except that adding κ-carrageenan (gelling agent-1) in amount of 3% by weight with respect to PVA.

2. Preparation of Photothermographic Material

1) Preparation of Photothermographic Material-301 to -310

Reverse surface of the support to the back surface was subjected to simultaneous overlaying coating by a slide bead coating method in order of the coating solution for image forming layer, coating solution for intermediate layer, coating solution for layer adjacent to outermost layer and coating solution for outermost layer starting from the support to outer side, and thus samples of the photothermographic material-301 to -310 were produced. The coating solutions used and those components are shown in Table 14. In this method, the temperature of the coating solution was adjusted to 36° C. for the image forming layer, to 37° C. for the layer adjacent to the outermost layer, and to 40° C. for the outermost layer.

The coating amount of each compound for the image forming layer (g/m$^2$) is as follows.

| | |
|---|---|
| Silver salt of fatty acid A | 5.42 |
| Pigment (C. I. Pigment Blue 60) | 0.036 |
| Polyhalogen compound-1 | 0.12 |
| Polyhalogen compound-2 | 0.25 |
| Phthalazine Compound-1 | 0.18 |
| SBR latex | 9.70 |
| Reducing agent-1 | 0.40 |
| Reducing agent-2 | 0.40 |
| Hydrogen bonding compound-1 | 0.58 |
| Development accelerator-1 | 0.02 |
| Development accelerator-2 | 0.015 |
| Color-tone-adjusting agent-1 | 0.008 |
| Mercapto compound-1 | 0.002 |
| Mercapto compound-2 | 0.012 |
| Silver halide (on the basis of Ag content) | 0.10 |

Conditions for coating and drying are similar to Example 1.

3. Evaluation of Phtographic Properties

1) Preparation

It was done similar to Example 1.

2) Exposure and Thermal Development

Exposure was performed on each sample using a Fuji medical dry laser imager FM-DP L (mounting a laser diode emitting a light with an wavelength of 660 nm at a maximum energy of 60 mW (IIIB)), and thermal development was performed in conditions that 4 panel heaters were set to be 112° C.-119° C.-121° C.-121° C., and a total thermal development time was set to 14 sec at an increased transport speed. Evaluation on an image obtained was performed with a densitometer.

Sensitivity was measured and expressed by the common logarithm of exposure value which gives the image density of 1.0.

Dmin is a density of unexposed area. Both of sensitivity and Dmin are expressed as a relative value of that being 100 of sample No. 301. (The lower the value of Dmin shows the lower amount in fogging and the better photographic material, and the higher the sensitivity shows the better high photographic material having high sensitivity.)

3) Evaluation of the Property of Coating Surface

It was done similar to Example 2.

4) Evaluation of Water Resistance of the Surface

It was done similar to Example 2.

5) Evaluation of Adhesion Trouble in the Thermal Development Process

Half-size photothermographic materials were uniformly exposed to an optical density of 1.2 and 5,000 sheets were continuously developed.

The image on the last sheet after continuous development was evaluated with respect to uniformity of the density. The density will not be uniform when influenced by adhesion. Evaluation was ranked as follows:

A: preferable uniform density;

B: slightly irregular density is observes;

C: the image is practically allowable with slightly irregular density;

D: apparent stripes of the density showing troubles.

6) Results of Evaluation

The results are shown in Table 14.

TABLE 14

| | Outermost layer | | | Layer adjacent to outermost layer | | |
|---|---|---|---|---|---|---|
| Sample No. | Coating solution | Binder | Surfactant | Coating solution | Binder | Gelation |
| 301 | 41 | gelatin | — | 11 | PVA | x |
| 302 | 41 | gelatin | — | 12 | gelatin | ○ |
| 303 | 42 | latex 1 | — | 11 | PVA | x |
| 304 | 42 | latex 1 | — | 12 | gelatin | ○ |
| 305 | 43 | latex 1 | F-29 | 11 | PVA | x |
| 306 | 43 | latex 1 | F-29 | 12 | gelatin | ○ |
| 307 | 43 | latex 1 | F-29 | 13 | PVA + gelling agent-1 | ○ |
| 308 | 44 | latex 2 | F-29 | 11 | PVA | x |
| 309 | 44 | latex 2 | F-29 | 12 | gelatin | ○ |
| 310 | 44 | latex 2 | F-29 | 13 | PVA + gelling agent-1 | ○ |

| Sample No. | Water resistance | Property of coating surface | Uneven image density at thermal development | Photographic properties Dmin | Photographic properties Sensitivity |
|---|---|---|---|---|---|
| 301 | x | Δ | C | 100 | 100 |
| 302 | x | ○ | C | 100 | 100 |
| 303 | x | x | D | 110 | 95 |
| 304 | Δ | Δ | D | 111 | 94 |
| 305 | ◎ | ○ | B | 98 | 104 |
| 306 | ◎ | ◎ | B | 97 | 103 |
| 307 | ◎ | ◎ | B | 97 | 102 |
| 308 | ◎ | ○ | B | 98 | 102 |
| 309 | ◎ | ◎ | A | 97 | 103 |
| 310 | ◎ | ◎ | A | 96 | 103 |

note)

latex 1: latex described above in <<Preparation of Coating Solution for Outermost Layer-2>> latex 2: styrene-butadiene-latex (P-17)

The samples according to the invention are excellent in the property of coating surface and water resistance and show excellent photographic properties.

Example 8

(Preparations of Coating Solution for Outermost Layer-45 to -50)

Preparations of coating solution for outermost layer-45 to -50 were conducted in the similar manner to that of coating solution for outermost layer-43 except that changing the surfactant to the compound shown in Table 15. Provided that as for coating solution for outermost layer-45, the coating amounts of a 1% by weight solution of the fluorocarbon surfactant (shown in Table 15) are 12 mL for FN-3 and 25 mL for F-10. Further, as for coating solution for outermost layer-49, the coating amounts of a 1% by weight solution of the fluorocarbon surfactant (shown in Table 15) are 12 mL for FN-9 and 23 mL for F-29.

(Preparations of Sample-311 to -316)

Preparations of sample-311 to -316 were conducted in the similar manner to that of sample-306 in Example 7 except that changing the coating solution for outermost layer to the solution shown in Table 15.

(Results of Evaluation)

Evaluations were done similar to Example 7. Results are shown in Table 15.

TABLE 15

| | Outermost layer | | | Layer adjacent to outermost layer | |
|---|---|---|---|---|---|
| Sample No. | Coating solution | Binder | Surfactant | Coating solution | Binder |
| 311 | 45 | latex 1 | FN-3 F-10 | 12 | gelatin |
| 312 | 46 | latex 1 | F-10 | 12 | gelatin |
| 313 | 47 | latex 1 | F-35 | 12 | gelatin |
| 314 | 48 | latex 1 | F-53 | 12 | gelatin |
| 315 | 49 | latex 1 | FN-9 F-29 | 12 | gelatin |
| 316 | 50 | latex 1 | FN-18 | 12 | gelatin |

| Sample No. | Water resistance | Property of coating surface | Uneven image density at thermal development | Photographic properties Dmin | Photographic properties Sensitivity |
|---|---|---|---|---|---|
| 311 | ◎ | ◎ | A | 97 | 103 |
| 312 | ◎ | ◎ | A | 97 | 102 |
| 313 | ◎ | ◎ | A | 96 | 104 |
| 314 | ◎ | ◎ | A | 97 | 103 |
| 315 | ◎ | ◎ | A | 96 | 10 |
| 316 | ◎ | ◎ | A | 96 | 102 |

As shown in Table 15, even changing the kind of surfactant, using the fluorine compoud of the invention, the property of coating surface is improved and the photothermographic material shows excellent photographic properties.

Example 9

1. Preparations of Coating Solutions

1) Preparation of Coating Solution for Image Forming Layer

The dispersion A of the silver salt of fatty acid obtained as described above in an amount of 1000 g, 135 mL of water, 35 g of the pigment-1 dispersion, 19 g of the organic polyhalogen compound-1 dispersion, 58 g of the organic polyhalogen compound-2 dispersion, 162 g of the phthalazine compound-1 solution, 1060 g of the SBR latex (Tg: 17° C.) solution, 75 g of the reducing agent-1 dispersion, 75 g of the reducing agent-2 dispersion, 106 g of the hydrogen bonding compound-1 dispersion, 4.8 g of the development accelerator-1 dispersion, 9 mL of the mercapto compound-1 aqueous solution, and 27 mL of the mercapto compound-2 aqueous solution were serially added. The coating solution for the image forming layer prepared by adding 118 g of the silver halide mixed emulsion A thereto followed by thorough mixing just prior to the coating was fed directly to a coating die, and was coated.

Viscosity of the coating solution for the image forming layer was measured with a B type viscometer from Tokyo Keiki, and was revealed to be 25 [mPa·s] at 40° C. (No. 1 rotor, 60 rpm).

Viscosity of the coating solution at 38° C. when it was measured using RheoStress RS150 manufactured by Haake was 32,35,33,26, and 17 [mPa·s], respectively, at the shearing rate of 0.1, 1, 10, 100, 1000 [1/second].

The amount of zirconium in the coating solution was 0.32 mg per one g of silver.

2) Preparation of Coating Solution for Intermediate Layer-31

To 1000 g of polyvinyl alcohol PVA-205 (manufactured by Kuraray Co., Ltd.), 163 g of the pigment-1 dispersion, 33 g of an aqueous solution of a blue dye-1 (manufactured by Nippon Kayaku Co., Ltd.: Kayafect turquoise RN liquid 150), 27 mL of a 5% by weight aqueous solution of di(2-ethylhexyl) sodium sulfosuccinate and 4200 mL of a 19% by weight solution of methyl methacrylate/styrene/butyl acrylate/hydroxyethyl methacrylate/acrylic acid copolymer (weight ratio of the copolymerization of 57/8/28/5/2) latex, were added 27 mL of a 5% by weight aqueous solution of aerosol OT (manufactured by American Cyanamid Co.), 135 mL of a 20% by weight aqueous solution of ammonium secondary phthalate and water to give total amount of 10000 g. The mixture was adjusted with NaOH to give the pH of 7.5. Accordingly, the coating solution for the intermediate layer was prepared, and was fed to a coating die to provide 8.9 mL/m$^2$.

Viscosity of the coating solution was 58 [mPa·s] which was measured with a B type viscometer at 40° C. (No. 1 rotor, 60 rpm).

3) Preparations of Matting Agent Dispersion

<Preparation of Matting Agent-1 Dispersion>

The matting agent-1 dispersion was prepared by mixing with 40 g of a powder of the matting agent (M-17: trade name SX-713 manufactured by Soken Chemical & Engineering Co., Ltd.) and an aqueous solvent previously dissolved 48 g of inert gelatin in 912 g of water, in a vessel, stirring the mixture at 3,000 rpm over 10 min with a homogenizer.

<Preparation of Matting Agent-2 Dispersion>

The matting agent-2 dispersion was prepared by mixing with 40 g of a powder of the matting agent (M-17: trade name SX-713 manufactured by Soken Chemical & Engineering Co., Ltd.) and an aqueous solvent previously dissolved 9.6 g of a surfactant (sodium triisopropylnaphthalene sulfonate) in 950.4 g of water, in a vessel, stirring the mixture at 3,000 rpm over 10 min with a homogenizer.

<Preparations of Matting Agent-3 to -5 Dispersion>

The matting agent-3 dispersion was prepared by mixing with 40 g of a powder of the matting agent (M-17: trade name SX-713 manufactured by Soken Chemical & Engineering Co., Ltd.) and an aqueous solvent previously dissolved 60 g of a partially saponified polyvinyl alcohol (PVA-205: manufactured by Kuraray Co., Ltd.) in 900 g of water, in a vessel, stirring the mixture at 3,000 rpm over 10 min with a homogenizer.

The matting agent-4 and -5 dispersions were prepared by the same dispersion method as described above by changing the kind of the matting agent to those shown in Table 16.

TABLE 16

| Dispersion of matting agent | Matting agent | Polymer for dispersion | Surfactant |
|---|---|---|---|
| 1 | M-17 | gelatin | — |
| 2 | M-17 | — | surfactant-1 |
| 3 | M-17 | PVA | — |
| 4 | M-2 | PVA | — |
| 5 | M-3 | PVA | — |

note)
surfactant-1: sodium tri-isopropylnaphthalenesulfonate

4) Preparation of Coating Solution for Outermost Layer

<<Preparation of Coating Solution for Outermost Layer-51>>

In 473.7 mL of water were dissolved 526.3 mL of a 19% by weight solution of methyl methacrylate/styrene/butyl acrylate/hydroxyethyl methacrylate/acrylic acid copolymer (weight ratio of the copolymerization of 57/8/28/5/2) latex and the solution was subjected to filteration with nylon cloth filter having a pore size of 200 μm to remove foreign substances such as dust. To 11 g of this solution were added 2 mL of a 10% by weight aqueous solution of sodium triisopropylnaphthalene sulfonate, 43 mL of a 1% by weight aqueous solution of flurocarbon surfactant (SF-3), 116 mL of a 1% by weight aqueous solution of di(2-ethylhexyl) sodium sulfosuccinate and 2.6 g of matting agent particles (M-17) and were mixed to give a coating solution for the outermost layer, which was fed to a coating die to provide a coating amount of 17 mL/m$^2$.

Viscosity of the coating solution was 35 [mPa·s] which was measured with a B type viscometer at 40° C. (No. 1 rotor, 60 rpm).

<<Preparation of Coating Solution for Outermost Layer-52>>

Preparation of coating solution for outermost layer-52 was conducted in the similar manner to that of coating solution for outermost layer-51 except that using polyvinyl alcohol PVA-205 instead of using latex.

<<Preparations of Coating Solution for Outermost Layer-53 to -57>>

Preparations of coating solution for outermost layer-53 to -57 were conducted in the similar manner to that of coating solution for outermost layer-51 except that adding 65 g of each one of matting agent-1 to -5 dispersions instead of adding matting agent (M-17).

<<Preparations of Coating Solution for Outermost Layer-58 to -60>>

Preparations of coating solution for outermost layer-58 to -60 were conducted in the similar manner to that of coating solution for outermost layer-52 except that adding 65 g of each one of matting agent-3 to -5 dispersions instead of adding matting agent (M-17).

5) Preparations of Coating Solution for Layer Adjacent to Outermost Layer

<<Preparation of Coating Solution for Layer Adjacent to Outermost Layer-21>>

In 800 mL of water were dissolved 100 g of polyvinyl alcohol PVA-217 (manufactured by Kuraray Co. Ltd.) and 10 mg of benzoisothiazolinone, and thereto were added 40 mL of a 15% by weight methanol solution of phthalic acid and 28 mL of a 5% by weight aqueous solution of di(2-ethylhexyl) sodium sulfosuccinate, 4 g of polymethyl methacrylate fine particles (mean particle diameter of 0.7 μm) and 21 g of polymethyl methacrylate fine particles (mean particle diameter of 4.5 μm) and were mixed to give a coating solution for the layer adjacent to the outermost layer-21, which was fed to a coating die.

Viscosity of the coating solution was 19 [mPa·s] which was measured with a B type viscometer at 40° C. (No. 1 rotor, 60 rpm).

<<Preparation of Coating Solution for Layer Adjacent to Outermost Layer-22>>

Preparation of coating solution for layer adjacent to outermost layer-22 was conducted in the similar manner to that of coating solution for layer adjacent to outermost layer-21 except that using inert gelatin instead of using polyvinyl alcohol PVA-217.

2. Preparation of Photothermographic Material

1) Preparation of Photothermographic Material-401 to -415

Reverse surface of the support to the back surface was subjected to simultaneous overlaying coating by a slide bead coating method in order of the coating solution for image forming layer, coating solution for intermediate layer, coating solution for layer adjacent to outermost layer and coating solution for outermost layer starting from the support to outer side, and thus samples of the photothermographic material-401 to -415 were produced. The coating solutions used and those components are shown in Table 17. In this method, the temperature of the coating solution was adjusted to 36° C. for the image forming layer and intermediate layer, to 37° C. for the layer adjacent to the outermost layer, and to 40° C. for the outermost layer.

The coating amount of each compound for the image forming layer (g/m$^2$) is as follows.

| | |
|---|---|
| Silver salt of fatty acid A | 5.42 |
| Pigment (C. I. Pigment Blue 60) | 0.036 |
| Polyhalogen compound-1 | 0.12 |
| Polyhalogen compound-2 | 0.25 |
| Phthalazine Compound-1 | 0.18 |
| SBR latex | 9.70 |
| Reducing agent-1 | 0.40 |
| Reducing agent-2 | 0.40 |
| Hydrogen bonding compound-1 | 0.58 |
| Development accelerator-1 | 0.02 |
| Development accelerator-2 | 0.015 |
| Color-tone-adjusting agent-1 | 0.008 |

-continued

| | |
|---|---|
| Mercapto compound-1 | 0.002 |
| Mercapto compound-2 | 0.012 |
| Silver halide (on the basis of Ag content) | 0.10 |

Conditions for coating and drying are similar to Example 1.

3. Evaluation of Phtographic Properties

1) Preparation

It was done similar to Example 1.

2) Exposure and Thermal Development

Exposure was performed on the photothermographic material-401 to -415 using a Fuji medical dry laser imager FM-DP L (mounting a laser diode emitting a light with an wavelength of 660 nm at a maximum energy of 60 mW (IIIB)), and thermal development was performed in conditions that 4 panel heaters were set to be 112° C.-119° C.-121° C.-121° C., and a total thermal development time was set to 14 sec at an increased transport speed. Evaluation on an image obtained was performed with a densitometer.

Sensitivity was measured and expressed by the common logarithm of exposure value which gives the image density of 1.0.

Dmin is a density of unexposed area. Both of sensitivity and Dmin are expressed as a relative value of that being 100 of sample No. 401. (The lower the value of Dmin shows the lower amount in fogging and the better photographic material, and the higher the sensitivity shows the better high photographic material having high sensitivity.)

3) Evaluation of the Property of Coating Surface

It was done similar to Example 2.

4) Evaluation of Water Resistance of the Surface

It was done similar to Example 2.

5) Evaluation of Trouble of Adhesion in the Thermal Development Process

It was done similar to Example 7.

6) Results of Evaluation

Results are shown in Table 17.

TABLE 17

| | Outermost layer | | Matting agent | | | Layer adjacent to outermost layer | |
|---|---|---|---|---|---|---|---|
| | | | Polymer | | | | |
| Sample No. | Coating solution | Binder | No. | for dispersion | Surfactant | Coating solution | Binder |
| 401 | 51 | latex | M-17 | — | — | 21 | PVA |
| 402 | 51 | latex | M-17 | — | — | 22 | gelatin |
| 403 | 53 | latex | M-17 | gelatin | — | 21 | PVA |
| 404 | 53 | latex | M-17 | gelatin | — | 22 | gelatin |
| 405 | 54 | latex | M-17 | — | F-29 | 21 | PVA |
| 406 | 54 | latex | M-17 | — | F-29 | 22 | gelatin |
| 407 | 55 | latex | M-17 | PVA | — | 21 | PVA |
| 408 | 55 | latex | M-17 | PVA | — | 22 | gelatin |
| 409 | 56 | latex | M-2 | PVA | — | 22 | gelatin |
| 410 | 57 | latex | M-3 | PVA | — | 22 | gelatin |
| 411 | 52 | PVA | M-17 | — | — | 21 | PVA |
| 412 | 52 | PVA | M-17 | — | — | 22 | gelatin |
| 413 | 58 | PVA | M-17 | PVA | — | 22 | gelatin |

TABLE 17-continued

| Sample No. | Water resistance | Property of coating surface | Uneven image density at thermal development | Photographic properties Dmax | Photographic properties Sensitivity |
|---|---|---|---|---|---|
| 401 | x | x | D | 100 | 100 |
| 402 | Δ | Δ | D | 100 | 100 |
| 403 | x | x | D | 110 | 90 |
| 404 | Δ | x | D | 110 | 90 |
| 405 | x | x | D | 105 | 100 |
| 406 | Δ | Δ | D | 105 | 100 |
| 407 | x | x | D | 102 | 100 |
| 408 | ○ | ○ | B | 98 | 102 |
| 409 | ○ | ○ | B | 98 | 103 |
| 410 | ○ | ○ | B | 97 | 102 |
| 411 | x | x | D | 102 | 100 |
| 412 | Δ | Δ | D | 100 | 100 |
| 413 | ○ | ○ | B | 98 | 102 |

The samples according to the invention are excellent in the property of coating surface and water resistance and show excellent photographic properties.

Example 10

(Preparations of Matting Agent-6 to -8 Dispersion)

Preparations of matting agent-6 to -8 dispersion were conducted in the similar manner to that of matting agent-3 dispersion except that adding 9.6 g of surfactant shown in Table 18.

(Preparations of Coating Solution for Outermost Layer-61 to -63)

Preparations of coating solution for outermost layer-61 to -63 were conducted in the similar manner to that of coating solution for outermost layer-51 except that adding 65 g of each one of matting agent-6 to -8 dispersions instead of adding matting agent (M-17).

(Preparations of Coating Solution for Outermost Layer-64 to -66)

Preparations of coating solution for outermost layer-64 to -66 were conducted in the similar manner to that of coating solution for outermost layer-52 except that adding 65 g of each one of matting agent-6 to -8 dispersions instead of adding matting agent (M-17).

(Preparations of Sample-416 to -421)

Preparations of sample-416 to -421 were conducted in the similar manner to that of sample-408 in Example 9 except that changing the coating solution for the outermost layer to the solution shown in Table 18.

(Results of Evaluation)

Evaluations were done similar to Example 9. Results are shown in Table 18.

TABLE 18

| Sample No. | Outermost layer Coating solution | Outermost layer Binder | Outermost layer Matting agent | Outermost layer Surfactant | Layer adjacent to outermost layer Coating solution | Layer adjacent to outermost layer Binder |
|---|---|---|---|---|---|---|
| 408 | 55 | latex | M-17 (PVA dispersion) | — | 22 | gelatin |
| 416 | 61 | latex | M-17 (PVA dispersion) | 1 | 22 | gelatin |
| 417 | 62 | latex | M-17 (PVA dispersion) | 2 | 22 | gelatin |
| 418 | 63 | latex | M-17 (PVA dispersion) | 3 | 22 | gelatin |
| 413 | 58 | PVA | M-17 (PVA dispersion) | — | 22 | gelatin |
| 419 | 64 | PVA | M-17 (PVA dispersion) | 1 | 22 | gelatin |
| 420 | 65 | PVA | M-17 (PVA dispersion) | 2 | 22 | gelatin |
| 421 | 66 | PVA | M-17 (PVA dispersion) | 3 | 22 | gelatin |

| Sample No. | Water resistance | Property of coating surface | Uneven image density at thermal development | Photographic properties Dmax | Photographic properties Sensitivity |
|---|---|---|---|---|---|
| 408 | ○ | ○ | B | 98 | 102 |
| 416 | ◎ | ◎ | A | 97 | 102 |
| 417 | ◎ | ◎ | A | 97 | 102 |
| 418 | ◎ | ◎ | A | 97 | 102 |
| 413 | ○ | ○ | B | 98 | 102 |
| 419 | ◎ | ◎ | A | 97 | 102 |
| 420 | ◎ | ◎ | A | 97 | 102 |
| 421 | ◎ | ◎ | A | 97 | 102 |

note)
surfactant-2: sodium dodecylbenzenesulfonate

Surfactant-3

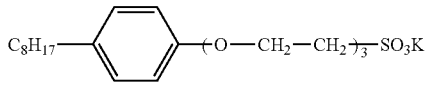

As shown in Table 18, adding the surfactant, the property of coating surface is more improved and the photothermographic material shows excellent photographic properties.

Example 11

(Preparations of Matting Agent-9 to -11 Dispersion)

Preparations of matting agent-9 to -11 dispersion were conducted in the similar manner to that of matting agent-3 dispersion in Example 9 except that dispersing with the water-soluble polymer shown in Table 19 instead of dispersing with polyvinyl alcohol PVA-205 (manufactured by Kuraray Co., Ltd.).

(Preparations of Coating Solution for Outermost Layer-67 to -69)

Preparations of coating solution for outermost layer-67 to -69 were conducted in the similar manner to that of coating solution for outermost layer-51 except that adding 65 g of each one of matting agent-9 to -11 dispersions instead of adding matting agent (M-17).

(Preparations of Sample-422 to -424)

Preparations of sample-422 to -424 were conducted in the similar manner to that of sample-408 in Example 9 except that changing the coating solution for the outermost layer to the solution shown in Table 19.

(Results of Evaluation)

Evaluations were done similar to Example 9. Results are shown in Table 19.

TABLE 19

| Sample No. | Outermost layer: Coating solution | Outermost layer: Binder | Outermost layer: Matting agent | Outermost layer: Polymer for dispersion | Layer adjacent to outermost layer: Coating solution | Layer adjacent to outermost layer: Binder |
|---|---|---|---|---|---|---|
| 408 | 55 | latex | M-17 (dispersion) | PVA-217 | 22 | gelatin |
| 422 | 67 | latex | M-17 (dispersion) | PVA-105 | 22 | gelatin |
| 423 | 68 | latex | M-17 (dispersion) | MP-203 | 22 | gelatin |
| 424 | 69 | latex | M-17 (dispersion) | PVA-124 | 22 | gelatin |

| Sample No. | Water resistance | Property of coating surface | Uneven image density at thermal development | Photographic properties: Dmax | Photographic properties: Sensitivity |
|---|---|---|---|---|---|
| 408 | ○ | ○ | B | 98 | 102 |
| 422 | ○ | ○ | B | 98 | 102 |
| 423 | ○ | ○ | B | 98 | 102 |
| 424 | ○ | ○ | B | 98 | 102 |

As shown in Table 19, even changing the kind of water-soluble polymer for dispersing the matting agent, the property of coating surface is improved and the photothermographic material shows excellent photographic properties.

What is claimed is:

1. An aqueous solvent-system photothermographic material which is coated from a coating solution with an aqueous solvent of water or a mixture of water and 70% by weight or less of water-miscible organic solvent, comprising, on a support, an image forming layer containing at least a photosensitive silver halide, a non-photosensitive organic silver salt, a reducing agent and a binder, and a non-photosensitive outermost layer at a surface side of the support at which the image forming layer is provided, wherein:

the non-photosensitive organic silver salt contains 90% by mole or more of silver behenate;

a binder in the outermost layer contains 50% by weight or more of a hydrophobic polymer latex; and the non-photosensitive outermost layer contains a gelling agent at a coating amount of 0.01% by weight to 10.0% by weight with respect to the hydrophobic polymer latex; and the photothermographic material further comprises a gelation accelerator at a coating amount of 0.1% by weight to 200% by weight with respect to the gelling agent.

2. The photothermographic material according to claim 1, further comprising at least one development accelerator at the surface side at which the image forming layer is provided.

3. The photothermographic material according to claim 1, wherein the gelling agent is a water-soluble polysaccharide.

4. The photothermographic material according to claim 1, wherein the gelation accelerator is contained in a layer that is not in direct contact with the layer containing the gelling agent.

5. An aqueous solvent-system photothermographic material which is coated from a coating solution with an aqueous solvent of water or a mixture of water and 70% by weight or less of water-miscible organic solvent, comprising, on a support, an image forming layer containing at least a photosensitive silver halide, a non-photosensitive organic silver salt, a reducing agent and a binder, and a non-photosensitive outermost layer at a surface side of the support at which the image forming layer is provided, wherein:

the non-photosensitive outermost layer contains a polymer latex;

a layer adjacent to the non-photosensitive outermost layer contains a gelling agent at a coating amount of 0.01% by weight to 10.0% by weight with respect to a polymer latex, and a coating solution for forming the layer adjacent to the outermost layer can lose fluidity upon a decrease in temperature; and the photothermographic material further comprises a gelation accelerator at a coating amount of 0.1% by weight to 200% by weight with respect to the gelling agent.

6. The photothermographic material according to claim 5, wherein the polymer latex has a glass transition temperature Tg in the range of from −20° C. to 70° C.

7. The photothermographic material according to claim 5, wherein the polymer latex is at least one selected from the group consisting of an acrylic polymer latex, a urethane polymer latex and a styrene-butadiene copolymer latex.

8. The photothermographic material according to claim 5, wherein the layer adjacent to the outermost layer contains a water-soluble polymer derived from an animal protein.

9. The photothermographic material according to claim 8, wherein the water-soluble polymer derived from an animal protein is gelatin.

10. The photothermographic material according to claim 5 wherein the gelling agent is at least one selected from the group consisting of agar, κ-carrageenan, ι-carrageenan, alginic acid, alginate, agarose, furcellean, jellan gum, glucono-δ-lactone, azotobactor vinelandii gum, xanthan gum, pectin, guar gum, locust bean gum, tara gum, cassia gum, glucomannan, tragacanth gum, karaya gum, pullulan, gum arabic, arabinogalacatan, dextran, sodium carboxymethyl cellulose, methyl cellulose, cyalume sheet gum, starch, chitin, chitosan, and curdlan.

11. The photothermographic material according to claim 5, wherein the gelation accelerator is contained in a layer that is not in direct contact with the layer containing the gelling agent.

12. The photothermographic material according to claim 5, wherein the non-photosensitive layer and image forming layer are formed by simultaneous multilayer application.

13. The photothermographic material according to claim 5, wherein any one of layers at the surface side of the support at which the outermost layer is provided contains a fluorocarbon compound having a fluoroalkyl group with at least 2 carbon atoms and no more than 12 fluorine atoms.

14. The photothermographic material according to claim 13, wherein the fluorocarbon compound has a fluoroalkyl group represented by the following formula (FW):

-Rc-Re—W formula (FW)

wherein, Rc represents an alkylene group with 1 to 4 carbon atoms, Re represents a perfluoroalkylene group with 2 to 6 carbon atoms, and W represents any one of a hydrogen atom, a fluorine atom and an alkyl group.

15. The photothermographic material according to claim 5, wherein at least one of the outermost layer and the layer adjacent to the outermost layer contains matting agent particles dispersed in advance with a water-soluble polymer that is not derived from an animal protein.

16. The photothermographic material according to claim 5, wherein the gelling agent is a water-soluble polysaccharide.

17. The photothermographic material according to claim 5, wherein the gelation accelerator is alkali metal ions or alkali earth metal ions and the gelling agent is carrageenan, alginate, azotobactor vinelandii gum, pectin, or sodium carboxymethyl cellulose.

18. The photothermographic material according to claim 5, wherein the gelation accelerator is boric acid or other boron compounds and the gelling agent is guar gum, locust bean gum, tara gum, cassia gum.

19. The photothermographic material according to claim 5, wherein the gelation accelerator is acids or alkali compounds and the gelling agent is alginate, glucomannan, pectin, chitin, chitosan, or curdlan.

20. The photothermographic material according to claim 5, wherein the gelation accelerator is water-soluble polysaccharides and the gelling agent is xanthan gum or carrageenan.

21. An aqueous solvent-system photothermographic material which is coated from a coating solution with an aqueous solvent of water, or a mixture of water and 70% by weight or less of water-miscible organic solvent, comprising, on a support, an image forming layer containing at least a photosensitive silver halide, a non-photosensitive organic silver salt, a reducing agent and a binder, and a non-photosensitive outermost layer at a surface side of the support at which the image forming layer is provided, wherein:

the non-photosensitive outermost layer contains a polymer latex and a gelling agent at a coating amount of 0.01% by weight to 10.0% by weight with respect to the polymer latex; and a coating solution for forming the outermost layer can lose fluidity upon a decrease in temperature; and the photothermographic material further comprises a gelation accelerator at a coating amount of 0.1 % by weight to 200% by weight with respect to the gelling agent.

22. The photothermographic material according to claim 21, wherein the gelling agent is at least one selected from the group consisting of agar, κ-carrageenan, ι-carrageenan, alginic acid, alginate, agarose, furcellean, jellan gum, glucono-δ-lactone, azotobactor vinelandii gum, xanthan gum, pectin, guar gum, locust bean gum, tara gum, cassia gum, glucomannan, tragacanth gum, karaya gum, pullulan, gum arabic, arabinogalacatan, dextran, sodium carboxymethyl cellulose, methyl cellulose, cyalume sheet gum, starch, chitin, chitosan, and curdlan.

23. The photothermographic material according to claim 21, wherein the gelling agent is κ-carrageenan.

24. The photothermographic material according to claim 21, wherein the gelation accelerator is contained in any one of layers provided between the outermost layer and the support at the surface side of the support at which the outermost layer is provided.

25. The photothermographic material according to claim 21, wherein the gelling agent is a water-soluble polysaccharide.

26. The photothermographic material according to claim 21, wherein the gelation accelerator is contained in a layer that is not in direct contact with the layer containing the gelling agent.

* * * * *